US007886556B2

(12) United States Patent
Fujiyoshi et al.

(10) Patent No.: US 7,886,556 B2
(45) Date of Patent: Feb. 15, 2011

(54) AIR CONDITIONING SYSTEM

(75) Inventors: Ryusuke Fujiyoshi, Sakai (JP); Tomohiro Yabu, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 563 days.

(21) Appl. No.: 10/591,060

(22) PCT Filed: Mar. 23, 2005

(86) PCT No.: PCT/JP2005/005235

§ 371 (c)(1),
(2), (4) Date: Aug. 30, 2006

(87) PCT Pub. No.: WO2005/098320

PCT Pub. Date: Oct. 20, 2005

(65) Prior Publication Data

US 2007/0180851 A1 Aug. 9, 2007

(30) Foreign Application Priority Data

Mar. 31, 2004 (JP) ..... 2004-105173

(51) Int. Cl.
*F25D 23/00* (2006.01)

(52) U.S. Cl. ..... 62/271; 62/324.5; 62/94; 62/175

(58) Field of Classification Search ..... 62/94
See application file for complete search history.

(56) References Cited

U.S. PATENT DOCUMENTS

| | | | | |
|---|---|---|---|---|
| 4,793,143 | A * | 12/1988 | Rhodes | 62/93 |
| 4,984,433 | A * | 1/1991 | Worthington | 62/90 |
| 5,547,018 | A * | 8/1996 | Takahashi et al. | 165/267 |
| 5,590,831 | A * | 1/1997 | Manson et al. | 236/51 |
| 5,950,442 | A * | 9/1999 | Maeda et al. | 62/175 |
| 6,050,100 | A * | 4/2000 | Belding et al. | 62/271 |
| 6,205,797 | B1 * | 3/2001 | Maeda | 62/94 |
| 6,701,732 | B2 * | 3/2004 | Shimoda | 62/228.3 |
| 2006/0086111 | A1 * | 4/2006 | Kang et al. | 62/176.6 |
| 2007/0125115 | A1 * | 6/2007 | Matsui et al. | 62/331 |

FOREIGN PATENT DOCUMENTS

| | | | |
|---|---|---|---|
| EP | 1227286 | * | 7/2002 |
| EP | 1 672 290 | A1 | 6/2006 |
| EP | 1 681 518 | A1 | 7/2006 |

(Continued)

OTHER PUBLICATIONS

WIPO-OCR Text of WO 2000/033932 (Chua et al.).*
English machine translation of JP2005-291570.*

*Primary Examiner*—Cheryl J Tyler
*Assistant Examiner*—Lakiya Rogers
(74) *Attorney, Agent, or Firm*—Global IP Counselors

(57) ABSTRACT

An air conditioning system includes a plurality of latent heat utilization side refrigerant circuits which are connected in parallel with one another, and a plurality of sensible heat utilization side refrigerant circuits which are connected in parallel with one another. The latent heat utilization side refrigerant circuits include adsorbent heat exchangers provided with an adsorbent on the surface of each. The sensible heat utilization side refrigerant circuits respectively include air heat exchangers and are capable of exchanging heat between the refrigerant and air.

29 Claims, 54 Drawing Sheets

FOREIGN PATENT DOCUMENTS

| | | | |
|---|---|---|---|
| JP | 06-101894 | A | 4/1994 |
| JP | 07-265649 | A | 10/1995 |
| JP | 2003-161465 | | 6/2003 |
| JP | 2005-291570 | * | 10/2005 |
| WO | WO 99/14535 | * | 3/1999 |
| WO | WO-03-029728 | | 4/2003 |

* cited by examiner

AIR CONDITIONING SYSTEM

CROSS-REFERENCE TO RELATED APPLICATIONS

This U.S. National stage application claims priority under 35 U.S.C. §119(a) to Japanese Patent Application No. 2004-105173, filed in Japan on Mar. 31, 2004, the entire contents of which are hereby incorporated herein by reference.

TECHNICAL FIELD

The present invention relates to an air conditioning system. More specifically, the present invention relates to an air conditioning system in which the latent heat load and the sensible heat load in the room are treated by operating a vapor compression refrigeration cycle.

BACKGROUND ART

Conventionally, air conditioners that cool and dehumidify the room are known (for example, see International Publication WO 03/029728). This type of air conditioner comprises a vapor compression refrigerant circuit having an outdoor heat exchanger as a heat source side heat exchanger and an indoor heat exchanger as an air heat exchanger, and a refrigerant is circulated in this refrigerant circuit to operate a refrigeration cycle. This air conditioner dehumidifies the room by setting the evaporation temperature of the refrigerant in the indoor heat exchanger lower than the dew point temperature of the room air and thus condensing moisture in the room air.

Also, dehumidifiers comprising a heat exchanger provided with an adsorbent on the surface thereof are also known (for example, see Japanese Patent Application Publication No. 07-265649). This type of dehumidifier comprises two heat exchangers each provided with an adsorbent. An adsorption process in which moisture in the air is adsorbed so as to dehumidify the air is performed in one of the two heat exchangers, while a regeneration process in which the moisture adsorbed is desorbed in performed in the other one of the two heat exchangers. During these processes, water that is cooled by a cooling tower is supplied to one heat exchanger that adsorbs the moisture, while heated wastewater is supplied to the other heat exchanger that regenerates water. Further, this dehumidifier is configured to supply the room with air that is dehumidified through the adsorption process and the regeneration process.

SUMMARY OF THE INVENTION

With the first described air conditioner, the latent heat load in the room is treated by setting the evaporation temperature of the refrigerant in the indoor heat exchanger lower than the dew point temperature of the room air and thus condensing moisture in the air. Specifically, although the sensible heat load can be treated even when the evaporation temperature of refrigerant in the indoor heat exchanger is higher than the dew point temperature of the room air, the evaporation temperature of refrigerant in the indoor heat exchanger must be set lower in order to treat the latent heat load. Consequently, the difference between high and low pressures in the vapor compression refrigeration cycle increases and so does the power consumption of the compressor, resulting in a reduced coefficient of performance (COP).

In addition, with the second described dehumidifier, the cooling water cooled by the cooling tower, i.e., the cooling water whose temperature is not so much lower than the room temperature is supplied to the heat exchanger. Therefore, this dehumidifier can treat the latent heat load in the room but not the sensible heat load, which has been a problem.

In order to solve such a problem, the inventors of the present invention have developed an air conditioner that comprises a vapor compression refrigerant circuit having a heat source side heat exchanger and an adsorbent heat exchanger as a utilization side heat exchanger (for example, see Patent Application No. 2003-351268). This air conditioner can treat the sensible heat load and the latent heat load in the room by alternating between the adsorption process in which moisture in the air is adsorbed onto an adsorbent heat exchanger having an adsorbent on the surface thereof and the regeneration process in which moisture in the air is desorbed from the adsorbent heat exchanger, and by supplying the room with air that passed through the adsorbent heat exchanger. Specifically, unlike the first described air conditioner that dehumidifies air by condensing moisture in the air, the air conditioner just described dehumidifies air by adsorbing moisture in the air onto the adsorbent, so that the evaporation temperature of the refrigerant does not need to be set lower than the air dew point temperature, and the air can be dehumidified even when the evaporation temperature of the refrigerant is set higher than the air dew point temperature. Consequently, compared to conventional air conditioners, this air conditioner allows the evaporation temperature of the refrigerant to be set high even when dehumidifying air, which consequently reduces the difference between high and low pressures in the refrigeration cycle. As a result, the power consumption of the compressor can be reduced, and the COP can be improved. In addition, this air conditioner is capable of treating the sensible heat load in the room at the same time when dehumidifying air, by setting the evaporation temperature of the refrigerant lower than the required evaporation temperature in the adsorbent heat exchanger.

Next, the inventors of the present invention intend to apply the above-described air conditioner that uses the adsorbent heat exchanger to an air conditioning system (so-called multi air conditioning system) that is installed in buildings and other facilities. However, in some cases, in such a large scale air conditioning system, a plurality of air conditioners each comprising an adsorbent heat exchanger are needed, so that several compressors and the like to be used as heat sources may need to be installed according to the number of the adsorbent heat exchangers, which consequently creates problems such as an increase in cost and an increase in the number of parts to be maintained. In addition, when the air conditioner comprising the adsorbent heat exchanger is installed along with an air conditioner comprising a typical air heat exchanger, a compressor and the like to be used as heat sources must be installed separately from the air conditioner comprising the air heat exchanger, which consequently creates problems such as an increase in cost and an increase in the number of parts to be maintained.

It is therefore an object of the present invention is to prevent problems such as an increase in cost and an increase in the number of parts to be maintained, which arise when a plurality of air conditioners that use adsorbent heat exchangers are installed or when an air conditioner that uses an adsorbent heat exchanger is installed along with an air conditioner comprising an air heat exchanger.

An air conditioning system according to a first aspect of the present invention is an air conditioning system that treats the latent heat load and the sensible heat load in the room by operating a vapor compression type refrigeration cycle, and comprises a plurality of first utilization side refrigerant circuits that are connected in parallel with one another, and a plurality of second utilization side refrigerant circuits that are connected in parallel with one another. The first utilization side refrigerant circuit includes an adsorbent heat exchanger provided with an adsorbent on the surface thereof, and are capable of alternating between an adsorption process in which moisture in the air is adsorbed onto the adsorbent by causing the adsorbent heat exchanger to function as an evaporator that evaporates the refrigerant, and a regeneration process in which moisture is desorbed from the adsorbent by causing the adsorbent heat exchanger to function as a condenser that condenses the refrigerant. The second utilization side refrigerant circuit includes an air heat exchanger, and are capable of exchanging heat between refrigerant and air. The air conditioning system is capable of supplying the room with air that passed through the adsorbent heat exchanger, and is also capable of supplying the room with air that passed through the air heat exchanger.

This air conditioning system constitutes so-called multi-type air conditioning system, which comprises a plurality of first utilization side refrigerant circuits that are capable of mainly treating the latent heat load in the room by alternating between the adsorption process and the regeneration process in the adsorbent heat exchanger so as to dehumidify or humidify air that passes through the adsorbent heat exchanger, and a plurality of second utilization side refrigerant circuits that are capable of mainly treating the sensible heat load in the room by exchanging heat between refrigerant and air that passes through the air heat exchanger. Here, the plurality of first utilization side refrigerant circuits are connected in parallel with one another. The plurality of second utilization side refrigerant circuits are also connected in parallel with one another. Specifically, heat sources used for the vapor compression refrigeration cycle operation are collected together at least for a system that includes the first utilization side refrigerant circuits (hereinafter referred to as latent heat load treatment system) or for a system that includes the second utilization side refrigerant circuits (hereinafter referred to as sensible heat load treatment system). In this way, it is possible to prevent problems such as an increase in cost and an increase in the number of parts to be maintained, which occur when a plurality of air conditioners that use the adsorbent heat exchangers are installed.

An air conditioning system according to a second aspect of the present invention is the air conditioning system of the first aspect of the present invention, in which the air conditioning system comprises a heat source side refrigerant circuit which includes a compression mechanism and a heat source side heat exchanger and which is used as a heat source for both the first utilization side refrigerant circuits and the second utilization side refrigerant circuits. The first utilization side refrigerant circuits are connected to an discharge gas connection pipe connected to a discharge side of the compression mechanism and to an inlet gas connection pipe connected to an inlet side of the compression mechanism.

In this air conditioning system, since both the first utilization side refrigerant circuits and the second utilization side refrigerant circuits are connected to one heat source side refrigerant circuit, the heat sources are collected together, further preventing an increase in cost and an increase in the number of parts to be maintained. Further, this air conditioning system constitutes the latent heat load treatment system in which the first utilization side refrigerant circuits are connected to the discharge side and the inlet side of the compression mechanism in the heat source side refrigerant circuit through the discharge gas connection pipe and the inlet gas connection pipe. Accordingly, by causing the adsorbent heat exchanger to function as an evaporator or a condenser in each of the plurality of first utilization side refrigerant circuits, this air conditioning system can perform a dehumidifying operation or a humidifying operation depending on the needs of each air-conditioned room, for example, dehumidifying an air-conditioned room while humidifying a different air-conditioned room. In addition, the compression mechanism can be installed in a place, such as outside, separate from the first and second utilization side refrigerant circuits, so that noise and vibration inside the building can be reduced. Here, the compression mechanism is not limited to include a single compressor. Two or more compressors that are connected in parallel may be included.

An air conditioning system according to a third aspect of the present invention is an air conditioning system that treats latent heat load and sensible heat load in the room by operating a vapor compression type refrigeration cycle, and the air conditioning system comprises a first utilization side refrigerant circuit, a plurality of second utilization side refrigerant circuits that are connected in parallel with one another, and a heat source side refrigerant circuit to be used as a heat source for both the first utilization side refrigerant circuits and the second utilization side refrigerant circuits. The first utilization side refrigerant circuit includes an adsorbent heat exchanger provided with an adsorbent on the surface thereof, and are capable of alternating between an adsorption process in which moisture in the air is adsorbed onto the adsorbent by causing the adsorbent heat exchanger to function as an evaporator that evaporates the refrigerant, and a regeneration process in which moisture is desorbed from the adsorbent by causing the adsorbent heat exchanger to function as a condenser that condenses the refrigerant. The second utilization side refrigerant circuits include an air heat exchanger, and are capable of exchanging heat between refrigerant and air. The heat source side refrigerant circuit includes a compression mechanism and a heat source side heat exchanger. The first utilization side refrigerant circuit is connected to a discharge gas connection pipe connected to a discharge side of the compression mechanism and to an inlet gas connection pipe connected to an inlet side of the compression mechanism. The air conditioning system is capable of supplying the room with air that passed through the adsorbent heat exchanger, and is also capable of supplying the room with air that passed through the air heat exchanger.

This air conditioning system constitutes a multi-type air conditioning system, which comprises the first utilization side refrigerant circuit capable of mainly treating the latent heat load in the room by alternating between the adsorption process and the regeneration process in the adsorbent heat exchanger so as to dehumidify or humidify air that passes through the adsorbent heat exchanger, and a plurality of second utilization side refrigerant circuits capable of mainly treating the sensible heat load in the room by exchanging heat between refrigerant and air that passes through the air heat exchanger. Here, in this air conditioning system, both of the first utilization side refrigerant circuit and the plurality of second utilization side refrigerant circuits are connected to one heat source side refrigerant circuit, so that the heat sources are collected together, preventing an increase in cost and an increase in the number of parts to be maintained. In other words, it is possible to prevent an increase in cost and an increase in the number of parts to be maintained, which occur when the air conditioner that uses the adsorbent heat exchanger and air conditioner that uses the air heat exchanger are installed together. Further, this air conditioning system constitutes the latent heat load treatment system in which the first utilization side refrigerant circuit is connected to the discharge side and the inlet side of the compression mechanism in the heat source side refrigerant circuit through the discharge gas connection pipe and the inlet gas connection pipe. Accordingly, by causing the adsorbent heat exchanger to function as an evaporator or a condenser in each of the plurality of first utilization side refrigerant circuits, this air conditioning system can perform a dehumidifying operation or a humidifying operation depending on the needs of each air-conditioned room, for example, dehumidifying an air-conditioned room while humidifying a different air-conditioned room. In addition, since the compression mechanism can be installed in a place, such as outside, separate from the first and second utilization side refrigerant circuits, noise and vibration inside the building can be reduced. Here, the compression mechanism is not limited to include only one compressor, but may include two or more compressors that are connected in parallel.

An air conditioning system according to a fourth aspect of the present invention is the air conditioning system of the second or the third aspect of the present invention, in which the second utilization side refrigerant circuits are connected to a liquid connection pipe connected to a liquid side of the heat source side heat exchanger, and are also switchably connected to the discharge gas connection pipe and the inlet gas connection pipe through a switching mechanism.

This air conditioning system constitutes the sensible heat load treatment system in which the second utilization side refrigerant circuits are connected to the liquid side of the heat source side heat exchanger in the heat source side refrigerant circuit through the liquid connection pipe; and connected to the discharge side and the inlet side of the compression mechanism through the discharge gas connection pipe and the inlet gas connection pipe. Further, the connection with the discharge side and the inlet side of the compression mechanism is switchable therebetween by the switching mechanism. Accordingly, by switching the switching mechanism to establish a connection through the discharge gas connection pipe, the air heat exchanger can be caused to function as a condenser so as to heat the room, and by switching the switching mechanism to establish a connection through the inlet gas connection pipe, the air heat exchanger can be caused to function as an evaporator so as to cool the room. Further, by causing the air heat exchanger to function as an evaporator or a condenser in each of the plurality of second utilization side refrigerant circuits, it is possible to constitute so-called simultaneous cooling and heating air conditioning system in which a cooling operation and a heating operation are simultaneously performed depending on the needs of each air-conditioned room, for example, cooling an air-conditioned room while heating a different air-conditioned room.

An air conditioning system according to a fifth aspect of the present invention is the air conditioning system of the second or the third aspect of the present invention, in which the second utilization side refrigerant circuits are connected to the inlet gas connection pipe and the liquid connection pipe connected to the liquid side of the heat source side heat exchanger.

This air conditioning system constitutes the sensible heat load treatment system in which the second utilization side refrigerant circuits are connected to the liquid side of the heat source side heat exchanger in the heat source side refrigerant circuit through the liquid connection pipe, and also connected to the inlet side of the compression mechanism through the inlet gas connection pipe. Accordingly, it is possible to cool the room by causing the air heat exchanger to function as an evaporator.

An air conditioning system according to a sixth aspect of the present invention is the air conditioning system of any one the second to the fifth aspects of the present invention, in which the first utilization side refrigerant circuit and the second utilization side refrigerant circuit constitute an integrated utilization unit.

In this air conditioning system, the first utilization side refrigerant circuit and the second utilization side refrigerant circuit constitute an integrated utilization unit, so that reduction in the size of the unit and laborsaving installation of the unit can be achieved, compared to the case where a unit provided with the first utilization side refrigerant circuit and a unit provided with the second utilization side refrigerant circuit are separately installed in the building.

An air conditioning system according to a seventh aspect of the present invention is the air conditioning system of the sixth aspect of the present invention, in which the utilization unit is capable of supplying the room with air that was dehumidified or humidified in the adsorbent heat exchanger.

In this air conditioning system, air that was dehumidified or humidified (in other words, the latent heat was treated) in the adsorbent heat exchanger i.e. the first utilization side refrigerant circuits can be supplied to the room, so that it is possible to dehumidify or humidify the room with one unit.

An air conditioning system according to an eighth aspect of the present invention is the air conditioning system of the sixth aspect of the present invention, in which the utilization unit is capable of causing the air heat exchanger to exchange heat between refrigerant and air that was dehumidified or humidified in the adsorbent heat exchanger.

This air conditioning system can further treat the sensible heat of the air that was dehumidified or humidified (in other words, the latent heat was treated) in the adsorbent heat exchanger i.e. the first utilization side refrigerant circuit. Therefore, for example, even when the sensible heat load was treated to some degree along with the treatment of the latent heat load in the adsorbent heat exchanger, and the temperature of the air was changed to a temperature that is not in agreement with the target temperature of the room air, this air will not be blown out into the room the way it is. Instead, the air will be subjected to the sensible heat treatment in the air heat exchanger so that the temperature of the air will be adjusted to be appropriate to the target temperature of the room air, and after which an operation in which the air is blown out into the room will be allowed.

An air conditioning system according to a ninth aspect of the present invention is the air conditioning system of any of the second to the eighth aspects of the present invention, in which a required latent heat treatment capacity value and a required sensible heat treatment capacity value are calculated to control the operational capacity of the compression mechanism based on the required latent heat treatment capacity value and the required sensible heat treatment capacity value.

In this air conditioning system, the required latent heat treatment capacity value and the required sensible heat treatment capacity value are calculated to control the operational capacity of the compression mechanism based on these values, so that it is possible to simultaneously treat the latent heat load in the latent heat load treatment system having the adsorbent heat exchanger, and the sensible heat load in the sensible heat load treatment system having the air heat exchanger. Consequently, even when the latent heat load treatment system and the sensible heat load treatment system share a heat source, the operational capacity of the compression mechanism that constitutes the heat source can be controlled in a satisfactory manner.

An air conditioning system according to a tenth aspect of the present invention is the air conditioning system of the ninth aspect of the present invention, in which a target evaporation temperature and a target condensation temperature of the system as a whole are calculated based on the required latent heat treatment capacity value and the required sensible heat treatment capacity value to control the operational capacity of the compression mechanism based on the target evaporation temperature and the target condensation temperature.

An air conditioning system according to an eleventh aspect of the present invention is the air conditioning system of the tenth aspect of the present invention, in which the evaporation temperature difference between the target evaporation temperature and the evaporation temperature is calculated, and the condensation temperature difference between the target condensation temperature and the condensation temperature is calculated, in order to control the operational capacity of the compression mechanism based on the evaporation temperature difference and the condensation temperature difference.

An air conditioning system according to a twelfth aspect of the present invention is the air conditioning system of any one of the ninth to the eleventh aspects of the present invention, in which a switching time interval between the adsorption process and the regeneration process in the adsorbent heat exchanger is changed.

In this air conditioning system, for example, when the required sensible heat treatment capacity value is high and the sensible heat treatment capacity in the second utilization side refrigerant circuits needs to be increased, and simultaneously when the required latent heat treatment capacity value is low and the latent heat treatment capacity in the first utilization side refrigerant circuit needs to be decreased, the switching time interval between the adsorption process and the regeneration process in the adsorbent heat exchanger is made longer so as to decrease the latent heat treatment capacity and simultaneously increase the sensible heat treatment capacity in the adsorbent heat exchanger (specifically, the ratio of the sensible heat treatment capacity in the adsorbent heat exchanger is increased), so that the sensible heat treatment capacity in the latent heat load treatment system can be increased.

In addition, in this air conditioning system, when the required latent heat treatment capacity value is high and the latent heat treatment capacity in the first utilization side refrigerant circuit needs to be increased, the switching time interval between the adsorption process and the regeneration process in the adsorbent heat exchanger is made shorter so as to decrease the sensible heat treatment capacity and simultaneously increase the latent heat treatment capacity in the adsorbent heat exchanger (specifically, the ratio of the sensible heat treatment capacity ratio in the adsorbent heat exchanger is reduced) so that the latent heat treatment capacity in the latent heat load treatment system can be increased.

In this way, this air conditioning system is capable of changing the sensible heat treatment capacity ratio in the adsorbent heat exchanger by changing the switching time interval between the adsorption process and the regeneration process in the adsorbent heat exchanger, without needing to increase the operational capacity of the compression mechanism, so that there is no inefficiency in this air conditioning as a whole and thus an efficient operation can be achieved.

An air conditioning system according to a thirteenth aspect of the present invention is the air conditioning system of any one of the first through the twelfth aspects of the present invention, in which, at system startup, air that has been heat-exchanged in the air heat exchanger is supplied to the room, and outdoor air is prevented from passing through the adsorbent heat exchanger.

In this air conditioning system, at system startup, mainly the sensible heat is treated by supplying the room with air that has been heat-exchanged in the heat exchanger, and also outdoor air is prevented from passing through the adsorbent heat exchanger in order to prevent introduction of outdoor air. Accordingly, at system startup, the introduction of heat load from outdoor air can be prevented when the air conditioning capacity of the latent heat load treatment system is not operating at full capacity, and thus the target temperature of the room air can be quickly obtained. Consequently, in the air conditioning system comprising the latent heat load treatment system having the adsorbent heat exchanger and configured to mainly treat the latent heat load in the room and the sensible heat load treatment system having the air heat exchanger and configured to mainly treat the sensible heat load in the room, it will be possible to quickly cool or heat the room at system startup.

An air conditioning system according to a fourteenth aspect of the present invention is the air conditioning system of any one of the first to the twelfth aspects of the present invention, in which, at system startup, in a state in which the switching operation between the adsorption process and the regeneration process in a plurality of adsorbent heat exchangers is stopped, outdoor air is passed through one of the plurality of adsorbent heat exchangers and after which the air is exhausted to the outside, and also room air is passed through adsorbent heat exchangers besides the one through which the outdoor air passed among the plurality of adsorbent heat exchangers, and after which the air is supplied to the room again.

In this air conditioning system, at system startup, mainly the sensible heat is treated by supplying the room with air that has been heat-exchanged in the heat exchanger, and also mainly the sensible heat is treated by passing outdoor air through the adsorbent heat exchanger and then exhausting the air to the outside in a state in which the switching operation between the adsorption process and the regeneration process in the adsorbent heat exchanger is stopped. As a result, at system startup, the sensible heat treatment in the room can be facilitated and the target temperature of the room air can be quickly obtained. Consequently, in the air conditioning system comprising the latent heat load treatment system having the adsorbent heat exchanger and configured to mainly treat the latent heat load in the room, and the sensible heat load treatment system having the air heat exchanger and configured to mainly treat the sensible heat load in the room, it will be possible to quickly cool or heat the room at system startup.

An air conditioning system according to a fifteenth aspect of the present invention is the air conditioning system of any one of the first to the twelfth aspects of the present invention, in which, at system startup, the switching time interval between the adsorption process and the regeneration process in the adsorbent heat exchanger is made longer than that during normal operation.

In this air conditioning system, at system startup, the switching time interval in the adsorbent heat exchanger is made longer than that during normal operation to mainly treat the sensible heat. In this way, the target temperature of the room air can be quickly obtained. Consequently, in the air conditioning system comprising the latent heat load treatment system having the adsorbent heat exchanger and configured to mainly treat the latent heat load in the room, and the sensible heat load treatment system having the air heat exchanger and configured to mainly treat the sensible heat load in the room, it will be possible to quickly cool or heat the room at system startup.

An air conditioning system according to a sixteenth aspect of the present invention is the air conditioning system of any one of the thirteenth to the fifteenth aspects of the present invention, in which a system startup operation is terminated after a predetermined period of time elapsed since system startup.

After a period of time enough to treat the sensible heat elapsed since system startup, this air conditioning system passes outdoor air through the adsorbent heat exchanger to treat the latent heat, starts switching between the adsorption process and the regeneration process in the adsorbent heat exchanger, and shortens the switching time interval in the adsorbent heat exchanger. In this way, the normal operation in which the latent heat load and the sensible heat load in the room are treated can be initiated as soon as possible.

An air conditioning system according to a seventeenth aspect of the present invention is the air conditioning system of any one of the thirteenth to the fifteenth aspects of the present invention, in which the system startup operation is terminated after the temperature difference between the target temperature of the room air and the temperature of the room air is equal to or below a predetermined temperature difference.

After the temperature difference between the target temperature of the room air and the temperature of the room air is equal to or below a predetermined temperature difference and the sensible heat is treated sufficiently, this air conditioning system passes outdoor air through the adsorbent heat exchanger to treat the latent heat, starts switching between the adsorption process and the regeneration process in the adsorbent heat exchanger, and shortens the switching time interval in the adsorbent heat exchanger. In this way, the normal operation in which the latent heat load and the sensible heat load in the room are treated can be initiated as soon as possible.

An air conditioning system according to an eighteenth aspect of the present invention is the air conditioning system of any one of the thirteenth to the seventeenth aspects of the present invention, in which, before the system startup operation starts, whether or not the temperature difference between the target temperature of the room air and the temperature of the room air is equal to or below a predetermined temperature difference is determined. When the temperature difference between the target temperature of the room air and the temperature of the room air is equal to or below a predetermined temperature, the system startup operation is prevented from being performed.

In this air conditioning system, at system startup, before starting an operation in which the sensible heat load in the room is preferentially treated according to any one of the thirteenth to the fifteenth aspects of the present invention, the necessity to start such an operation is determined based on the temperature of the room air. Accordingly, at system startup, the operation in which the sensible heat load in the room is preferentially treated is prevented from being unnecessarily performed, and therefore the normal operation in which the latent heat load and the sensible heat load in the room are treated can be initiated as soon as possible.

An air conditioning system according to a nineteenth aspect of the present invention is the air conditioning system of any one of the second to the eighth aspects of the present invention, in which the air conditioning system comprises a pressure control mechanism that is connected to a gas side of the air heat exchanger and controls the evaporation pressure of the refrigerant in the air heat exchanger when the air heat exchanger is caused to function as an evaporator that evaporates the refrigerant.

An air conditioning system according to a twentieth aspect of the present invention is the air conditioning system of the nineteenth aspect of the present invention, in which the evaporation pressure of the refrigerant is controlled by the pressure control mechanism, based on the dew point temperature of the room air, when the air heat exchanger is caused to function as an evaporator.

This air conditioning system controls the pressure control mechanism based on the dew point temperature of the room air such that, for example, the evaporation temperature of the refrigerant in the air heat exchanger does not drop below the dew point temperature. In this way, moisture in the air is prevented from being condensed on the surface of the air heat exchanger, and drain water is prevented from being generated in the air heat exchanger. Consequently, a drain pipe will not be needed in the unit having the second utilization side refrigerant circuit, and thus the laborsaving installation of the unit having the second utilization side refrigerant circuit can be achieved.

Here, the dew point temperature of the room air may be obtained, for example, by using a dew point sensor provided in the unit having the air heat exchanger to measure the dew point temperature of the room air to be drawn into this unit, or by using a temperature/humidity sensor provided in the unit having the air heat exchanger to measure the temperature and humidity of the room air to be drawn into this unit and to perform calculation based on these measured values. In addition, when the unit having the air heat exchanger is not provided with the dew point sensor or the temperature/humidity sensor, measured values obtained by the dew point sensor or the temperature/humidity sensor provided in the unit having the adsorbent heat exchanger may be used.

An air conditioning system according to a twenty-first aspect of the present invention is the air conditioning system of the twentieth aspect of the present invention, in which the air conditioning system comprises a pressure detection mechanism that detects the refrigerant pressure in the air heat exchanger. This air conditioning system calculates the target evaporation pressure based on the dew point temperature of the room air, and uses the pressure control mechanism to adjust the evaporation pressure of the refrigerant detected by the pressure detection mechanism to be equal to or higher than the target evaporation pressure.

In this air conditioning system, instead of the dew point temperature, the evaporation pressure of the refrigerant in the air heat exchanger measured by the pressure detection mechanism is used as a control value for the pressure control mechanism for controlling the evaporation pressure of the refrigerant in the air heat exchanger. Therefore, the control responsiveness is improved, compared to a case where the evaporation pressure of the refrigerant is controlled by using the dew point temperature.

An air conditioning system according to a twenty-second aspect of the present invention is the air conditioning system of the twenty-first aspect of the present invention, in which the air conditioning system comprises a condensation detection mechanism that detects the presence of condensation in the air heat exchanger. This air conditioning system changes the target evaporation pressure when condensation is detected by the condensation detection mechanism.

In this air conditioning system, the condensation detection mechanism reliably detects condensation in the air heat exchanger, and also, when condensation is detected, the evaporation temperature of the refrigerant in the air heat exchanger is raised, for example, by increasing the target evaporation pressure. Therefore, condensation in the air heat exchanger can be reliably prevented.

An air conditioning system according to a twenty-third aspect of the present invention is the air conditioning system of the twenty-first aspect of the present invention, in which the air conditioning system comprises a condensation detection mechanism that detects the presence of condensation in the air heat exchanger. This air conditioning system stops the compression mechanism when condensation is detected by the condensation detection mechanism.

In this air conditioning system, the condensation detection mechanism reliably detects condensation in the air heat exchanger, and also, the compression mechanism is configured to be stopped when condensation is detected. Therefore, condensation in the air heat exchanger can be reliably prevented.

An air conditioning system according to a twenty-fourth aspect of the present invention is the air conditioning system of the twenty-first aspect of the present invention, in which the air conditioning system comprises a condensation detection mechanism that detects the presence of condensation in the air heat exchanger. The second utilization side refrigerant circuit comprises a utilization side expansion valve that is connected to the liquid side of the air heat exchanger. The air conditioning system closes the utilization side expansion valve when condensation is detected by the condensation detection mechanism.

In this air conditioning system, the condensation detection mechanism reliably detects condensation in the air heat exchanger, and also, the utilization side expansion valve is configured to be closed when condensation is detected. Therefore, condensation in the air heat exchanger can be reliably prevented.

An air conditioning system according to a twenty-fifth aspect of the present invention is the air conditioning system of any one of the second to the eighth and the nineteenth to the twenty-fourth aspects of the present invention, in which the switching time interval between the adsorption process and the regeneration process in the adsorbent heat exchanger can be changed.

In this air conditioning system, by changing the switching time interval between the adsorption process and the regeneration process in the adsorbent heat exchanger, the ratio of the sensible heat treatment capacity to the latent heat treatment capacity in the adsorbent heat exchanger (hereinafter referred to as a sensible heat treatment capacity ratio) can be changed. Accordingly, when the required sensible heat treatment capacity increases and the sensible heat treatment capacity in the second utilization side refrigerant circuits needs to be increased, the switching time interval between the adsorption process and the regeneration process in the adsorbent heat exchanger is made longer than that during normal operation. By so doing, the sensible heat treatment capacity ratio in the first utilization side refrigerant circuit can be increased.

Consequently, even when the required sensible heat treatment capacity increases, the air conditioning system can follow a change in the sensible heat treatment capacity while being operated so as to prevent moisture in the air from being condensed in the second utilization side refrigerant circuits and treat only the sensible heat load in the room.

An air conditioning system according to a twenty-sixth aspect of the present invention is the air conditioning system of the nineteenth to the twenty-fifth aspects of the present invention, in which, at system startup, treatment of the latent heat load in the room by the first utilization side refrigerant circuit is given priority over treatment of the sensible heat load in the room by the second utilization side refrigerant circuit.

In this air conditioning system, at system startup, treatment of the latent heat load in the room by the first utilization side refrigerant circuits is given priority over treatment of the sensible heat load in the room by the second utilization side refrigerant circuits. Therefore, it is possible to treat the sensible heat by the sensible heat load treatment system after sufficiently lowering the humidity of the room air by treating the latent heat by the latent heat load treatment system. Consequently, in the air conditioning system comprising the latent heat load treatment system having the adsorbent heat exchanger and configured to mainly treat the latent heat load in the room, and the sensible heat load treatment system having the air heat exchanger and configured to operate such that moisture in the air is prevented from being condensed in the air heat exchanger and treat only the sensible heat load in the room, it will be possible to quickly treat the sensible heat load while being operated so as to prevent condensation in the air heat exchanger even when the system starts under a condition in which the dew point temperature of the room air is high.

An air conditioning system according to a twenty-seventh aspect of the present invention is the air conditioning system of the twenty-sixth aspect of the present invention, in which, at system startup, treatment of the sensible heat load in the room by the second utilization side refrigerant circuits is stopped until the dew point temperature of the room air is equal to or below the target dew point temperature.

In this air conditioning system, at system startup, treatment of the sensible heat load by the sensible heat load treatment system is stopped and only the latent heat load is treated by the latent heat load treatment system until the dew point temperature of the room air is equal to or below the target dew point temperature. In this way, treatment of the sensible heat load by the sensible heat load treatment system can be initiated as soon as possible.

An air conditioning system according to a twenty-eighth aspect of the present invention is the air conditioning system of the twenty-sixth aspect of the present invention, in which, at system startup, treatment of the sensible heat load in the room by the second utilization side refrigerant circuit is stopped until the absolute humidity of the room air is equal to or below the target absolute humidity.

In this air conditioning system, at system startup, treatment of the sensible heat load by the sensible heat load treatment system is stopped and only the latent heat is treated by the latent heat load treatment system until the absolute humidity is equal to or below the target absolute humidity. In this way, treatment of the sensible heat load by the sensible heat load treatment system can be initiated as soon as possible.

An air conditioning system according to a twenty-ninth aspect of the present invention is the air conditioning system of any one of the twenty-sixth to the twenty-eighth aspects of the present invention, in which, at system startup, outdoor air is passed through the adsorbent heat exchanger that is performing the regeneration process among a plurality of adsorbent heat exchangers and after which the outdoor air is exhausted to the outside, and also the room air is passed through the adsorbent heat exchanger that is performing the adsorption process among a plurality of adsorbent heat exchangers and after which the room air is supplied to the room again.

At system startup, this air conditioning system performs a dehumidifying operation while circulating room air. In this way, treatment of the sensible heat load by the sensible heat load treatment system can be initiated as soon as possible.

An air conditioning system according to a thirtieth aspect of the present invention is the air conditioning system of any one of the twenty-sixth to the twenty-ninth aspect of the present invention, in which, before starting the system startup operation, whether or not the dew point temperature difference between the target dew point temperature of the room air and the dew point temperature of the room air is equal to or below a predetermined dew point temperature difference is determined. When the dew point temperature difference between the target dew point temperature of the room air and the dew point temperature of the room air is equal to or below the predetermined dew point temperature difference, the system startup operation is prevented from being performed.

In this air conditioning system, at system startup, before starting an operation in which the latent heat load in the room is preferentially treated according to any one of the twenty-sixth to the twenty-ninth aspects of the present invention, the necessity to start such an operation is determined based on the dew point temperature of the room air. Accordingly, at system startup, the operation in which the latent heat load in the room is preferentially treated is prevented from being unnecessarily performed, and therefore the normal operation in which the latent heat load and the sensible heat load in the room are treated can be initiated as soon as possible.

An air conditioning system according to a thirty-first aspect of the present invention is the air conditioning system of any one of the twenty-sixth to the twenty-ninth aspects of the present invention, in which, before starting the system startup operation, whether or not the absolute humidity difference between the target absolute humidity of the room air and the absolute humidity of the room air is equal to or below a predetermined absolute humidity difference is determined. When the absolute humidity difference between the target absolute humidity of the room air and the absolute humidity of the room air is equal to or below the predetermined absolute humidity difference, the startup operation is prevented from being performed.

In this air conditioning system, at system startup, before starting the operation in which the latent heat load in the room is preferentially treated according to any one of the twenty-sixth to the twenty-ninth aspects of the present invention, the necessity to start such an operation is determined based on the absolute humidity of the room air. Accordingly, at system startup, the operation in which the latent heat load in the room is preferentially treated is prevented from being unnecessarily performed, and therefore the normal operation in which the latent heat load and the sensible heat load in the room are treated can be initiated as soon as possible.

DETAILED DESCRIPTION OF THE INVENTION

Embodiments of an air conditioning system according to the present invention will be described below with reference to the drawings.

First Embodiment

(1) Configuration of the Air Conditioning System

Figure 1:
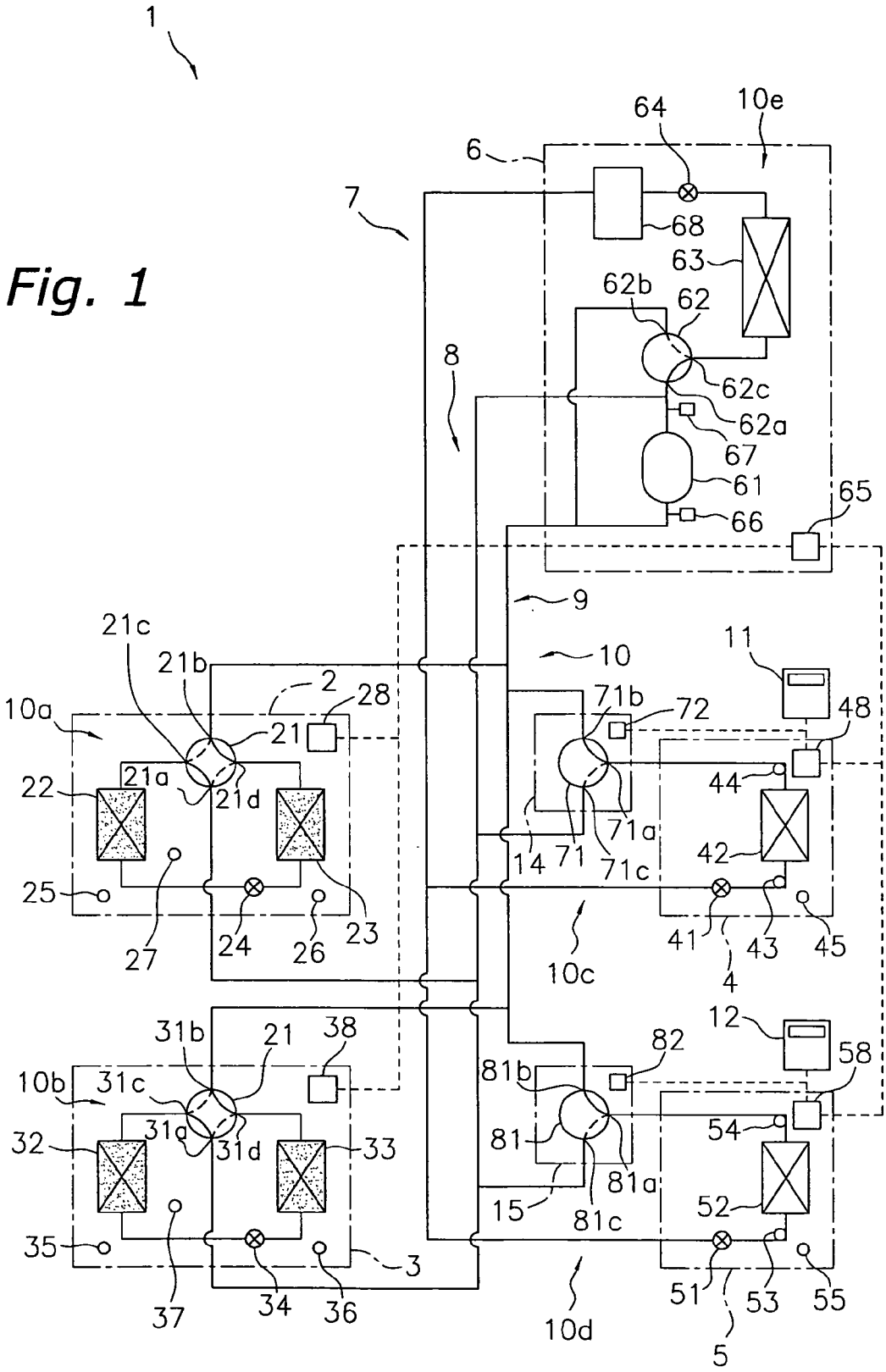
FIG. 1 is a schematic diagram of a refrigerant circuit of an air conditioning system of a first embodiment according to the present invention.

FIG. 1 a schematic diagram of a refrigerant circuit of an air conditioning system 1 of a first embodiment according to the present invention. The air conditioning system 1 is an air conditioning system that treats the latent heat load and the sensible heat load in the room of a building and the like by operating a vapor compression type refrigeration cycle. The air conditioning system 1 is so-called separate type multi air conditioning system, and mainly comprises: a plurality (two in this embodiment) of latent heat utilization units 2, 3 connected in parallel with one another; a plurality (two in this embodiment) of sensible heat utilization units 4, 5 connected in parallel with one another; a heat source unit 6; and connection pipes 7, 8, 9 which connect the latent heat utilization units 2, 3 and the sensible heat utilization units 4, 5 to the heat source unit 6. In the present embodiment, the heat source unit 6 functions as a heat source that is shared between the latent heat utilization units 2, 3 and the sensible heat utilization units 4, 5. In addition, although the present embodiment has only one heat source unit 6, a plurality of heat source units 6 may be connected in parallel when there are many latent heat utilization units 2, 3 and sensible heat utilization units 4, 5.

<Latent Heat Utilization Unit>

The latent heat utilization units 2, 3 are disposed such by being embedded in or hung from an indoor ceiling of a building or the like, or by being mounted in a space in above a ceiling. The latent heat utilization units 2, 3 are connected to the heat source unit 6 through the connection pipes 8, 9, and constitute part of a refrigerant circuit 10 in a space between the latent heat utilization units 2, 3 and the heat source unit 6. The latent heat utilization units 2, 3 function as a latent heat load treatment system that mainly treats the latent heat load in the room by circulating refrigerant in the refrigerant circuit 10 and operating a vapor compression type refrigeration cycle (when the term "latent heat load treatment system" is used in the description below, the term refers to a combination of the latent heat utilization units 2, 3 and the heat source unit 6).

Next, the configuration of the latent heat utilization units 2, 3 will be described. Note that the latent heat utilization unit 2 and the latent heat utilization unit 3 have the same configuration, so that only the configuration of the latent heat utilization unit 2 will be described here, and in regard to the configuration of the latent heat utilization unit 3, reference numerals in the 30s will be used instead of reference numerals in the 20s representing each component of the latent heat utilization unit 2, and a description of each component will be omitted.

The latent heat utilization unit 2 mainly constitutes part of the refrigerant circuit 10, and comprises a latent heat utilization side refrigerant circuit 10*a* capable of dehumidifying or humidifying air. This latent heat utilization side refrigerant circuit 10*a* mainly comprises: a latent heat utilization side four-way directional control valve 21; a first adsorbent heat exchanger 22; a second adsorbent heat exchanger 23; and a latent heat utilization side expansion valve 24.

The latent heat utilization side four-way directional control valve 21 is a valve used to switch a passage of refrigerant that flows into the latent heat utilization side refrigerant circuit 10*a*. A first port 21*a* of the valve 21 is connected to a discharge side of a compression mechanism 61 (to be described below) in the heat source unit 6 through the discharge gas connection pipe 8, a second port 21*b* thereof is connected to an inlet side of the compression mechanism 61 in the heat source unit 6 through the inlet gas connection pipe 9, and a third port 21*c* thereof is connected to a gas side end of the first adsorbent heat exchanger 22, and the fourth port 21*d* thereof is connected to a gas side end of the second adsorbent heat exchanger 23. Further, the latent heat utilization side four-way directional control valve 21 is capable of switching between a state in which the first port 21*a* is connected to the third port 21*c* while the second port 21*b* is connected to the fourth port 21*d* (a first state; see the solid lines in the latent heat utilization side four-way directional control valve 21 in FIG. 1) and a state in which the first port 21*a* is connected to the fourth port 21*d* while the second port 21*b* is connected to the third port 21*c* (a second state; see the broken lines in the latent heat utilization side four-way directional control valve 21 in FIG. 1).

The first adsorbent heat exchanger 22 and the second adsorbent heat exchanger 23 are fin and tube type heat exchangers of the cross fin type, which are formed with a heat transfer tube and a number of fins. Specifically, the first adsorbent heat exchanger 22 and the second adsorbent heat exchanger 23 include a number of rectangular plate shaped fins made of aluminum, and a heat transfer tube made of copper, which penetrates the fins. Note that the first adsorbent heat exchanger 22 and the second adsorbent heat exchanger 23 are not limited to the fin and tube type heat exchangers of the cross fin type. Other types of heat exchangers, such as corrugated fin type heat exchangers may be used.

The first adsorbent heat exchanger 22 and the second adsorbent heat exchanger 23 each have an adsorbent that is supported on the surface of the fins by dip molding (dipping mold). A method for supporting an adsorbent on the surface of a fin and a heat exchanger tube is not limited to the method that uses dip molding. An adsorbent may be supported on the surface in any method as long as adsorbing capacity of the adsorbent is not impaired. An adsorbent to be used here may include: zeolite, silica gel, activated carbon, organic polymer system material having a hydrophilic property or a water-absorbing property, ion exchange resin system material having a carboxylic acid group or a sulfonic acid group, functional polymer material such as temperature-sensitive polymers, and the like.

The first adsorbent heat exchanger 22 and the second adsorbent heat exchanger 23 allow moisture in the air to be adsorbed onto the adsorbent supported on the surface thereof, by being caused to function as evaporators that evaporate the refrigerant while allowing air to pass through the outside thereof. In addition, the first adsorbent heat exchanger 22 and the second adsorbent heat exchanger 23 allow the moisture adsorbed onto the adsorbent supported on the surface thereof to be desorbed, by being caused to function as condensers that condense the refrigerant while allowing air to pass through the outside thereof.

The latent heat utilization side expansion valve 24 is an electric expansion valve connected between the liquid side end of the first adsorbent heat exchanger 22 and the liquid side end of the second adsorbent heat exchanger 23, and is capable of reducing the pressure of the refrigerant that is sent from one of the first adsorbent heat exchanger 22 and the second adsorbent heat exchanger 23, whichever is acting as a condenser, to the other one of the first adsorbent heat exchanger 22 and the second adsorbent heat exchanger 23, whichever is acting as an evaporator.

In addition, although the detail is not shown, the latent heat utilization unit 2 comprises: an outside air inlet for drawing outdoor air (hereinafter referred to as outdoor air OA) into the unit; an exhaust air outlet for exhausting air from the unit to the outside; an indoor air inlet for drawing room air (hereinafter referred to as room air RA) into the unit; a supply air outlet for supplying air that is blown out from the unit to the room (hereinafter referred to as supply air SA); an exhaust fan that is disposed in the unit so as to communicate with the exhaust air outlet; an air supply fan that is disposed in the unit so as to communicate with the supply air outlet; and a switching mechanism comprising a damper and the like for switching an air passage. Accordingly, the latent heat utilization unit 2 can do the following actions: draw outdoor air OA from the outside air inlet into the unit, pass the air through one of the first and second adsorbent heat exchangers 22, 23, and then supply the air as the supply air SA to the room from the supply air outlet; draw outdoor air OA from the outside air inlet into the unit, pass the air through one of the first and second adsorbent heat exchangers 22, 23, and then exhaust the air as the exhaust air EA to the outside from the exhaust air outlet; draw the room air RA from the indoor air inlet into the unit, pass the air through one of the first and second adsorbent heat exchangers 22, 23, and then supply the air as the supply air SA to the room from the supply air outlet; and draw the room air RA from the indoor air inlet into the unit, pass the air through one of the first or second adsorbent heat exchangers 22, 23, and then exhaust the air as the exhaust air EA to the outside from the exhaust air outlet.

Further, the latent heat utilization unit 2 comprises: an RA inlet temperature/humidity sensor 25 that detects the temperature and the relative humidity of the room air RA to be drawn into the unit; an OA inlet temperature/humidity sensor 26 that detects the temperature and the relative humidity of the outdoor air OA to be drawn into the unit; an SA supply temperature sensor 27 that detects the temperature of the supply air SA to be supplied to the room from the unit; and a latent heat utilization side controller 28 that controls the operation of each component that constitutes the latent heat utilization unit 2. The latent heat utilization side controller 28 includes a microcomputer and a memory device provided for controlling the latent heat utilization unit 2. Through a remote control 11 and a heat source side controller 65 of the heat source unit 6, which will be described below, the latent heat utilization side controller 28 can send and receive input signals of the target temperature and the target humidity of the room air, and also can exchange control signals and other signals with the heat source unit 6.

<Sensible Heat Utilization Unit>

The sensible heat utilization units 4, 5 are disposed such by being embedded in or hung from an indoor ceiling of a building or the like, or by being mounted in a space in above a ceiling. The sensible heat utilization units 4, 5 are connected to the heat source unit 6 through the connection pipes 7, 8, 9 and connection units 14, 15, and constitute part of the refrigerant circuit 10 in a space between the sensible utilization units 4, 5 and the heat source unit 6. The sensible heat utilization units 4, 5 function as a sensible heat load treatment system that mainly treats the sensible heat load in the room by circulating refrigerant in the refrigerant circuit 10 and operating a vapor compression type refrigeration cycle (when the term "sensible heat load treatment system" is used in the description below, the term refers to a combination of the sensible heat utilization units 4, 5 and the heat source unit 6). Further, the sensible heat utilization unit 4 is disposed in the same air-conditioned space as is the latent heat utilization unit 2, and the sensible heat utilization unit 5 is disposed in the same air-conditioned space as is the latent heat utilization unit 3. In other words, the latent heat utilization unit 2 pairs up with the sensible heat utilization unit 4 to treat the latent heat load and the sensible heat load in an air-conditioned space, whereas the latent heat utilization unit 3 pairs up with the sensible heat utilization unit 5 to treat the latent heat load and the sensible heat load in a different air-conditioned space.

Next, the configuration of the sensible heat utilization units 4, 5 will be described. Note that the sensible heat utilization unit 4 and the sensible heat utilization unit 5 have the same configuration, so that only the configuration of the sensible heat utilization unit 4 will be described here, and in regard to the configuration of the sensible heat utilization unit 5, reference numerals in the 50s will be used instead of reference numerals in the 40s representing each component of the sensible heat utilization unit 4, and a description of each component will be omitted.

The sensible heat utilization unit 4 mainly constitutes part of the refrigerant circuit 10, and comprises a sensible heat utilization side refrigerant circuit 10*c* capable of dehumidifying or humidifying air (a sensible heat utilization side refrigerant circuit 10*d* in the sensible heat utilization unit 5). This sensible heat utilization side refrigerant circuit 10*c* mainly comprises a sensible heat utilization side expansion valve 41 and an air heat exchanger 42. In the present embodiment, the sensible heat utilization side expansion valve 41 is an electric expansion valve connected to the liquid side of the air heat exchanger 42 in order to adjust the flow rate of the refrigerant. In the present embodiment, the air heat exchanger 42 is a fin and tube type heat exchanger of the cross fin type, which is formed with a heat transfer tube and a number of fins, and is a device configured to exchange heat between refrigerant and the room air RA. In the present embodiment, the sensible heat utilization unit 4 comprises a ventilation fan (not shown) for supplying air as the supply air SA to the room, after the room air RA is drawn into the unit and is heat-exchanged. The sensible heat utilization unit 4 is capable of exchanging the heat between the room air RA and the refrigerant that flows through an air heat exchanger 42.

In addition, the sensible heat utilization unit 4 is provided with various sensors. The liquid side of the air heat exchanger 42 is provided with a liquid side temperature sensor 43 that detects the temperature of the liquid refrigerant, and the gas side of the air heat exchanger 42 is provided with a gas side temperature sensor 44 that detects the temperature of the gas refrigerant. The sensible heat utilization unit 4 is further provided with an RA inlet temperature sensor 45 that detects the temperature of the room air RA to be drawn into the unit. In addition, the sensible heat utilization unit 4 comprises a sensible heat utilization side controller 48 that controls the operation of each component that constitutes the sensible heat utilization unit 4. The sensible heat utilization side controller 48 includes a microcomputer and a memory device provided for controlling the sensible heat utilization unit 4. Through the remote control 11, the sensible heat utilization side controller 48 can send and receive input signals of the target temperature of the room air and the target humidity of the room air, and also can exchange control signals and other signals with the heat source unit 6.

<Heat Source Unit>

The heat source unit 6 is disposed on the roof of a building and the like, and is connected to the latent heat utilization units 2, 3 and the sensible heat utilization units 4, 5 through the connection pipes 7, 8, 9. The heat source unit 6 constitutes the refrigerant circuit 10 between the latent heat utilization units 2, 3 and the sensible heat utilization units 4, 5.

Next, the configuration of the heat source unit 6 will be described. The heat source unit 6 mainly constitutes part of the refrigerant circuit 10, and comprises a heat source side refrigerant circuit 10*e*. This heat source side refrigerant circuit 10*e* mainly comprises the compression mechanism 61; a three-way direction control valve 62; a heat source side heat exchanger 63; a heat source side expansion valve 64; and a receiver 68.

In the present embodiment, the compression mechanism 61 is a positive-displacement compressor whose operational capacity can be changed by the inverter control. In the present embodiment, the compression mechanism 61 only has one compressor but is not limited thereto, and may also be one where two or more compressors are connected in parallel in accordance with the number of utilization units to be connected.

The three-way direction control valve 62 is a valve that can switch passages of the refrigerant inside the heat source refrigerant circuit 10*e* such that when the heat source heat exchanger 63 is caused to function as a condenser (hereinafter, referred to as a condensing operation state), the discharge side of the compression mechanism 61 is connected to the gas side of the heat source heat exchanger 63, and when the heat source heat exchanger 63 is caused to function as an evaporator (hereinafter, referred to as an evaporating operation state), the inlet side of the compression mechanism 61 is connected to the gas side of the heat source heat exchanger 63. A first port 62*a* of the three-way direction control valve 62 is connected to the discharge side of the compression mechanism 61, a second port 62*b* thereof is connected to the inlet side of the compression mechanism 61, and a third port 62*c* thereof is connected to the gas side end of the heat source side heat exchanger 63. Additionally, as described above, the three-way direction control valve 62 is capable of switching between a state in which the first port 62*a* is connected to the third port 62*c* (corresponding to the condensing operation state; see the solid lines in the three-way direction control valve 62 in FIG. 1) and a state in which the second port 62*b* is connected to the third port 62*c* (corresponding to the evaporating operation state; see the broken lines in the three-way direction control valve 62 in FIG. 1). In addition, the discharge gas connection pipe 8 is connected between the discharge side of the compression mechanism 61 and the three-way direction control valve 62. Accordingly, high-pressure gas refrigerant that is compressed in and discharged from the compression mechanism 61 can be supplied to the latent heat utilization units 2, 3 and the sensible heat utilization units 4, 5, regardless of a switching operation of the three-way direction control valve 62. In addition, the inlet side of the compression mechanism 61 is connected to the inlet gas connection pipe 9 through which flows low-pressure gas refrigerant that returns from the latent heat utilization units 2, 3 and the sensible heat utilization units 4, 5.

In the present embodiment, the heat source side heat exchanger 63 is a fin and tube type heat exchanger of the cross fin type, which is formed with a heat transfer tube and a number of fins, and is a device configured to exchange the heat with refrigerant, using air as a heat source. In the present embodiment, the heat source unit 6 comprises an outdoor fan (not shown) for drawing the outdoor air into the unit and blowing the air out, and is capable of exchanging the heat between the outdoor air and the refrigerant that flows through the heat source side heat exchanger 63.

In the present embodiment, the heat source side expansion valve 64 is an electric expansion valve capable of adjusting the flow rate of the refrigerant flowing between the heat source side heat exchanger 63 and the air heat exchangers 42, 52 through the liquid connection pipe 7. When the heat source side heat exchanger 63 is in the condensing operation state, the heat source side expansion valve 64 is used in an almost full open state, whereas when in the evaporating operation state, the degree of opening of the heat source side expansion valve 64 is adjusted so as to reduce the pressure of the refrigerant that flows into the heat source side heat exchanger 63 from the air heat exchangers 42, 52 through the liquid connection pipe 7.

The receiver 68 is a container that is used to temporarily store the refrigerant that flows between the heat source side heat exchanger 63 and the air heat exchangers 42, 52. In the present embodiment, the receiver 68 is connected between the heat source side expansion valve 64 and the liquid connection pipe 7.

In addition, the heat source unit 6 is provided with various sensors. Specifically, the heat source unit 6 comprises: an inlet pressure sensor 66 that detects the inlet pressure of the compression mechanism 61; a discharge pressure sensor 67 that detects the discharge pressure of the compression mechanism 61; and a heat source side controller 65 that controls the operation of each component that constitutes the heat source unit 6. The heat source side controller 65 includes a microcomputer and a memory device provided for controlling the heat source unit 6, and is capable of transmitting a control signal to and from the latent heat utilization side controllers 28, 38 of the latent heat utilization units 2, 3, respectively, and also to and from the sensible heat utilization side controllers 48, 58 of the sensible heat utilization units 4, 5, respectively. The heat source side controller 65 can also exchange a control signal and the like with the heat source side controller 65.

The air conditioning system 1 of the present embodiment can supply high-pressure gas refrigerant that is compressed in and discharged from the compression mechanism 61 of the heat source unit 6 to the adsorbent heat exchangers 22, 23, 32, 33 of the latent heat utilization units 2, 3 through the discharge gas connection pipe 8; and return the high-pressure gas refrigerant from the adsorbent heat exchangers 22, 23, 32, 33 of the latent heat utilization units 2, 3 to the inlet side of the compression mechanism 61 of the heat source unit 6 through the inlet gas connection pipe 9 back. Accordingly, the room can be dehumidified or humidified, regardless of the operation of the sensible heat utilization units 4, 5.

In addition, as for the sensible heat utilization units 4, 5, the gas sides of the air heat exchangers 42, 52 is switchably connected to the discharge gas connection pipe 8 and the inlet gas connection pipe 9 through the connection units 14, 15. The connection units 14, 15 mainly comprise, respectively, air conditioning switching valves 71, 81; and connection unit controllers 72, 82 which control the operation of each component that constitutes the connection units 14, 15. The air conditioning switching valves 71, 81 are valves that function as switching mechanisms that can switch between a state in which the gas sides of the air heat exchangers 42, 52 of the sensible heat utilization units 4, 5 are connected to the inlet gas connection pipe 9 when the sensible heat utilization units 4, 5 performing a cooling operation (hereinafter referred to as a cooling operation state), and a state in which the gas sides of the air heat exchangers 42, 52 of the sensible heat utilization units 4, 5 are connected to the discharge gas connection pipe 8 when the sensible heat utilization units 4, 5 perform a heating operation (hereinafter referred to as a heating operation state). First ports 71*a*, 81*a* of the air conditioning switching valves 71, 81, respectively, are connected to the gas sides of the air heat exchangers 42, 52, respectively; second ports 71*b*, 81*b* thereof are connected to the inlet gas connection pipe 9; and third ports 71*c*, 81*c* thereof are connected to the discharge gas connection pipe 8. Additionally, as described above, the air conditioning switching valves 71, 81 are capable of switching between a state in which the first ports 71*a*, 81*a* are respectively connected to the second ports 71*b*, 81*b* (corresponding to the cooling operation state; see the solid lines in the air conditioning switching valves 71, 81 in FIG. 1) and a state in which the first ports 71*a*, 81*a* are respectively connected to the third ports 71*c*, 81*c* (corresponding to the heating operation state; see the broken lines in the air conditioning switching valves 71, 81 in FIG. 1). The connection unit controllers 72, 82 each include a microcomputer and a memory device provided for respectively controlling the connection units 14, 15, and are capable of transmitting a control signal to and from the sensible heat utilization side controllers 48, 58 of the sensible heat utilization units 4, 5, respectively. Accordingly, the sensible heat utilization units 4, 5 can perform so-called simultaneous cooling and heating operation such that, for example, the sensible heat utilization unit 4 performs the cooling operation, while the sensible heat utilization unit 5 performs the heating operation.

(2) Operation of the Air Conditioning System

Next, the operation of the air conditioning system 1 of the present embodiment will be described. The air conditioning system 1 is capable of treating the latent heat load in the room by the latent heat load treatment system, and treating the sensible heat load in the room mainly by the sensible heat load treatment system. Prior to the description of various operations, first, the operation of the air conditioning system 1 during a single operation of the latent heat load treatment system (in other words, when the sensible heat utilization units 4, 5 are not operated) will be described.

The air conditioning system 1 can perform various types of dehumidifying operations and humidifying operations as described below, by a single operation performed only by the latent heat load treatment system.

<Full Ventilation Mode>

First, a dehumidifying operation and a humidifying operation in a full ventilation mode will be described. In the full ventilation mode, when the air supply fan and the exhaust fan of the latent heat utilization units 2, 3 are operated, outdoor air OA is drawn through the outside air inlets into the units, and is supplied as the supply air SA through the supply air outlets to the room, while the room air RA is drawn through the indoor air inlets into the units, and is exhausted as the exhaust air EA through the exhaust air outlets to the outside.

Figure 2:
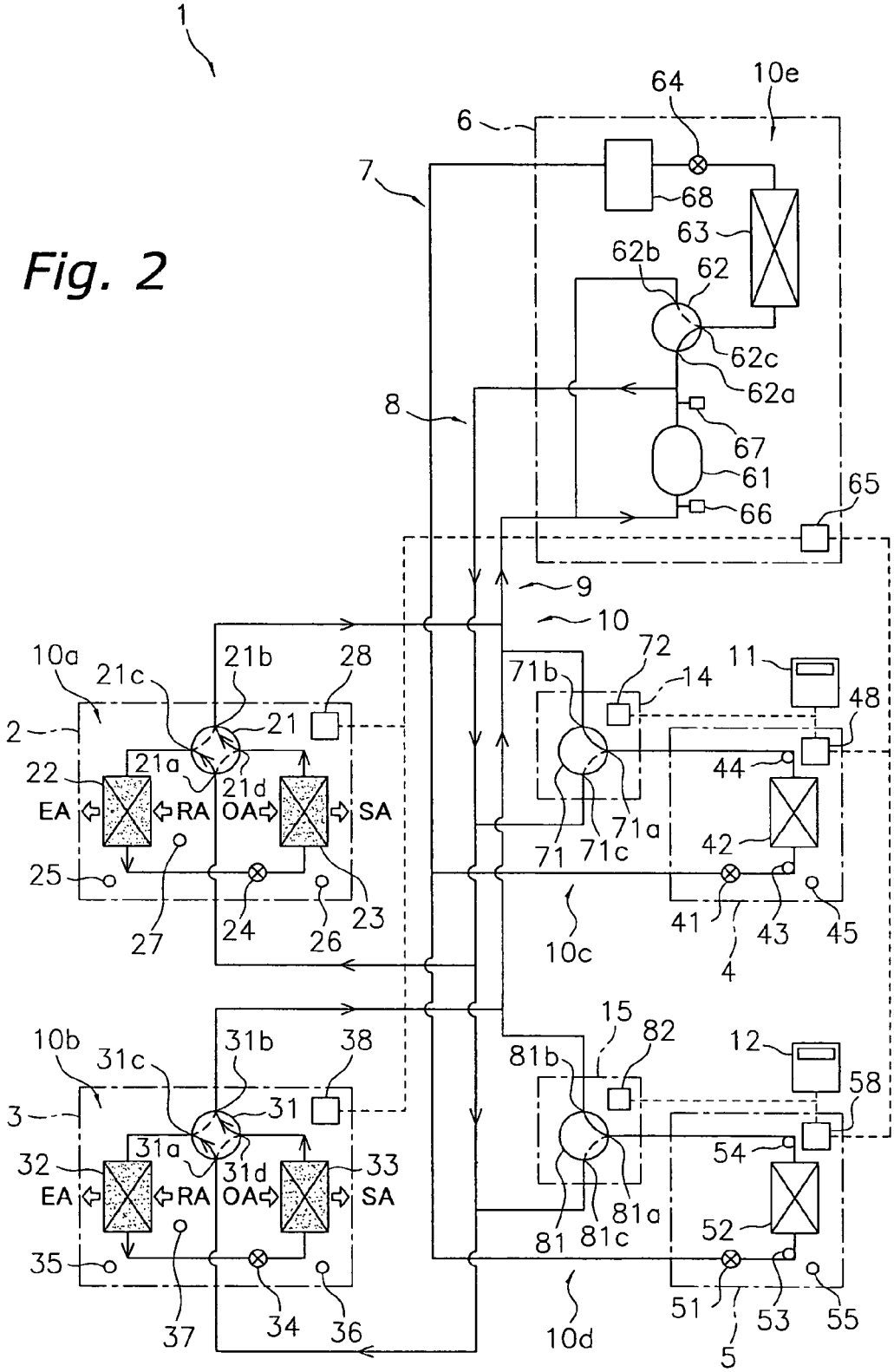
FIG. 2 is a schematic diagram of a refrigerant circuit showing the operation during a dehumidifying operation in a full ventilation mode when only a latent heat load treatment system is operated.
Figure 3:
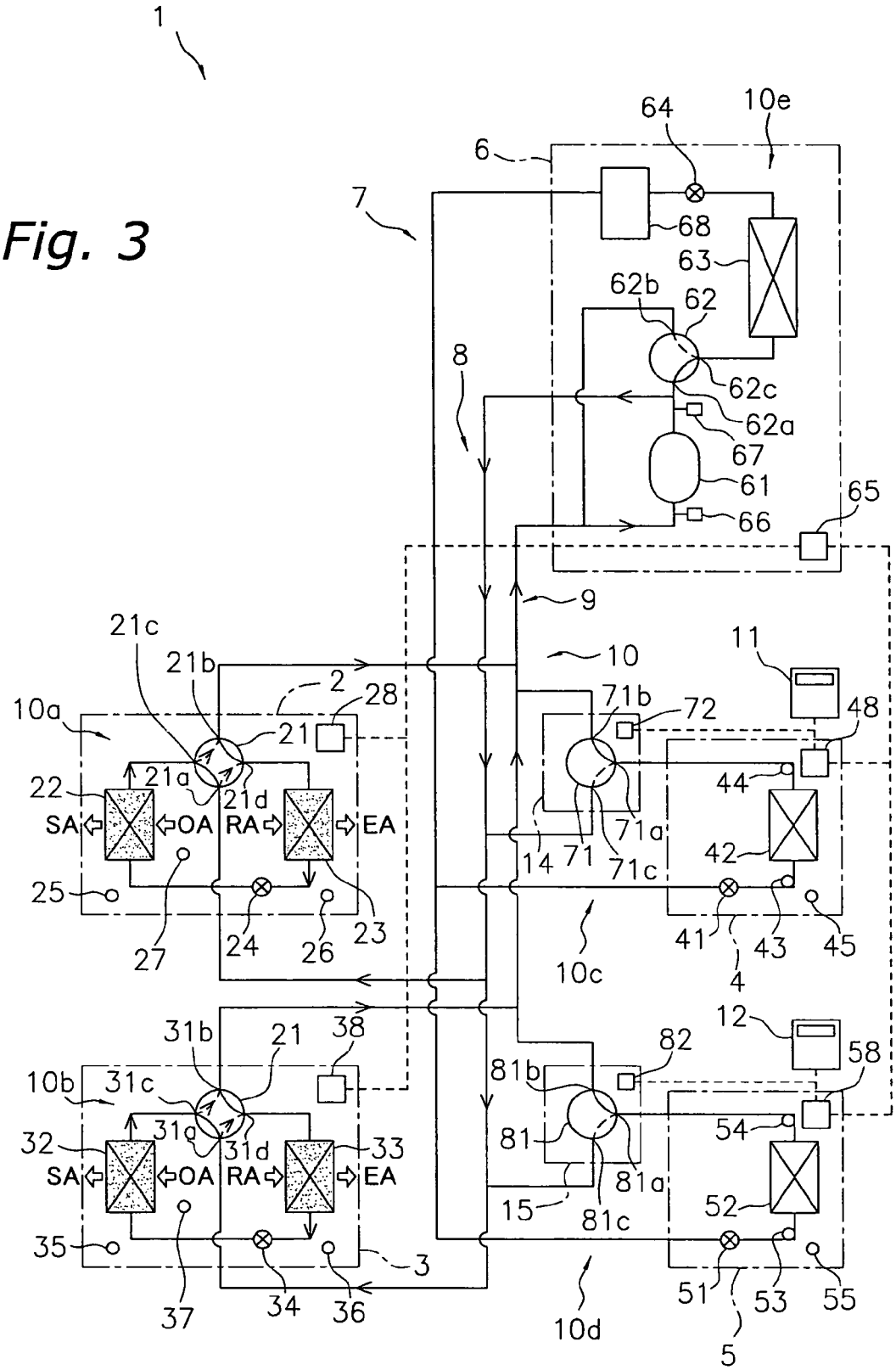
FIG. 3 is a schematic diagram of refrigerant circuit showing the operation during the dehumidifying operation in the full ventilation mode when only the latent heat load treatment system is operated.
Figure 4:
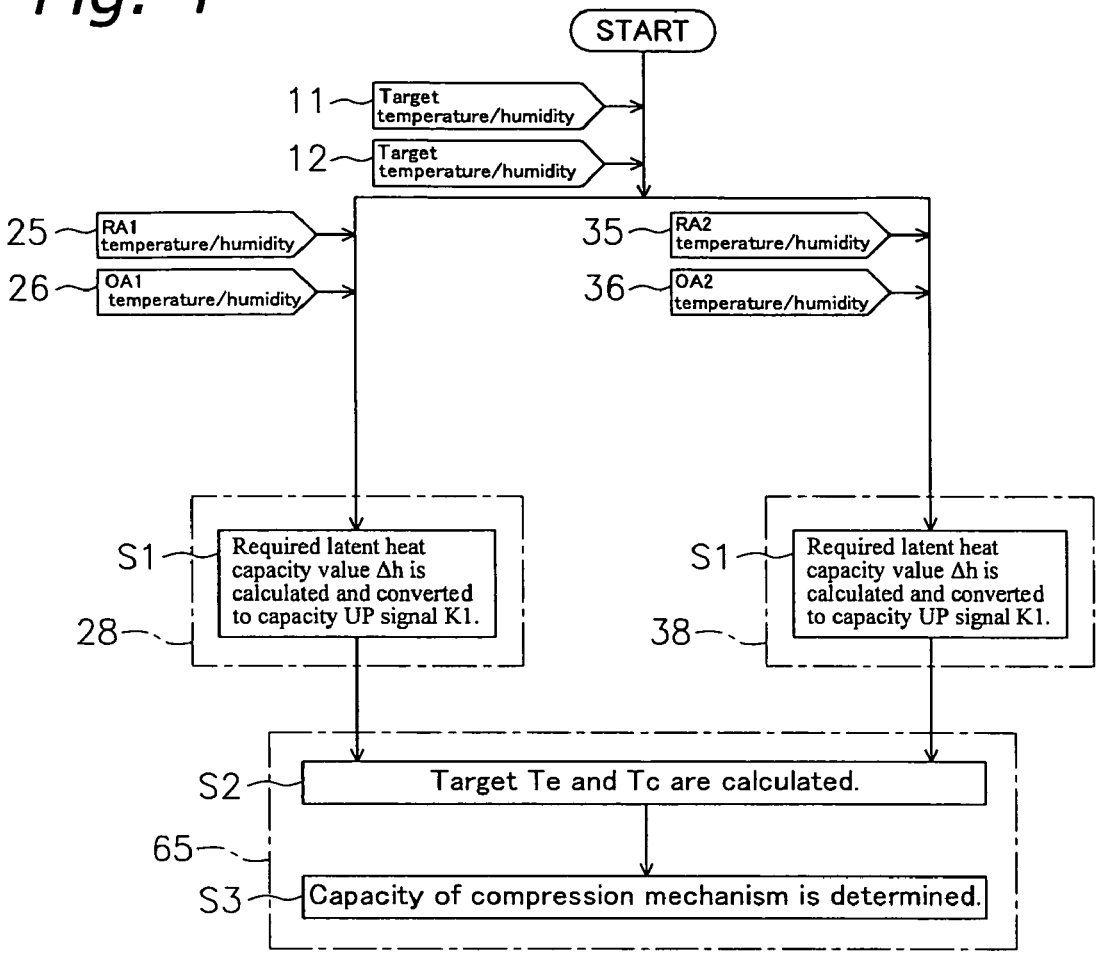
FIG. 4 is a diagram of control flow when only the latent heat load treatment system is operated.

The operation of the dehumidifying operation during the full ventilation mode will be described with reference to FIGS. 2, 3, and 4. Here, FIGS. 2 and 3 are schematic diagrams of a refrigerant circuit showing the operation during the dehumidifying operation in the full ventilation mode, when only the latent heat load treatment system of the air conditioning system 1 is operated. FIG. 4 is a diagram of control flow when only the latent heat load treatment system of the air conditioning system 1 is operated.

During the dehumidifying operation, as shown in FIGS. 2 and 3, for example, the latent heat utilization unit 2 alternately repeats a first operation in which the first adsorbent heat exchanger 22 functions as a condenser and the second adsorbent heat exchanger 23 functions as an evaporator, and a second operation in which that second adsorbent heat exchanger 23 functions as a condenser and the first adsorbent heat exchanger 22 functions as an evaporator. Likewise, the latent heat utilization unit 3 alternately repeats a first operation in which the first adsorbent heat exchanger 32 functions as a condenser and the second adsorbent heat exchanger 33 functions as an evaporator and, a second operation in which the second adsorbent heat exchanger 33 functions as a condenser and the first adsorbent heat exchanger 32 functions as an evaporator.

The operation of the two latent heat utilization units 2 and 3 will be described together below.

In the first operation, a regeneration process in the first adsorbent heat exchangers 22, 32 and an adsorption process in the second adsorbent heat exchangers 23, 33 are performed in parallel. During the first operation, as shown in FIG. 2, the latent heat utilization side four-way directional control valves 21, 31 are set to a first state (see the solid lines in the latent heat utilization side four-way directional control valves 21, 31 in FIG. 2). In this state, high-pressure gas refrigerant discharged from the compression mechanism 61 flows into the first adsorbent heat exchangers 22, 32 through the discharge gas connection pipe 8 and the latent heat utilization side four-way directional control valves 21, 31, and is condensed while passing through the first adsorbent heat exchangers 22, 32. The condensed refrigerant is pressure-reduced by the latent heat utilization side expansion valves 24, 34, and is subsequently evaporated while passing through the second adsorbent heat exchangers 23, 33. Then, the refrigerant is again drawn into the compression mechanism 61 through the latent heat utilization side four-way directional control valves 21, 31 and the inlet gas connection pipe 9 (see the arrows shown on the refrigerant circuit 10 in FIG. 2). During this time, since the sensible heat utilization side expansion valve 41, 51 of the sensible heat utilization units 4, 5 are closed, the refrigerant is prevented from flowing into the sensible heat utilization units 4, 5.

During the first operation, in the first adsorbent heat exchangers 22, 32, moisture is desorbed from the adsorbent heated by condensation of the refrigerant, and this desorbed moisture is added to the room air RA that is drawn from the indoor air inlet. The moisture desorbed from the first adsorbent heat exchangers 22, 32 is carried with the room air RA and is exhausted as the exhaust air EA through the exhaust air outlet to the outside. In the second adsorbent heat exchangers 23, 33, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the second adsorbent heat exchangers 23, 33 passes through the supply air outlet and is supplied as the supply air SA to the room (see the arrows shown on the both sides of the adsorbent heat exchangers 22, 23, 32, 33 in FIG. 2).

In the second operation, the adsorption process in the first adsorbent heat exchangers 22, 32 and the regeneration process in the second adsorbent heat exchangers 23, 33 are performed in parallel. During the second operation, as shown in FIG. 3, the latent heat utilization side four-way directional control valves 21, 31 are set to a second state (see the broken lines in the latent heat utilization side four-way directional control valves 21, 31 in FIG. 3). In this state, high-pressure gas refrigerant discharged from the compression mechanism 61 flows into the second adsorbent heat exchangers 23, 33 through the discharge gas connection pipe 8 and the latent heat utilization side four-way directional control valves 21, 31, and is condensed while passing through the second adsorbent heat exchangers 23, 33. The condensed refrigerant is pressure-reduced by the latent heat utilization side expansion valves 24, 34, and is subsequently evaporated while passing through the first adsorbent heat exchangers 22, 32. Then, the refrigerant is again drawn into the compression mechanism 61 through the latent heat utilization side four-way directional control valves 21, 31 and the inlet gas connection pipe 9 (see the arrows shown on the refrigerant circuit 10 in FIG. 3).

During the second operation, in the second adsorbent heat exchangers 23, 33, moisture is desorbed from the adsorbent heated by condensation of the refrigerant, and this desorbed moisture is added to the room air RA that is drawn from the indoor air inlet. The moisture desorbed from the second adsorbent heat exchangers 23, 33 is carried with the room air RA and is exhausted as the exhaust air EA through the exhaust air outlet to the outside. In the first adsorbent heat exchangers 22, 32, the moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the first adsorbent heat exchangers 22, 32 passes through the supply air outlet and is supplied as the supply air SA to the room (see the arrows shown on the both sides of the adsorbent heat exchangers 22, 23, 32, 33 in FIG. 3).

Here, the system control for the single operation performed only by the latent heat load treatment system of the air conditioning system 1 will be described.

First, when the target temperature and target relative humidity of the room air are set by the remote controls 11, 12, along with these target temperature and target relative humidity, the following information will be input into the latent heat utilization side controllers 28, 38 of the latent heat utilization units 2, 3, respectively: the temperature and the relative humidity of the room air to be drawn into the units, which were detected by RA inlet temperature/humidity sensors 25, 35; and the temperature and the relative humidity of outdoor air to be drawn into the units, which were detected by OA inlet temperature/humidity sensors 26, 36.

Then, in step S1, the latent heat utilization side controllers 28, 38 calculate the target value of the enthalpy or the target absolute humidity based on the target temperature and target relative humidity of the room air; calculate the current value of the enthalpy or the current absolute humidity of the air to be drawn into the unit from the room based on the temperature and the relative humidity detected by the RA inlet temperature/humidity sensors 25, 35; and then calculate the difference between the two calculated values (hereinafter referred to as the required latent heat capacity value Δh). Here, as described above, the required latent heat capacity value Δh is the difference between the target value of the enthalpy or target absolute humidity of the room air and the current value of the enthalpy or current absolute humidity of the room air, so that the required latent heat capacity value Δh corresponds to the latent heat load that must be treated in the air conditioning system 1. Then, this required latent heat capacity value Δh is converted to a capacity UP signal K1 that informs the heat source side controller 65 whether or not it is necessary to increase the treatment capacity of the latent heat utilization units 2, 3. For example, when the absolute value of Δh is lower than a predetermined value (in other words, when the humidity of the room air is close to the target humidity and the treatment capacity does not need to be increased or decreased), the capacity UP signal K1 will be "0." When the absolute value of Δh is higher than a predetermined value in a way that the treatment capacity needs to be increased (in other words, the humidity of the room air is higher than the target humidity during the dehumidifying operation and the treatment capacity needs to be increased), the capacity UP signal K1 will be "A," and when the absolute value of Δh is higher than a predetermined value in a way that the treatment capacity needs to be decreased (in other words, the humidity of the room air is lower than the target humidity during the dehumidifying operation, and the treatment capacity needs to be decreased), the capacity UP signal K1 will be "B."

Next, in step S2, the heat source side controller 65 calculates the target condensation temperature TcS1 and the target evaporation temperature TeS1, by using the capacity UP signal K1 of the latent heat utilization units 2, 3 transmitted from the latent heat utilization side controllers 28, 38. For example, the target condensation temperature TcS1 is calculated by adding the capacity UP signal K1 of the latent heat utilization units 2, 3 to the current target condensation temperature. In addition, the target evaporation temperature TeS1 is calculated by subtracting the capacity UP signal K1 of the latent heat utilization units 2, 3 from the current target evaporation temperature. Accordingly, when a value of the capacity UP signal K1 is "A," the target condensation temperature TcS1 will be high and the target evaporation temperature TeS1 will be low.

Next in step S3, a system condensation temperature Tc1 and a system evaporation temperature Te1, which respectively correspond to measured values of the condensation temperature and the evaporation temperature of the entire air conditioning system 1, are calculated. For example, the system condensation temperature Tc1 and the system evaporation temperature Te1 are calculated by converting an inlet pressure of the compression mechanism 61 detected by the inlet pressure sensor 66 and a discharge pressure of the compression mechanism 61 detected by the discharge pressure sensor 67 to the saturation temperatures of the refrigerant at these pressures. Then, the temperature difference ΔTc1 between the system condensation temperature Tc1 and the target condensation temperature TcS1 and the temperature difference ΔTe1 between the system evaporation temperature Te1 and the target evaporation temperature TeS1 are calculated. Then, based on the subtraction between these temperature differences, the necessity and amount of the increase or decrease in the operational capacity of the compression mechanism 61 will be determined.

By using thus determined operational capacity of the compression mechanism 61 to control the operational capacity of the compression mechanism 61, the system control to aim the target temperature and target relative humidity of the room air is performed. The system control is performed such that, for example, when a value determined by subtracting the temperature difference ΔTe1 from the temperature difference ΔTc1 is a positive value, the operational capacity of the compression mechanism 61 is increased, whereas when a value determined by subtracting the temperature difference ΔTe1 from the temperature difference ΔTc1 is a negative value, the operational capacity of the compression mechanism 61 is decreased.

Figure 5:
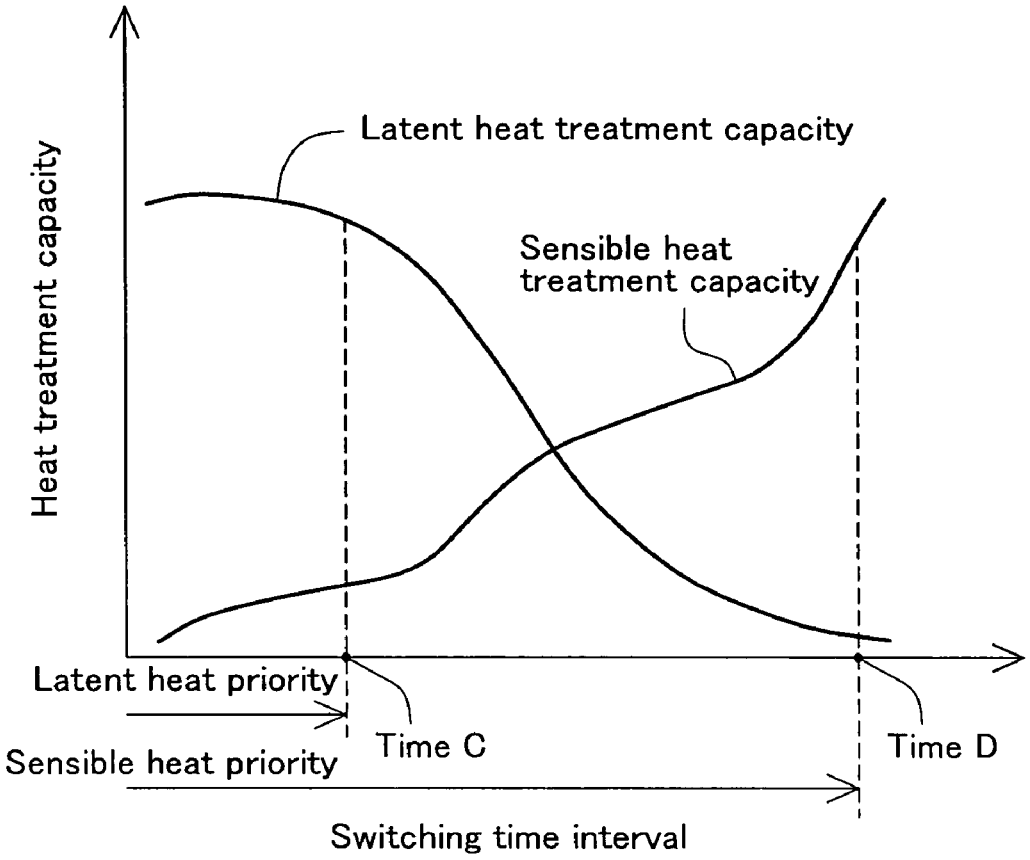
FIG. 5 is a graph indicating a latent heat treatment capacity and a sensible heat treatment capacity in adsorbent heat exchanger, with a switching time interval between an adsorption process and a regeneration process as a horizontal axis.

Here, through these adsorption process and regeneration process, the first adsorbent heat exchangers 22, 32 and the second adsorbent heat exchangers 23, 33 perform not only a treatment to adsorb moisture in the air and desorb the adsorbed moisture back into the air (hereinafter referred to as the latent heat treatment) but also a treatment to cool or heat the passing air to change the temperature thereof (hereinafter referred to as the sensible heat treatment). The graph in FIG. 5 shows the latent heat treatment capacity and the sensible heat treatment capacity which are obtained in the adsorbent heat exchanger, with the switching time interval between the first operation and the second operation, i.e., the adsorption process and the regeneration process as a horizontal axis. This graph shows that, when the switching time interval is made shorter (time C in FIG. 5, referred to as the latent heat priority mode), the latent heat treatment, i.e., a treatment to adsorb moisture in the air and desorb the moisture back into the air, is preferentially performed. On the other hand, when the switching time interval is made longer (time D in FIG. 5, referred to as the sensible heat priority mode), the sensible heat treatment, i.e., a treatment to heat or cool the air to change the temperature thereof, is preferentially performed. This is because, for example, when air is contacted with one of the first adsorbent heat exchangers 22, 32 and one of the second adsorbent heat exchangers 23, 33, whichever are acting as evaporators, at first, mainly moisture is adsorbed by the adsorbent provided on the surface of these heat exchangers, so that the absorption heat thus generated will be treated; however, once an amount of moisture close to the maximum moisture adsorption capacity of the adsorbent is adsorbed, then mainly, air will be cooled. This is also because when air is contacted with one of the first adsorbent heat exchangers 22, 32 and one of the second adsorbent heat exchangers 23, 33, whichever are acting as condensers, at first, mainly the moisture that was adsorbed onto the adsorbent provided on the surface of these heat exchangers is desorbed back into the air because of the heated adsorbent; however, once almost all the moisture adsorbed onto the adsorbent is desorbed, then mainly, air will be heated. Further, by changing this switching time interval by a command from the latent heat utilization side controllers 28, 38, the ratio of the sensible heat treatment capacity to the latent heat treatment capacity (hereinafter referred to as the sensible heat treatment capacity ratio) can be changed. Note that, as described below, the latent heat load treatment system of the air conditioning system 1 mainly performs the latent heat treatment when the latent heat load treatment system is operated along with the sensible heat load treatment system (in other words, when the sensible heat utilization units 4, 5 are operated; hereinafter referred to as the normal operation), so that the switching time interval is set to time C, i.e., set in the latent heat priority mode.

In this way, in the dehumidifying operation in the full ventilation mode performed only by the latent heat load treatment system, this air conditioning system 1 can perform the cooling operation in which dehumidification of outdoor air is performed, and simultaneously cooling is performed using the sensible heat treatment capacity that is obtained according to the switching time interval and the cooled air is supplied to the room.

Figure 6:
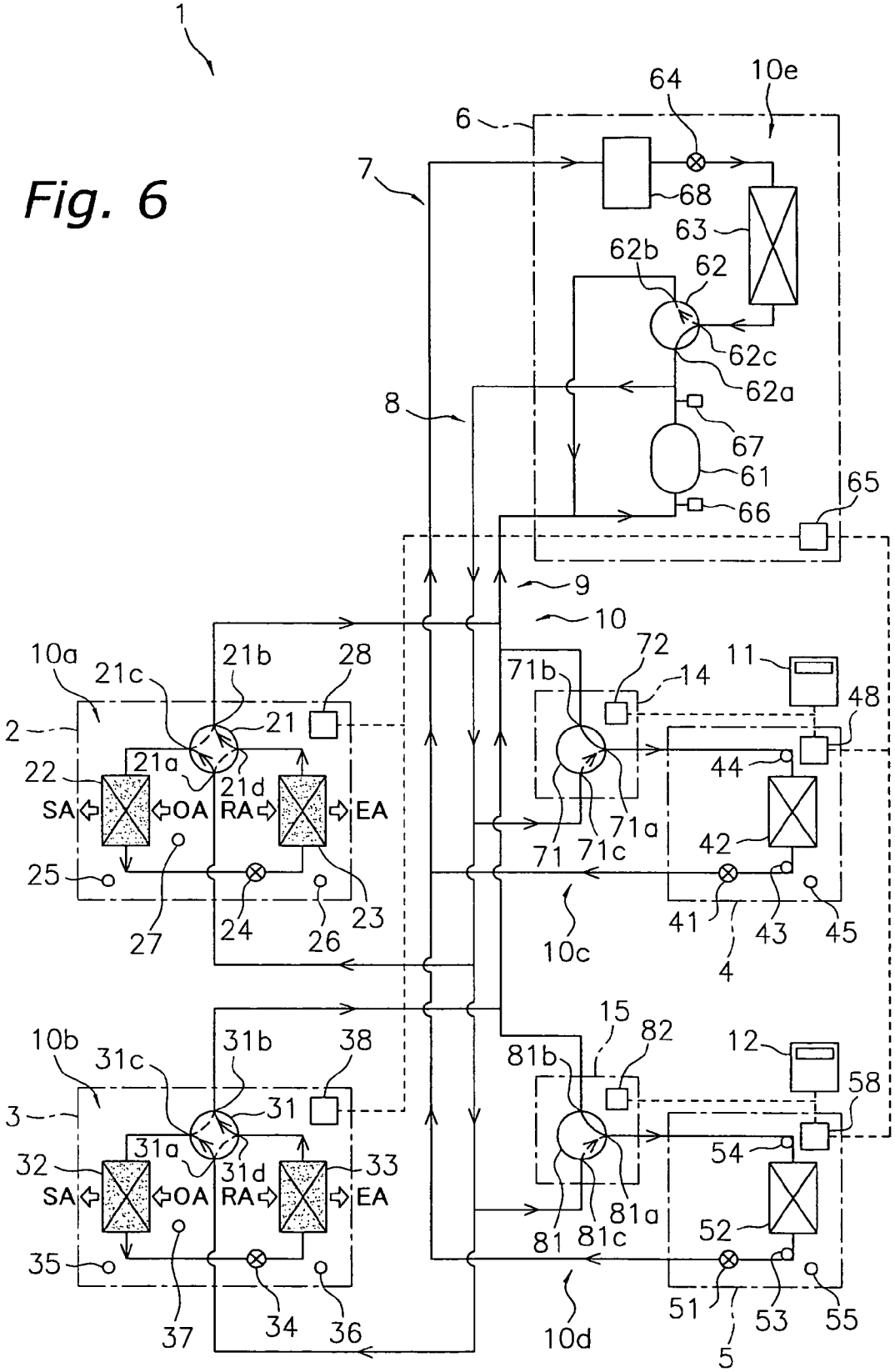
FIG. 6 is a schematic diagram of a refrigerant circuit showing the operation during a humidifying operation in the full ventilation mode when only the latent heat load treatment system is operated.
Figure 7:
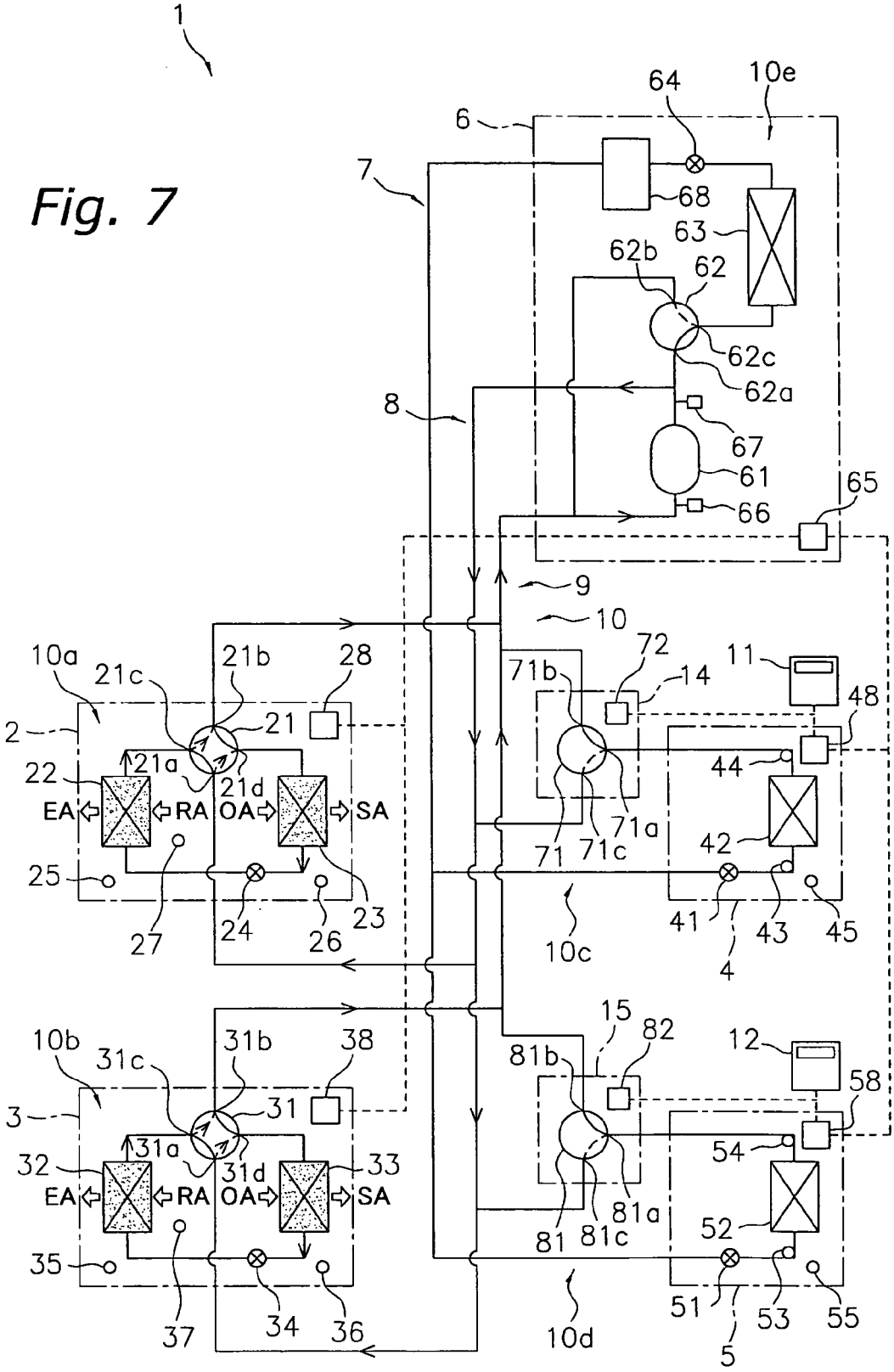
FIG. 7 is a schematic diagram of a refrigerant circuit showing the operation during the humidifying operation in the full ventilation mode when only the latent heat load treatment system is operated.

The operation during the humidifying operation in the full ventilation mode will be described with reference to FIGS. 6 and 7. Here, FIGS. 6 and 7 are schematic diagrams of a refrigerant circuit showing the operation during the humidifying operation in the full ventilation mode when only the latent heat load treatment system of the air conditioning system 1 is operated. Note that the system control that is performed in the air conditioning system 1 is the same as the system control for the above-described dehumidifying operation in the full ventilation mode, so that a description thereof will be omitted.

During the humidifying operation, as shown in FIGS. 6 and 7, for example, the latent heat utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the latent heat utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator. Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the outdoor air OA that was drawn from the outside air inlet. The moisture desorbed from the first adsorbent heat exchangers 22, 32 is carried with outdoor air OA and is supplied as the supply air SA through the supply air outlet to the room. In the second adsorbent heat exchangers 23, 33, moisture in the room air RA is adsorbed onto the adsorbent, the room air RA is dehumidified, the absorption heat thereby generated is transferred to the refrigerant, and the refrigerant evaporates. Then the room air RA dehumidified in the second adsorbent heat exchangers 23, 33 passes through the exhaust air outlet and is exhausted as the exhaust air EA to the outside (see the arrows shown on the both sides of the adsorbent heat exchangers 22, 23, 32, 33 in FIG. 6).

During the second operation, in the second adsorbent heat exchangers 23, 33, moisture is desorbed from the adsorbent heated by condensation of the refrigerant, and this desorbed moisture is added to the outdoor air OA that was drawn from the outside air inlet. The moisture desorbed from the second adsorbent heat exchangers 23, 33 is carried with outdoor air OA and is supplied as the supply air SA through the supply air outlet to the room. In the first adsorbent heat exchangers 22, 32, moisture in the room air RA is adsorbed onto the adsorbent, the room air RA is dehumidified, the absorption heat thereby generated is transferred to the refrigerant, and the refrigerant evaporates. Then the room air RA dehumidified in the first adsorbent heat exchangers 22, 32 passes through the exhaust air outlet and is exhausted as the exhaust air EA to the outside (see the arrows shown on the both sides of the adsorbent heat exchangers 22, 23, 32, 33 in FIG. 7).

Here, the first adsorbent heat exchangers 22, 32 and second adsorbent heat exchangers 23, 33 treat not only the latent heat but also the sensible heat, as in the case of the dehumidifying operation in the full ventilation mode.

In this way, in the humidifying operation in the full ventilation mode performed only by the latent heat load treatment system, this air conditioning system 1 can perform the humidifying operation in which humidification of outdoor air is performed, and simultaneously heating is performed using the sensible heat treatment capacity that is obtained according to the switching time interval and the heated air is supplied to the room.

<Circulation Mode>

Next, the dehumidifying operation and the humidifying operation in a circulation mode will be described. In the circulation mode, when the air supply fan and the exhaust fan of the latent heat utilization units 2, 3 are operated, the room air RA is drawn through the indoor air inlets into the units, and is supplied as the supply air SA through the supply air outlets to the room, while outdoor air OA is drawn through the outside air inlets into the units, and is exhausted as the exhaust air EA through the exhaust air outlets to the outside.

Figure 8:
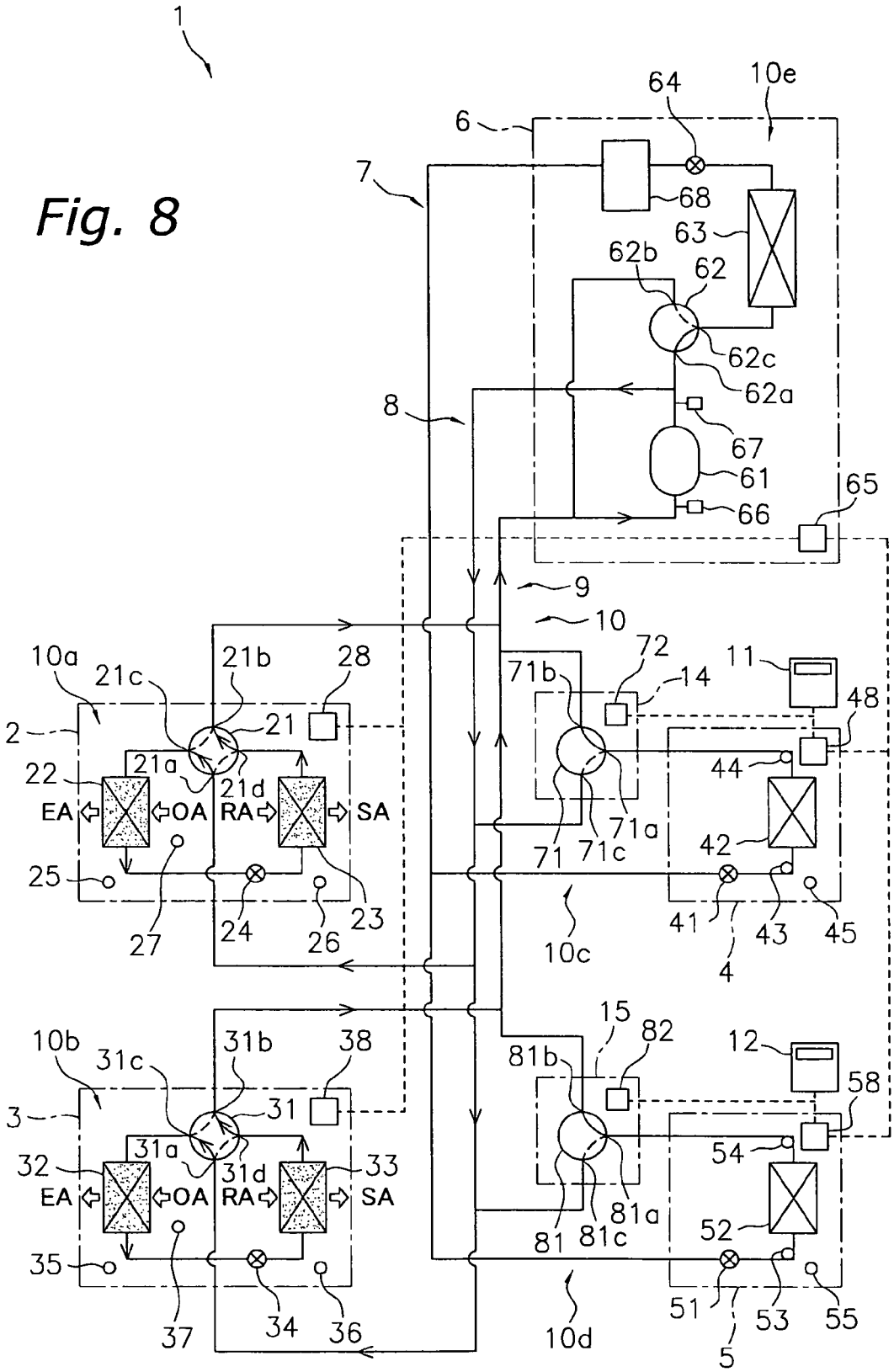
FIG. 8 is a schematic diagram of a refrigerant circuit showing the operation during the dehumidifying operation in a circulation mode when only the latent heat load treatment system is operated.
Figure 9:
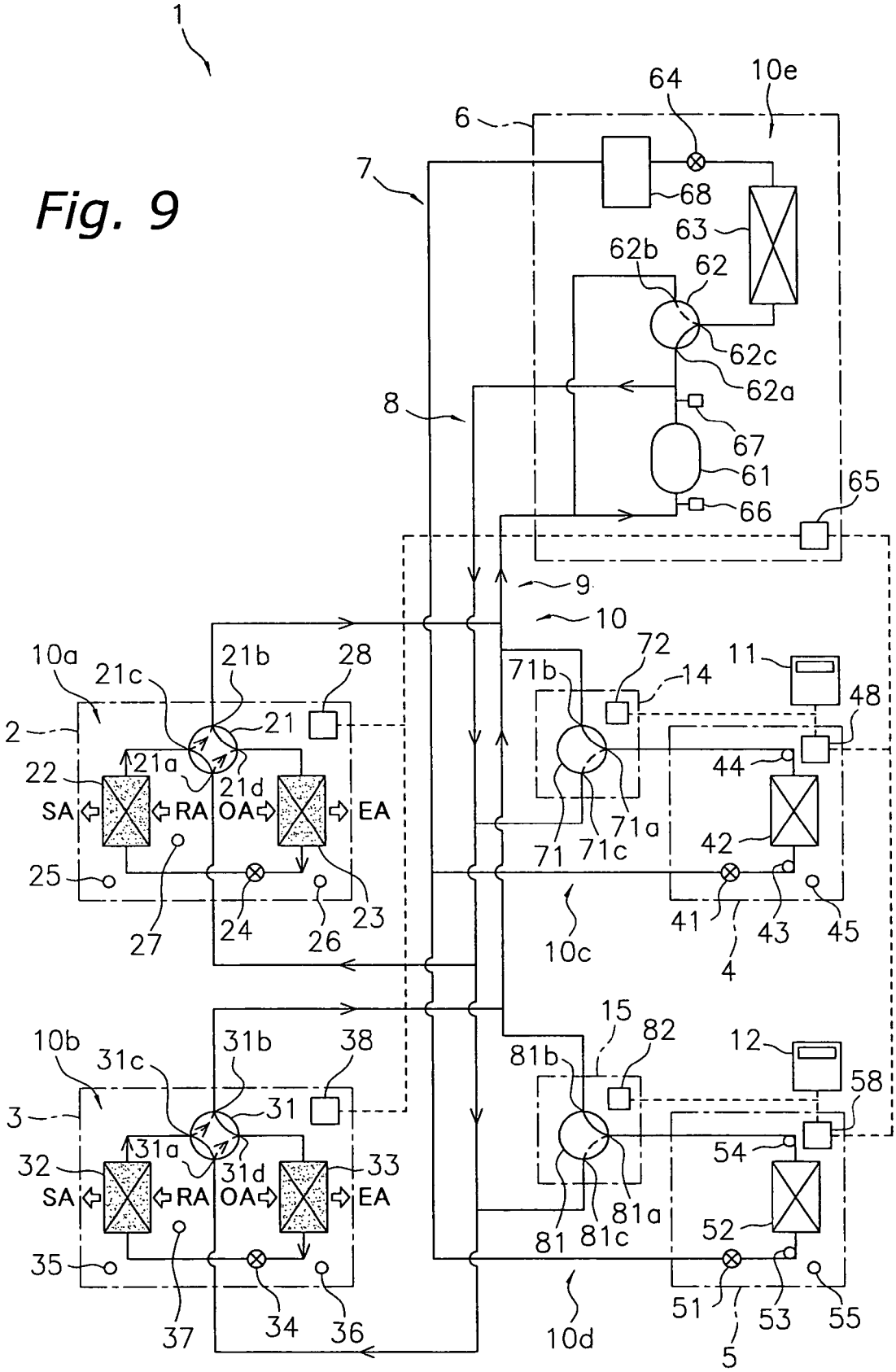
FIG. 9 is a schematic diagram of a refrigerant circuit showing the operation during the dehumidifying operation in the circulation mode when only the latent heat load treatment system is operated.

The operation during the dehumidifying operation in the circulation mode will be described with reference to FIGS. 8 and 9. Here, FIGS. 8 and 9 are schematic diagrams of a refrigerant circuit showing the operation during the dehumidifying operation in the circulation mode when only the latent heat load treatment system of the air conditioning system 1 is operated. Note that the system control that is performed in the air conditioning system 1 is the same as the system control for the above-described dehumidifying operation in the full ventilation mode, so that a description thereof will be omitted.

During the dehumidifying operation, as shown in FIGS. 8 and 9, for example, the latent heat utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the latent heat utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator. Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the outdoor air OA that is drawn from the outside air inlet. The moisture desorbed from the first adsorbent heat exchangers 22, 32 is carried with the outdoor air OA and is exhausted as the exhaust air EA through the exhaust air outlet to the outside. In the second adsorbent heat exchangers 23, 33, moisture in the room air RA is adsorbed onto the adsorbent, the room air RA is dehumidified, the absorption heat thereby generated is transferred to the refrigerant, and the refrigerant evaporates. Then the room air RA dehumidified in the second adsorbent heat exchangers 23, 33 passes through the supply air outlet and is supplied as the supply air SA to the room (see the arrows shown on the both sides of the adsorbent heat exchangers 22, 23, 32, 33 in FIG. 8).

During the second operation, in the second adsorbent heat exchangers 23, 33, moisture is desorbed from the adsorbent heated by condensation of the refrigerant, and this desorbed moisture is added to the outdoor air OA that is drawn from the outside air inlet. The moisture desorbed from the second adsorbent heat exchangers 23, 33 is carried with the outdoor air OA and is exhausted as the exhaust air EA through the exhaust air outlet to the outside. In the first adsorbent heat exchangers 22, 32, moisture in the room air RA is adsorbed onto the adsorbent, the room air RA is dehumidified, the absorption heat thereby generated is transferred to the refrigerant, and the refrigerant evaporates. Then the room air RA dehumidified in the first adsorbent heat exchangers 22, 32 passes through the supply air outlet and is supplied as the supply air SA to the room (see the arrows shown on the both sides of the adsorbent heat exchangers 22, 23, 32, 33 in FIG. 9).

Here, the first adsorbent heat exchangers 22, 32 and second adsorbent heat exchangers 23, 33 treat not only the latent heat but also the sensible heat.

In this way, in the dehumidifying operation in the circulation mode performed only by the latent heat load treatment system, this air conditioning system 1 can perform the dehumidifying operation in which dehumidification of the room air, and simultaneously cooling is performed using the sensible heat treatment capacity that is obtained according to the switching time interval and the cooled air is supplied to the room.

Figure 10:
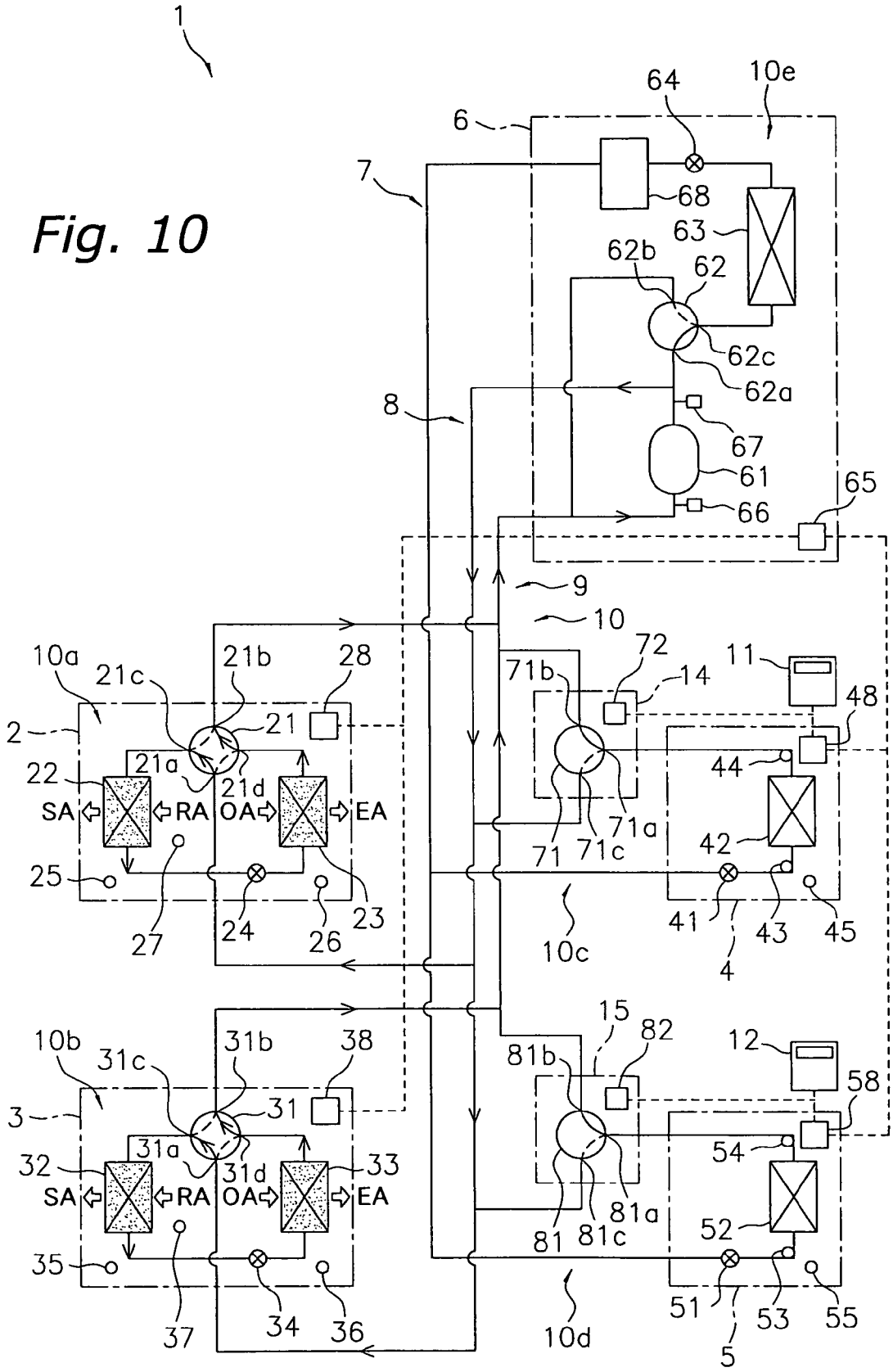
FIG. 10 is a schematic diagram of a refrigerant circuit showing the operation during the humidifying operation in the circulation mode when only the latent heat load treatment is operated.
Figure 11:
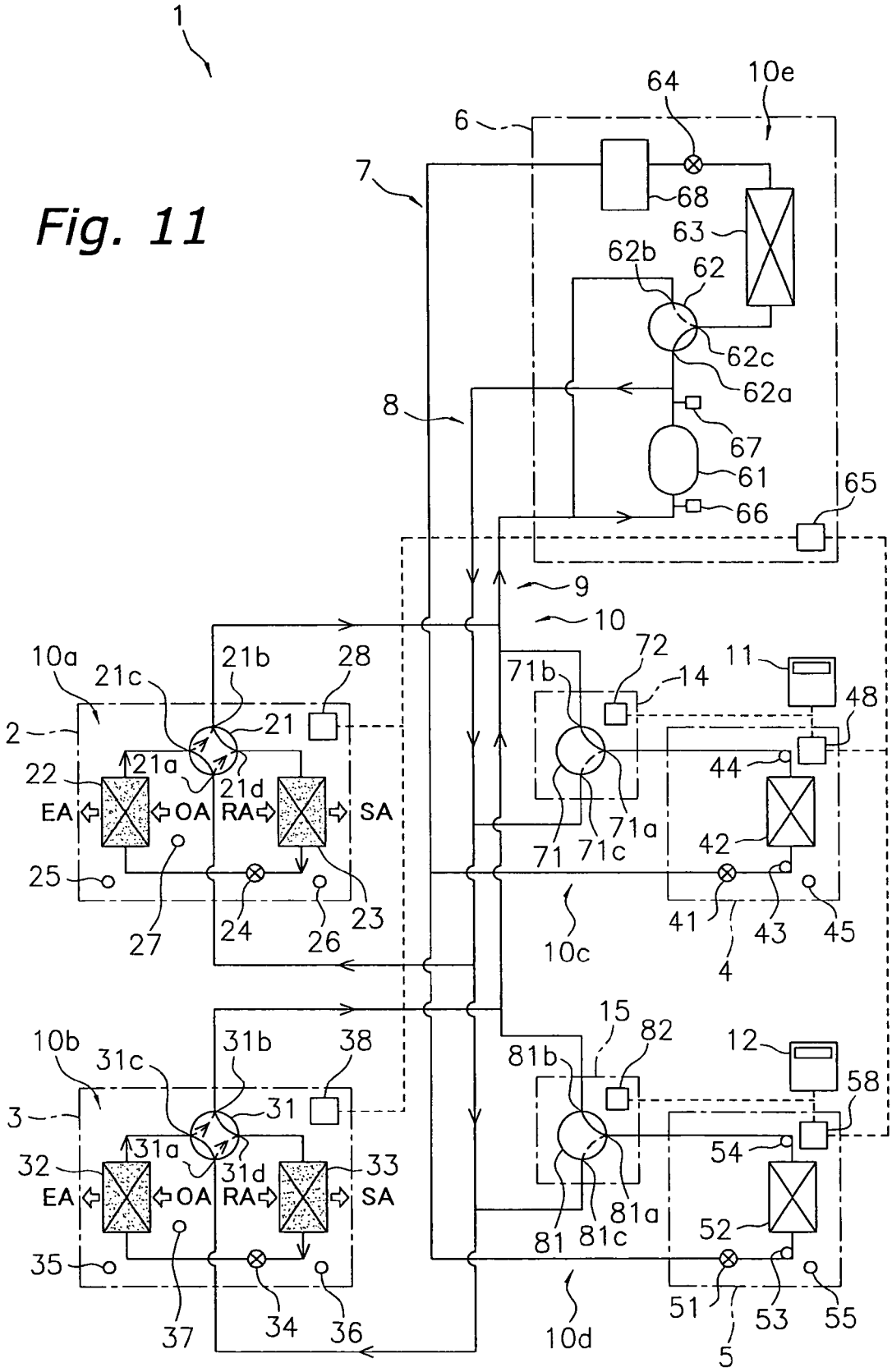
FIG. 11 is a schematic diagram of a refrigerant circuit showing the operation during the humidifying operation in the circulation mode when only the latent heat load treatment system is operated.

The operation during humidifying operation in the circulation mode will be described with reference to FIGS. 10 and 11. Here, FIGS. 10 and 11 are schematic diagrams of a refrigerant circuit showing the operation during a dehumidifying operation in the circulation mode when only the latent heat load treatment system of the air conditioning system 1 is operated. Note that the system control being performed in the air conditioning system 1 is the same as the system control for the above-described dehumidifying operation in the full ventilation mode, so that a description thereof will be omitted.

During the humidifying operation, as shown in FIGS. 10 and 11, for example, the latent heat utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the latent heat utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator. Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the room air RA that is drawn from the indoor air inlet. The moisture desorbed from the first adsorbent heat exchangers 22, 32 is carried with the room air RA and is supplied as the supply air SA through the supply air outlet to the room. In the second adsorbent heat exchangers 23, 33, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the second adsorbent heat exchangers 23, 33 passes through the exhaust air outlet and exhausted as the exhaust air EA to the outside (see the arrows shown on the both sides of the adsorbent heat exchangers 22, 23, 32, 33 in FIG. 10).

During the second operation, in the second adsorbent heat exchangers 23, 33, moisture is desorbed from the adsorbent heated by condensation of the refrigerant, and this desorbed moisture is added to the room air RA that is drawn from the indoor air inlet. The moisture desorbed from the second adsorbent heat exchangers 23, 33 is carried with the room air RA and is supplied as the supply air SA through the supply air outlet to the room. In the first adsorbent heat exchangers 22, 32, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the first adsorbent heat exchangers 22, 32 passes through the exhaust air outlet and is exhausted as the exhaust air EA to the outside (see the arrows shown on the both sides of the adsorbent heat exchangers 22, 23, 32, 33 in FIG. 11).

Here, the first adsorbent heat exchangers 22, 32 and second adsorbent heat exchangers 23, 33 treat not only the latent heat but also the sensible heat, as in the case of the dehumidifying operation in the full ventilation mode.

In this way, in the humidifying operation in the circulation mode performed only by the latent heat load treatment system, this air conditioning system 1 can perform the humidifying and heating operation in which humidification of the room air is performed, and simultaneously heating is performed using the sensible heat treatment capacity that is obtained according to the switching time interval and the heated air is supplied to the room.

<Air Supply Mode>

Next, the dehumidifying operation and the humidifying operation in an air supply mode will be described. In the air supply mode, when the air supply fan and the exhaust fan of the latent heat utilization units 2, 3 are operated, outdoor air OA is drawn through the outside air inlets into the units, and is supplied as the supply air SA through the supply air outlets to the room, while outdoor air OA is drawn through the outside air inlets into the units, and is exhausted as the exhaust air EA through the exhaust air outlets to the outside.

Figure 12:
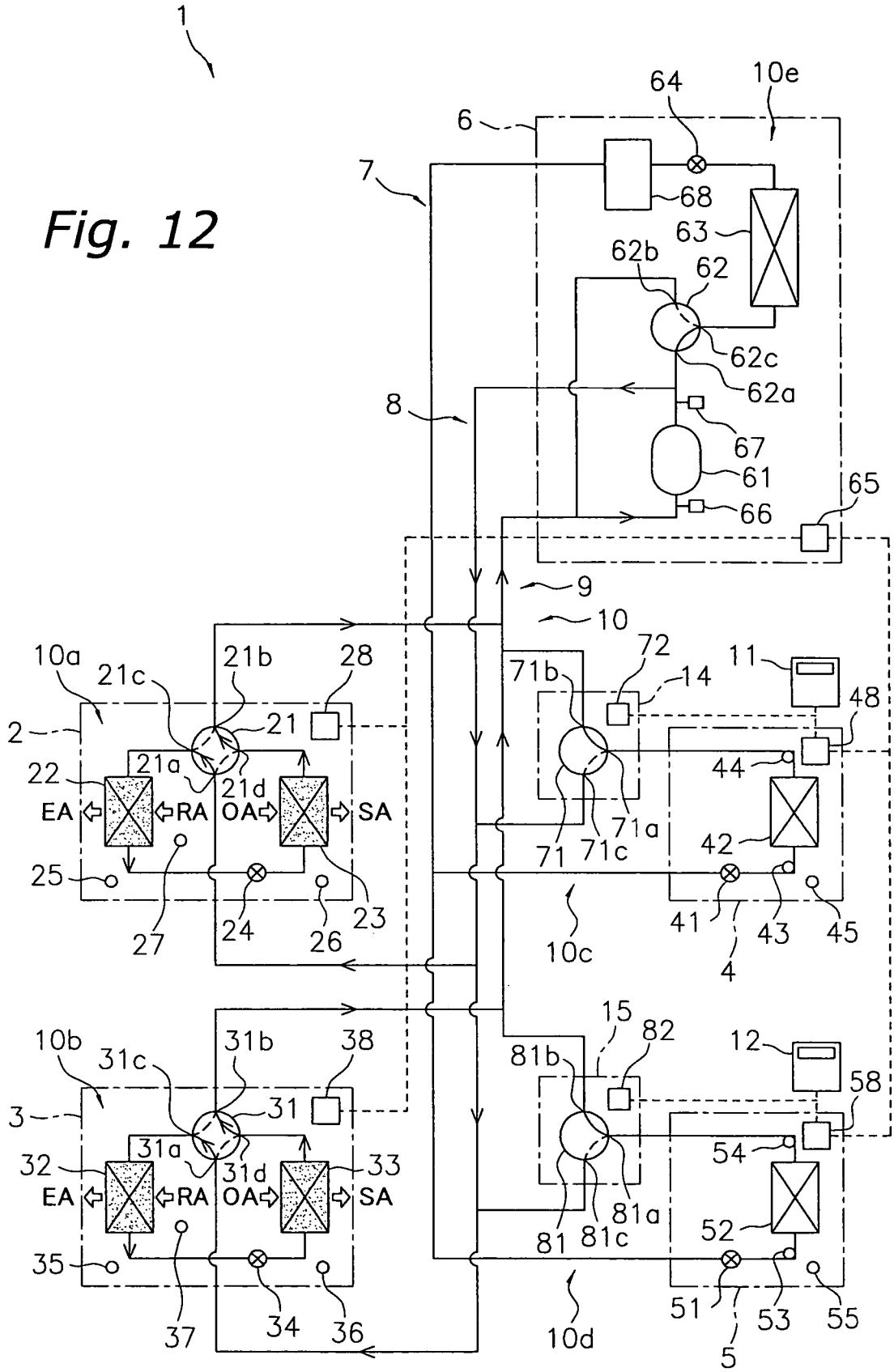
FIG. 12 is a schematic diagram of a refrigerant circuit showing the operation during the dehumidifying operation in a supply mode when only the latent heat load treatment system is operated.
Figure 13:
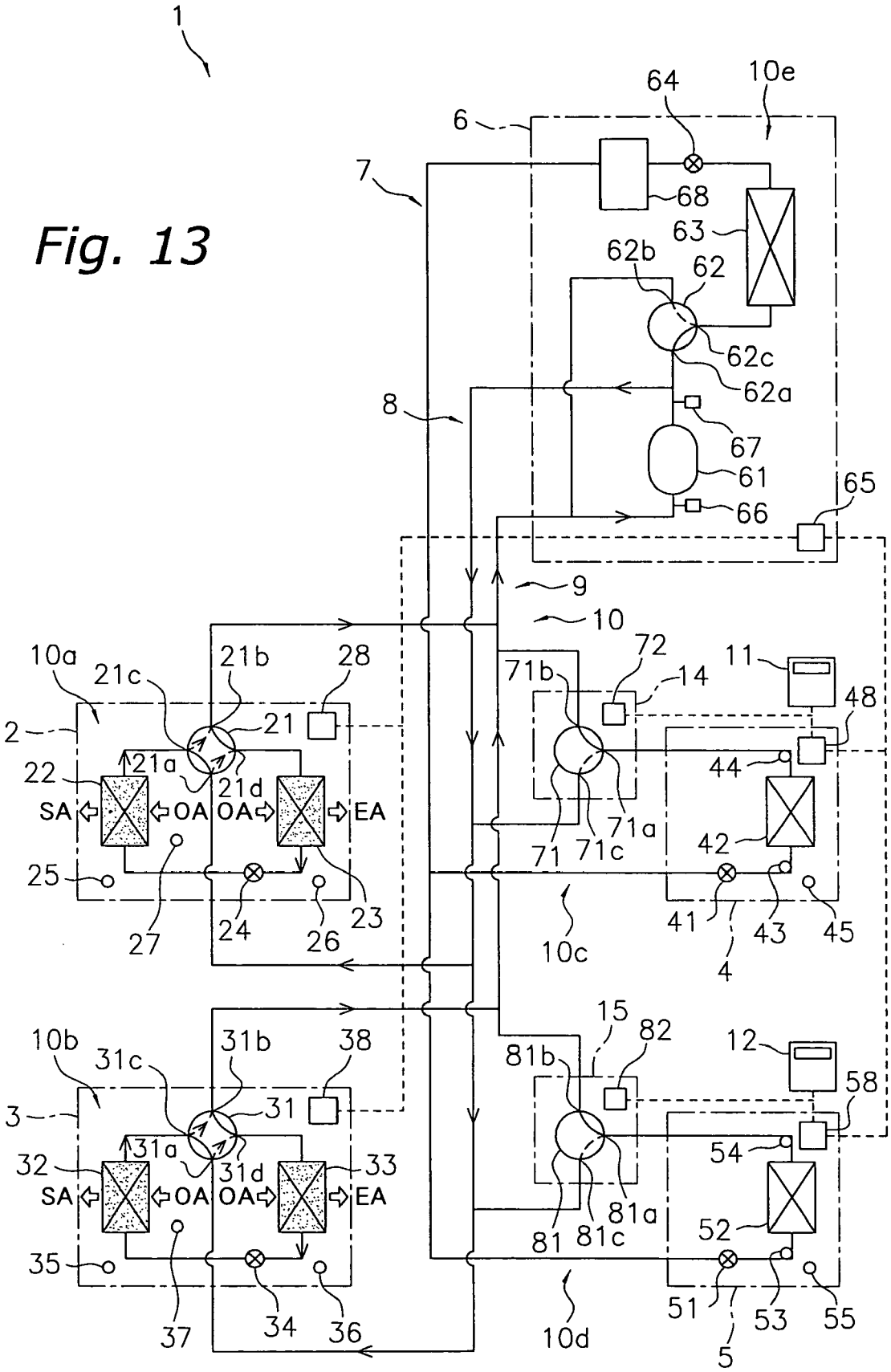
FIG. 13 is a schematic diagram of a refrigerant circuit showing the operation during the dehumidifying operation in the supply mode when only the latent heat load treatment system is operated.

The operation of the air conditioning system during the dehumidifying operation in the air supply mode will be described with reference to FIGS. 12 and 13. Here, FIGS. 12 and 13 are schematic diagrams of a refrigerant circuit showing the operation during a dehumidifying operation in the supply mode when only the latent heat load treatment system of the air conditioning system 1 is operated. Note that the system control that is performed in the air conditioning system 1 is the same as the system control for the above-described dehumidifying operation in the full ventilation mode, so that a description thereof will be omitted.

During the dehumidifying operation, as shown in FIGS. 12 and 13, for example, the latent heat utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the latent heat utilization unit 3 alternately repeats the first operation in which the first adsorbent heat exchanger 32 functions as a condenser and the second adsorbent heat exchanger 33 functions as an evaporator, and the second operation in which the second adsorbent heat exchanger 33 functions as a condenser and the first adsorbent heat exchanger 32 functions as an evaporator. Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the outdoor air OA that is drawn from the outside air inlet. The moisture desorbed from the first adsorbent heat exchangers 22, 32 is carried with the outdoor air OA and is exhausted as the exhaust air EA through the exhaust air outlet to the outside. In the second adsorbent heat exchangers 23, 33, the moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the second adsorbent heat exchangers 23, 33 passes through the supply air outlet and is supplied as the supply air SA to the room (see the arrows shown on the both sides of the adsorbent heat exchangers 22, 23, 32, 33 in FIG. 12).

During the second operation, in the second adsorbent heat exchangers 23, 33, moisture is desorbed from the adsorbent heated by condensation of the refrigerant, and this desorbed moisture is added to the outdoor air OA that is drawn from the outside air inlet. The moisture desorbed from the second adsorbent heat exchangers 23, 33 is carried with the outdoor air OA and is exhausted as the exhaust air EA through the exhaust air outlet to the outside. In the first adsorbent heat exchangers 22, 32, the moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the first adsorbent heat exchangers 22, 32 passes through the supply air outlet and is supplied as the supply air SA to the room (see the arrows shown on the both sides of the adsorbent heat exchangers 22, 23, 32, 33 in FIG. 13).

Here, the first adsorbent heat exchangers 22, 32 and second adsorbent heat exchangers 23, 33 treat not only the latent heat but also the sensible heat.

In this way, in the dehumidifying operation in the air supply mode performed only by the latent heat load treatment system, this air conditioning system 1 can perform the dehumidifying operation in which dehumidification of the room air is performed, and simultaneously cooling is performed using the sensible heat treatment capacity that is obtained according to the switching time interval and the cooled air is supplied to the room.

Figure 14:
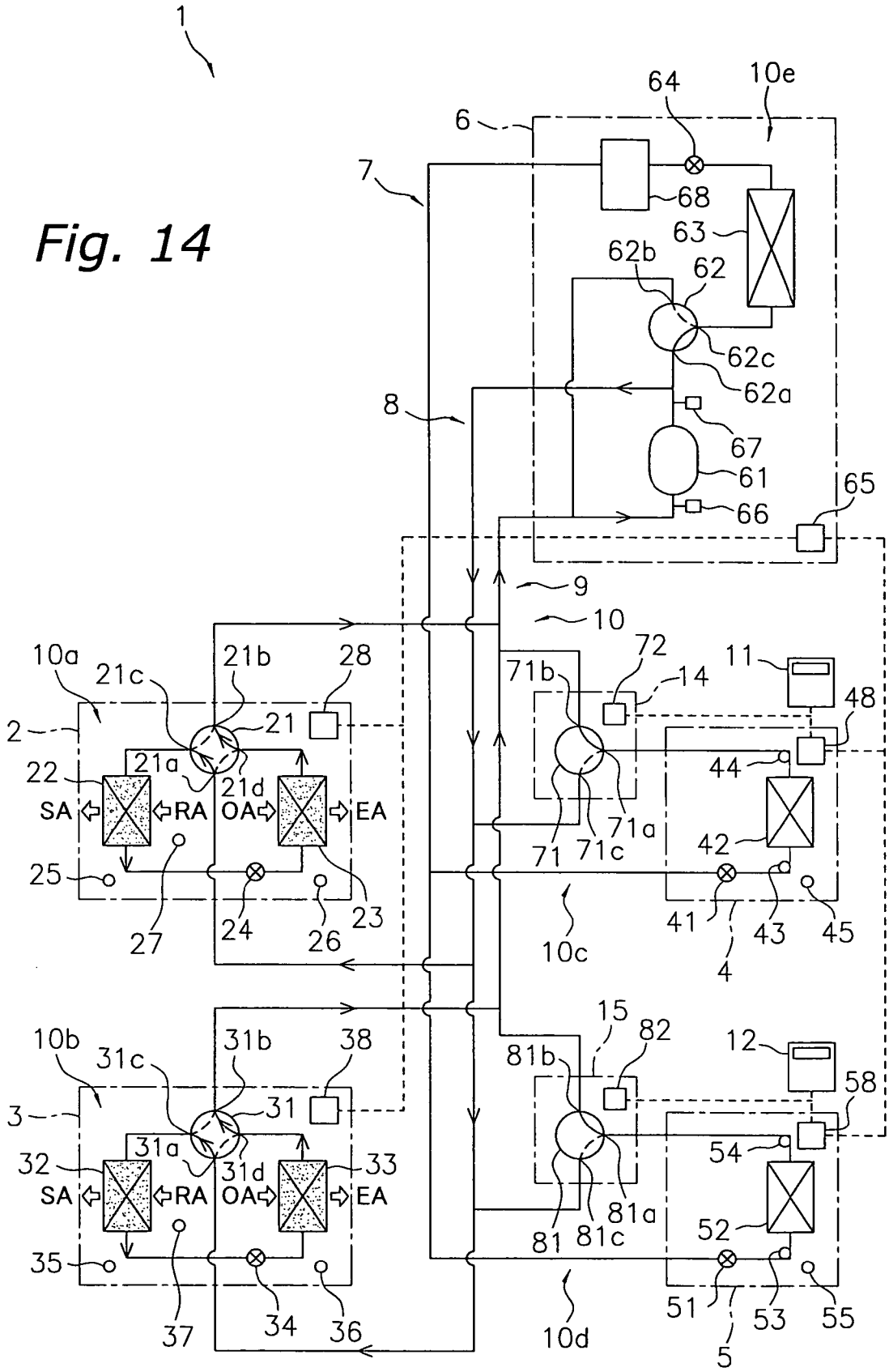
FIG. 14 is a schematic diagram of a refrigerant circuit showing the operation during the humidifying operation in the supply mode when only the latent heat load treatment system is operated.
Figure 15:
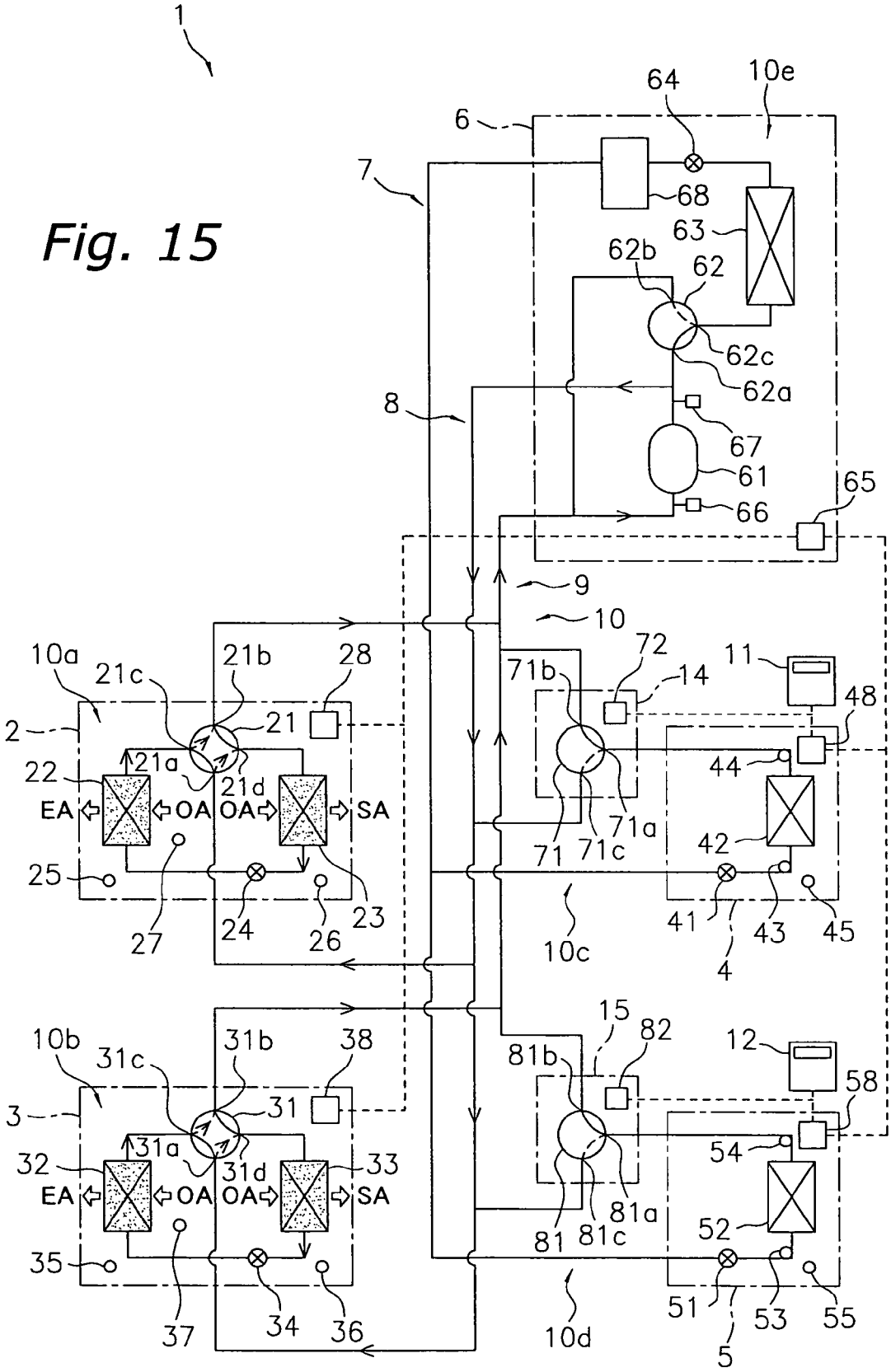
FIG. 15 is a schematic diagram of a refrigerant circuit showing the operation during the humidifying operation in the supply mode when only the latent heat load treatment system is operated.

The operation during the humidifying operation in the air supply mode will be described with reference to FIGS. 14 and 15. Here, FIGS. 14 and 15 are schematic diagrams of a refrigerant circuit showing the operation during the humidifying operation in the supply mode when only the latent heat load treatment system of the air conditioning system 1 is operated. Note that the system control that is performed in the air conditioning system 1 is the same as the system control for the above-described dehumidifying operation in the full ventilation mode, so that a description thereof will be omitted.

During the humidifying operation, as shown in FIGS. 14 and 15, for example, the latent heat utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the latent heat utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator. Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the outdoor air OA that is drawn from the outside air inlet. The moisture desorbed from the first adsorbent heat exchangers 22, 32 is carried with outdoor air OA and is supplied as the supply air SA through the supply air outlet to the room. In the second adsorbent heat exchangers 23, 33, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the second adsorbent heat exchangers 23, 33 passes through the exhaust air outlet and is exhausted as the exhaust air EA to the outside (see the arrows shown on the both sides of the adsorbent heat exchangers 22, 23, 32, 33 in FIG. 14).

During the second operation, in the second adsorbent heat exchangers 23, 33, moisture is desorbed from the adsorbent heated by condensation of the refrigerant, and this desorbed moisture is added to the outdoor air OA that was drawn from the outside air inlet. The moisture desorbed from the second adsorbent heat exchangers 23, 33 is carried with outdoor air OA and is supplied as the supply air SA through the supply air outlet to the room. In the first adsorbent heat exchangers 22, 32, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the first adsorbent heat exchangers 22, 32 passes through the exhaust air outlet and is exhausted as the exhaust air EA to the outside (see the arrows shown on the both sides of the adsorbent heat exchangers 22, 23, 32, 33 in FIG. 15).

Here, the first adsorbent heat exchangers 22, 32 and second adsorbent heat exchangers 23, 33 treat not only the latent heat but also the sensible heat.

In this way, in the humidifying operation in the air supply mode performed only by the latent heat load treatment system, this air conditioning system 1 can perform the humidifying operation in which humidification of outdoor air is performed, and simultaneously heating is performed using the sensible heat treatment capacity that is obtained according to the switching time interval and the heated air is supplied to the room.

<Exhaust Mode>

Next, the dehumidifying operation and the humidifying operation in an exhaust mode will be described. In the exhaust mode, when the air supply fan and the exhaust fan of the latent heat utilization units 2, 3 are operated, the room air RA is drawn through the indoor air inlets into the units, and is supplied as the supply air SA through the supply air outlets to the room, while the room air RA is drawn through the indoor air inlets into the units, and is exhausted as the exhaust air EA through the exhaust air outlets to the outside.

Figure 16:
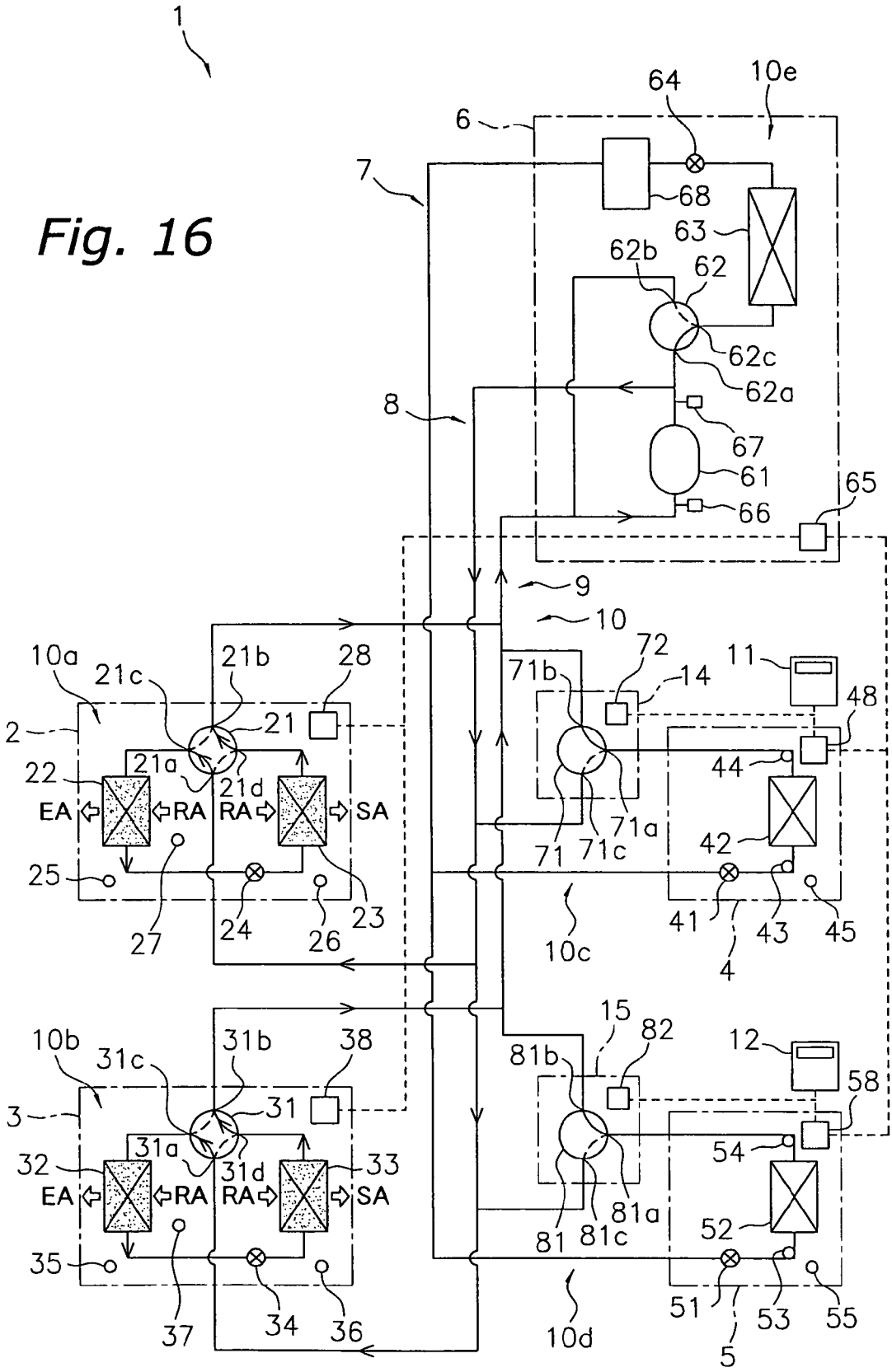
FIG. 16 is a schematic diagram of a refrigerant circuit showing the operation during the dehumidifying operation in an exhaust mode when only the latent heat load treatment system is operated.
Figure 17:
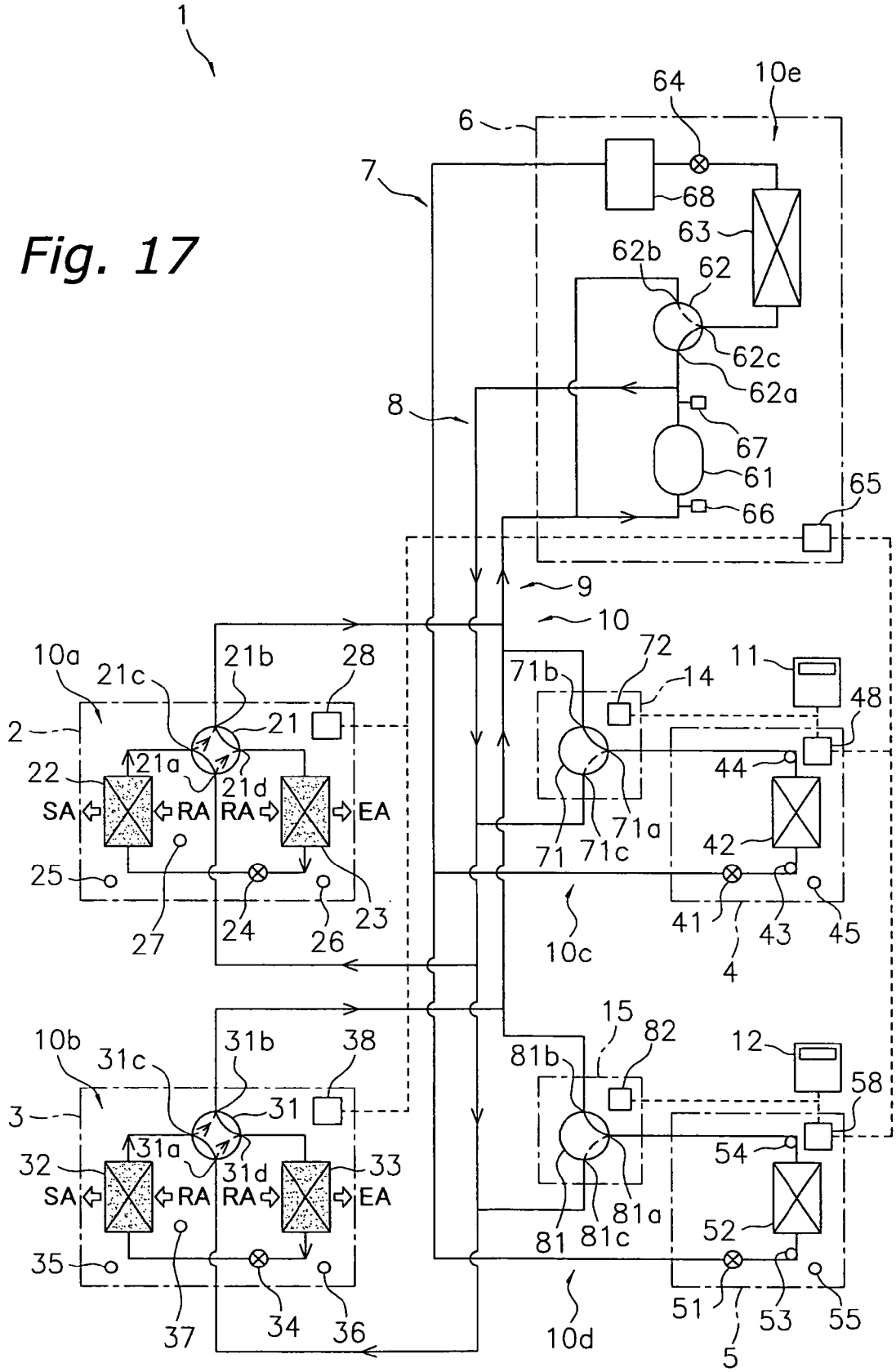
FIG. 17 is a schematic diagram of a refrigerant circuit showing the operation during the dehumidifying operation in the exhaust mode when only the latent heat load treatment system is operated.

The operation during the dehumidifying operation in the exhaust mode will be described with reference to FIGS. 16 and 17. Here, FIGS. 16 and 17 are schematic diagrams of a refrigerant circuit showing the operation during the dehumidifying operation in the exhaust mode when only the latent heat load treatment system is of the air conditioning system 1 operated. Note that the system control that is performed in the air conditioning system 1 is the same as the system control for the above-described dehumidifying operation in the full ventilation mode, so that a description thereof will be omitted.

During the dehumidifying operation, as shown in FIGS. 16 and 17, for example, the latent heat utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the latent heat utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator. Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the room air RA that is drawn from the indoor air inlet. The moisture desorbed from the first adsorbent heat exchangers 22, 32 is carried with the room air RA and is exhausted as the exhaust air EA through the exhaust air outlet to the outside. In the second adsorbent heat exchangers 23, 33, moisture in the room air RA is adsorbed onto the adsorbent, the room air RA is dehumidified, the absorption heat thereby generated is transferred to the refrigerant, and the refrigerant evaporates. Then the room air RA dehumidified in the second adsorbent heat exchangers 23, 33 passes through the supply air outlets and is supplied as the supply air SA to the room (see the arrows shown on the both sides of the adsorbent heat exchangers 22, 23, 32, 33 in FIG. 16).

During the second operation, in the second adsorbent heat exchangers 23, 33, moisture is desorbed from the adsorbent heated by condensation of the refrigerant, and this desorbed moisture is added to the room air RA that is drawn from the indoor air inlet. The moisture desorbed from the second adsorbent heat exchangers 23, 33 is carried with the room air RA and is exhausted as the exhaust air EA through the exhaust air outlet to the outside. In the first adsorbent heat exchangers 22, 32, moisture in the room air RA is adsorbed onto the adsorbent, the room air RA is dehumidified, the absorption heat thereby generated is transferred to the refrigerant, and the refrigerant evaporates. Then the room air RA dehumidified in the first adsorbent heat exchangers 22, 32 passes through the supply air outlet and is supplied as the supply air SA to the room (see the arrows shown on the both sides of the adsorbent heat exchangers 22, 23, 32, 33 in FIG. 17).

Here, the first adsorbent heat exchangers 22, 32 and second adsorbent heat exchangers 23, 33 treat not only the latent heat but also the sensible heat.

In this way, in the dehumidifying operation in the exhaust mode performed only by the latent heat load treatment system, this air conditioning system 1 can perform the dehumidifying operation in which dehumidification of the room air is performed, and simultaneously cooling is performed using the sensible heat treatment capacity that is obtained according to the switching time interval and the cooled air is supplied to the room.

Figure 18:
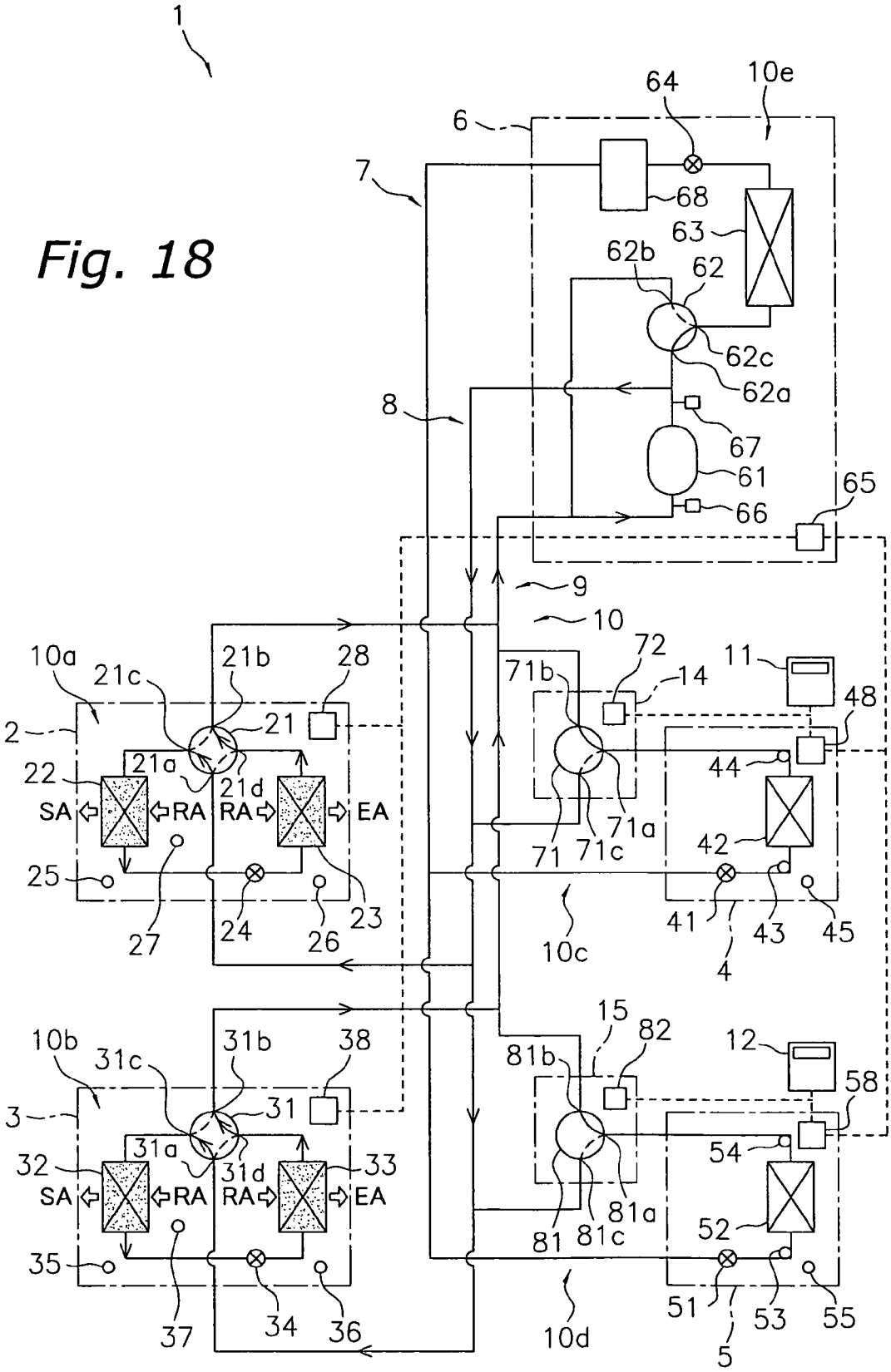
FIG. 18 is a schematic diagram of a refrigerant circuit showing the operation during the humidifying operation in the exhaust mode when only the latent heat load treatment system is operated.
Figure 19:
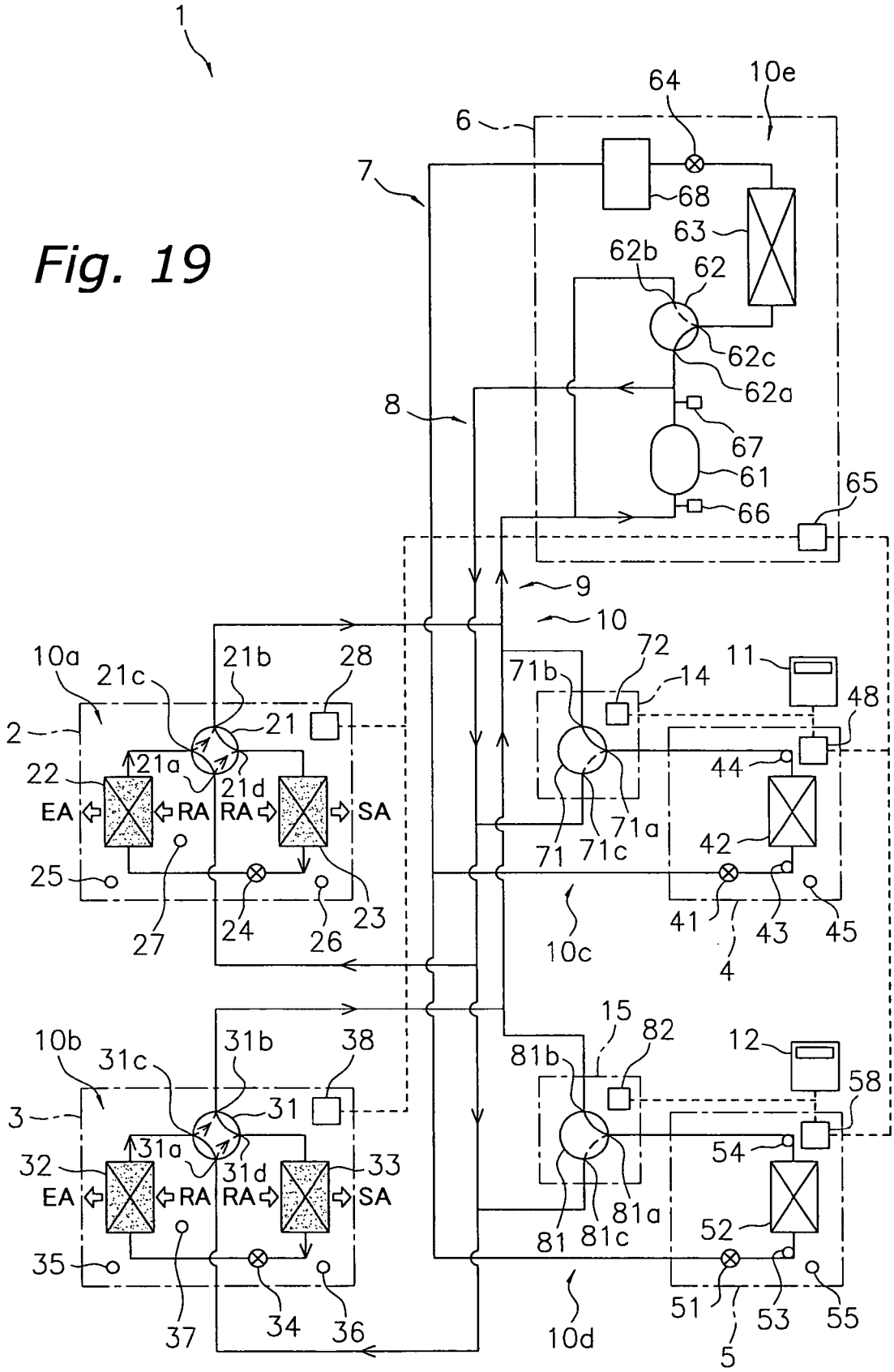
FIG. 19 is a schematic diagram of a refrigerant circuit showing the operation during the humidifying operation in the exhaust mode when only the latent heat load treatment system is operated.

The operation during the humidifying operation in the exhaust mode will be described with reference to FIGS. 18 and 19. Here, FIGS. 18 and 19 are schematic diagrams of a refrigerant circuit showing the operation during the humidifying operation in the exhaust mode when only the latent heat load treatment system of the air conditioning system 1 is operated. Note that the system control that is performed in the air conditioning system 1 is the same as the system control for the above-described dehumidifying operation in the full ventilation mode, so that a description thereof will be omitted.

During the humidifying operation, as shown in FIGS. 18 and 19, for example, the latent heat utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the latent heat utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator. Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the room air RA that is drawn from the indoor air inlet. The moisture desorbed from the first adsorbent heat exchangers 22, 32 is carried with the room air RA and is supplied as the supply air SA through the supply air outlet to the room. In the second adsorbent heat exchangers 23, 33, moisture in the room air RA is adsorbed onto the adsorbent, the room air RA is dehumidified, the absorption heat thereby generated is transferred to the refrigerant, and the refrigerant evaporates. Then the room air RA dehumidified in the second adsorbent heat exchangers 23, 33 passes through the exhaust air outlet and is exhausted as the exhaust air EA to the outside (see the arrows shown on the both sides of the adsorbent heat exchangers 22, 23, 32, 33 in FIG. 18).

During the second operation, in the second adsorbent heat exchangers 23, 33, moisture is desorbed from the adsorbent heated by condensation of the refrigerant, and this desorbed moisture is added to the room air RA that is drawn from the indoor air inlet. The moisture desorbed from the second adsorbent heat exchangers 23, 33 is carried with the room air RA and is supplied as the supply air SA through the supply air outlet to the room. In the first adsorbent heat exchangers 22, 32, moisture in the room air RA is adsorbed onto the adsorbent, the room air RA is dehumidified, the absorption heat thereby generated is transferred to the refrigerant, and the refrigerant evaporates. Then the room air RA dehumidified in the first adsorbent heat exchangers 22, 32 passes through the exhaust air outlet and is exhausted as the exhaust air EA to the outside (see the arrows shown on the both sides of the adsorbent heat exchangers 22, 23, 32, 33 in FIG. 19).

Here, the first adsorbent heat exchangers 22, 32 and second adsorbent heat exchangers 23, 33 treat not only the latent heat but also the sensible heat.

In this way, in the humidifying operation in the exhaust mode performed only by the latent heat load treatment system, this air conditioning system 1 can perform the humidifying and operation in which humidification of the room air is performed, and simultaneously heating is performed using the sensible heat treatment capacity that is obtained according to the switching time interval and the heated air is supplied to the room.

Next, the operation of the air conditioning system 1 when the whole air conditioning system 1 including the sensible heat utilization units 4, 5 is operated will be described. The air conditioning system 1 can treat the latent heat load in the room mainly in the latent heat load treatment system (in other words, the latent heat utilization units 2, 3), and treat the sensible heat load in the room mainly in the sensible heat load treatment system (in other words, the sensible heat utilization units 4, 5). Each type of operation will be described below.

<Dehumidifying and Cooling Operation>

Figure 20:
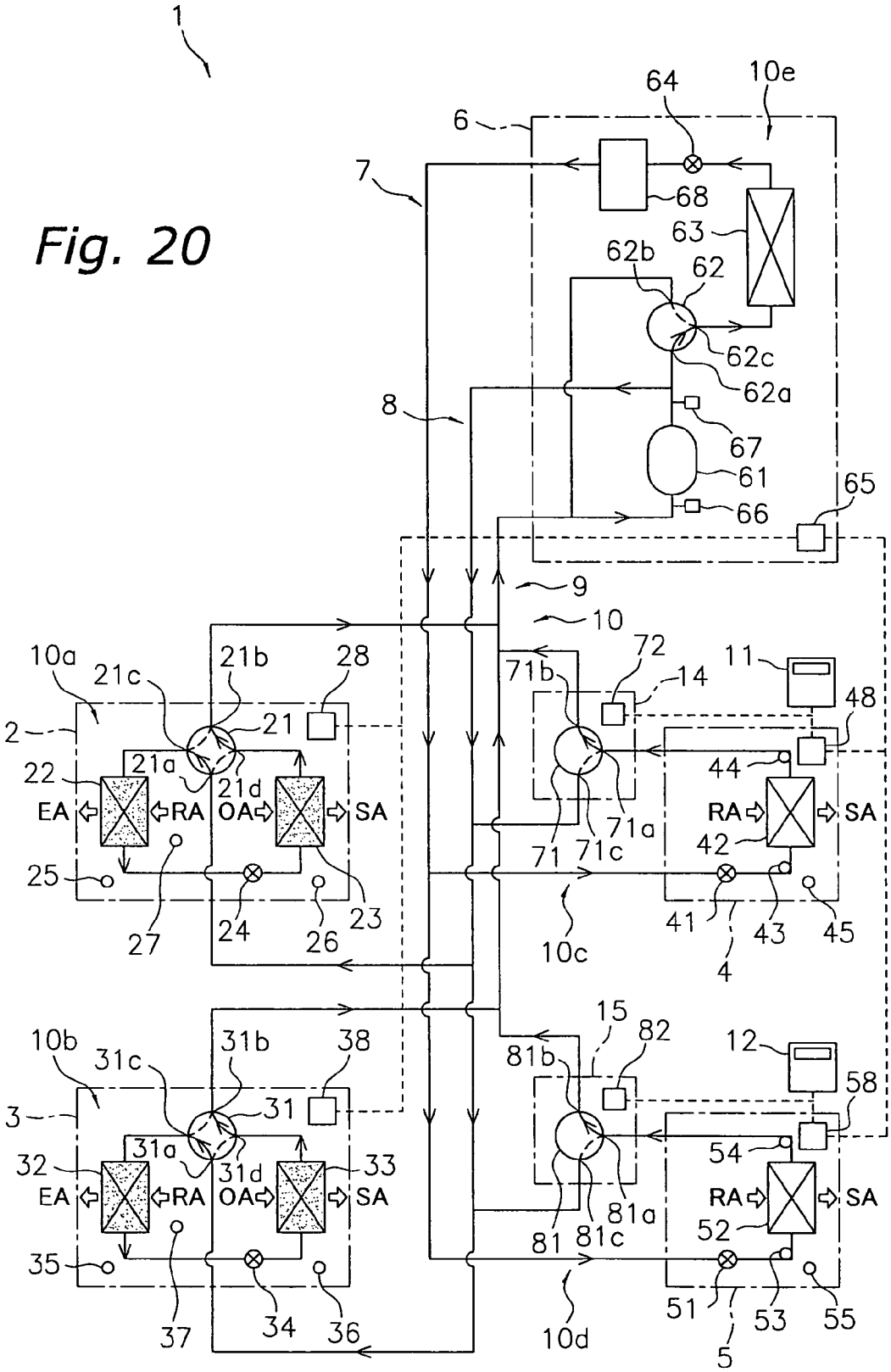
FIG. 20 is a schematic diagram of a refrigerant circuit showing the operation during the dehumidifying and cooling operation in the full ventilation mode in the air conditioning system of the first embodiment.
Figure 21:
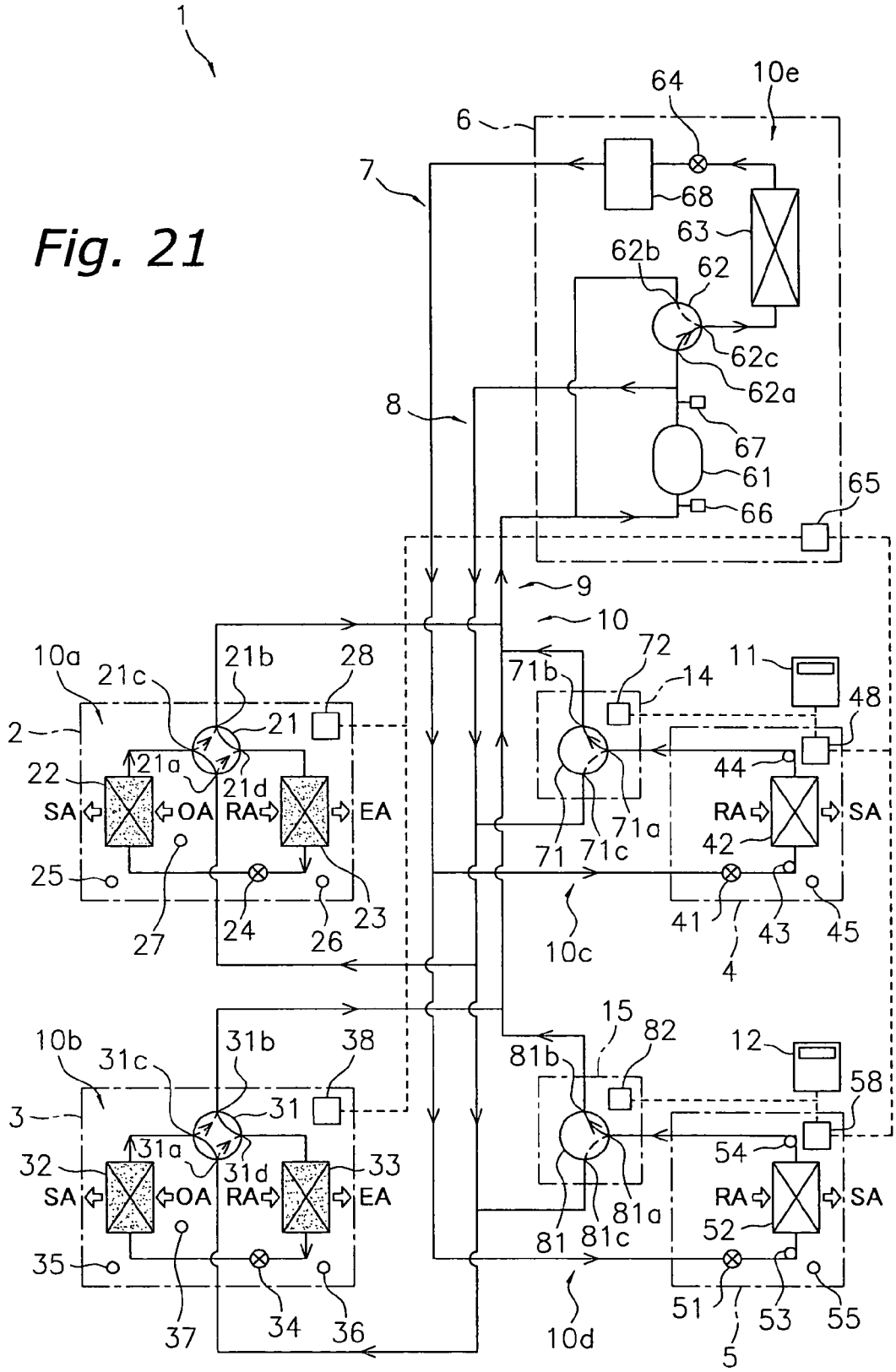
FIG. 21 is a schematic diagram of a refrigerant circuit showing the operation during the dehumidifying and cooling operation in the full ventilation mode in the air conditioning system of the first embodiment.
Figure 22:
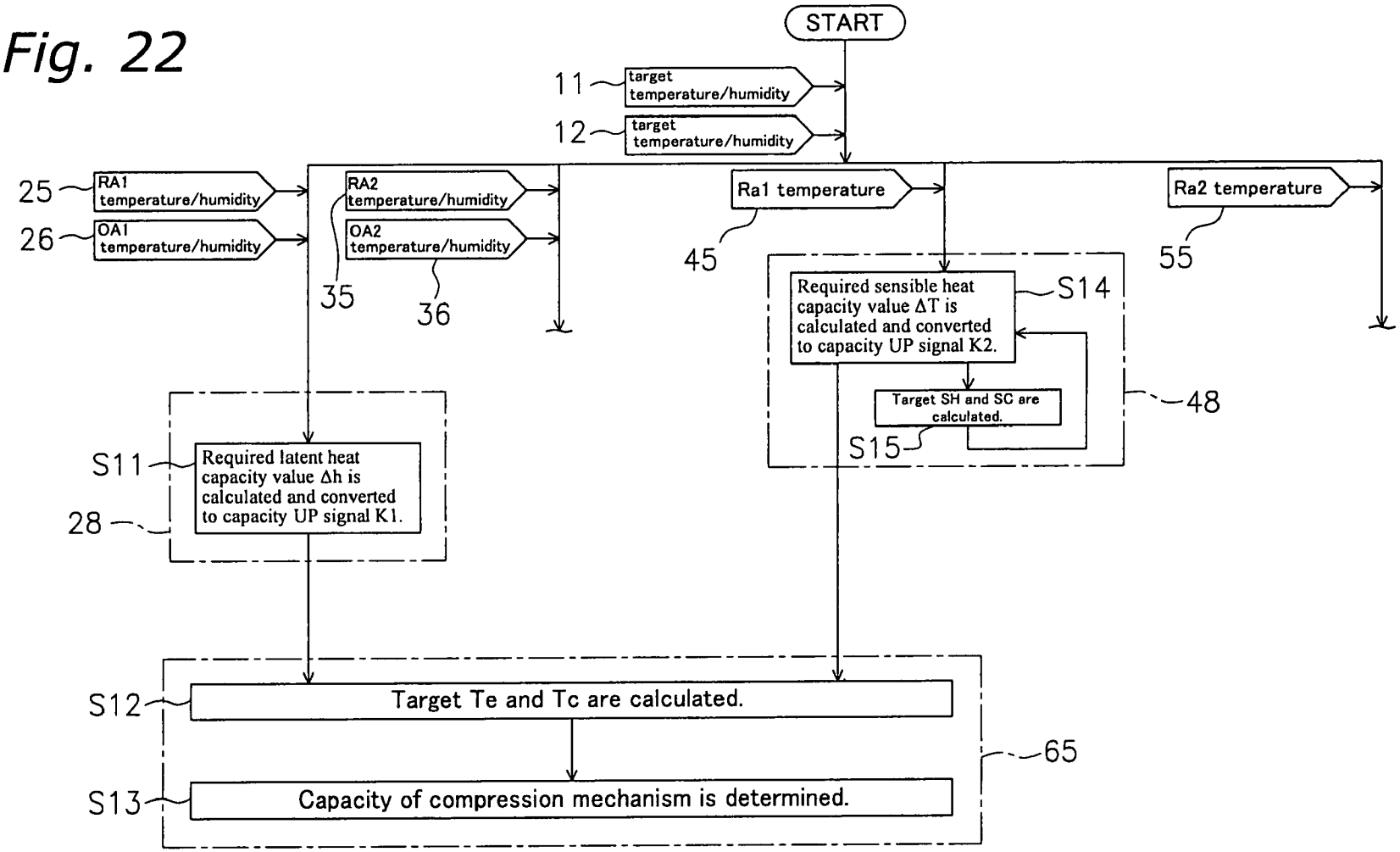
FIG. 22 is a diagram of control flow during the normal operation in the air conditioning system of the first embodiment.
Figure 23:
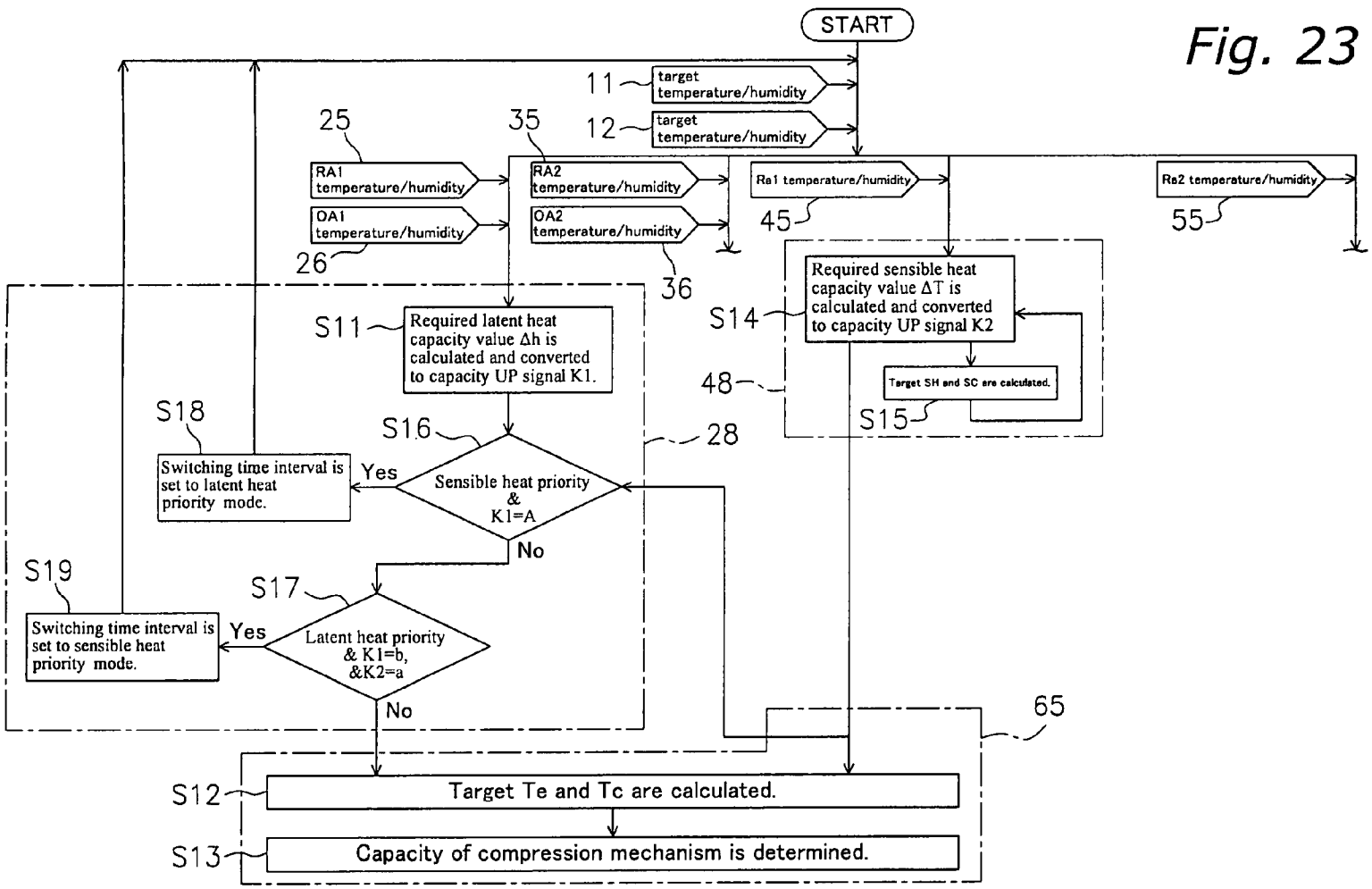
FIG. 23 is a diagram of control flow during normal operation in the air conditioning system of the first embodiment.

First, the operation of a cooling and dehumidifying operation in which the cooling operation is performed in the sensible heat load treatment system of the air conditioning system 1 while the dehumidifying operation is performed in the full ventilation mode in the latent heat load treatment system of the air conditioning system 1 will be described with reference to FIGS. 20, 21, 22, and 23. Here, FIGS. 20 and 21 are schematic diagrams of a refrigerant circuit showing the operation during the dehumidifying and cooling operation in the full ventilation mode in the air conditioning system 1. FIG. 22 is a control flow diagram during the normal operation in the air conditioning system 1. FIG. 23 is a diagram of control flow during the normal operation in the air conditioning system 1 (when the switching time interval in each of the adsorbent heat exchangers 22, 23, 32, 33 is changed). Note that as for FIGS. 22 and 23, since the latent heat utilization unit 2 and the sensible heat utilization unit 4 as a pair have the same control flow as the latent heat utilization unit 3 and the sensible heat utilization unit 5 as a pair, so that the illustration of the control flow of the latent heat utilization unit 3 and the sensible heat utilization unit 5 as a pair is omitted.

First, the operation of the latent heat load treatment system of the air conditioning system 1 will be described.

As in the case of the above-described single operation of the latent heat load treatment system, the latent heat utilization unit 2 of the latent heat load treatment system alternately repeats the first operation in which the first adsorbent heat exchanger 22 functions as a condenser and the second adsorbent heat exchanger 23 functions as an evaporator, and the second operation in which the second adsorbent heat exchanger 23 functions as a condenser and the first adsorbent heat exchanger 22 functions as an evaporator. Likewise, the latent heat utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator.

The operation of the two latent heat utilization units 2 and 3 will be described together below.

In the first operation, the regeneration process in the first adsorbent heat exchangers 22, 32 and the adsorption process in the second adsorbent heat exchangers 23, 33 are performed in parallel. During the first operation, as shown in FIG. 20, the latent heat utilization side four-way directional control valves 21, 31 are set to a first state (see the solid lines in the latent heat utilization side four-way directional control valves 21, 31 in FIG. 20). In this state, high-pressure gas refrigerant discharged from the compression mechanism 61 flows into the first adsorbent heat exchangers 22, 32 through the discharge gas connection pipe 8 and the latent heat utilization side four-way directional control valves 21, 31, and is condensed while passing through the first adsorbent heat exchangers 22, 32. The condensed refrigerant is pressure-reduced by the latent heat utilization side expansion valves 24, 34, and is subsequently evaporated while passing through the second adsorbent heat exchangers 23, 33. Then, the refrigerant is again drawn into the compression mechanism 61 through the latent heat utilization side four-way directional control valves 21, 31 and the inlet gas connection pipe 9 (see the arrows shown on the refrigerant circuit 10 in FIG. 20). Here, unlike the above-described case where the only latent heat load treatment system is operated, the sensible heat utilization side expansion valves 41, 51 of the sensible heat utilization units 4, 5, respectively, are opened allowing the refrigerant to flow into the air heat exchangers 42, 52 in order to perform the cooling operation, and the degree of opening of these valves is adjusted. Accordingly, a portion of high-pressure gas refrigerant compressed in and discharged from the compression mechanism 61 will be flowing in the latent heat utilization units 2, 3.

During the first operation, in the first adsorbent heat exchangers 22, 32, moisture is desorbed from the adsorbent heated by condensation of the refrigerant, and this desorbed moisture is added to the room air RA that is drawn from the indoor air inlet. The moisture desorbed from the first adsorbent heat exchangers 22, 32 is carried with the room air RA and is exhausted as the exhaust air EA through the exhaust air outlets to the outside. In the second adsorbent heat exchangers 23, 33, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the second adsorbent heat exchangers 23, 33 passes through the supply air outlet and is supplied as the supply air SA to the room (see the arrows shown on the both sides of the adsorbent heat exchangers 22, 23, 32, 33 in FIG. 20).

In the second operation, the adsorption process in the first adsorbent heat exchangers 22, 32 and the regeneration process in the second adsorbent heat exchangers 23, 33 are performed in parallel. During the second operation, as shown in FIG. 21, the latent heat utilization side four-way directional control valves 21, 31 are set to a second state (see the broken lines in the latent heat utilization side four-way directional control valves 21, 31 in FIG. 21). In this state, high-pressure gas refrigerant discharged from the compression mechanism 61 flows into the second adsorbent heat exchangers 23, 33 through the discharge gas connection pipe 8 and the latent heat utilization side four-way directional control valves 21, 31, and is condensed while passing through the second adsorbent heat exchangers 23, 33. The condensed refrigerant is pressure-reduced by the latent heat utilization side expansion valves 24, 34, and is subsequently evaporated while passing through the first adsorbent heat exchangers 22, 32. Then, the refrigerant is again drawn into the compression mechanism 61 through the latent heat utilization side four-way directional control valves 21, 31 and the inlet gas connection pipe 9 (see the arrows shown on the refrigerant circuit 10 in FIG. 21).

During the second operation, in the second adsorbent heat exchangers 23, 33, moisture is desorbed from the adsorbent heated by condensation of the refrigerant, and this desorbed moisture is added to the room air RA that is drawn from the indoor air inlet. The moisture desorbed from the second adsorbent heat exchangers 23, 33 is carried with the room air RA and is exhausted as the exhaust air EA through the exhaust air outlets to the outside. In the first adsorbent heat exchangers 22, 32, the moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the first adsorbent heat exchangers 22, 32 passes through the supply air outlet and is supplied as the supply air SA to the room (see the arrows shown on the both sides of the adsorbent heat exchangers 22, 23, 32, 33 in FIG. 21).

Here, the system control that is performed in the air conditioning system 1 will be described, focusing on the latent heat load treatment system.

First, when the target temperature and the target relative humidity are set by the remote controls 11, 12, along with these target temperature and target relative humidity, the following information will be input into the latent heat utilization side controllers 28, 38 of the latent heat utilization units 2, 3, respectively: the temperature and relative humidity of the room air to be drawn into the units, which were detected by RA inlet temperature/humidity sensors 25, 35; and the temperature and relative humidity of outdoor air to be drawn into the units, which were detected by OA inlet temperature/humidity sensors 26, 36.

Then, in step S11, the latent heat utilization side controllers 28, 38 calculate the target value of the enthalpy or the target absolute humidity based on the target temperature of the room air and the target relative humidity; calculate the current value of the enthalpy or the current absolute humidity of the air to be drawn into the units from the room based on the temperature and the relative humidity detected by the RA inlet temperature/humidity sensors 25, 35; and then calculate the required latent heat capacity value Δh, which is the difference between the two calculated values. Then, this value Δh is converted to a capacity UP signal K1 that informs the heat source side controller 65 whether or not it is necessary to increase the treatment capacity of the latent heat utilization units 2, 3. For example, when the absolute value of Δh is lower than a predetermined value (in other words, when the humidity of the room air is close to the target humidity and the treatment capacity does not need to be increased or decreased), the capacity UP signal K1 will be "0." When the absolute value of Δh is higher than a predetermined value in a way that the treatment capacity needs to be increased (in other words, the humidity of the room air is higher than the target humidity during the dehumidifying operation, and the treatment capacity needs to be increased), the capacity UP signal K1 will be "A," and when the absolute value of Δh is higher than a predetermined value in a way that the treatment capacity needs to be decreased (in other words, the humidity of the room air is lower than the target humidity during the dehumidifying operation, and the treatment capacity needs to be decreased), the capacity UP signal K1 will be "B." Then, this capacity UP signal K1 is transmitted from the latent heat utilization side controllers 28, 38 to the heat source side controller 65, and in step S12, this signal K1 is used for calculation of the target condensation temperature TcS and the target evaporation temperature TeS, which will be described below.

Next, the operation of the sensible heat load treatment system of the air conditioning system 1 will be described.

When the cooling operation of the sensible heat utilization units 4, 5 is performed, the three-way direction control valve 62 of the heat source unit 6 is in a condensing operation state (a state in which the first port 62*a* is connected to the third port 62*c*). In addition, the air conditioning switching valves 71, 81 of the connection units 14, 15 are in a cooling operation state (a state in which the first ports 71*a*, 81*a* are connected to the second ports 71*b*, 81*b*). Further, the degree of opening of the sensible heat utilization side expansion valves 41, 51 of the sensible heat utilization units 4, 5, respectively, is adjusted so as to reduce the pressure of the refrigerant. The heat source side expansion valve 64 is opened.

When the refrigerant circuit 10 is in the above-described state, high-pressure gas refrigerant discharged from the compression mechanism 61 passes through the three-way direction control valve 62, flows into the heat source side heat exchanger 63, and is condensed into liquid refrigerant. This liquid refrigerant is sent to the sensible heat utilization units 4, 5 through the heat source side expansion valve 64, the receiver 68, and the liquid connection pipe 7. The liquid refrigerant sent to the sensible heat utilization units 4, 5 is pressure-reduced by the sensible heat utilization side expansion valves 41, 51, and then, in the air heat exchangers 42, 52, this liquid refrigerant is evaporated into low-pressure gas refrigerant by heat exchange with the room air RA drawn into the unit. This gas refrigerant is again drawn into the compression mechanism 61 of the heat source unit 6 through the air conditioning switching valves 71, 81 of the connection units 14, 15 and the inlet gas connection pipe 9. On the other hand, the room air RA cooled by heat exchange with the refrigerant in the air heat exchangers 42, 52 is supplied as the supply air SA to the room. Note that, as described below, the degree of opening of the sensible heat utilization side expansion valves 41, 51 is adjusted such that the degree of superheat SH in the air heat exchangers 42, 52, i.e., the temperature difference between the refrigerant temperature on the liquid side of the air heat exchangers 42, 52 respectively detected by the liquid side temperature sensors 43, 53 and the refrigerant temperature on the gas side of the air heat exchangers 42, 52 respectively detected by the gas side temperature sensors 44, 54, is equal to the target degree of superheat SHS.

Here, the system control that is performed in the air conditioning system 1 will be described, focusing on the sensible heat load treatment system.

First, when the target temperatures are set by the remote controls 11, 12, along with these target temperatures, the temperature of the room air to be drawn into the unit, which were detected by RA inlet temperature sensors 45, 55, will be input into the sensible heat utilization side controllers 48, 58 of the sensible heat utilization units 4, 5, respectively.

Then, in step S14, the sensible heat utilization side controllers 48, 58 calculate the temperature difference between the target temperature of the room air and the temperature detected by the RA inlet temperature sensors 45, 55 (this temperature difference will be hereinafter referred to as the required sensible heat capability value ΔT). Here, as described above, the required sensible heat capacity value ΔT is the difference between the target temperature of the room air and the current temperature of the room air, so that this value ΔT corresponds to the sensible heat load that must be treated in the air conditioning system 1. Then, this required sensible heat capacity value ΔT is converted to a capacity UP signal K2 that informs the heat source side controller 65 whether or not it is necessary to increase the treatment capacity of the sensible heat utilization units 4, 5. For example, when the absolute value of ΔT is lower than a predetermined value (in other words, when the temperature of the room air is close to the target temperature of the room air and the treatment capacity does not need to be increased or decreased), the capacity UP signal K2 will be "0." When the absolute value of ΔT is higher than a predetermined value in a way that the treatment capacity needs to be increased (in other words, the room temperature air is higher than the target temperature during the cooling operation and the treatment capacity needs to be increased), the capacity UP signal K2 will be "a," and when the absolute value of ΔT is higher than a predetermined value in a way that the treatment capacity needs to be decreased (in other words, the temperature of the room air is lower than the target temperature during the cooling operation, and the treatment capacity needs to be decreased), the capacity UP signal K2 will be "b."

Next, in step S15, the sensible heat utilization side controllers 48, 58 change the target degree of superheat SHS according to the required sensible heat capability value ΔT. For example, when the treatment capacity of the sensible heat utilization units 4, 5 needs to be decreased (when the capacity UP signal K2 is "b"), the degree of opening of the sensible heat utilization side expansion valves 41, 51 is controlled such that the target degree of superheat SHS is increased and the amount of heat exchanged between the air and the refrigerant in the air heat exchangers 42, 52 is decreased.

Next, in step S12, the heat source side controller 65 calculates the target condensation temperature TcS and the target evaporation temperature TeS, using the capacity UP signal K1 of the latent heat utilization units 2, 3, which was transmitted from the latent heat utilization side controllers 28, 38 to the heat source side controller 65, and also the capacity UP signal K2 of the sensible heat utilization units 4, 5, which was transmitted from the sensible heat utilization side controllers 48, 58 to the heat source side controller 65. For example, the target condensation temperature TcS is calculated by adding the capacity UP signal K1 of the latent heat utilization units 2, 3 and the capacity UP signal K2 of the sensible heat utilization units 4, 5 to the current target condensation temperature. In addition, the target evaporation temperature TeS is calculated by subtracting the capacity UP signal K1 of the latent heat utilization units 2, 3 and the capacity UP signal K2 of the sensible heat utilization units 4, 5 from the current target evaporation temperature. Accordingly, when a value of the capacity UP signal K1 is "A" or when a value of the capacity UP signal K2 is "a," the target condensation temperature TcS will be high and the target evaporation temperature TeS will be low.

Next in step S13, a system condensation temperature Tc and a system evaporation temperature Te, which respectively correspond to measured values of the condensation temperature and the evaporation temperature of the entire air conditioning system 1, are calculated. For example, the system condensation temperature Tc and the system evaporation temperature Te are calculated by converting an inlet pressure of the compression mechanism 61 detected by the inlet pressure sensor 66 and a discharge pressure of the compression mechanism 61 detected by the discharge pressure sensor 67 to the saturation temperatures of the refrigerant at these pressures. Then, the temperature difference ΔTc between the system condensation temperature Tc and the target condensation temperature TcS and the temperature difference ΔTe between the system evaporation temperature Te and the target evaporation temperature TeS are calculated. Then based on the subtraction between these temperature differences, the necessity and amount of the increase or decrease in the operational capacity of the compression mechanism 61 will be determined.

By using thus determined operational capacity of the compression mechanism 61 to control the operational capacity of the compression mechanism 61, the system control to aim the target relative humidity of the room air is performed. The system control is performed such that, for example, when a value determined by subtracting the temperature difference ΔTe from the temperature difference ΔTc is a positive value, the operational capacity of the compression mechanism 61 is increased, whereas when a value determined by subtracting the temperature difference ΔTe from the temperature difference ΔTc is a negative value, the operational capacity of the compression mechanism 61 is decreased.

In this way, in this air conditioning system 1, the latent heat load (required latent heat treatment capacity, which corresponds to Δh), which must be treated in the air conditioning system 1 as a whole, and the sensible heat load (required sensible heat treatment capacity, which correspond to ΔT), which must be treated in the air conditioning system 1 as a whole, are treated by using the latent heat load treatment system (specifically, the latent heat utilization units 2, 3) and the sensible heat load treatment system (specifically, sensible heat utilization units 4, 5). Here, as for the increase and decrease of the treatment capacity of the latent heat load treatment system and the increase and decrease of the treatment capacity of the sensible heat load treatment system, the required latent heat treatment capacity value Δh and the required sensible heat treatment capacity value ΔT are calculated, and the operational capacity of the compression mechanism 61 is controlled based on these calculated values. Accordingly, it is possible to treat the latent heat load in the latent heat load treatment system having the adsorbent heat exchangers 22, 23, 32, 33, while treating the sensible heat load in the sensible heat load treatment system having the air heat exchangers 42, 52 at the same time. Consequently, as in the air conditioning system 1 of the present embodiment, even when the latent heat load treatment system and the sensible heat load treatment system share a heat source, the operational capacity of the compression mechanism that constitutes the heat source can be controlled in a satisfactory manner.

Incidentally, the system control in the above-described air conditioning system 1 is basically performed such that the operational capacity of the compression mechanism 61 is increased when the required sensible heat treatment capacity value ΔT is high (in other words, the capacity UP signal K2 is "a") and also the required latent heat treatment capacity value Δh is low (in other words, the capacity UP signal K1 is "B"). In addition, when the required latent heat treatment capacity value Δh is high (in other words, the capacity UP signal K1 is "A"), control is performed basically such that the operational capacity of the compression mechanism 61 is increased.

On the other hand, in the latent heat load treatment by the latent heat load treatment system, as described above, both the latent heat and the sensible heat are treated through the adsorption process or the regeneration process in the adsorbent heat exchangers 22, 23, 32, 33. The ratio of the sensible heat treatment capacity to the latent heat treatment capacity during the above-described operation is changed according to the change in the switching time interval, as shown in FIG. 5. Accordingly in the air conditioning system 1, when the required latent heat treatment capacity value Δh is low and the required sensible heat treatment capacity value ΔT is high, the switching time interval is made longer so as to increase the sensible heat treatment capacity ratio in order to handle the increase in the sensible heat load. Here, an operation to increase the sensible heat treatment capacity in the latent heat load treatment system of the air conditioning system 1 by making the switching time interval longer is not an operation to increase the operational capacity of the compression mechanism 61, so that there is no inefficiency in this air conditioning 1 as a whole and thus an efficient operation can be achieved. In addition, when the required latent heat treatment capacity value Δh is high (in other words, the capacity UP signal K1 is "A"), the switching time interval is made shorter so as to reduce the sensible heat treatment capacity ratio in order to handle the increase in the latent heat load.

The air conditioning system 1 of the present embodiment performs the above-described system control, based on the control flow shown in FIG. 23. Below, the system control of the air conditioning system 1 shown in FIG. 23 will be described. Note that steps shown in FIG. 23 excluding steps S16 to S19, i.e., steps S11 to S15 are the same steps S11 to S15 shown in FIG. 22, so that a description thereof will be omitted here.

In step S16, the latent heat utilization side controllers 28, 38 determine whether or not the switching time interval in the adsorbent heat exchangers 22, 23, 32, 33 is in the sensible heat priority mode (in other words, time D) and whether or not the capacity UP signal K1 is "A" (in other words, the latent heat treatment capacity is to be increased). When both of the two conditions are satisfied, in step S18, the switching time interval is changed to the latent heat priority mode (in other words, time C). On the contrary, when either of the two conditions is not satisfied, the system control proceeds to step S17.

In step S17, the latent heat utilization side controllers 28, 38 determine whether or not the switching time interval of the adsorbent heat exchangers 22, 23, 32, 33 is in the latent heat priority mode (in other words, time C); whether or not the capacity UP signal K1 is "B" (in other words, the latent heat treatment capacity is to be decreased); and whether or not the capacity UP signal K2 transmitted from the sensible heat utilization side controllers 48, 58 through the heat source side controller 65 is "a" (in other words, the sensible heat treatment capacity is to be increased). Then, when all the three conditions are satisfied, in step S19, the switching time interval is changed to the sensible heat priority mode (in other words, time D). On the contrary, when any one of the three conditions is not satisfied, the system control proceeds to step S12.

With this system control, as described above, when the required latent heat treatment capacity value Δh is low and also the required sensible heat treatment capacity value ΔT is high, the switching time interval is made longer (specifically, time C during the normal operation is changed to time D, see FIG. 5) so as to increase the sensible heat treatment capacity ratio in order to handle the increase in the sensible heat load. Further, with this system control, the switching time interval can set back to the latent heat priority mode when the latent heat load increases as in step S16, so that the increase in the sensible heat load can be handled while the latent heat load in the room is reliably treated.

Note that, here, as an example of the dehumidifying and cooling operation, the case where the cooling operation is performed in the sensible heat load treatment system while the dehumidifying operation is performed in the full ventilation mode in the latent heat load treatment system of the air conditioning system 1 is described; however, a case where the dehumidifying operation in a different mode such as the circulation mode or the air supply mode is performed in the latent heat load treatment system is also applicable.

<Humidifying and Heating Operation>

Figure 24:
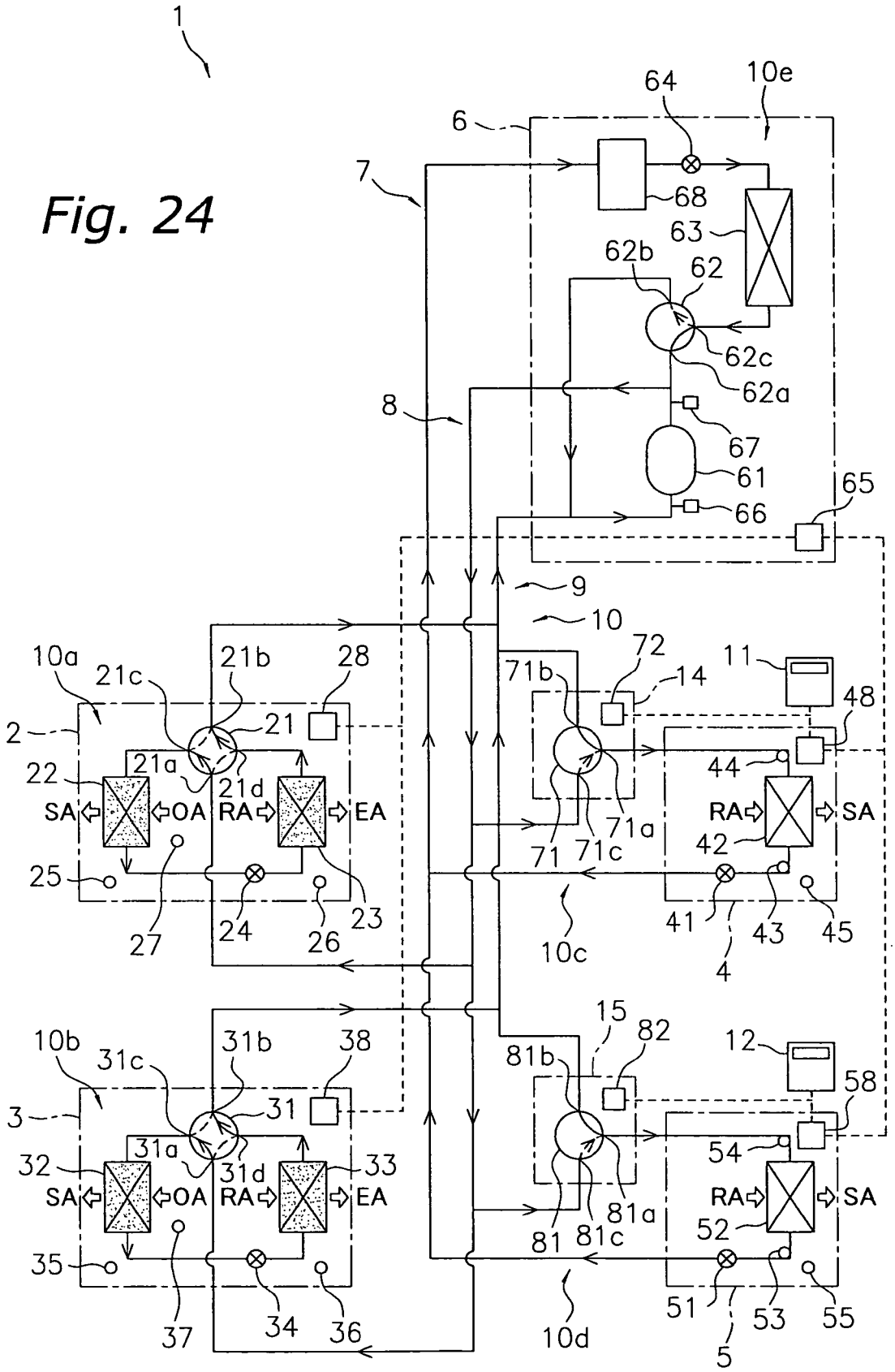
FIG. 24 is a schematic diagram of a refrigerant circuit showing the operation during a humidifying and heating operation in the full ventilation mode in the air conditioning system of the first embodiment.
Figure 25:
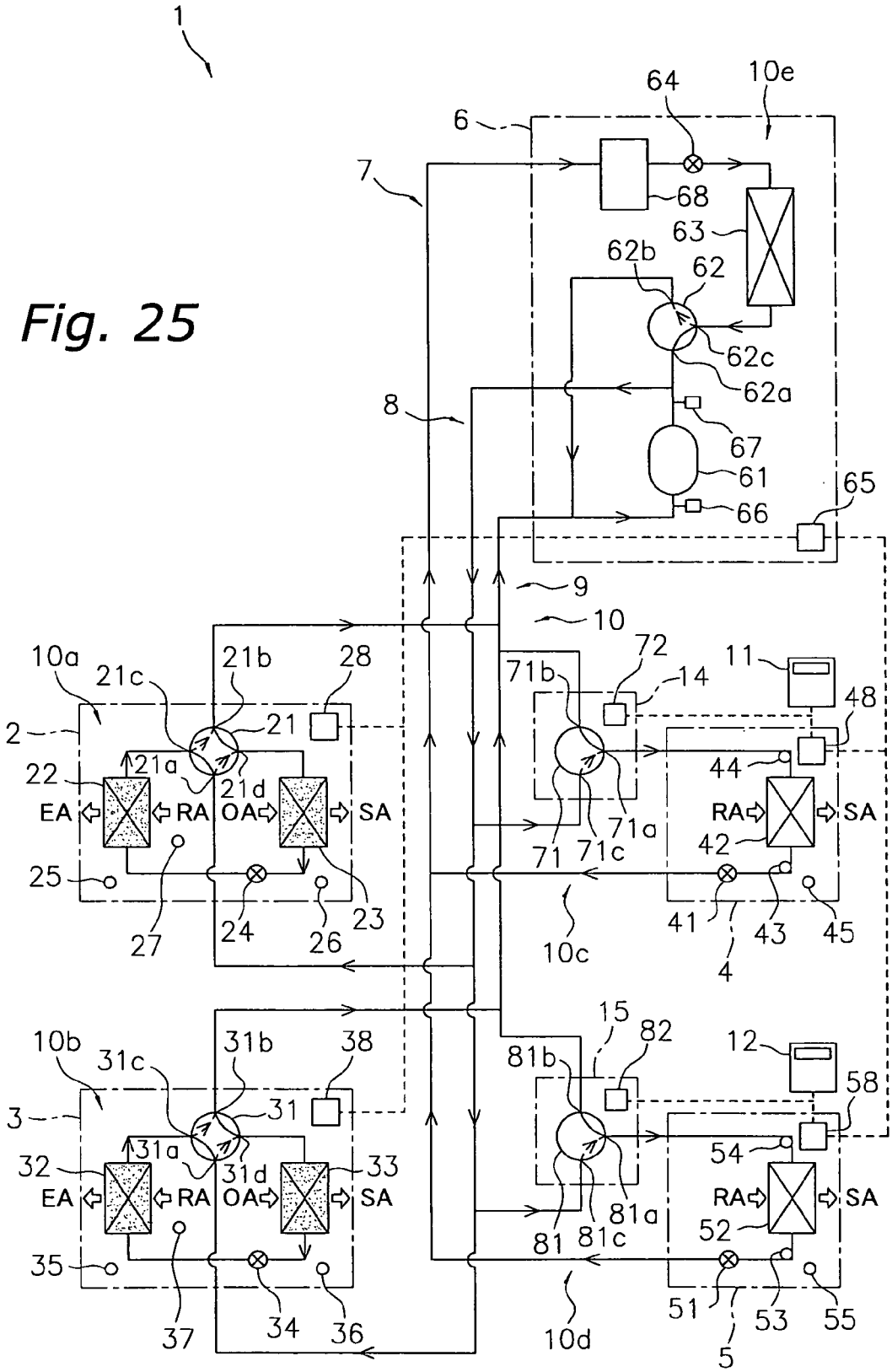
FIG. 25 is a schematic diagram of a refrigerant circuit showing the operation during the humidifying and heating operation in the full ventilation mode in the air conditioning system of the first embodiment.

Next, the operation of a humidifying and heating operation in which the heating operation is performed in the sensible heat load treatment system of the air conditioning system 1 while the humidifying operation is performed in the full ventilation mode in the latent heat load treatment system of the air conditioning system 1 will be described with reference to FIGS. 22, 23, 24, and 25. Here, FIGS. 24 and 25 are schematic diagrams of a refrigerant circuit showing the operation during the humidifying and heating operation in the full ventilation mode in the air conditioning system 1 of the first embodiment.

First, the operation of the latent heat load treatment system of the air conditioning system 1 will be described.

As in the case of the above-described single operation by the latent heat load treatment system, the latent heat utilization unit 2 of the latent heat load treatment system alternately repeats the first operation in which the first adsorbent heat exchanger 22 functions as a condenser and the second adsorbent heat exchanger 23 functions as an evaporator, and the second operation in which the second adsorbent heat exchanger 23 functions as a condenser and the first adsorbent heat exchanger 22 functions as an evaporator. Likewise, the latent heat utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator.

The operation of the two latent heat utilization units 2 and 3 will be described together below.

In the first operation, the regeneration process in the first adsorbent heat exchangers 22, 32 and the adsorption process in the second adsorbent heat exchangers 23, 33 are performed in parallel. During the first operation, as shown in FIG. 24, the latent heat utilization side four-way directional control valves 21, 31 are set to a first state (see the solid lines in the latent heat utilization side four-way directional control valves 21, 31 in FIG. 24). In this state, high-pressure gas refrigerant discharged from the compression mechanism 61 flows into the first adsorbent heat exchangers 22, 32 through the discharge gas connection pipe 8 and the latent heat utilization side four-way directional control valves 21, 31, and is condensed while passing through the first adsorbent heat exchangers 22, 32. The condensed refrigerant is pressure-reduced by the latent heat utilization side expansion valves 24, 34, and is subsequently evaporated while passing through the second adsorbent heat exchangers 23, 33. Then, the refrigerant is again drawn into the compression mechanism 61 through the latent heat utilization side four-way directional control valves 21, 31 and the inlet gas connection pipe 9 (see the arrows shown on the refrigerant circuit 10 in FIG. 24). Here, unlike the case of the above-described operation performed only by the latent heat load treatment system, the sensible heat utilization side expansion valves 41, 51 of the sensible heat utilization units 4, 5, respectively, are opened allowing the refrigerant flow into the air heat exchangers 42, 52 in order to perform the heating operation, and the degree of opening these valves is adjusted. Accordingly, a portion of high-pressure gas refrigerant compressed in and discharged from the compression mechanism 61 will be flowing in the latent heat utilization units 2, 3.

During the first operation, in the first adsorbent heat exchangers 22, 32, moisture is desorbed from the adsorbent heated by condensation of the refrigerant, and this desorbed moisture is added to the outdoor air OA that is drawn from the outside air inlets. The moisture desorbed from the first adsorbent heat exchangers 22, 32 is carried with the outdoor air OA and supplied as the supply air SA through the supply air outlet to the room. In the second adsorbent heat exchangers 23, 33, moisture in the room air RA is adsorbed onto the adsorbent, the room air RA is dehumidified, the absorption heat thereby generated is transferred to the refrigerant, and the refrigerant evaporates. Then the room air RA dehumidified in the second adsorbent heat exchangers 23, 33 passes through the exhaust air outlet and is exhausted as the exhaust air EA to the outside (see the arrows shown on the both sides of the adsorbent heat exchangers 22, 23, 32, 33 in FIG. 24).

In the second operation, the adsorption process in the first adsorbent heat exchangers 22, 32 and the regeneration process in the second adsorbent heat exchangers 23, 33 are performed in parallel. During the second operation, as shown in FIG. 25, the latent heat utilization side four-way directional control valves 21, 31 are set to a second state (see the broken lines in the latent heat utilization side four-way directional control valves 21, 31 in FIG. 25). In this state, high-pressure gas refrigerant discharged from the compression mechanism 61 flows into the second adsorbent heat exchangers 23, 33 through the discharge gas connection pipe 8 and the latent heat utilization side four-way directional control valves 21, 31, and is condensed while passing through the second adsorbent heat exchangers 23, 33. The condensed refrigerant is pressure-reduced by the latent heat utilization side expansion valves 24, 34, and is subsequently evaporated while passing through the first adsorbent heat exchangers 22, 32. Then, the refrigerant is again drawn into the compression mechanism 61 through the latent heat utilization side four-way directional control valves 21, 31 and the inlet gas connection pipe 9 (see the arrows shown on the refrigerant circuit 10 in FIG. 25).

During the second operation, in the second adsorbent heat exchangers 23, 33, moisture is desorbed from the adsorbent heated by condensation of the refrigerant, and this desorbed moisture is added to the outdoor air OA that is drawn from the outside air inlets. The moisture desorbed from the second adsorbent heat exchangers 23, 33 is carried with the outdoor air OA and is supplied as the supply air SA through the supply air outlets to the room. In the first adsorbent heat exchangers 22, 32, moisture in the room air RA is adsorbed onto the adsorbent, the room air RA is dehumidified, the absorption heat thereby generated is transferred to the refrigerant, and the refrigerant evaporates. Then the room air RA dehumidified in the first adsorbent heat exchangers 22, 32 passes through the exhaust air outlets and is exhausted as the exhaust air EA to the outside (see the arrows shown on the both sides of the adsorbent heat exchangers 22, 23, 32, 33 in FIG. 25).

Here, the system control being performed in the air conditioning system 1 will be described, focusing on the latent heat load treatment system.

First, when the target temperature and the target relative humidity are set by the remote controls 11, 12, along with these target temperature and target relative humidity, the following information will be input into the latent heat utilization side controllers 28, 38 of the latent heat utilization units 2, 3: the temperature and relative humidity of the room air to be drawn into the units, which were detected by RA inlet temperature/humidity sensors 25, 35; and the temperature and relative humidity of outdoor air to be drawn into the units, which were detected by OA inlet temperature/humidity sensors 26, 36.

Then, in step S11, the latent heat utilization side controllers 28, 38 calculate the target value of the enthalpy or the target absolute humidity based on the target temperature and target relative humidity of the room air; calculate the current value of the enthalpy or the current absolute humidity of the air to be drawn into the units from the room based on the temperature and the relative humidity detected by the RA inlet temperature/humidity sensors 25, 35; and then calculate the required latent heat capacity value $\Delta h$, which is the difference between the two calculated values. Then, this value $\Delta h$ is converted to a capacity UP signal K1 that informs the heat source side controller 65 whether or not it is necessary to increase the treatment capacity of the latent heat utilization units 2, 3. For example, when the absolute value of $\Delta h$ is lower than a predetermined value (in other words, when the humidity of the room air is close to the target humidity, and the treatment capacity does not need to be increased or decreased), the capacity UP signal K1 will be "0." When the absolute value of $\Delta h$ is higher than a predetermined value in a way that the treatment capacity needs to be increased (in other words, the humidity of the room air is lower than the target humidity during the humidifying operation, and the treatment capacity needs to be increased), the capacity UP signal K1 will be "A," and when the absolute value of $\Delta h$ is higher than a predetermined value in a way that the treatment capacity needs to be decreased (in other words, the humidity of the room air is higher than the target humidity during the humidifying operation, and the treatment capacity needs to be decreased), the capacity UP signal K1 will be "B." Then, this capacity UP signal K1 is transmitted from the latent heat utilization side controllers 28, 38 to the heat source side controller 65, and in step S12, this signal K1 is used for calculation of the target condensation temperature TcS and the target evaporation temperature TeS, which will be described below.

Next, the operation of the sensible heat load treatment system of the air conditioning system 1 will be described.

When the heating operation of the sensible heat utilization units 4, 5 is performed, the three-way direction control valve 62 of the heat source unit 6 is in an evaporating operation state (a state in which the second port 62*b* is connected to the third port 62*c*). In addition, the air conditioning switching valves 71, 81 of the connection units 14, 15 are in a heating operation state (a state in which the first ports 71*a*, 81*a* are connected to the third ports 71*c*, 81*c*). Further, the degree of opening of the sensible heat utilization side expansion valves 41, 51 of the sensible heat utilization units 4, 5 is adjusted so as to reduce the pressure of the refrigerant. The degree of opening of the heat source side expansion valve 64 is adjusted so as to reduce the pressure of the refrigerant.

When the refrigerant circuit 10 is in the above-described state, high-pressure gas refrigerant discharged from the compression mechanism 61 is sent to the sensible heat utilization units 4, 5 between the discharge side of the compression mechanism 61 and the three-way direction control valve 62 through the discharge gas connection pipe 8 and the connection units 14, 15. Then, high-pressure gas refrigerant sent to the sensible heat utilization units 4, 5 is condensed into liquid refrigerant by heat exchange with the room air RA drawn into the unit in the air heat exchangers 42, 52, and is sent to the heat source unit 6 through the sensible heat utilization side expansion valves 41, 51 and the liquid connection pipe 7. On the other hand, the room air RA cooled by heat exchange with the refrigerant in the air heat exchangers 42, 52 is supplied as the supply air SA to the room. The liquid refrigerant sent to the heat source unit 6 is passed through the receiver 68, is pressure-reduced by the heat source side expansion valve 64, is evaporated in the heat source side heat exchanger 63 into low-pressure gas refrigerant, and is again drawn back to the compression mechanism 61 through the three-way direction control valve 62. Note that, as described below, the degree of opening of the sensible heat utilization side expansion valves 41, 51 is adjusted so that the degree of subcool SC of the air heat exchangers 42, 52, i.e., the temperature difference between the refrigerant temperature on the liquid side of the air heat exchangers 42, 52, which is detected by the liquid side temperature sensors 43, 53, and the refrigerant temperature on the gas side of the air heat exchangers 42, 52, which is detected by the gas side temperature sensors 44, 54, is equal to the target degree of subcool ScS.

Here, the system control being performed in the air conditioning system 1 will be described, focusing on the sensible heat load treatment system.

First, when the target temperature is set by the remote controls 11, 12, along with these target temperatures, the temperature of the room air to be drawn into the units, which were detected by RA inlet temperature sensors 45, 55, will be also input into the sensible heat utilization side controllers 48, 58 of the sensible heat utilization units 4, 5, respectively.

Then, in step S14, the sensible heat utilization side controllers 48, 58 calculate the temperature difference between the target temperature of the room air and the temperature detected by the RA inlet temperature sensors 45, 55 (this temperature difference will be hereinafter referred to as the required sensible heat capability value ΔT). Here, as described above, the required sensible heat capacity value ΔT is the difference between the target temperature of the room air and the current temperature of the room air, so that this value ΔT corresponds to the sensible heat load that must be treated in the air conditioning system 1. Then, this required sensible heat capacity value ΔT is converted to a capacity UP signal K2 that informs the heat source side controller 65 whether or not it is necessary to increase the treatment capacity of the sensible heat utilization units 4, 5. For example, when the absolute value of ΔT is lower than a predetermined value (in other words, when the temperature of the room air is close to the target temperature of the room air and the treatment capacity does not need to be increased or decreased), the capacity UP signal K2 will be "0." When the absolute value of ΔT is higher than a predetermined value in a way that the treatment capacity needs to be increased (in other words, the room temperature air is lower than the target temperature during the heating operation and the treatment capacity needs to be increased), the capacity UP signal K2 will be "a," and when the absolute value of ΔT is higher than a predetermined value in a way that the treatment capacity needs to be decreased (in other words, the temperature of the room air is higher than the target temperature during the heating operation, and the treatment capacity needs to be decreased), the capacity UP signal K2 will be "b."

Next, in step S15, the sensible heat utilization side controllers 48, 58 change the target degree of subcool SCS according to the required sensible heat capability value ΔT. For example, when the treatment capacity of the sensible heat utilization units 4, 5 needs to be decreased (when the capacity UP signal K2 is "b"), the degree of opening of the sensible heat utilization side expansion valves 41, 51 is controlled such that the target degree of superheat SCS is increased and the amount of heat exchanged between the air and the refrigerant in the air heat exchangers 42, 52 is decreased.

Next, in step S12, the heat source side controller 65 calculates the target condensation temperature TcS and the target evaporation temperature TeS, using the capacity UP signal K1 of the latent heat utilization units 2, 3, which was transmitted from the latent heat utilization side controllers 28, 38 to the heat source side controller 65, and also the capacity UP signal K2 of the sensible heat utilization units 4, 5, which was transmitted from the sensible heat utilization side controllers 48, 58 to the heat source side controller 65. For example, the target condensation temperature TcS is calculated by adding the capacity UP signal K1 of the latent heat utilization units 2, 3 and the capacity UP signal K2 of the sensible heat utilization units 4, 5 to the current target condensation temperature. In addition, the target evaporation temperature TeS is calculated by subtracting the capacity UP signal K1 of the latent heat utilization units 2, 3 and the capacity UP signal K2 of the sensible heat utilization units 4, 5 from the current target evaporation temperature. Accordingly, when a value of the capacity UP signal K1 is "A" or when a value of the capacity UP signal K2 is "a," the target condensation temperature TcS will be high and the target evaporation temperature TeS will be low.

Next in step S13, a system condensation temperature Tc and a system evaporation temperature Te, which respectively correspond to measured values of the condensation temperature and the evaporation temperature of the entire air conditioning system 1, are calculated. For example, the system condensation temperature Tc and the system evaporation temperature Te are calculated by converting an inlet pressure of the compression mechanism 61 detected by the inlet pressure sensor 66 and a discharge pressure of the compression mechanism 61 detected by the discharge pressure sensor 67 to the saturation temperatures of the refrigerant at these pressures. Then, the temperature difference ΔTc between the system condensation temperature Tc and the target condensation temperature TcS and the temperature difference ΔTe between the system evaporation temperature Te and the target evaporation temperature TeS are calculated. Then based on the subtraction between these temperature differences, the necessity and the amount of the increase or decrease in the operational capacity of the compression mechanism 61 will be determined.

By using thus determined operational capacity of the compression mechanism 61 to control the operational capacity of the compression mechanism 61, the system control to aim the target relative humidity of the room air is performed. The system control is performed such that, for example, when a value determined by subtracting the temperature difference ΔTe from the temperature difference ΔTc is a positive value, the operational capacity of the compression mechanism 61 is increased, whereas when a value determined by subtracting the temperature difference ΔTe from the temperature difference ΔTc is a negative value, the operational capacity of the compression mechanism 61 is decreased.

In this way, this air conditioning system 1 can perform the system control for the humidifying and heating operation in the same manner as for the dehumidifying and cooling operation.

In addition, during the humidifying and heating operation, as in the case of the dehumidification heating operation, the system control in the air conditioning system 1 described above is basically performed such that the operational capacity of the compression mechanism 61 is increased when the required sensible heat treatment capacity value ΔT is high (in other words, the capacity UP signal K2 is "a") and also the required latent heat treatment capacity value Δh is low (in other words, the capacity UP signal K1 is "B"). In addition, also when the required latent heat treatment capacity value Δh increases (in other words, the capacity UP signal K1 is "A"), control is basically performed such that the operational capacity of the compression mechanism 61 is increased. Therefore, also during the humidifying and heating operation, the air conditioning system 1 of the present embodiment can perform, based on the control flow shown in FIG. 23, the system control in which the switching time interval in the adsorbent heat exchangers 22, 23, 32, 33 is changed. Specifically, as in the case of the dehumidifying and cooling operation, when the required latent heat treatment capacity value Δh is low and the required sensible heat treatment capacity value ΔT is high, the switching time interval is made longer (specifically, time C during the normal operation is changed to time D, see FIG. 5) so as to increase the sensible heat treatment capacity ratio in order to handle the increase in the sensible heat load. Further, with this system control, the switching time interval can set back to the latent heat priority mode when the latent heat load increases as in step S16, so that the increase in the sensible heat load can be handled while the latent heat load in the room is treated.

Note that, here, as an example of the humidifying and heating operation, the case where the heating operation is performed in the sensible heat load treatment system while the humidifying operation in the full ventilation mode is performed in the latent heat load treatment system of the air conditioning system 1 is described; however, a case where the humidifying operation in a different mode such as the circulation mode or the air supply mode is performed in the latent heat load treatment system is also applicable.

<Simultaneous Operation of the Dehumidifying and Cooling Operation and the Humidifying and Heating Operation>

Figure 26:
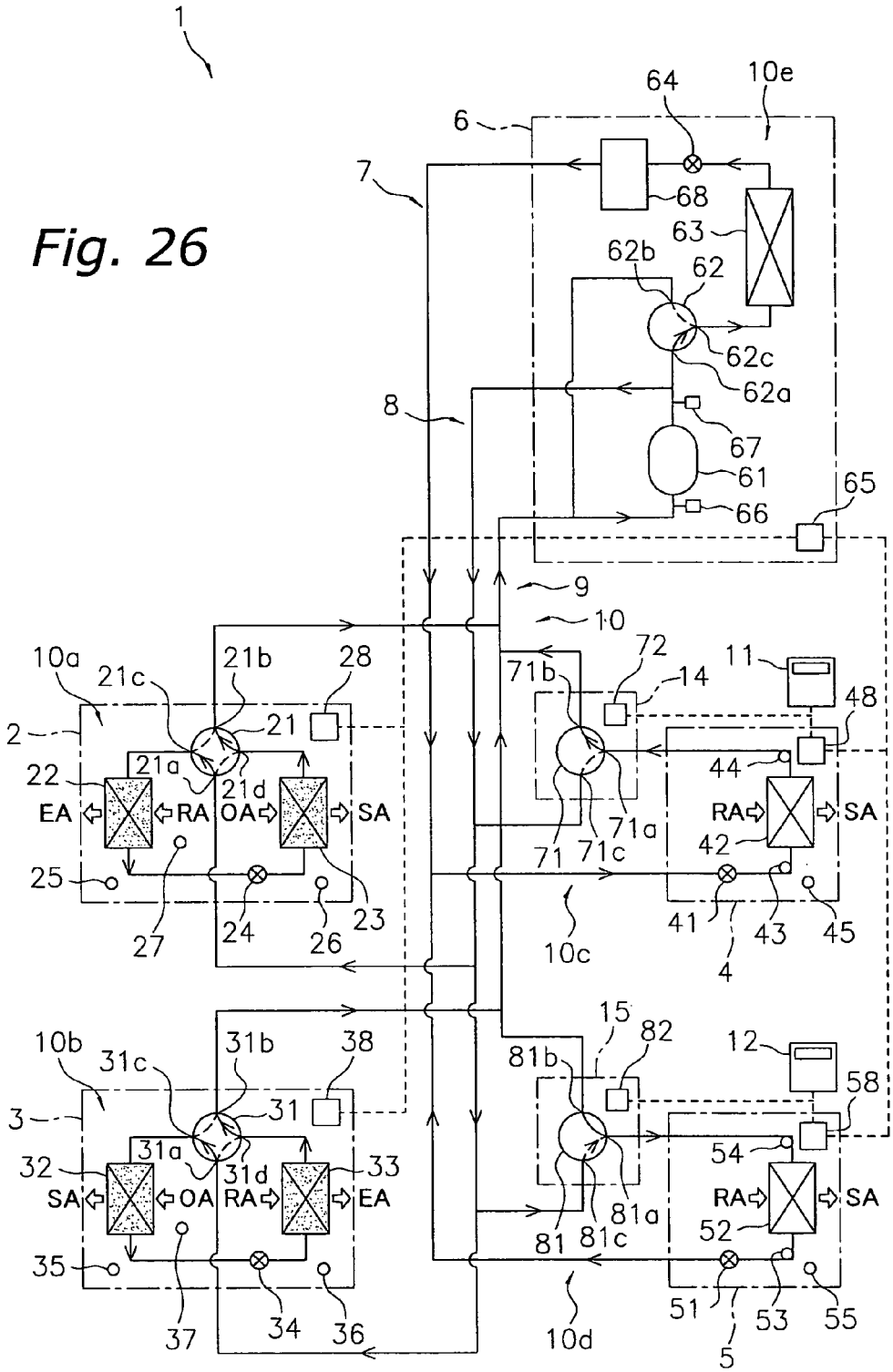
FIG. 26 is a schematic diagram of a refrigerant circuit showing the operation during a simultaneous operation of the dehumidifying and cooling operation and humidifying and heating operation in the full ventilation mode in the air conditioning system of the first embodiment.
Figure 27:
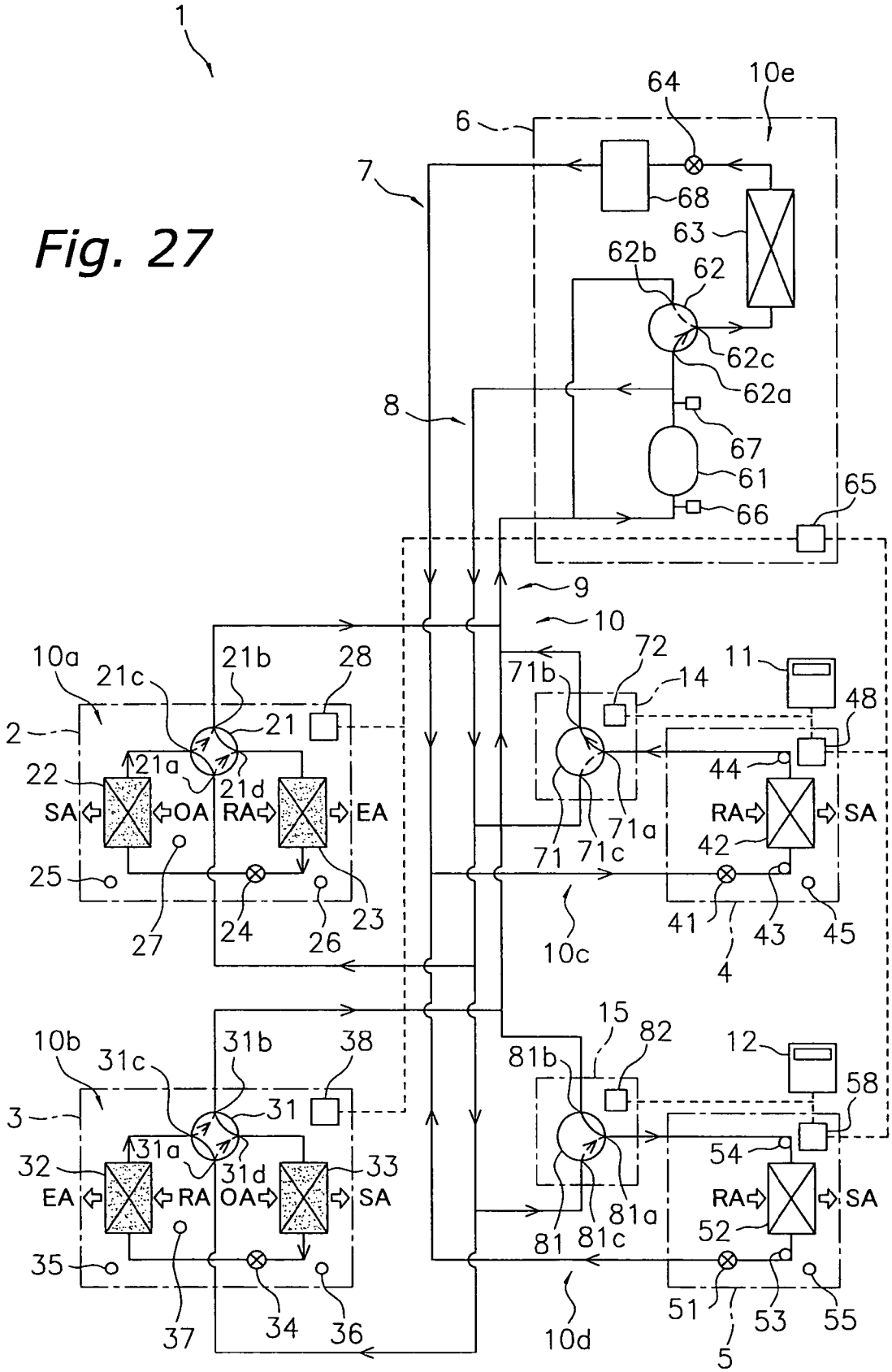
FIG. 27 is a schematic diagram of a refrigerant circuit showing the operation during the simultaneous operation of the dehumidifying and cooling operation and the humidifying and heating operation in the full ventilation mode in the air conditioning system of the first embodiment.

Next, the operation of the simultaneous operation of the dehumidifying and cooling operation and the humidifying and heating operation, in which the cooling operation and the heating operation are simultaneously performed in the sensible heat load treatment system of the air conditioning system 1 while the dehumidifying operation and the humidifying operation are performed simultaneously in the full ventilation mode in the latent heat load treatment system of the air conditioning system 1 while will be described with reference to FIGS. 26 and 27. Here, FIGS. 26 and 27 are schematic diagrams of a refrigerant circuit showing the operation during the simultaneous operations of the dehumidifying and cooling operation and the humidifying and heating operation in the full ventilation mode in the air conditioning system 1. Note that, here, the description will be given for a case where the latent heat utilization unit 2 and the sensible heat utilization unit 4 as a pair perform the dehumidifying and cooling operation, the latent heat utilization unit 3 and the sensible heat utilization unit 5 as a pair perform the humidifying and heating operation, the three-way direction control valve 62 is in a condensing operation state in the heat source unit 6 as a whole, and the cooling load is larger in the system. Note that since the system control in the air conditioning system 1 is the same as that performed during the above-described dehumidifying operation and humidifying operation, a description thereof will be omitted.

First, the operation of the latent heat load treatment system of the air conditioning system 1 will be described.

In the latent heat utilization unit 2, the same operation as the above-described dehumidifying operation in the full ventilation mode during the dehumidifying and cooling operation is performed. On the other hand, in the latent heat utilization unit 3, the same operation as the above-described humidifying operation in the full ventilation mode during the humidifying and heating operation is performed.

Next the operation of the sensible heat load treatment system of the air conditioning system 1 will be described. In the sensible heat utilization unit 4 that is operated with the latent heat utilization unit 2 as a pair, the same operation as the above-described cooling operation during the dehumidifying and cooling operation is performed. On the other hand, in the sensible heat utilization unit 5 that is operated with the latent heat utilization unit 3 as a pair, the same operation as the above-described heating operation during the humidifying and heating operation is performed. Here, in the heat source unit 6, the three-way direction control valve 62 in a condensing operation state, so that the flow of the refrigerant in the heat source side refrigerant circuit 10*e* is the same as that during the cooling operation.

In this way, the air conditioning system 1 of the present embodiment is capable of simultaneously performing the dehumidifying and cooling operation and the humidifying and heating operation.

<System Startup>

Figure 28:
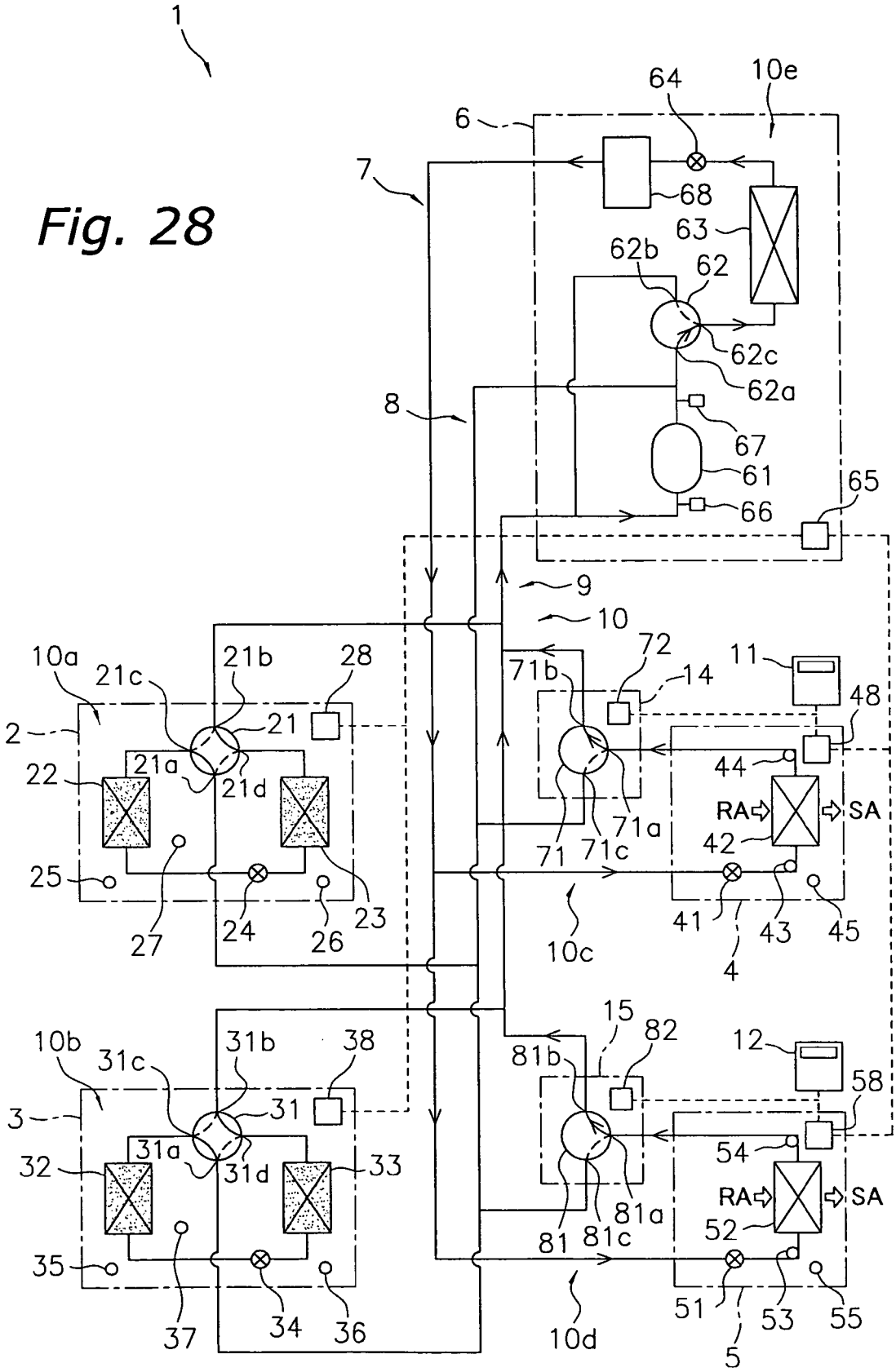
FIG. 28 is a schematic diagram of a refrigerant circuit showing a system startup operation of the air conditioning system of the first embodiment.
Figure 29:
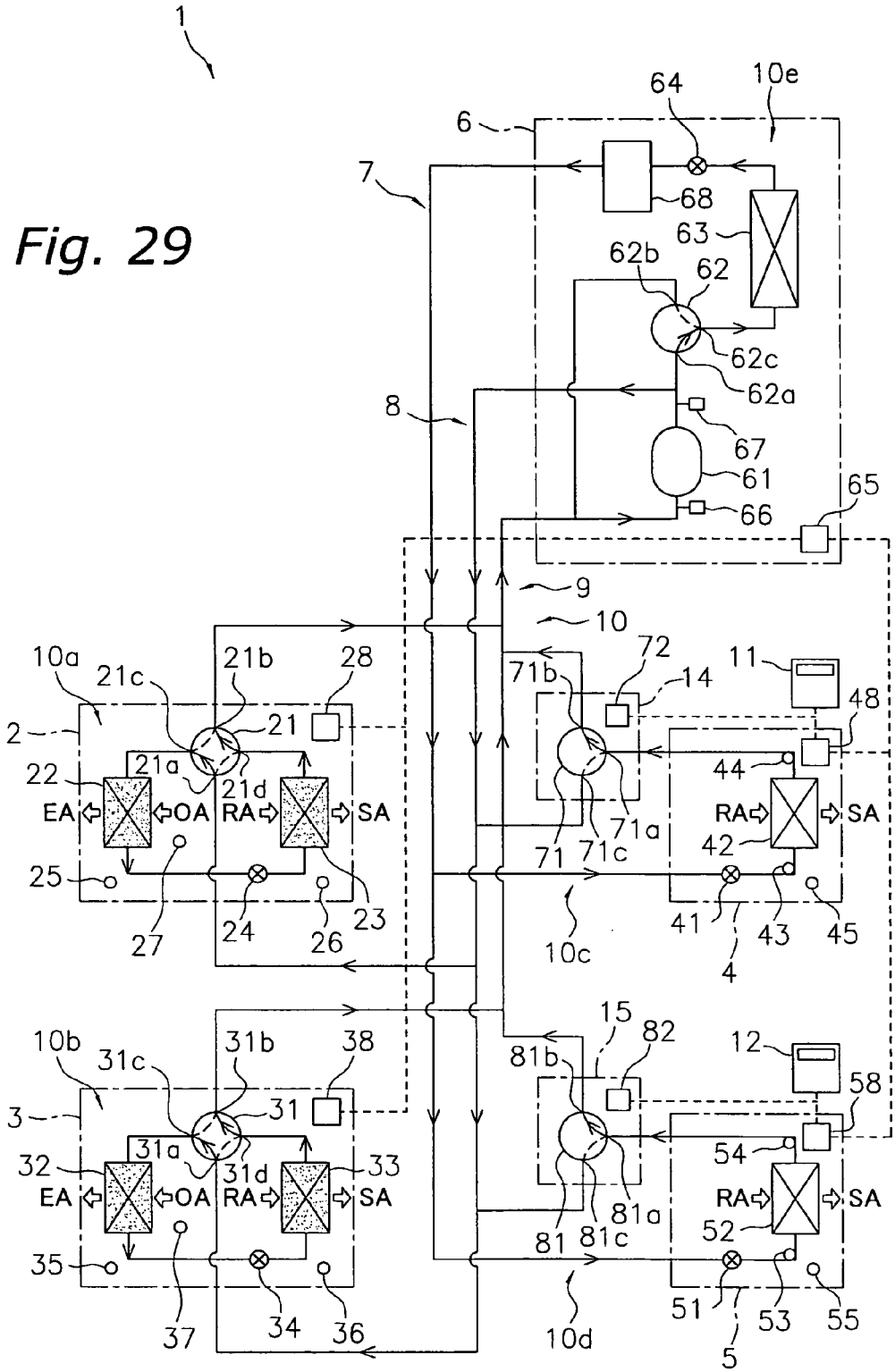
FIG. 29 is a schematic diagram of a refrigerant circuit showing the system startup operation of the air conditioning system of the first embodiment.

Next, a startup operation of the air conditioning system 1 will be described with reference to FIGS. 5, 20, 21, 28, and 29. Here, FIG. 28 is a schematic diagram of a refrigerant circuit showing a first system startup operation of the air conditioning system 1. FIG. 29 is a schematic diagram of a refrigerant circuit showing a second system startup operation of the air conditioning system 1.

As for the startup operation of the air conditioning system 1, there are three startup methods as described below. A first system startup method is a method to start the operation without having the outdoor air pass through the adsorbent heat exchangers 22, 23, 32, 33 in the latent heat load treatment system of the air conditioning system 1. A second system startup method is an operation method in which, in a state in which switching between the adsorption process and the regeneration process in the adsorbent heat exchangers 22, 23, 32, 33 in the latent heat load treatment system of the air conditioning system 1 is stopped, outdoor air is passed through one of the first adsorbent heat exchangers 22, 32 and one of the second adsorbent heat exchangers 23, 33 in the latent heat load treatment system and then be exhausted to the outside, and also room air is passed through the other one of the first adsorbent heat exchangers 22, 32 and the other one of the second adsorbent heat exchangers 23, 33 and then be supplied to the room. A third system startup method is a method to start the operation with the switching time interval between the adsorption process and the regeneration process in the adsorbent heat exchangers 22, 23, 32, 33 being made longer than that during the normal operation.

First, the first system startup operation will be described for the case where the cooling operation is performed in the sensible heat load treatment system of the air conditioning system 1, with reference to FIG. 28.

When an operation command is issued from the remote controls 11, 12, the sensible heat load treatment system of the air conditioning system 1 (in other words, the sensible heat utilization units 4, 5 and the heat source unit 6) will start up and the cooling operation will be performed. Here, since the operation of the sensible heat load treatment system during the cooling operation is the same as that during the above-described dehumidifying and cooling operation, a description thereof will be omitted.

On the other hand, the latent heat load treatment system of the air conditioning system 1 starts in a state in which, through the operation of air supply fan, exhaust fan, damper, etc., the outdoor air is drawn into the unit and is not passed through the adsorbent heat exchangers 22, 23, 32, 33 in the latent heat utilization units 2, 3.

Consequently, since the refrigerant and the air does not exchange heat therebetween in the adsorbent heat exchangers 22, 23, 32, 33 in the latent heat utilization units 2, 3, the compression mechanism 61 of the heat source unit 6 will not start, and the latent heat will not be treated in the latent heat load treatment system.

Then the system startup operation will be terminated after a predetermined condition is satisfied, and then shifted to a normal dehumidifying and cooling operation. For example, after a timer provided in the heat source side controller 65 indicates that a predetermined period of time (for example, about 30 minutes) elapsed since system startup, the system startup operation will be terminated, or after the temperature difference between the target temperature of the room air, which was input by the remote controls 11, 12, and the temperature of the room air to be drawn into the unit, which was detected by the RA inlet temperature sensors 45, 55, is equal to or below a predetermined temperature difference (for example, 3 degree C.), the system startup operation will be terminated.

In this air conditioning system 1, at system startup, mainly the sensible heat is treated by supplying air that has been heat-exchanged in the heat exchanger 42, 52 in the sensible heat utilization units 4, 5, and also outdoor air is prevented from passing through the adsorbent heat exchangers 22, 23, 32, 33 in the latent heat utilization units 2, 3 in order to prevent introduction of outdoor air. Accordingly, at system startup, the introduction of heat load from outdoor air can be prevented when the air conditioning capacity of the latent heat load treatment system is not operating at full capacity, and the target temperature of the room air can be quickly obtained. Consequently, in the air conditioning system 1 comprising the latent heat load treatment system having the adsorbent heat exchangers 22, 23, 32, 33 and configured to mainly treat the latent heat load in the room, and the sensible heat load treatment system having the air heat exchangers 42, 52 and configured to mainly treat the sensible heat load in the room, it will be possible to quickly cool the room at system startup. Note that, here, the case where the cooling operation is performed in the sensible heat load treatment system was described; however, this system startup method is also applicable to a case where the heating operation is performed.

Next, the second system startup operation will be described for the case where the cooling operation is performed in the sensible heat load treatment system of the air conditioning system 1, with reference to FIGS. 5 and 29.

When an operation command is issued from the remote controls 11, 12, the sensible heat load treatment system of the air conditioning system 1 (in other words, the sensible heat utilization units 4, 5 and the heat source unit 6) will start up and the cooling operation will be performed. Here, since the operation of the sensible heat load treatment system during the cooling operation is the same as described above, a description thereof will be omitted.

On the other hand, in the latent heat load treatment system of the air conditioning system 1, in a state in which the switching operation of the latent heat utilization side four-way directional control valves 21, 31 is not performed and also an air passage is switched to the same air passage as in the circulation mode by operating the damper and the like, when the air supply fan and the exhaust fan of the latent heat utilization units 2, 3 are operated, room air RA is drawn through the indoor air inlets into the unit, and is supplied as the supply air SA through the supply air outlets to the room, while outdoor air OA is drawn through the outside air inlet into the unit, and is exhausted as the exhaust air EA through the exhaust air outlets to the outside.

When such an operation is performed, immediately after system startup, the desorbed moisture is added to the outdoor air OA drawn from the outside air inlets, and is exhausted as the exhaust air EA through the exhaust air outlets to the outside, while moisture in the room air RA is adsorbed on to the adsorbent, and the room air RA is dehumidified and supplied as the supply air SA through the supply air outlets to the room. However, after some period of time elapsed since system startup, as shown in FIG. 5, the adsorbent of the adsorbent heat exchangers 22, 23, 32, 33 will have adsorbed an amount of moisture close to the maximum moisture adsorption capacity, and after which the sensible heat treatment will be mainly performed. As a result, the latent heat load treatment system will be caused to function as a system to treat the sensible heat load. Accordingly, the sensible heat treatment in the room can be facilitated by increasing the sensible heat treatment capacity in the air conditioning system 1 as a whole.

Then the system startup operation will be terminated after a predetermined condition is satisfied, and then shifted to a normal dehumidifying and cooling operation. For example, after a timer provided in a heat source side controller 265 indicates that a predetermined period of time (for example, about 30 minutes) elapsed from system startup, the system startup operation will be terminated, or after the temperature difference between the target temperature of the room air, which was input by the remote controls 11, 12, and the temperature of the room air to be drawn into the unit, which was detected by the RA inlet temperature/humidity sensors 25, 35, is equal to or below a predetermined temperature difference (for example, 3 degree C.), the system startup operation will be terminated.

In this way, in the air conditioning system 1, at system startup, mainly the sensible heat is treated by supplying the room with air that has been heat exchanged in the air heat exchangers 42, 52 of the sensible heat utilization units 4, 5, and also in a state in which switching between the adsorption process and the regeneration process in the adsorbent heat exchangers 22, 23, 32, 33 is stopped, the sensible heat is treated by passing outdoor air through the adsorbent heat exchangers 22, 23, 32, 33 and then exhausting the air to the outside. As a result, at system startup, the sensible heat treatment in the room can be facilitated and the target temperature of the room air can be quickly obtained. Consequently, in the air conditioning system 1 comprising the latent heat load treatment system having the adsorbent heat exchangers 22, 23, 32, 33 and configured to mainly treat the latent heat load in the room, and the sensible heat load treatment system having the air heat exchangers 42, 52 and configured to mainly treat the sensible heat load in the room, it will be possible to quickly cool the room at system startup. Note that, here, the case where the cooling operation is performed in the sensible heat load treatment system was described; however, this system startup method is also applicable to a case where the heating operation is performed.

Next, the third system startup operation will be described for the case where the dehumidifying operation is performed in the full ventilation mode in the latent heat load treatment system of the air conditioning system 1 and also the cooling operation is performed in the sensible heat load treatment system of the air conditioning system 1, with reference to FIGS. 5, 20, and 21.

When an operation command is issued from the remote controls 11, 12, the sensible heat load treatment system (in other words, the sensible heat utilization units 4, 5 and the heat source unit 6) will start up and the cooling operation will be performed. Here, since the operation of the sensible heat load treatment system during the cooling operation is the same as described above, a description thereof will be omitted.

On the other hand, the latent heat load treatment system of the air conditioning system 1 is the same described above in that the dehumidifying operation is performed in the full ventilation mode; however, the switching time interval between the adsorption process and the regeneration process is set to the switching time interval D, which prioritizes the treatment of the sensible heat process, and which has a longer interval than the switching time interval C that prioritizes the treatment of the latent heat used in the normal operation. Therefore, the switching operation of the latent heat utilization side four-way directional control valves 21, 31 in the latent heat utilization units 2, 3, respectively, is performed at longer cycle than that during the normal operation only at the time of system startup. Consequently, in a period immediately after the latent heat utilization side four-way directional control valves 21, 31 are switched, the adsorbent heat exchangers 22, 23, 32, 33 will mainly treat the latent heat; however, when time D elapses, mainly the sensible heat will be treated. As a result, the latent heat load treatment system will be caused to function as a system that mainly treats the sensible heat load. Accordingly, the sensible heat treatment in the room can be facilitated by increasing the sensible heat treatment capacity in the air conditioning system 1 as a whole.

Then the system startup operation will be terminated after a predetermined condition is satisfied, and then a normal dehumidifying and cooling operation will be initiated. For example, after a timer provided in the heat source side controller 65 indicates that a predetermined period of time (for example, about 30 minutes) elapsed since system startup, the system startup operation will be terminated, or after the temperature difference between the target temperature of the room air, which was input by the remote controls 11, 12, and the temperature of the room air to be drawn into the unit, which was detected by the RA inlet temperature/humidity sensors 25, 35, is equal to or below a predetermined temperature difference (for example, 3 degree C.), the system startup operation will be terminated.

In this way, in this air conditioning system 1, at system startup, the switching time interval in the adsorbent heat exchangers 22, 23, 32, 33 in the latent heat utilization units 2, 3 is made longer than that during normal operation, and mainly the sensible heat is treated. As a result, the target temperature of the room air can be quickly obtained. Consequently, in the air conditioning system 1 comprising the latent heat load treatment system having the adsorbent heat exchangers 22, 23, 32, 33 and configured to mainly treat the latent heat load in the room, and the sensible heat load treatment system having the air heat exchangers 42, 52 and configured to mainly treat the sensible heat load in the room, it will be possible to quickly cool the room at system startup. Note that, here, the case where the cooling operation is performed in the sensible heat load treatment system was described; however, this system startup method is also applicable to a case where the heating operation is performed. In addition, here, the case where the latent heat load treatment system is operated in the full ventilation mode was described; however, this system startup method can be applied to a case where the system is operated in a different mode such as the circulation mode or the air supply mode.

When the above-described system startup of the air conditioning system 1 is performed, which preferentially treats the sensible heat load in the room, there is a case where, for example, the temperature of the room air at system startup is close to the target temperature of the room air. In such a case, the above-described system startup does not need to be performed, so that the system startup operation can be omitted and then the normal operation will be initiated.

Therefore, this air conditioning system 1 is configured such that, at system startup, whether or not the temperature difference between the target temperature of the room air and the temperature of the room air is equal to or below a predetermined temperature difference (for example, the same temperature difference as a condition to terminate the system startup operation) will be determined before starting the above-described operation that preferentially treats the sensible heat load in the room, and when the temperature difference between the target temperature of the room air and the temperature of the room air is equal to or below a predetermined temperature, the system startup operation is prevented from being performed.

Accordingly, in the air conditioning system 1, at system startup, the operation in which the latent heat load in the room is preferentially treated is prevented from being unnecessarily performed, and therefore the normal operation in which the latent heat load and the sensible heat load in the room are treated can be initiated as soon as possible.

(3) Characteristics of the Air Conditioning System

The air conditioning system 1 of the present embodiment has the following characteristics.

(A)

In the air conditioning system 1 of the present embodiment, the latent heat utilization side refrigerant circuits 10*a*, 10*b* having the adsorbent heat exchangers 22, 23, 32, 33, and the sensible heat utilization side refrigerant circuits 10*c*, 10*d* having the air heat exchangers 42, 52 are both connected to the heat source side refrigerant circuit 10*e*, thus constituting the latent heat load treatment system that mainly treat the latent heat load in the room, and the sensible heat load treatment system that mainly treat the sensible heat load in the room. Specifically, in this air conditioning system 1, the latent heat load that must be treated in the air conditioning system as a whole (in other words, the required latent heat treatment capacity), and the sensible heat load that must treated in the air conditioning system 1 as a whole (in other words, the required sensible heat treatment capacity) are treated by using the latent heat load treatment system and the sensible heat load treatment system which comprise the latent heat utilization side refrigerant circuits 10*a*, 10*b*, the sensible heat utilization side refrigerant circuits 10*c*, 10*d*, and the heat source side refrigerant circuit 10*e*. In other words, all of the latent heat utilization side refrigerant circuits 10*a*, 10*b* and the sensible heat utilization side refrigerant circuits 10*c*, 10*d* are collected together as one heat source. Consequently, it is possible to prevent an increase in cost and an increase in the number of parts to be maintained, which arise when a plurality of air conditioners that use the adsorbent heat exchangers are installed or when the air conditioner that uses the adsorbent heat exchanger is installed along with the air conditioner comprising the air heat exchanger.

(B)

Further, the air conditioning system 1 of the present embodiment constitutes the latent heat load treatment system in which the latent heat utilization side refrigerant circuits 10*a*, 10*b* are connected to the discharge side and the inlet side of the compression mechanism 61 in the heat source side refrigerant circuit 10*e* through the discharge gas connection pipe 8 and the inlet gas connection pipe 9. Accordingly, by causing the adsorbent heat exchangers 22, 23, 32, 33 to function as evaporators or condensers, it is possible to perform dehumidification or humidification depending on the needs of each air-conditioned room, for example, dehumidifying an air-conditioned room while humidifying a different air-conditioned room.

(C)

Further, the air conditioning system 1 of the present embodiment comprises the sensible heat load treatment system in which the sensible heat utilization side refrigerant circuits 10*c*, 10*d* are connected to the liquid side of the heat source side heat exchanger 63 in the heat source side refrigerant circuit 10*e* through the liquid connection pipe 7, and also connected to the discharge side and the inlet side of the compression mechanism 61 through the discharge gas connection pipe 8 and the inlet gas connection pipe 9, and further the connection with the discharge side and the inlet side of the compression mechanism 61 is switchable therebetween by the air conditioning switching valves 71, 81 of the connection units 14, 15 which function as the switching mechanisms. Accordingly, by switching the switching valves 71, 81 to establish a connection through the discharge gas connection pipe 8, the air heat exchangers 42, 52 can be caused to function as condensers so as to heat the room, and by switching the switching valves 71, 81 to establish a connection through the inlet gas connection pipe 9, the air heat exchangers 42, 52 can be caused to function as evaporators so as to cool the room. Further, by causing the air heat exchangers 42, 52 to function as evaporators or condensers in each of the plurality of sensible heat utilization side refrigerant circuits 10*c*, 10*d*, it is possible to configure so-called simultaneous cooling and heating air conditioning system in which cooling and heating are simultaneously performed depending on the needs of each air-conditioned room, for example, cooling an air-conditioned room while heating a different air-conditioned room.

(D)

In the air conditioning system 1 of the present embodiment, the treatment capacity of the latent heat load treatment system and the treatment capacity of the sensible heat load treatment system are increased or decreased by mainly controlling the operational capacity of the compression mechanism 61. In this air conditioning system 1, the required latent heat treatment capacity value $\Delta h$ and the required sensible heat treatment capacity value $\Delta T$ are calculated, and the operational capacity of the compression mechanism 61 is controlled based on these calculated values, so that it is possible to treat the latent heat load in the latent heat load treatment system having the adsorbent heat exchangers 22, 23, 32, 33, while treating the sensible heat load in the sensible heat load treatment system having the air heat exchangers 42, 52 at the same time. Consequently, even when the latent heat load treatment system and the sensible heat load treatment system share a heat source, the operational capacity of the compression mechanism that constitutes the heat source can be controlled in a satisfactory manner.

In addition, in the air conditioning system 1, the target evaporation temperature and the target condensation temperature of the entire system are calculated based on the required latent heat treatment capacity value $\Delta h$ and the required sensible heat treatment capacity value $\Delta T$. Also, the evaporation temperature that corresponds to the evaporation temperature of the entire system is calculated based on the inlet pressure of the compression mechanism 61, and the condensation temperature that corresponds to the condensation temperature of the entire system is calculated based on the discharge pressure of the compression mechanism. Further, the temperature differences between these calculated values and the target evaporation temperature and the target condensation temperature are calculated, and then based on these temperature differences, the operational capacity of the compression mechanism that constitute the heat source is controlled.

(E)

In the air conditioning system 1 of the present embodiment, for example, when the required sensible heat treatment capacity value $\Delta T$ is high and the sensible heat treatment capacity in the sensible heat utilization side refrigerant circuits 10*c*, 10*d* needs to be increased, and also the required latent heat treatment capacity value $\Delta h$ is low and the latent heat treatment capacity in the latent heat utilization side refrigerant circuits 10*a*, 10*b* needs to be decreased, the switching time interval between the adsorption process and the regeneration process in the adsorbent heat exchangers 22, 23, 32, 33 is made longer so as to increase the sensible heat treatment capacity ratio in the adsorbent heat exchangers 22, 23, 32, 33 in order to increase the sensible heat treatment capacity in the latent heat load treatment system.

In addition, in this air conditioning system 1, when the required latent heat treatment capacity value $\Delta h$ is high and the latent heat treatment capacity in the latent heat utilization side refrigerant circuits 10*a*, 10*b* needs to be increased, the switching time interval between the adsorption process and the regeneration process in the adsorbent heat exchangers 22, 23, 32, 33 is made shorter so as to reduce the sensible heat treatment capacity ratio in the adsorbent heat exchangers 22, 23, 32, 33 in order to increase the latent heat treatment capacity in the latent heat load treatment system.

In this way, this air conditioning system can change the sensible heat treatment capacity ratio in the adsorbent heat exchangers 22, 23, 32, 33 by changing the switching time interval between the adsorption process and the regeneration process in the adsorbent heat exchangers 22, 23, 32, 33, without increasing the operational capacity of the compression mechanism, so that there is no inefficiency in this air conditioning as a whole and thus an efficient operation is achieved.

(F)

In this air conditioning system 1 of the present embodiment, at system startup, mainly the sensible heat is treated by supplying air that has been heat-exchanged in the heat exchanger 42, 52 in the sensible heat utilization units 4, 5, and also outdoor air is prevented from passing through the adsorbent heat exchangers 22, 23, 32, 33 in the latent heat utilization units 2, 3 in order to prevent introduction of outdoor air. Accordingly, at system startup, the introduction of heat load from outdoor air can be prevented when the air conditioning capacity of the latent heat load treatment system is not operating at full capacity, and the target temperature of the room air can be quickly obtained. Consequently, in the air conditioning system 1 comprising the latent heat load treatment system having the adsorbent heat exchangers 22, 23, 32, 33 and configured to mainly treat the latent heat load in the room, and the sensible heat load treatment system having the air heat exchangers 42, 42 and configured to mainly treat the sensible heat load in the room, it will be possible to quickly cool and heat the room at system startup.

In addition, in the air conditioning system 1 of the present embodiment, at system startup, mainly the sensible heat is treated by supplying the room with air that has been heat exchanged in the air heat exchangers 42, 52 of the sensible heat utilization units 4, 5, and also in a state in which switching between the adsorption process and the regeneration process in the adsorbent heat exchangers 22, 23, 32, 33 is stopped, the sensible heat is treated by passing outdoor air through the adsorbent heat exchangers 22, 23, 32, 33 and then exhausting the air to the outside. As a result, at system startup, the sensible heat treatment in the room can be facilitated and the target temperature of the room air can be quickly obtained. Consequently, in the air conditioning system 1 comprising the latent heat load treatment system having the adsorbent heat exchangers 22, 23, 32, 33 and configured to mainly treat the latent heat load in the room, and the sensible heat load treatment system having the air heat exchangers 42, 42 and configured to mainly treat the sensible heat load in the room, it will be possible to quickly cool and heat the room at system startup.

In addition, in the air conditioning system 1 of the present embodiment, at system startup, the switching time interval in the adsorbent heat exchangers 22, 23, 32, 33 in the latent heat utilization units 2, 3 is made longer than that during normal operation, and mainly the sensible heat is treated. As a result, the target temperature of the room air can be quickly obtained. Consequently, in the air conditioning system 1 comprising the latent heat load treatment system having the adsorbent heat exchangers 22, 23, 32, 33 and configured to mainly treat the latent heat load in the room, and the sensible heat load treatment system having the air heat exchangers 42, 42 and configured to mainly treat the sensible heat load in the room, it will be possible to quickly cool and heat the room at system startup.

Further, these operations at system startup are terminated after a period of time enough to treat the sensible heat elapsed since the system startup, or are terminated after the difference between the target temperature of the room air and the temperature of the room air is equal to or below a predetermined temperature difference, and therefore the normal operation in which the latent heat load and the sensible heat load in the room are treated can be initiated as soon as possible.

In addition, before starting these operations at system startup, the air conditioning system determines whether or not it is necessary to start such operations based on the outdoor air temperature. Accordingly, at system startup, the operation in which the sensible heat load in the room is preferentially treated is prevented from being unnecessarily performed, and therefore the normal operation in which the latent heat load and the sensible heat load in the room are treated can be initiated as soon as possible.

(4) Modified Example 1

Figure 30:
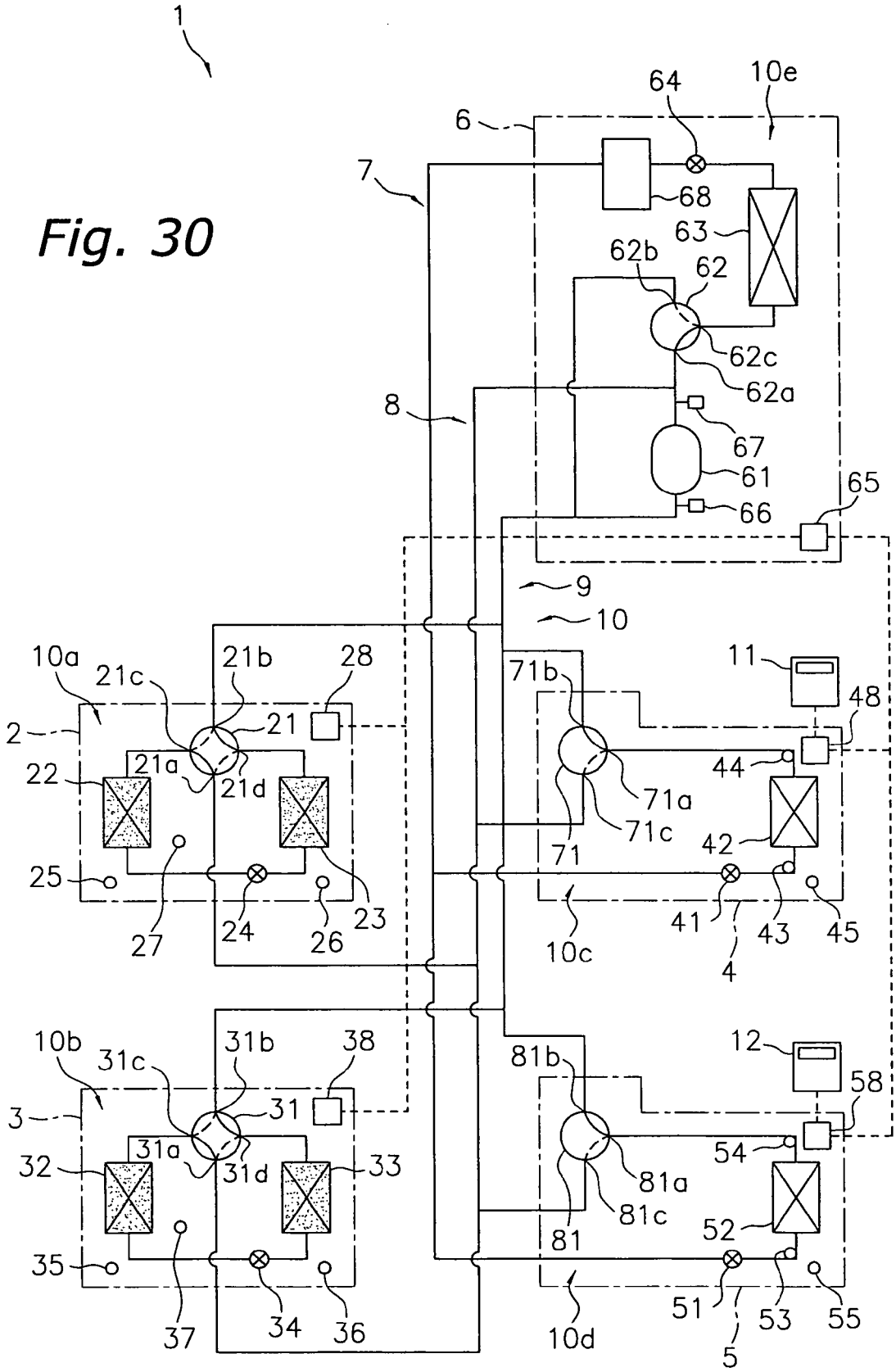
FIG. 30 is a schematic diagram of a refrigerant circuit of an air conditioning system according to a modified example 1 of the first embodiment.

In the air conditioning system 1 of the above-described embodiment, the sensible heat utilization units 4, 5 that constitute the sensible heat load treatment system are different units from the connection units 14, 15; however, as in the modified example shown in FIG. 30, the air conditioning switching valves 71, 81 of the connection units 14, 15, respectively, may be built into the sensible heat utilization units 4, 5. In this case, the connection unit controllers 72, 82 respectively provided in the connection units 14, 15 will be omitted, and the sensible heat utilization side controllers 48, 58 will respectively include the function of the connection unit controllers 72, 82.

(5) Modified Example 2

Figure 31:
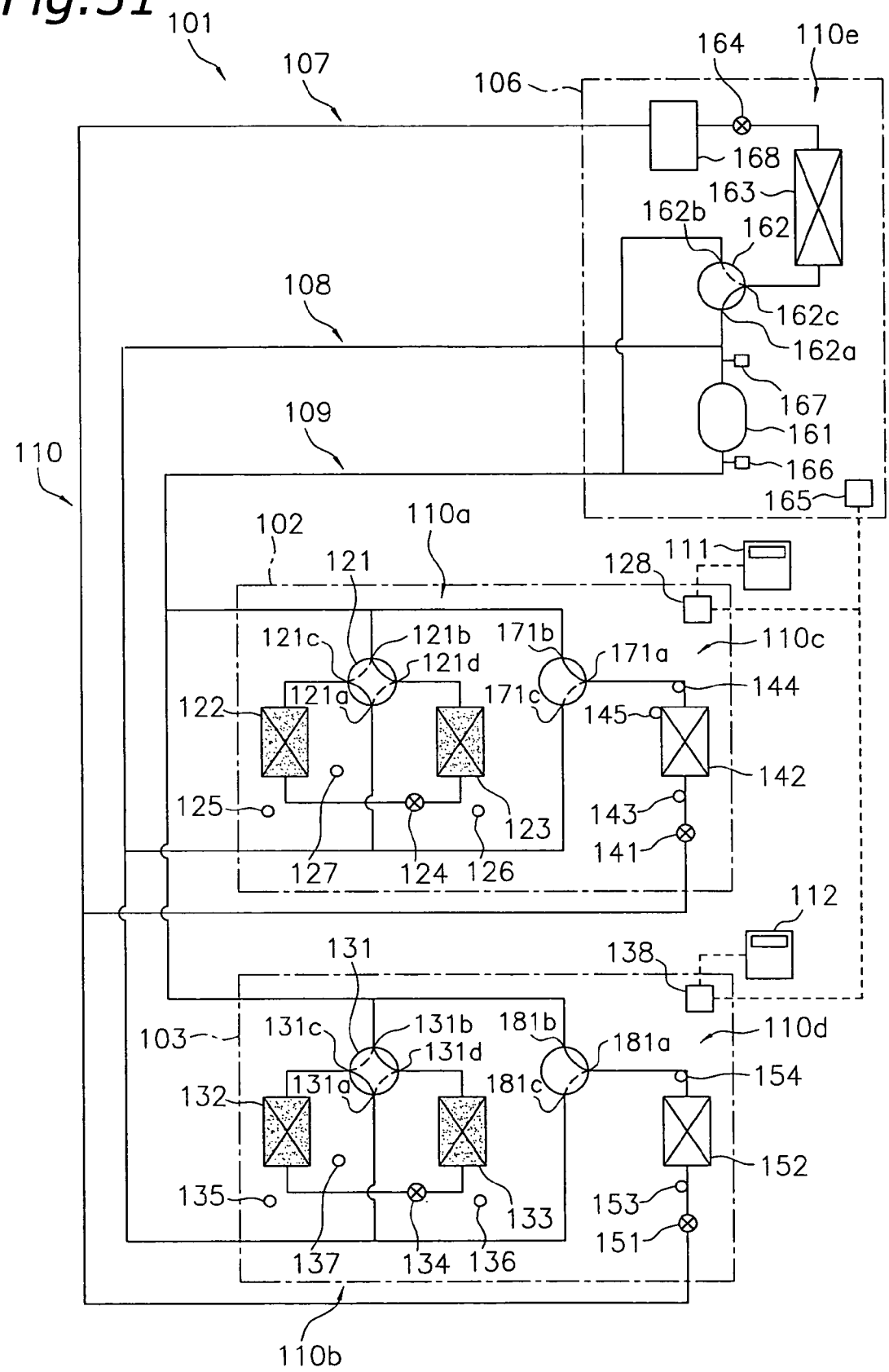
FIG. 31 is a schematic diagram of a refrigerant circuit of an air conditioning system according to a modified example 2 of the first embodiment.

In the air conditioning system 1 in the above-described embodiment, the latent heat utilization side refrigerant circuits 10*a*, 10*b* that constitute the latent heat load treatment system are respectively built into the latent heat utilization units 2, 3; the sensible heat utilization side refrigerant circuits 10*c*, 10*d* that constitute the sensible heat load treatment system are respectively built into the sensible heat utilization units 4, 5 and the connection units 14, 15; and the latent heat utilization units 2, 3, the sensible heat utilization units 4, 5, and the connection units 14, 15 are installed separately. However, as in an air conditioning system 101 of the modified example shown in FIG. 31, latent heat utilization side refrigerant circuits 110*a*, 110*b* that constitute the latent heat load treatment system, and sensible heat utilization side refrigerant circuits 110*c*, 110*d* that constitute the sensible heat load treatment system may constitute integrated utilization units 102, 103.

In this way, as in air conditioning system 1 in the above-described embodiment, reduction in the size of the unit and laborsaving installation of the unit can be achieved, compared to the case where the latent heat utilization units 2, 3 respectively comprising the latent heat utilization side refrigerant circuits 10*a*, 10*b*, the sensible heat utilization units 4, 5 respectively comprising the sensible heat utilization side refrigerant circuits 10*c*, 10*d* and the connection units 14, 15 are separately installed in the building. In this case, the RA inlet temperature sensors 45, 55, the sensible heat utilization side controllers 48, 58 and the connection unit controllers 72, 82 provided in the sensible heat utilization units 4, 5 and the connection units 14, 15 of the air conditioning system 1 in the above-described embodiment will be omitted, and latent heat utilization side controllers 128, 138 will include the functions of the sensible heat utilization side controllers 48, 58 and the connection unit controllers 72, 82, respectively.

In addition, as in the above-described air conditioning system 1, in this air conditioning system 101 of the modified example, it is possible to perform only the operation that supplies the room with the air that was dehumidified or humidified (specifically, the latent heat was treated) in the adsorbent heat exchangers 122, 123, 132, 133, i.e., the latent heat utilization side refrigerant circuits 110*a*, 110*b*.

Figure 32:
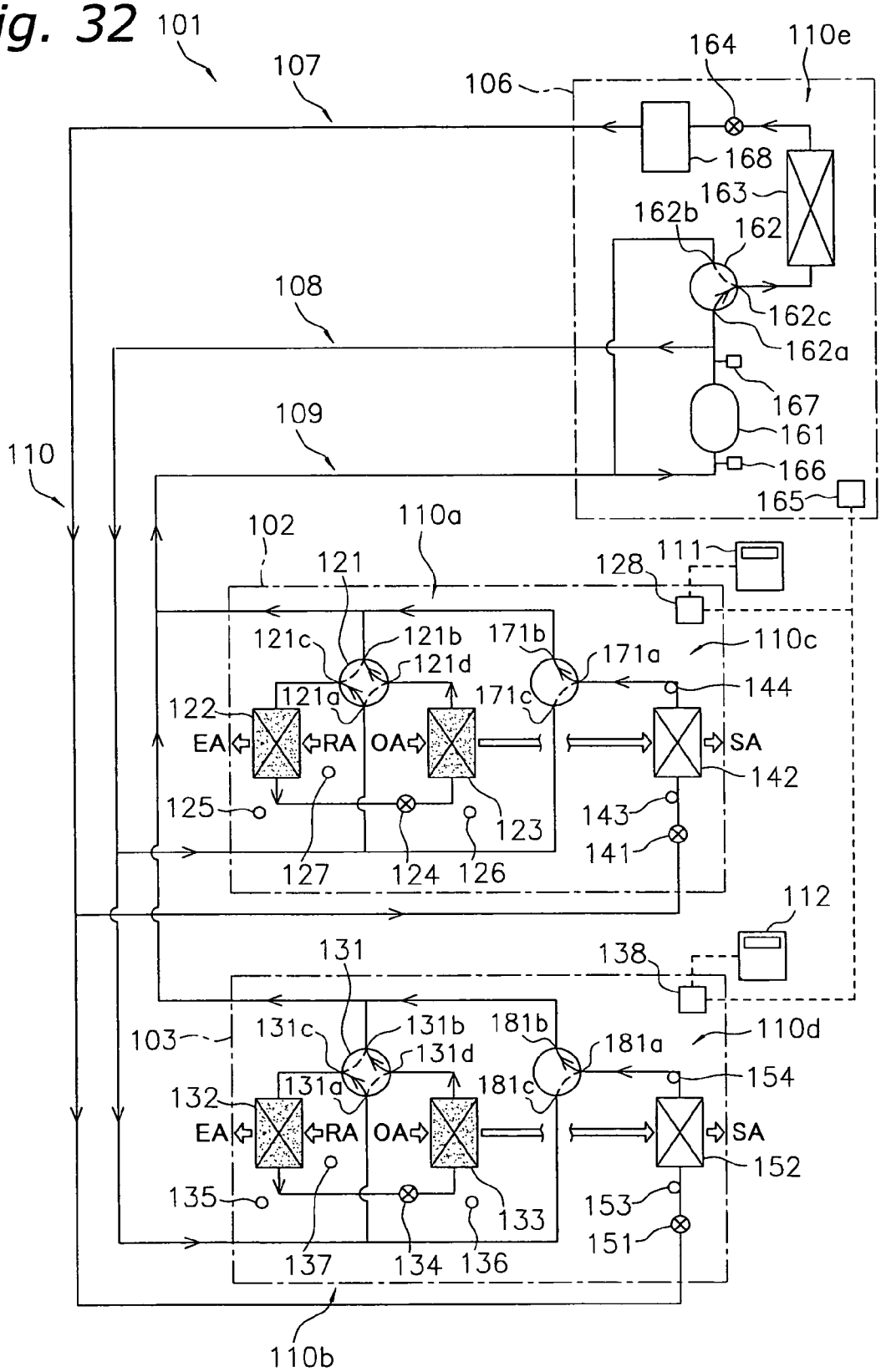
FIG. 32 is a schematic diagram of a refrigerant circuit showing the operation during the dehumidifying and cooling operation in the full ventilation mode in the air conditioning system according the modified example 2 of the first embodiment.

Further, in the air conditioning system 101 of the modified example, the latent heat utilization side refrigerant circuits 110*a*, 110*b* and the sensible heat utilization side refrigerant circuits 110*c*, 110*d* which constitute the sensible heat load treatment system are respectively built into the integrated utilization units 102, 103. Therefore, as shown in FIG. 32, the air dehumidified or humidified (specifically, the latent heat was treated) in the adsorbent heat exchangers 122, 123, 132, 133, i.e., the latent heat utilization side refrigerant circuit 110*a*, 110*b*, can be further cooled or heated (specifically, the sensible heat will be treated) (see the arrows shown on both sides of the adsorbent heat exchangers 122, 123, 132, 133 in FIG. 32). As a result, for example, even when the sensible heat load was treated to some degree when the latent heat load was treated by the adsorbent heat exchangers 122, 123, 132, 133, causing the temperature of the air to change to a temperature that is not in agreement with the target temperature of the room air, this air will not be blown out into the room the way it is. Instead, the air will be subjected to the sensible heat treatment by the air heat exchangers 142, 152 so that the temperature of the air is adjusted to be appropriate to the target temperature of the room air, and after which an operation in which air is blown out into the room will be allowed.

Note that since a refrigerant circuit 110 of the air conditioning system 101 of the present modified example and the above-described refrigerant circuit 10 of the air conditioning system 1 have the same configuration, reference numerals representing each component of the above-described air conditioning system 1 will be changed to reference numerals in 100s, and a description of each component will be omitted.

Second Embodiment

Figure 33:
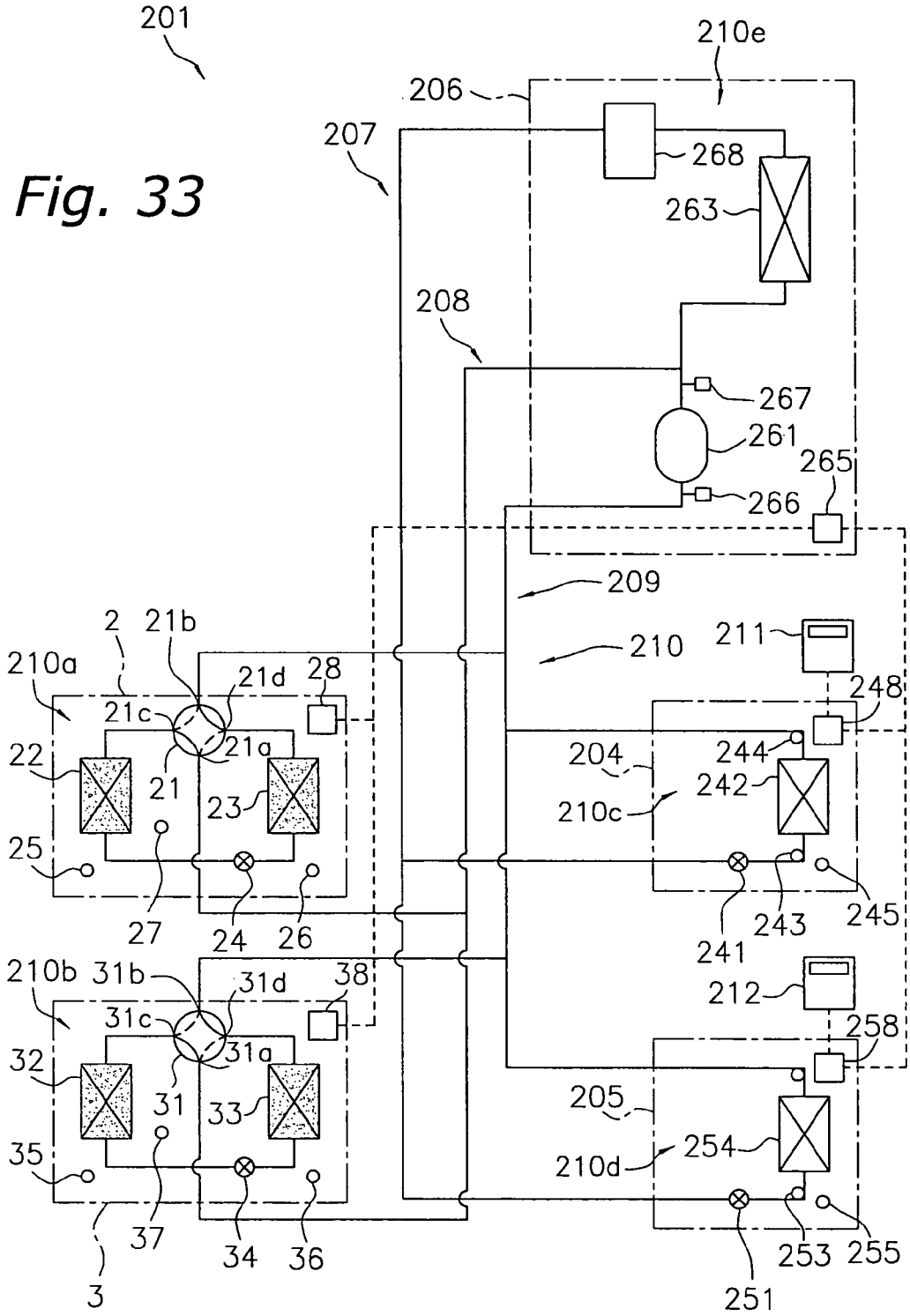
FIG. 33 is a schematic diagram of a refrigerant circuit of an air conditioning system of a second embodiment according to the present invention.

In the air conditioning system 1 of the above-described first embodiment, the sensible heat utilization side refrigerant circuits 10*c*, 10*d* are connected to the liquid connection pipe 7 that is connected to the liquid side of the heat source side heat exchanger 63 of the heat source side refrigerant circuit 10*e*, and also are switchably connected between the discharge gas connection pipe 8 and the inlet gas connection pipe 9 through the air conditioning switching valves 71, 81, and thereby, in each of the sensible heat utilization side refrigerant circuits 10*c*, 10*d*, the air heat exchangers 42, 52 can be caused to function as evaporators or condensers. As a result, an air conditioning system capable of so-called simultaneous cooling and heating operations is achieved, in which cooling and heating are simultaneously performed depending on the needs of each air-conditioned room, for example, cooling an air-conditioned room while heating a different air-conditioned room. However, as in an air conditioning system 201 of the present embodiment as shown in FIG. 33, the above-described air conditioning system 1 may be configured such that sensible heat utilization side refrigerant circuits 210*c*, 210*d* are used only for cooling the room, by connecting the sensible heat utilization side refrigerant circuits 210*c*, 210*d* to the liquid side of a heat source side heat exchanger 263 of a heat source side refrigerant circuit 210*e* through a liquid connection pipe 207 and also to the inlet side of a compression mechanism 261 of the heat source side refrigerant circuit 210*e* through an inlet gas connection pipe 209.

Note that the configuration of the air conditioning system 201 of the present embodiment is different from that of the refrigerant circuit 10 of the air conditioning system 1 of the first embodiment in that the three-way direction control valve 62 and the connection units 14, 15 in the heat source side refrigerant circuit 10*e* which are provided in the air conditioning system 1 are omitted in the air conditioning system 201; however, since the configuration of other components is the same as that of the refrigerant circuit 10 in the air conditioning system 1 of the first embodiment, reference numerals will be changed to those in 200s excepting reference numerals representing each component of the latent heat utilization side refrigerant circuit 210*a*, 210*b* of the air conditioning system 201 of the present embodiment, and a description of those other components will be omitted.

(2) Modified Example

Figure 34:
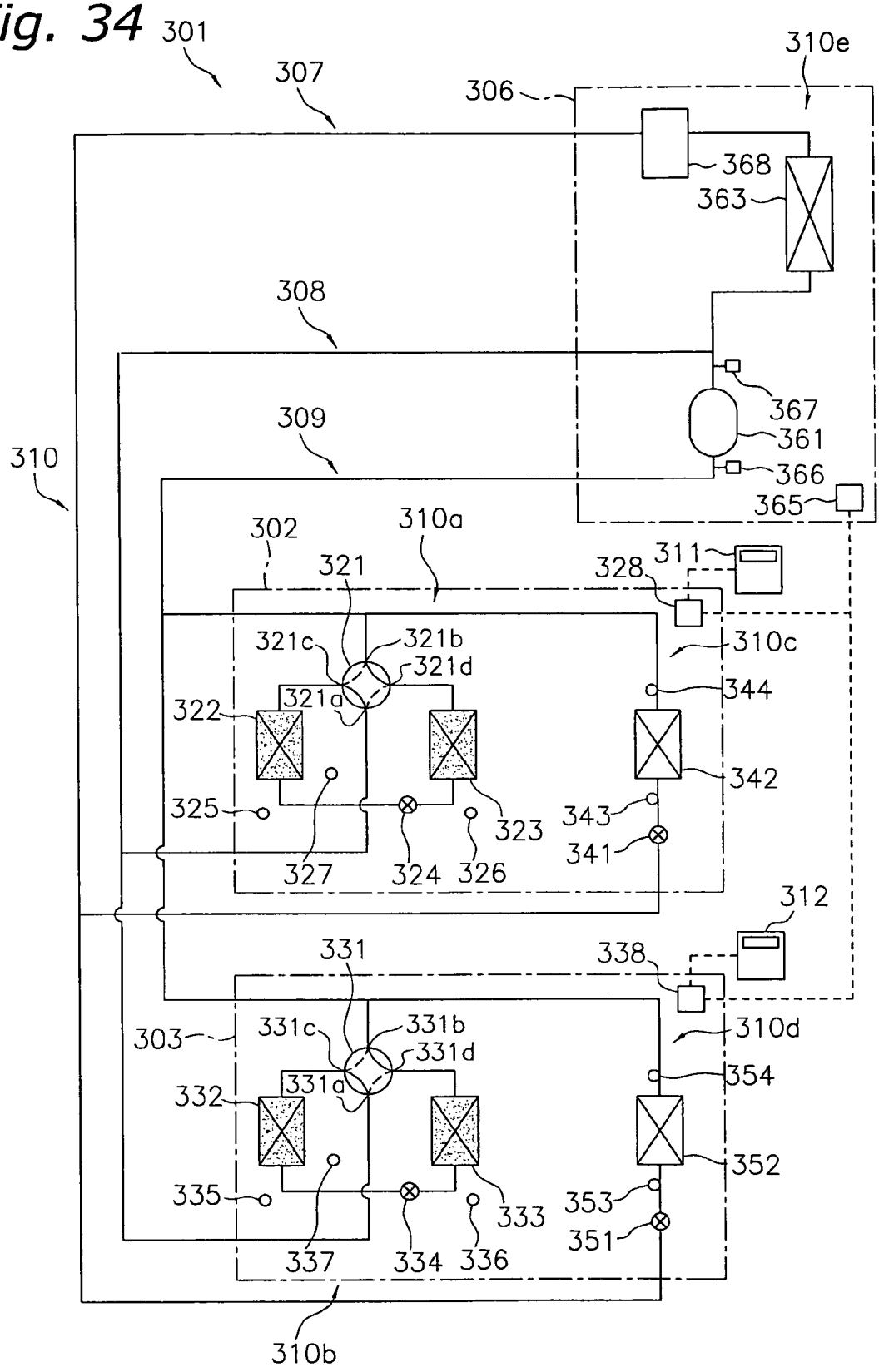
FIG. 34 is a schematic diagram of a refrigerant circuit of an air conditioning system according a modified example of the second embodiment.

In the air conditioning system 201 in the above-described second embodiment, latent heat utilization side refrigerant circuits 210*a*, 210*b* that constitute the latent heat load treatment system are respectively built into the latent heat utilization units 2, 3; sensible heat utilization side refrigerant circuits 210*c*, 210*d* that constitute the sensible heat load treatment system are respectively built into sensible heat utilization units 204, 205; and the latent heat utilization units 2, 3 and the sensible heat utilization units 204, 205 are installed separately. However, as in an air conditioning system 301 of the modified example shown in FIG. 34, latent heat utilization side refrigerant circuits 310*a*, 310*b* that constitute the latent heat load treatment system, and the sensible heat utilization side refrigerant circuits 310*c*, 310*d* that constitute the sensible heat load treatment system may constitute integrated utilization units 302, 303.

In this way, as in the air conditioning system 201 in the above-described second embodiment, reduction in the size of the unit and laborsaving installation of the unit can be achieved, compared to the case where the latent heat utilization units 2, 3 respectively comprising the latent heat utilization side refrigerant circuits 210*a*, 210*b* and the sensible heat utilization units 204, 205 respectively comprising the sensible heat utilization side refrigerant circuits 210*c*, 210*d* are separately installed in the building. In this case, RA inlet temperature sensors 245, 255 and sensible heat utilization side controllers 248, 258 provided in the sensible heat utilization units 204, 205 of the air conditioning system 201 in the above-described second embodiment will be omitted, and the latent heat utilization side controllers 328, 338 will include functions of the sensible heat utilization side controllers 248, 258, respectively.

In addition, as in the above-described air conditioning system 201, in the air conditioning system 301 of the modified example, it is possible to perform only the operation that supplied the room with the air that was dehumidified or humidified (specifically, the latent heat was treated) in the adsorbent heat exchangers 322, 323, 332, 333, i.e., the latent heat utilization side refrigerant circuits 310*a*, 310*b*.

Figure 35:
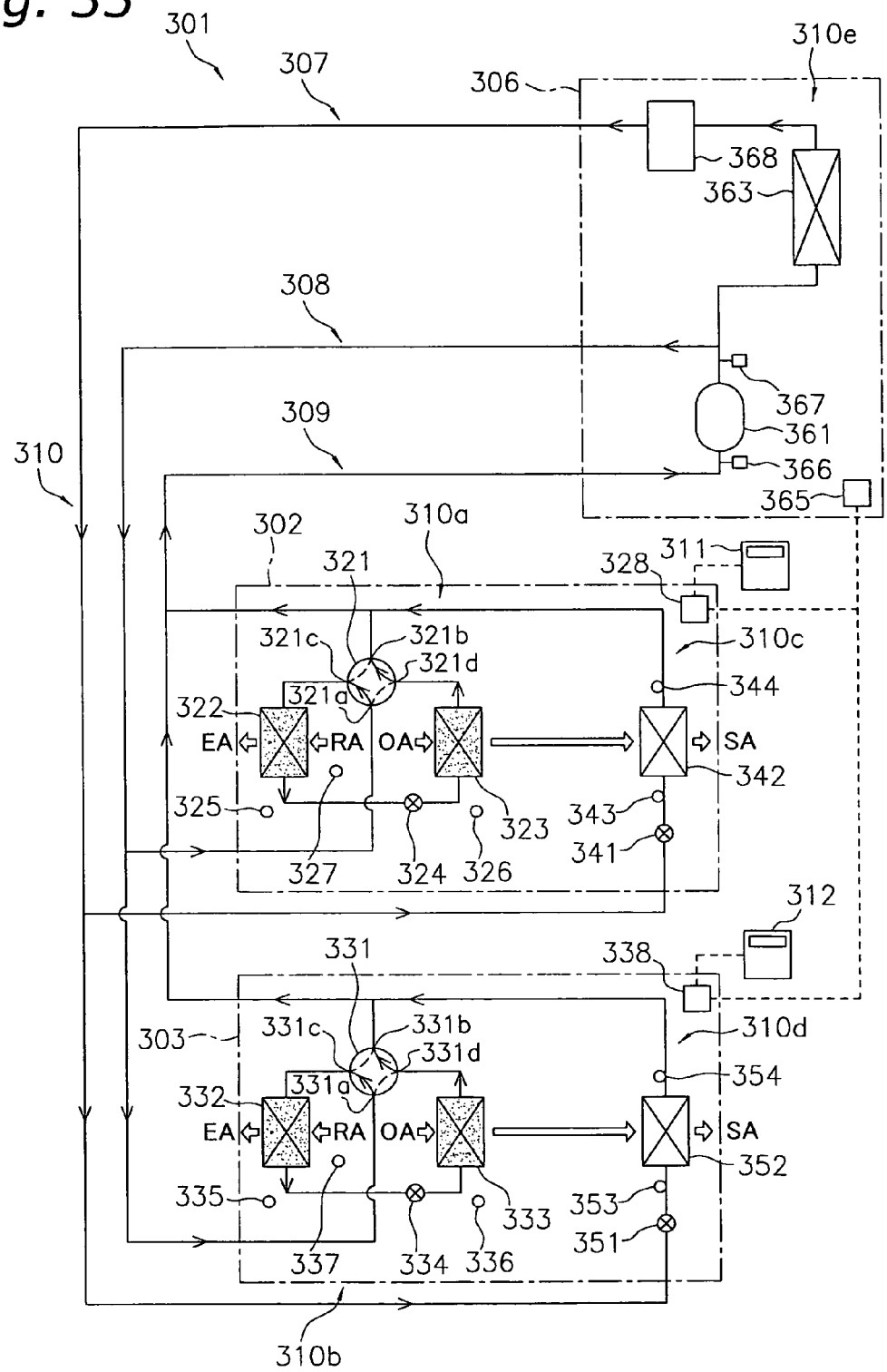
FIG. 35 is a schematic diagram of a refrigerant circuit showing the operation during the dehumidifying and cooling operation in the full ventilation mode in the air conditioning system according the modified example of the second embodiment.

Further, in the air conditioning system 301 of the modified example, the latent heat utilization side refrigerant circuits 310*a*, 310*b* and the sensible heat utilization side refrigerant circuits 310*c*, 310*d* which constitute the sensible heat load treatment system are built into the integrated utilization units 302, 303. Therefore, as shown in FIG. 35, the air dehumidified or humidified (specifically, the latent heat was treated) in the adsorbent heat exchangers 322, 323, 332, 333, i.e., the latent heat utilization side refrigerant circuit 310*a*, 310*b*, can be further cooled or heated (specifically, the sensible heat will be treated) (see the arrows shown on both sides of the adsorbent heat exchangers 322, 323, 332, 333 in FIG. 35). As a result, for example, even when the sensible heat load was treated to some degree when the latent heat load was treated by the adsorbent heat exchangers 322, 323, 332, 333, causing the temperature of the air to change to a temperature that is not in agreement with the target temperature of the room air, this air will not be blown out into the room the way it is. Instead, the air will be subjected to the sensible heat treatment by air heat exchangers 342, 352 so that the temperature of the air is adjusted to be appropriate to the target temperature of the room air, and after which an operation in which air is blown out into the room will be allowed.

Note that since the refrigerant circuit 310 of the air conditioning system 301 of the present modified example and the above-described refrigerant circuit 210 of the air conditioning system 201 have the same configuration, reference numerals representing each component of the above-described air conditioning system 201 will be changed to reference numerals in 300s, and a description of each component will be omitted.

Third Embodiment

(1) Configuration of the Air Conditioning System

Figure 36:
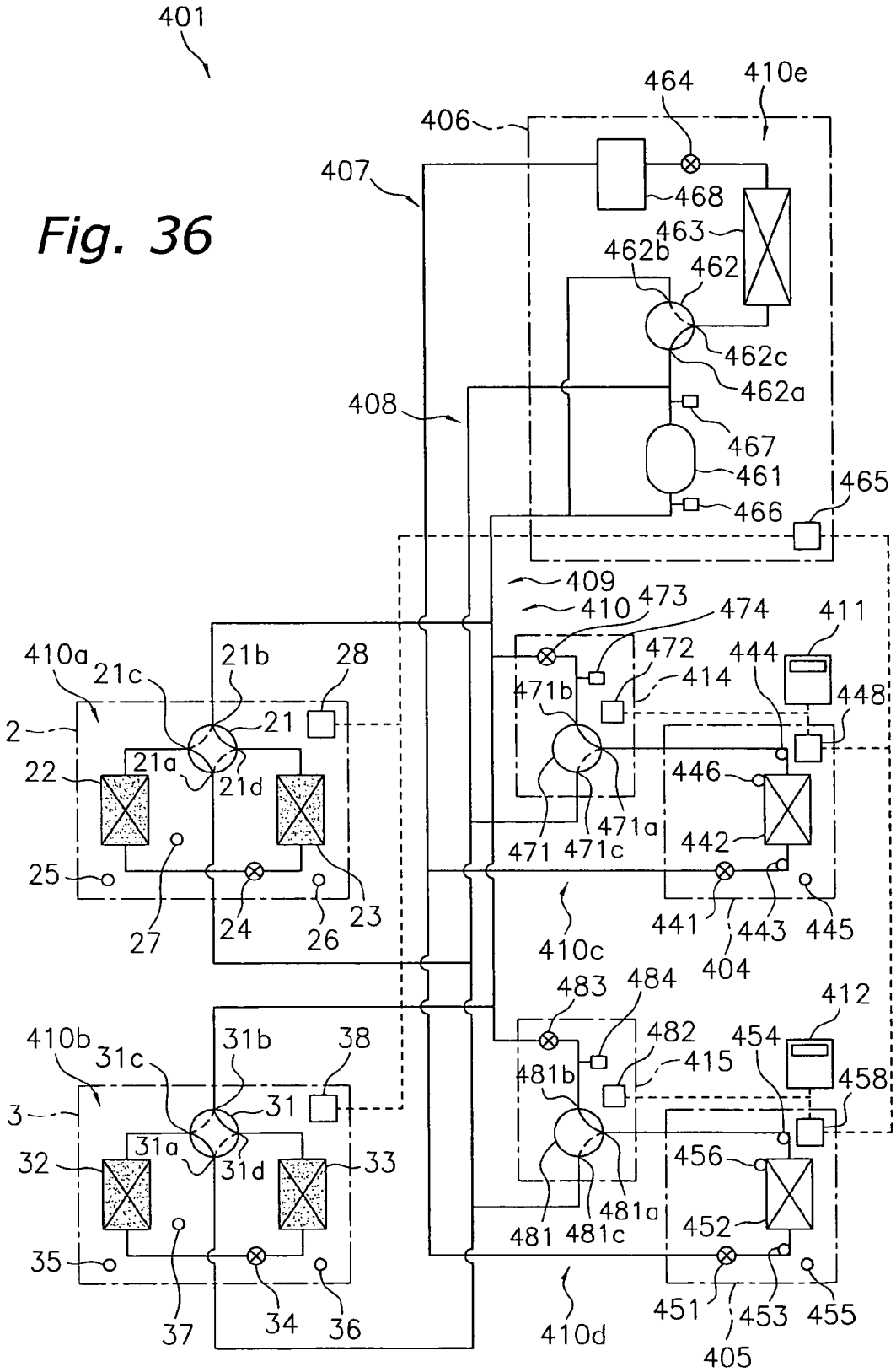
FIG. 36 is a schematic diagram of a refrigerant circuit of an air conditioning system of a third embodiment according to the present invention.

FIG. 36 a schematic diagram of a refrigerant circuit of an air conditioning system 401 of a third embodiment according to the present invention. The air conditioning system 401 is an air conditioning system that treats the latent heat load and the sensible heat load in the room of a building and the like by operating a vapor compression type refrigeration cycle. The air conditioning system 401 is a separate type multi air conditioning system, and mainly comprises a plurality (two in this embodiment) of latent heat utilization units 2, 3 connected in parallel with one another, a plurality (two in this embodiment) of sensible heat utilization units 404, 405 connected in parallel with one another, a heat source unit 406, and connection pipes 407, 408, 409 which connect the latent heat utilization units 2, 3 and the sensible heat utilization units 404, 405 to the heat source unit 406. In the present embodiment, the heat source unit 406 functions as a heat source that is shared between the latent heat utilization units 2, 3 and the sensible heat utilization units 404, 405.

Since the configurations of the latent heat utilization units 2, 3 is the same as that of the latent heat utilization units 2, 3 of the first embodiment, a description of each component thereof will be omitted.

The sensible heat utilization units 404, 405 are different from the sensible heat utilization units 4, 5 of the first embodiment in that condensation sensors 446, 456 and RA inlet temperature/humidity sensors 445, 455 are provided in the sensible heat utilization units 404, 405; however, since the configuration of other components is the same as that in the sensible heat utilization units 4, 5 of the first embodiment, all reference numerals representing each component of the sensible heat utilization units 4, 5 of the first embodiment will be simply changed to those in 400s, and a description of those other components will be omitted.

The condensation sensors 446, 456 are provided to function as condensation detection mechanisms that detect the presence of condensation in air heat exchangers 442, 452, respectively. Note that in the embodiment, the condensation sensors 446, 456 are used; however, it is not limited thereto and a float switch may be used instead of a condensation sensor, as long as a function as a condensation detection mechanism is ensured.

The RA Inlet temperature/humidity sensors 445, 455 are temperature/humidity sensors that detect the temperature and the relative humidity of the room air RA to be drawn into the units.

Since the heat source unit 406 and the heat source unit 6 of the first embodiment have the same configuration, all reference numerals representing each component of the heat source unit 6 of the first embodiment will be simply changed to reference numerals in 400s, and a description of each component will be omitted.

In addition, as in the sensible heat utilization units 4, 5 of the first embodiment, as for the sensible heat utilization units 404, 405, the gas side of the air heat exchangers 442, 452 are switchably connected to the discharge gas connection pipe 408 and the inlet gas connection pipe 409 through connection units 414, 415. The connection unit 414, 415 mainly comprises: air conditioning switching valves 471, 481; evaporation pressure control valves 473, 483; evaporation pressure sensors 474, 484; and connection unit controllers 472, 482 that controls the operation of each component that constitutes the connection units 414, 415. Here, since the air conditioning switching valves 471, 481 and the connection unit controllers 472, 482 are the same as the air conditioning switching valves 71, 81 and the connection unit controllers 72, 82 of the first embodiment, a description thereof will be omitted. The evaporation pressure control valves 473, 483 are electric expansion valves that are provided to function as a pressure control mechanism that controls the evaporation pressure of the refrigerant in the air heat exchangers 442, 452, when the air heat exchangers 442, 452 of the sensible heat utilization units 404, 405 are caused to function as evaporators that evaporate the refrigerant. The evaporation pressure sensors 474, 484 are pressure sensors that are provided to function as pressure detection mechanisms that detect the pressure of the refrigerant in the air heat exchangers 442, 452, respectively.

In addition, as described below, the sensible heat utilization units 404, 405 of the present embodiment are controlled such that a cooling operation is performed so as to prevent the generation of condensation in the air heat exchangers 442, 452 when performing the dehumidifying and cooling operation. In other words, the sensible heat utilization units 404, 405 are controlled so as to perform the sensible heat cooling operation. Accordingly, a drain pipe is not connected to the sensible heat utilization units 404, 405.

Further, as described above, the latent heat utilization units 2, 3 used in the latent heat load treatment system of the air conditioning system 401 can treat the latent heat through the adsorption process and the regeneration process in the adsorbent heat exchangers 22, 23, 32, 33, so that a drain pipe is not connected, as in the case of the sensible heat utilization units 404, 405. In other words, a drainless system is achieved in the entire air conditioning system 401 of the present embodiment.

(2) Operation of the Air Conditioning System

Next, the operation of the air conditioning system 401 of the present embodiment will be described. The air conditioning system 401 can treat the latent heat load in the room by the latent heat load treatment system, and treat the sensible heat load in the room mainly by the sensible heat load treatment system. As in the air conditioning system 1 of the first embodiment, in the air conditioning system 401 of the present embodiment, the single operation by the latent heat load treatment system is possible. Note that since this operation is the same as that of the air conditioning system 1 of the first embodiment, a description thereof will be limited.

Next, the operation of the air conditioning system 401 when the latent heat load treatment system and the sensible heat load treatment system are simultaneously operated will be described. The air conditioning system 401 can treat the latent heat load in the room mainly by the latent heat load treatment system, and treat the sensible heat load in the room mainly by the sensible heat load treatment system. Each type of operation will be described below.

<Drainless Dehumidifying and Cooling Operation>

Figure 37:
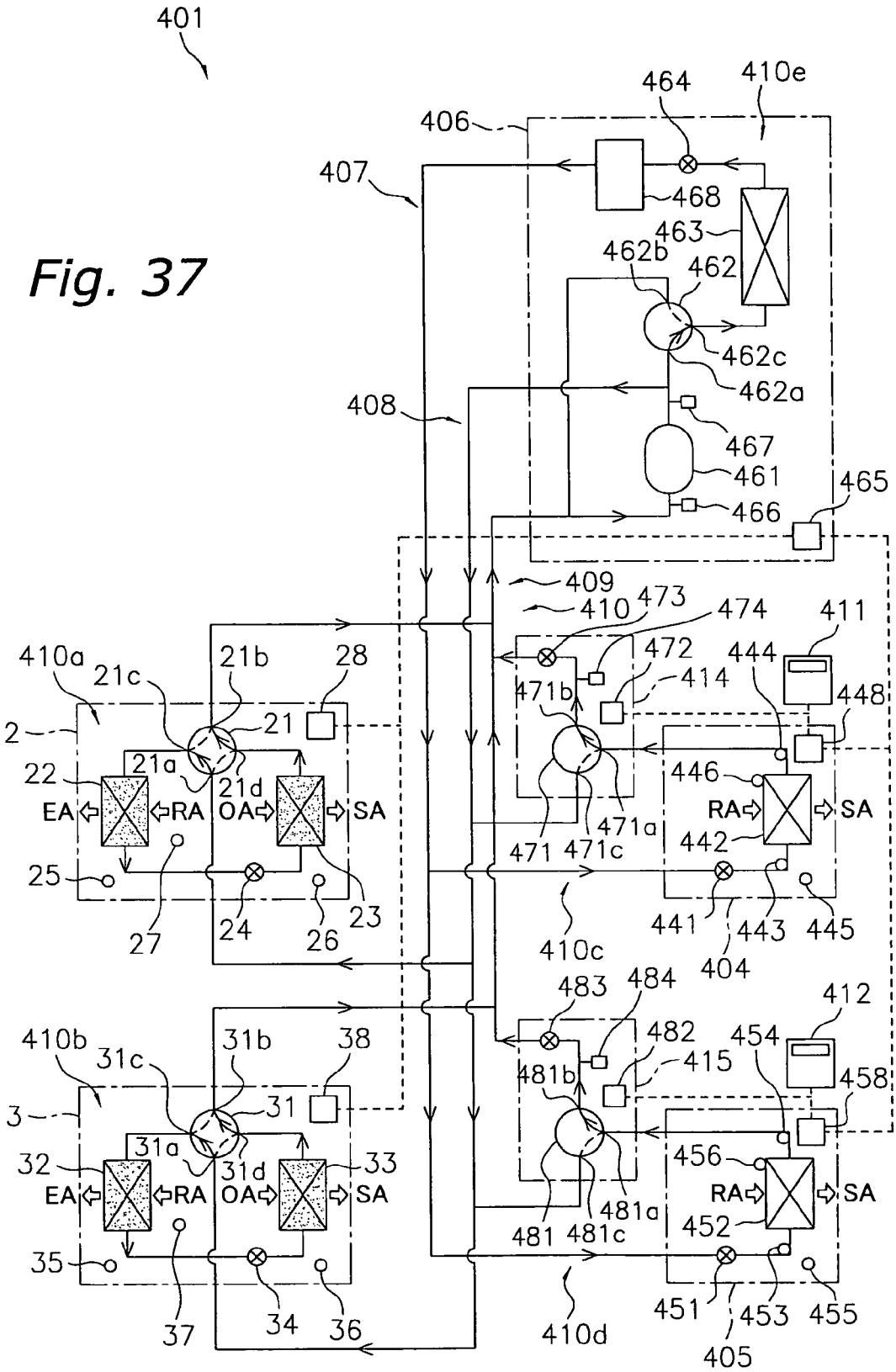
FIG. 37 is a schematic diagram of a refrigerant circuit showing the operation during a drainless dehumidifying and cooling operation in the full ventilation mode in the air conditioning system according the third embodiment.
Figure 38:
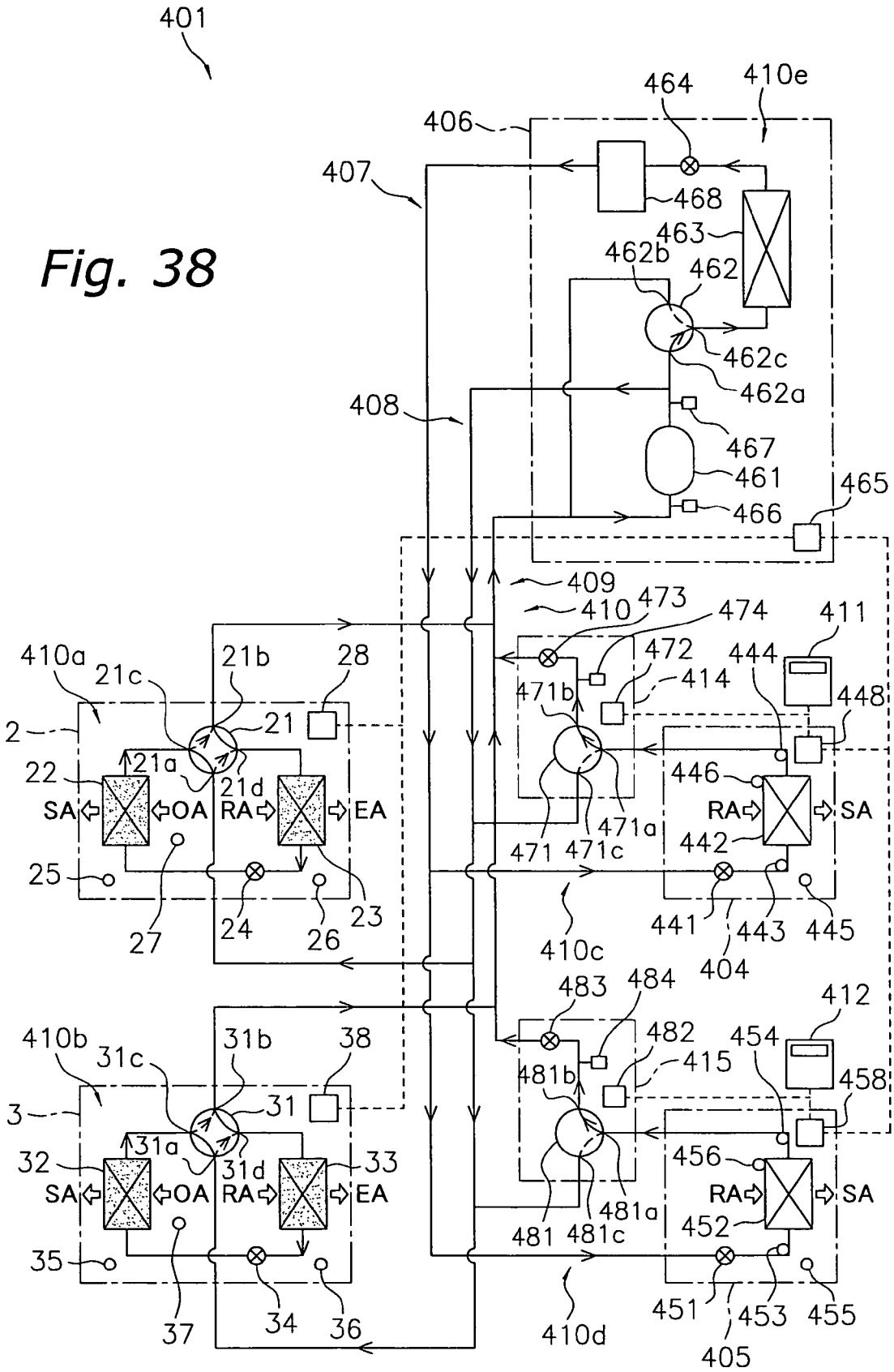
FIG. 38 is a schematic diagram of a refrigerant circuit showing the operation during the drainless dehumidifying and cooling operation in the full ventilation mode in the air conditioning system according the third embodiment.
Figure 39:
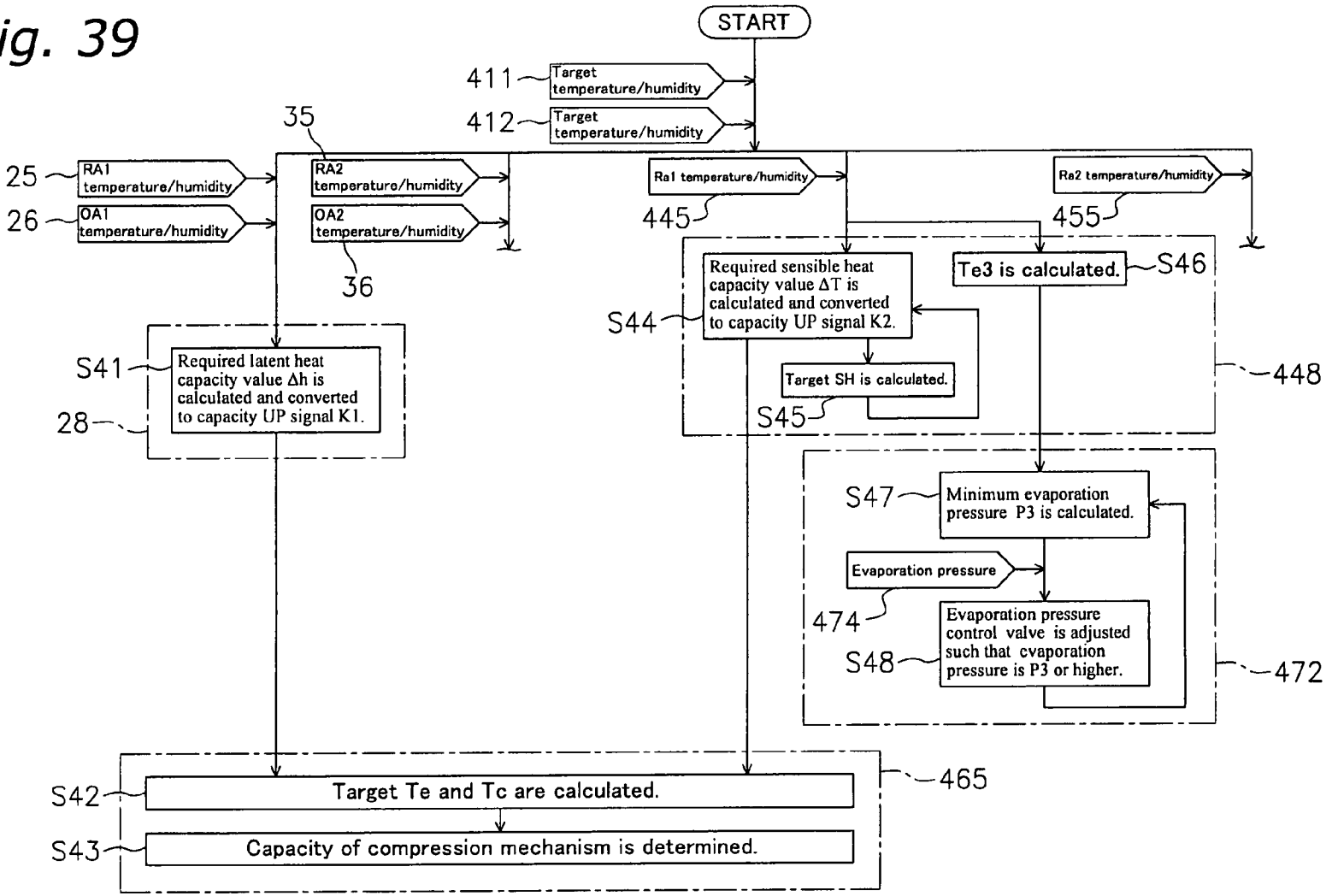
FIG. 39 is a diagram of control flow during the drainless dehumidifying and cooling operation in the air conditioning system according the third embodiment.
Figure 40:
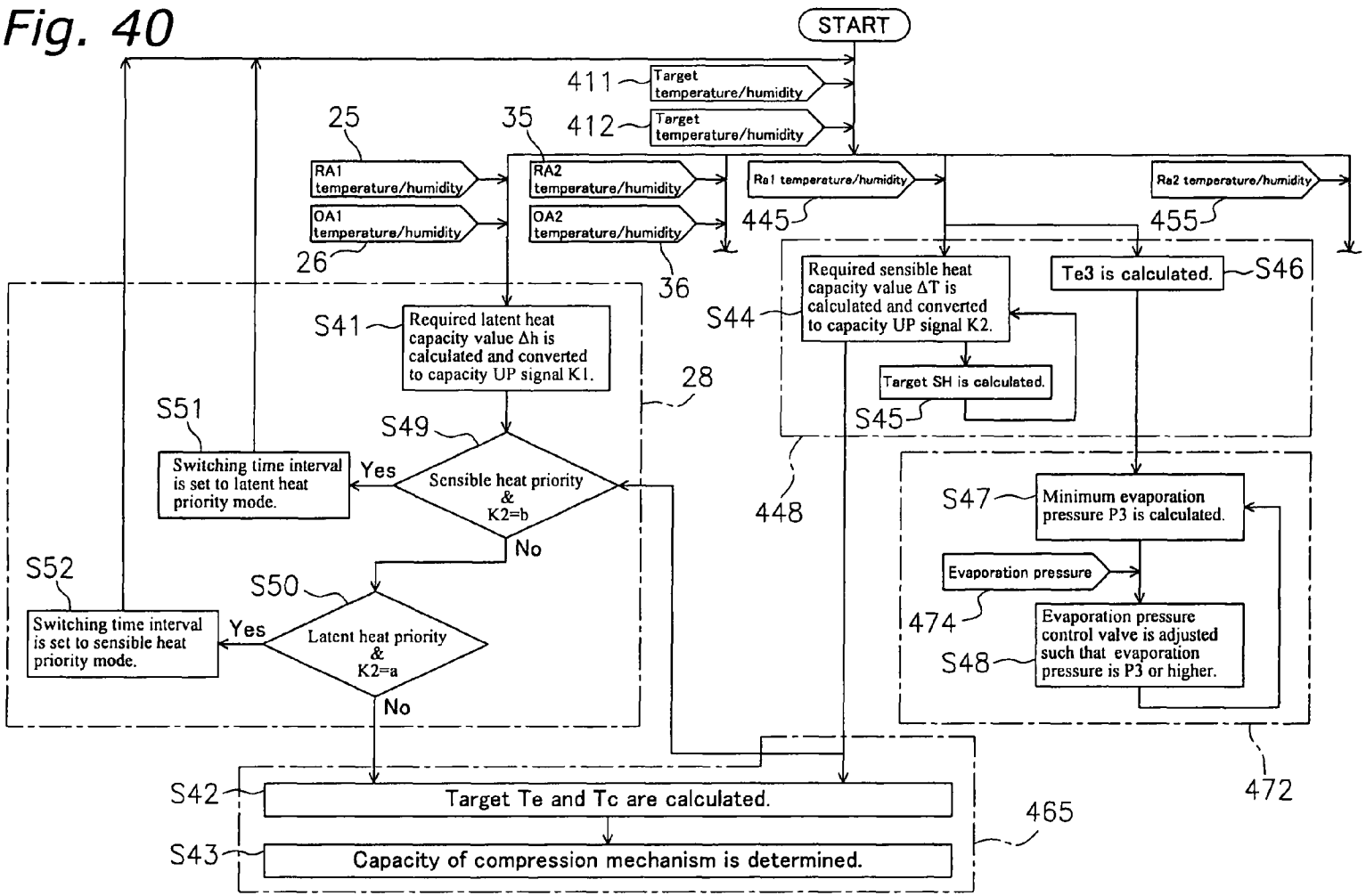
FIG. 40 is a diagram of control flow during the drainless dehumidifying and cooling operation in the air conditioning system according the third embodiment.

First, the operation of a drainless cooling operation in which the sensible heat cooling operation is performed in the sensible heat load treatment system while the dehumidifying operation is performed in a full ventilation mode in the latent heat load treatment system of the air conditioning system 401 will be described with reference to FIGS. 37, 38, 39, and 40. Here, FIGS. 37 and 38 are schematic diagrams of a refrigerant circuit showing the operation during a drainless dehumidifying and cooling operation in the full ventilation mode in the air conditioning system 401. FIG. 39 is a diagram of control flow during a first drainless dehumidifying and cooling operation in the air conditioning system 401. Also, FIG. 40 is a diagram of control flow during a second drainless dehumidifying and cooling operation in the air conditioning system 401. Note that as for FIGS. 39 and 40, since the latent heat utilization unit 2 and the sensible heat utilization unit 404 as a pair in the air conditioning system 401 have the same control flow as the latent heat utilization unit 3 and the sensible heat utilization unit 405 as a pair, so that the illustration of the control flow of the latent heat utilization unit 3 and the sensible heat utilization unit 405 as a pair is omitted.

There are two operation methods as described below, as the operation during the drainless dehumidifying and cooling operation of the air conditioning system 1. The first method of the drainless dehumidifying and cooling operation is a control method to use the evaporation pressure control valves 473, 483 of the connection units 414, 415 in order to control the evaporation pressure of the refrigerant in the air heat exchangers 442, 452 such that the evaporation pressure is equal to or higher than the minimum evaporation temperature Te3. Here, the minimum evaporation temperature Te3 is the evaporation temperature of the refrigerant that flows in the air heat exchangers 442, 452 such that condensation of air in the air heat exchangers 442, 452 is prevented, specifically, so that air in the air heat exchangers 442, 452 will be at least equal to or greater than the dew point temperature of the room air. As with the first method of the drainless dehumidifying and cooling operation, the second method of the drainless dehumidifying and cooling operation is a control method to use the evaporation pressure control valves 473, 483 of the connection units 414, 415 in order to control the evaporation pressure of the refrigerant in the air heat exchangers 442, 452 so that the evaporation pressure will be equal to or higher than the minimum evaporation temperature Te3, and simultaneously to change the switching time interval between the adsorption process and the regeneration process in the adsorbent heat exchangers 22, 32, 23, 33 of the latent heat utilization units 2, 3 that constitute the latent heat load treatment system.

First, the first operation during the drainless dehumidifying and cooling operation will be described with reference to FIGS. 37, 38, and 39.

First, the operation of the latent heat load treatment system of the air conditioning system 401 will be described. Note that, the control necessary to achieve the sensible heat cooling operation in the latent heat load treatment system will be described later; and the basic control of the sensible heat load treatment system will be described herein.

The latent heat utilization unit 2 of the latent heat load treatment system alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the latent heat utilization unit 3 alternately repeats the first operation in which the first adsorbent heat exchanger 32 functions as a condenser and the second adsorbent heat exchanger 33 functions as an evaporator, and the second operation in which the second adsorbent heat exchanger 33 functions as a condenser and the first adsorbent heat exchanger 32 functions as an evaporator.

The operation of both of the latent heat utilization units 2, 3 will be described together below.

In the first operation, the regeneration process in the first adsorbent heat exchangers 22, 32 and the adsorption process in the second adsorbent heat exchangers 23, 33 are performed in parallel. During the first operation, as shown in FIG. 37, the latent heat utilization side four-way directional control valves 21, 31 are set to a first state (see the solid lines in the latent heat utilization side four-way directional control valves 21, 31 in FIG. 37). In this state, high-pressure gas refrigerant discharged from a compression mechanism 461 flows into the first adsorbent heat exchangers 22, 32 through the discharge gas connection pipe 408 and the latent heat utilization side four-way directional control valves 21, 31, and is condensed while passing through the first adsorbent heat exchangers 22, 32. The condensed refrigerant is pressure-reduced by the latent heat utilization side expansion valves 24, 34, and is subsequently evaporated while passing through the second adsorbent heat exchangers 23, 33. Then, the refrigerant is again drawn into the compression mechanism 461 through the latent heat utilization side four-way directional control valves 21, 31 and the inlet gas connection pipe 409 (see the arrows shown on the latent heat refrigerant circuit 410 in FIG. 37). Here, unlike the case of the above-described operation performed only by the latent heat load treatment system, sensible heat utilization side expansion valves 441, 451 of the sensible heat utilization units 404, 405 are opened allowing the refrigerant flow into the air heat exchangers 442, 452 in order to perform the cooling operation, and the degree of opening of these valves is adjusted. Accordingly, a portion of high-pressure gas refrigerant compressed in and discharged from the compression mechanism 461 will be flowing in the latent heat utilization units 2, 3.

During the first operation, in the first adsorbent heat exchangers 22, 32, moisture is desorbed from the adsorbent heated by condensation of the refrigerant, and this desorbed moisture is added to the room air RA that is drawn from the indoor air inlets. The moisture desorbed from the first adsorbent heat exchangers 22, 32 is carried with the room air RA and is exhausted as the exhaust air EA through the exhaust air outlets to the outside. In the second adsorbent heat exchangers 23, 33, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the second adsorbent heat exchangers 23, 33 passes through the supply air outlets and is supplied as the supply air SA to the room (see the arrows shown on the both sides of the adsorbent heat exchangers 22, 23, 32, 33 in FIG. 37).

In the second operation, the adsorption process in the first adsorbent heat exchangers 22, 32 and the regeneration process in the second adsorbent heat exchangers 23, 33 are performed in parallel. During the second operation, as shown in FIG. 38, the latent heat utilization side four-way directional control valves 21, 31 are set to a second state (see the broken lines in the latent heat utilization side four-way directional control valves 21, 31 in FIG. 38). In this state, high-pressure gas refrigerant discharged from the compression mechanism 461 flows into the second adsorbent heat exchangers 23, 33 through the discharge gas connection pipe 408 and the latent heat utilization side four-way directional control valves 21, 31, and is condensed while passing through the second adsorbent heat exchangers 23, 33. The condensed refrigerant is pressure-reduced by the latent heat utilization side expansion valves 24, 34, and is subsequently evaporated while passing through the first adsorbent heat exchangers 22, 32. Then, the refrigerant is again drawn into the compression mechanism 461 through the latent heat utilization side four-way directional control valves 21, 31 and the inlet gas connection pipe 409 (see the arrows shown on the latent heat refrigerant circuit 410 in FIG. 38).

During the second operation, in the second adsorbent heat exchangers 23, 33, moisture is desorbed from the adsorbent heated by condensation of the refrigerant, and this desorbed moisture is added to the room air RA that is drawn from the indoor air inlets. The moisture desorbed from the second adsorbent heat exchangers 23, 33 is carried with the room air RA and is exhausted as the exhaust air EA through the exhaust air outlets to the outside. In the first adsorbent heat exchangers 22, 32, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the first adsorbent heat exchangers 22, 32 passes through the supply air outlets and is supplied as the supply air SA to the room (see the arrows shown on the both sides of the adsorbent heat exchangers 22, 23, 32, 33 in FIG. 38).

Here, the system control being performed in the air conditioning system 401 will be described, focusing on the latent heat load treatment system.

First, when the target temperature and the target relative humidity are set by remote controls 411, 412, along with these target temperature and target relative humidity, the following information will be input into the latent heat utilization side controllers 28, 38 of the latent heat utilization units 2, 3, respectively: the temperature and the relative humidity of the room air to be drawn into the units, which were detected by RA inlet temperature/humidity sensors 25, 35; and the temperature and the relative humidity of outdoor air to be drawn into the units, which were detected by OA inlet temperature/humidity sensors 26, 36.

Then, in step S41, the latent heat utilization side controllers 28, 38 calculate the target value of the enthalpy or the target absolute humidity based on the target temperature and target relative humidity of the room air; calculate the current value of the enthalpy or the current absolute humidity of the air to be drawn into the unit from the room, based on the temperature and the relative humidity detected by the RA inlet temperature/humidity sensors 25, 35; and then calculate the required latent heat capacity value Δh, which is the difference between the two calculated values. Then, this value Δh is converted to a capacity UP signal K1 that informs a heat source side controller 465 whether or not it is necessary to increase the treatment capacity of the latent heat utilization units 2, 3. For example, when the absolute value of Δh is lower than a predetermined value (in other words, when the humidity of the room air is close to the target humidity, and the treatment capacity does not need to be increased or decreased), the capacity UP signal K1 will be "0." When the absolute value of Δh is higher than a predetermined value in a way that the treatment capacity needs to be increased (in other words, the humidity of the room air is higher than the target humidity during the dehumidifying operation and the treatment capacity needs to be increased), the capacity UP signal K1 will be "A," and when the absolute value of Δh is higher than a predetermined value in a way that the treatment capacity needs to be decreased (in other words, the humidity of the room air is lower than the target humidity during the dehumidifying operation, and the treatment capacity needs to be decreased), the capacity UP signal K1 will be "B."

Next the operation of the sensible heat load treatment system of the air conditioning system 1 will be described.

When the cooling operation of the sensible heat utilization units 404, 405 is performed, a three-way direction control valve 462 of the heat source unit 406 is in a condensing operation state (a state in which a first port 462*a* is connected to a third port 462*c*). In addition, the air conditioning switching valves 471, 481 of the connection units 414, 415 are in a cooling operation state (a state in which first ports 471*a*, 481*a* are connected to second ports 471*b*, 481*b*). Further, the degree of opening of the sensible heat utilization side expansion valves 441, 451 of the sensible heat utilization units 404, 405 is adjusted so as to reduce the pressure of the refrigerant. The heat source side expansion valve 464 is opened.

When the refrigerant circuit 410 is in the above-described state, high-pressure gas refrigerant discharged from the compression mechanism 461 passes through the three-way direction control valve 462, flows into a heat source side heat exchanger 463, and is condensed into liquid refrigerant. This liquid refrigerant is sent to the sensible heat utilization units 404, 405 through a heat source side expansion valve 464, a receiver 468, and the liquid connection pipe 407. The liquid refrigerant sent to the sensible heat utilization units 404, 405 is pressure-reduced by the sensible heat utilization side expansion valves 441, 451, and then, in air heat exchangers 442, 452, this liquid refrigerant is evaporated into low-pressure gas refrigerant by heat exchange with the room air RA drawn into the unit. This gas refrigerant is again drawn into the compression mechanism 461 of the heat source unit 406 through the air conditioning switching valves 471, 481 of the connection units 414, 415 and the inlet gas connection pipe 409. On the other hand, the room air RA cooled by heat exchange with the refrigerant in the air heat exchangers 442, 452 is supplied as the supply air SA to the room. Note that, as described below, the degree of opening of the sensible heat utilization side expansion valves 441, 451 is adjusted such that the degree of superheat SH in the air heat exchangers 442, 452, i.e., the temperature difference between the refrigerant temperature on the liquid side of the air heat exchangers 442, 452 respectively detected by the liquid side temperature sensors 443, 453 and the refrigerant temperature on the gas side of the air heat exchangers 442, 452 respectively detected by the gas side temperature sensors 444, 445, is the target degree of superheat SHS.

Here, the system control being performed in the air conditioning system 401 will be described, focusing on the sensible heat load treatment system. Note that, the control necessary to achieve the sensible heat cooling operation in the sensible heat load treatment system will be described later; and the basic control of the sensible heat load treatment system will be described herein.

First, when the target temperature is set by the remote controls 411, 412, along with these target temperatures, the temperature of the room air to be drawn into the unit, which were detected by the RA inlet temperature/humidity sensors 445, 455, will be input into sensible heat utilization side controllers 448, 458 of the sensible heat utilization units 404, 405, respectively.

Then, in step S44, the sensible heat utilization side controllers 448, 458 calculate the temperature difference between the target temperature of the room air and the temperature detected by the RA inlet temperature/humidity sensors 445, 455 (this temperature difference will be hereinafter referred to as the required sensible heat capability value ΔT). Here, as described above, the required sensible heat capacity value ΔT is the difference between the target temperature of the room air and the current temperature of the room air, so that this value ΔT corresponds to the sensible heat load that must be treated in the air conditioning system 401. Then, this required sensible heat capacity ΔT is converted to a capacity UP signal K2 that informs the heat source side controller 465 whether or not it is necessary to increase the treatment capacity of the sensible heat utilization units 404, 405. For example, when the absolute value of ΔT is lower than a predetermined value (in other words, when the temperature of the room air is close to the target temperature of the room air, and the treatment capacity does not need to be increased or decreased), the capacity UP signal K2 will be "0." When the absolute value of ΔT is higher than a predetermined value in a way that the treatment capacity needs to be increased (in other words, the room temperature air is higher than the target temperature during the cooling operation and the treatment capacity needs to be increased), the capacity UP signal K2 will be "a," and when the absolute value of ΔT is higher than a predetermined value in a way that the treatment capacity needs to be decreased (in other words, the temperature of the room air is lower than the target temperature during the cooling operation, and the treatment capacity needs to be decreased), the capacity UP signal K2 will be "b."

Next, in step S45, the sensible heat utilization side controllers 448, 458 change the target degree of superheat SHS according to the required sensible heat capability value ΔT. For example, when the treatment capacity of the sensible heat utilization units 404, 405 needs to be decreased (when the capacity UP signal K2 is "b"), the degree of opening of the sensible heat utilization side expansion valves 441, 451 is controlled such that the target degree of superheat SHS is increased and the amount of heat exchanged between the air and the refrigerant in the air heat exchangers 442, 452 is decreased.

Next, in step S42, the heat source side controller 465 calculates the target condensation temperature TcS and the target evaporation temperature TeS, using the capacity UP signal K1 of the latent heat utilization units 2, 3, which was transmitted from the latent heat utilization side controllers 28, 38 to the heat source side controller 465, and also the capacity UP signal K2 of the sensible heat utilization units 404, 405, which was transmitted from the sensible heat utilization side controllers 448, 458 to the heat source side controller 465. For example, the target condensation temperature TcS is calculated by adding the capacity UP signal K1 of the latent heat utilization units 2, 3 and the capacity UP signal K2 of the sensible heat utilization units 404, 405 to the current target condensation temperature. In addition, the target evaporation temperature TeS is calculated by subtracting the capacity UP signal K1 of the latent heat utilization units 2, 3 and the capacity UP signal K2 of the sensible heat utilization units 404, 405 from the current target evaporation temperature. Accordingly, when a value of the capacity UP signal K1 is "A" or when a value of the capacity UP signal K2 is "a," the target condensation temperature TcS will be high and the target evaporation temperature TeS will be low.

Next in step S43, a system condensation temperature Tc and a system evaporation temperature Te, which respectively correspond to measured values of the condensation temperature and the evaporation temperature of the entire air conditioning system 1, are calculated. For example, the system condensation temperature Tc and the system evaporation temperature Te are calculated by converting an inlet pressure of the compression mechanism 461 detected by an inlet pressure sensor 466 and a discharge pressure of the compression mechanism 461 detected by a discharge pressure sensor 467 to the saturation temperatures of the refrigerant at these pressures. Then, the temperature difference ΔTc between the system condensation temperature Tc and the target condensation temperature TcS and the temperature difference ΔTe between the system evaporation temperature Te and the target evaporation temperature TeS are calculated. Then based on the subtraction between these temperature differences, the necessity and amount of the increase or decrease in the operational capacity of the compression mechanism 461 will be determined.

By using thus determined operational capacity of the compression mechanism 461 to control the operational capacity of the compression mechanism 461, the system control to aim the target relative humidity of the room air is performed. The system control is performed such that, for example, when a value determined by subtracting the temperature difference ΔTe from the temperature difference ΔTc is a positive value, the operational capacity of the compression mechanism 461 is increased, whereas when a value determined by subtracting the temperature difference ΔTe from the temperature difference ΔTc is a negative value, the operational capacity of the compression mechanism 461 is decreased.

In this way, in this air conditioning system 401, the latent heat load (required latent heat treatment capacity, which corresponds to Δh), which must be treated in the air conditioning system 401 as a whole, and the sensible heat load (required sensible heat treatment capacity, which correspond to ΔT), which must be treated in the air conditioning system 401 as a whole, are treated by using the latent heat load treatment system (specifically, the latent heat utilization units 2, 3) and the sensible heat load treatment system (specifically, sensible heat utilization units 404, 405). Here, as for the increase and decrease of the treatment capacity of the latent heat load treatment system and the increase and decrease of the treatment capacity of the sensible heat load treatment system, the required latent heat treatment capacity value Δh and the required sensible heat treatment capacity value ΔT are calculated, and the operational capacity of the compression mechanism 461 is controlled based on these calculated values, so that it is possible to treat the latent heat load in the latent heat load treatment system having the adsorbent heat exchangers 22, 23, 32, 33, while treating the sensible heat load in the sensible heat load treatment system having the air heat exchangers 442, 452 at the same time. Consequently, as in the air conditioning system 401 of the present embodiment, even when the latent heat load treatment system and the sensible heat load treatment system share a heat source, the operational capacity of the compression mechanism that constitutes the heat source can be controlled in a satisfactory manner.

Incidentally, in this air conditioning system 401, as described above, the latent heat treatment that mainly treats the latent heat load in the room is performed in the latent heat load treatment system (in other words, the latent heat utilization units 2, 3), and the sensible heat cooling operation that only treats the sensible heat load in the room is performed in the sensible heat load treatment system (in other words, the sensible heat utilization units 404, 405). This air conditioning system 401 uses the evaporation pressure control valves 473, 483 of the connection units 414, 415, respectively, so as to perform the system control as described below in order to achieve the sensible heat cooling operation in the sensible heat load treatment system.

First, in step S46, the sensible heat utilization side controllers 448, 458 calculate the dew point temperature based on the temperature and the relative humidity of the room air that is to be drawn in to the unit, which are detected by the RA inlet temperature/humidity sensors 445, 455, and then calculate the minimum evaporation temperature Te3 of the refrigerant that flows in the air heat exchangers 442, 452 such that condensation of air in the air heat exchangers 442, 452 is prevented, specifically, so that air in the air heat exchangers 442, 452 will be at least equal to or higher than this dew point temperature.

Next, in step S47, the minimum evaporation temperature Te3 transmitted from the sensible heat utilization side controllers 448, 458 to the connection unit controllers 472, 482 is converted to the minimum evaporation pressure value P3 that is the saturation pressure that corresponds to this temperature Te3. Then in step S48, this minimum evaporation pressure value P3 is compared to the pressure of the refrigerant in the air heat exchangers 442, 452, which was detected by the evaporation pressure sensors 474, 484. The degree of opening of the evaporation pressure control valves 473, 483 is adjusted such that the pressure of the refrigerant in the air heat exchangers 442, 452, which was detected by the evaporation pressure sensors 474, 484, is equal to or higher than the minimum evaporation pressure value P3.

Accordingly, even when the operational capacity of the compression mechanism 461 is changed according to the required sensible heat treatment capacity value, the degree of opening of the evaporation pressure control valves 473, 483 is adjusted such that the pressure of the refrigerant in the air heat exchangers 442, 452, which was detected by the evaporation pressure sensors 474, 484, is equal to or higher than the minimum evaporation pressure value P3. As a result, it is possible to achieve the sensible heat cooling operation.

Note that during the above-described drainless dehumidifying and cooling operation, when the evaporation temperature of the air heat exchangers 442, 452 in the sensible heat load treatment system of the air conditioning system 401 is equal to or below the dew point temperature (in other words, equal to or below the minimum evaporation temperature Te3), and when condensation is detected by the condensation sensors 446, 456, the following actions are taken in order to reliably prevent condensation in the air heat exchangers 442, 452: the connection unit controllers 414, 415 correct the value of the minimum evaporation pressure P3 such that the minimum evaporation pressure P3 is higher than the that the minimum evaporation pressure P3 observed when condensation is detected; the sensible heat utilization side controllers 448, 458 respectively close the sensible heat utilization side expansion valves 441, 451; and the sensible heat utilization side controllers 448, 458 transmit a signal that informs that condensation is detected to the heat source side controller 465, and then the heat source side controller 465 stops the compression mechanism 461.

Next the second operation during the drainless dehumidifying and cooling operation will be described with reference to FIGS. 37, 38, and 40.

With the above-described first method of the drainless dehumidifying and cooling operation, the latent heat load in the room is treated in the latent heat load treatment system, and the sensible heat cooling operation that treats only the sensible heat load in the room by using the evaporation pressure control valves 473, 483 is performed in the sensible heat load treatment system. Specifically, the latent heat load (required latent heat treatment capacity, which corresponds to $\Delta h$), which must be treated in the latent heat load treatment system and the sensible heat load treatment system, and the sensible heat load (required sensible heat treatment capacity, which correspond to $\Delta T$), which must be treated in the latent heat load treatment system and the sensible heat load treatment system, are treated by using the latent heat load treatment system and the sensible heat load treatment system. Here, the treatment capacity of the latent heat load treatment system and the sensible heat load treatment system are increased or decreased by mainly controlling the operational capacity of the compression mechanism 461.

In the latent heat load treatment by the latent heat load treatment system of the air conditioning system 1, as shown in FIG. 5, not only the latent heat but also the sensible heat are treated through the adsorption process or the regeneration process in the first adsorbent heat exchangers 22, 32 and the second adsorbent heat exchangers 23, 33 which constitute the latent heat load treatment system. As a result, both the latent heat and the sensible heat are treated. Here, given that the capacity of the sensible heat treatment that is performed along with the latent heat treatment in the latent heat load treatment system is referred to as a generated sensible heat treatment capacity, the sensible heat load that must treated in the sensible heat load treatment system is equal to the amount remaining after subtracting the generated sensible heat treatment capacity from the required latent heat treatment capacity.

Accordingly, with the second method of the drainless dehumidifying and cooling operation, the following system control is performed, in view of that the sensible heat is treated in the latent heat load treatment system of the air conditioning system 401. Note that in regard to this second drainless dehumidifying and cooling operation method, the steps excluding steps S49 to S52 particular to this operation method (in other words, steps S41 to S48) are the same as those in the control flow of the first operation method, so that a description thereof will be omitted.

In the latent heat utilization side controllers 28, 38, in step S49, when the switching time interval between the adsorption process and the regeneration process in the adsorbent heat exchangers 22, 23 and the adsorbent heat exchangers 32, 33 is set to a sensible heat priority mode (for example, time D in FIG. 5), and also when the capacity UP signal K2 is "b" (when the required sensible heat treatment capacity in the sensible heat utilization side units 404, 405 is small), in step S51, the switching time interval is changed to a latent heat priority mode (for example, time C in FIG. 5). When a condition is different than described above, the system control proceeds to step S50.

Then, in step S50, when the switching time interval between the adsorption process and the regeneration process in the adsorbent heat exchangers 22, 23 and the adsorbent heat exchangers 32, 33 is set to the latent heat priority mode (for example, time C in FIG. 5), and also when the capacity UP signal K2 is "a" (when the required sensible heat treatment capacity in the sensible heat utilization side units 404, 405 has increased), in step S52, the switching time interval is changed to the latent heat priority mode (for example, time D in FIG. 5) so as to increase the sensible heat treatment capacity in the latent heat load treatment system.

In this way, with the second operation method, when the required sensible heat treatment capacity value $\Delta T$ is high and the sensible heat treatment capacity in the sensible heat load treatment system of the air conditioning system 1 needs to be increased, the switching time interval between the adsorption process and the regeneration process in the adsorbent heat exchangers 22, 32, 23, 33 of the latent heat utilization units 2, 3 is made longer so as to decrease the latent heat treatment capacity and to increase the sensible heat treatment capacity in the adsorbent heat exchangers 22, 32, 23, 33, in order to increase the sensible heat treatment capacity in the latent heat load treatment system, in other words, to increase the sensible heat treatment capacity ratio. Consequently, even when the required sensible heat treatment capacity value ΔT is high, the air conditioning system 1 can follow a change in the sensible heat treatment capacity while being operated so as to prevent condensation of moisture in the air in the air heat exchangers 442, 452 in the sensible heat load treatment system and to treat only the sensible heat load in the room.

Note that, as with the first operation method, during the above-described drainless dehumidifying and cooling operation, when the evaporation temperature of the air heat exchangers 442, 452 in the sensible heat load treatment system of the air conditioning system 401 is equal to or below the dew point temperature (in other words, equal to or below the minimum evaporation temperature Te3), and when condensation is detected by the condensation sensors 446, 456, the following actions are taken in order to reliably prevent condensation in the air heat exchangers 442, 452: the connection unit controllers 472, 482 correct the value of the minimum evaporation pressure P3 such that the minimum evaporation pressure P3 is higher than the that the minimum evaporation pressure P3 observed when condensation is detected; the sensible heat utilization side controllers 448, 458 respectively close the sensible heat utilization side expansion valves 441, 451; and the sensible heat utilization side controllers 448, 458 transmit a signal for detection of condensation to the heat source side controller 465, and the heat source side controller 465 stops the compression mechanism 461.

<Drainless System Startup>

Figure 41:
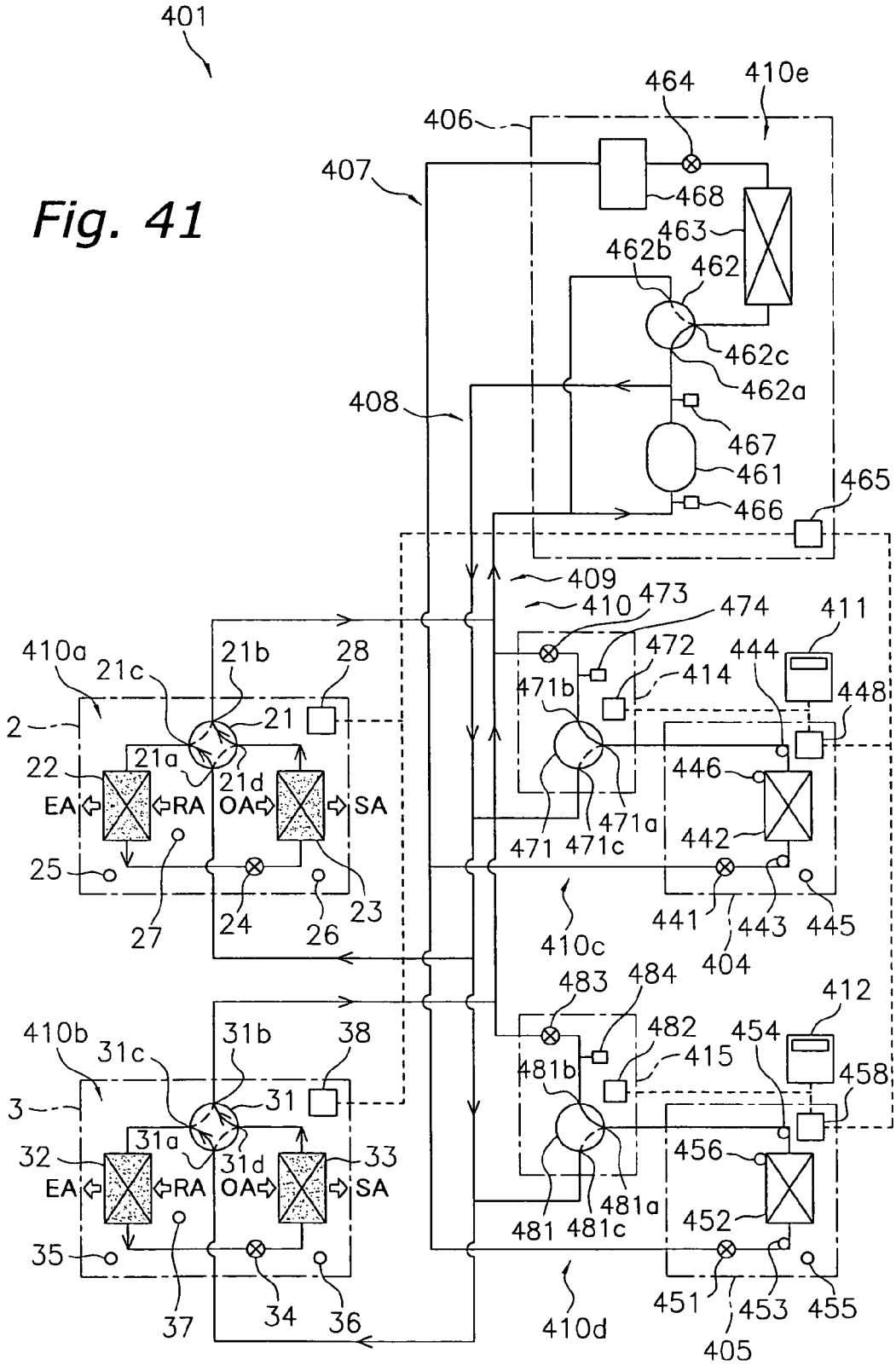
FIG. 41 is a schematic diagram of a refrigerant circuit showing the operation at drainless system startup of the air conditioning system of the third embodiment.
Figure 42:
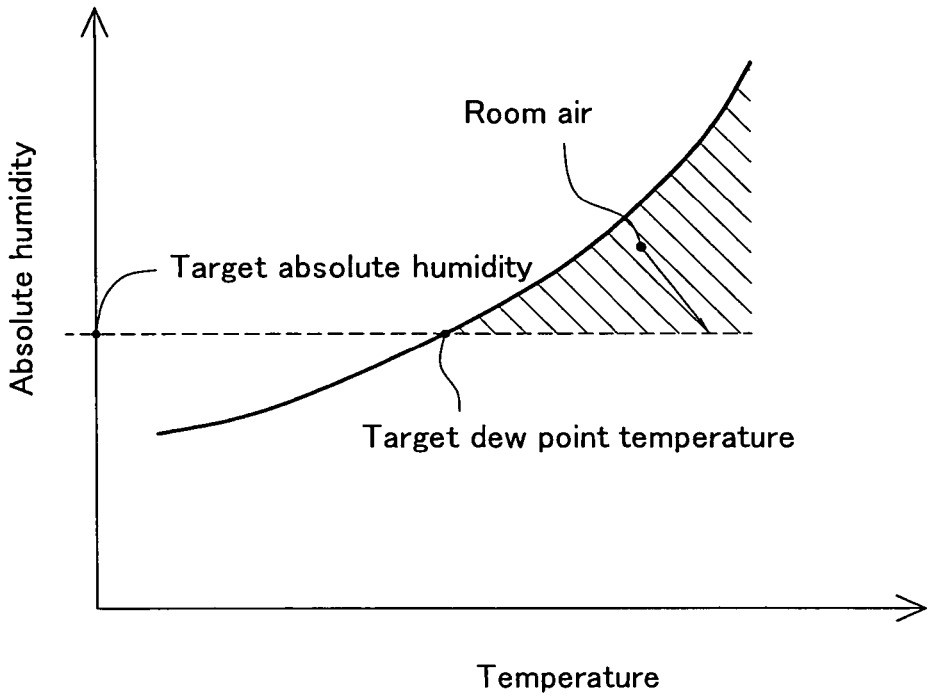
FIG. 42 is a psychrometric chart showing the state of the room air at drainless system startup of the air conditioning system of the third embodiment.
Figure 43:
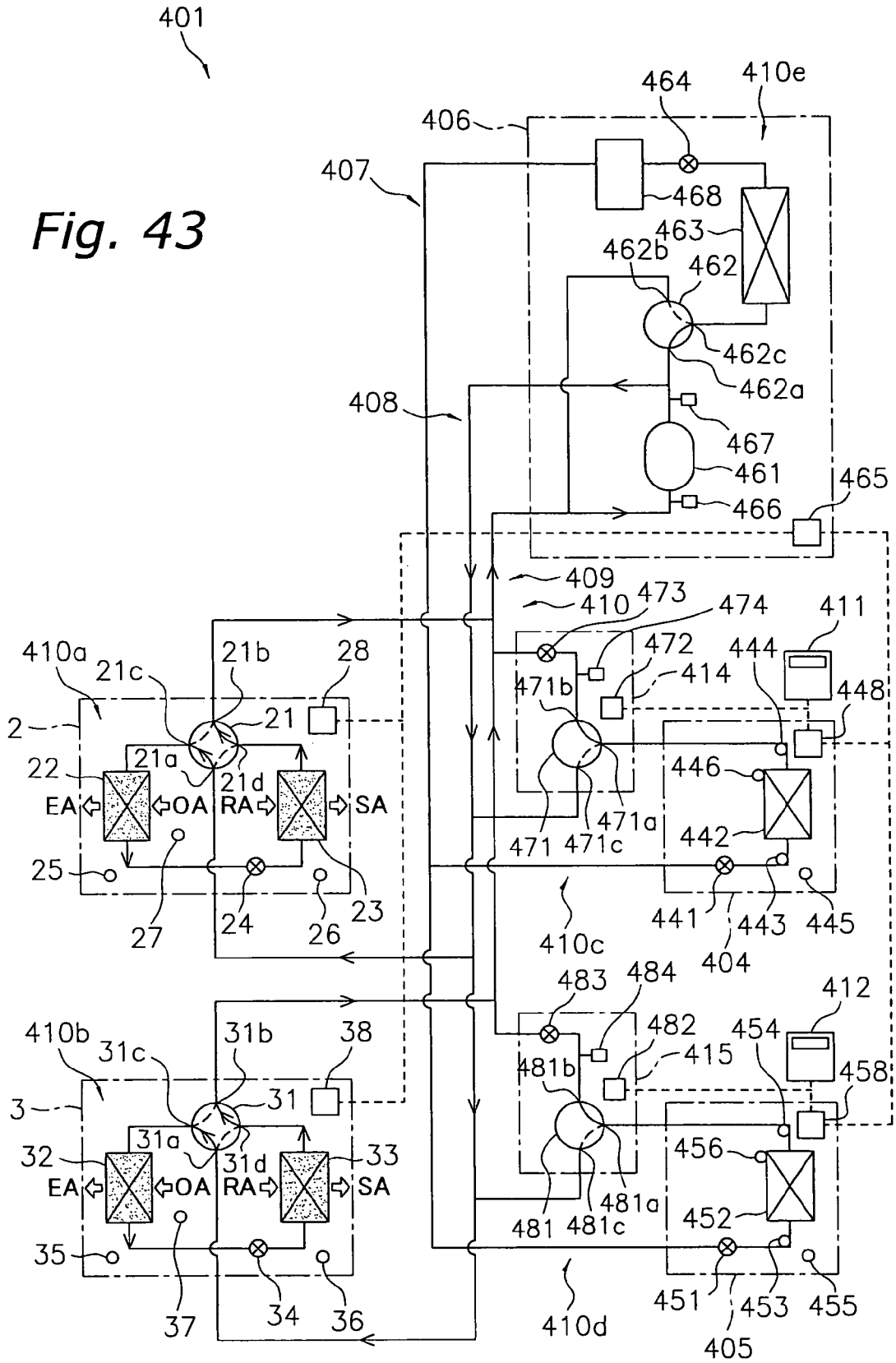
FIG. 43 is a schematic diagram of a refrigerant circuit showing the operation at drainless system startup of the air conditioning system of the third embodiment.
Figure 44:
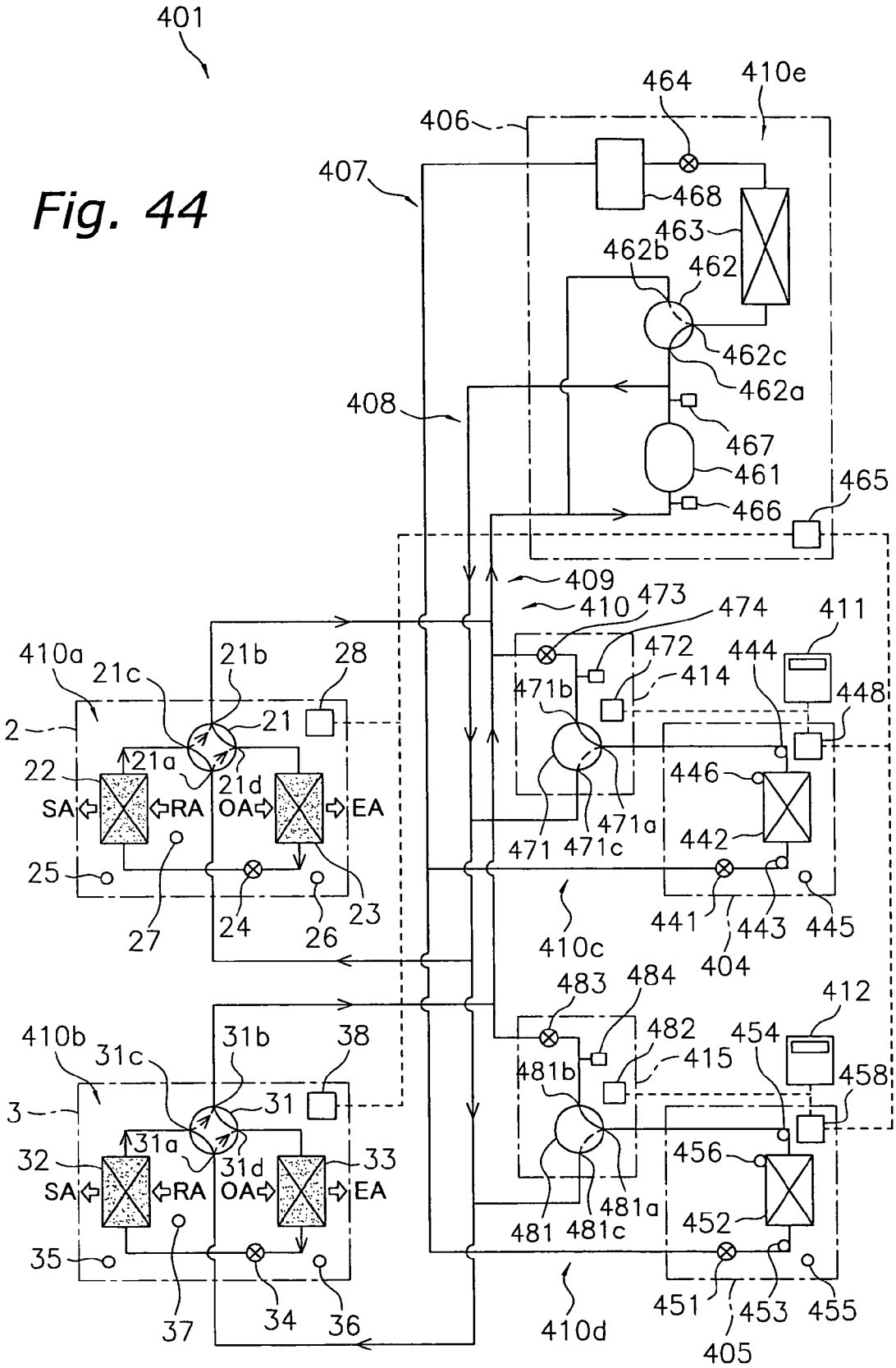
FIG. 44 is a schematic diagram of a refrigerant circuit showing the operation at drainless system startup of the air conditioning system of the third embodiment.

Next, the startup operation of the air conditioning system 401 will be described with reference to FIGS. 41, 42, 43, and 44. In the air conditioning system 401, a drainless system startup is performed in which the system starts without generating condensation in the air heat exchangers 442, 452 in the sensible heat utilization units 404, 405. FIG. 41 is a schematic diagram of a refrigerant circuit showing the operation at a first drainless system startup of the air conditioning system 401. FIG. 42 is a psychrometric chart showing the state of the room air at drainless system startup of the air conditioning system 401. FIGS. 43 and 44 are schematic diagrams of a refrigerant circuit showing the operation at a second drainless system startup of air conditioning system 401.

As for the startup operation of the air conditioning system 401, there are two startup methods as described below. A first method for drainless system startup is a method in which the treatment of the latent heat load in the room by the latent heat load system is given priority over the treatment of the sensible heat load treatment system by the sensible heat load treatment system of the air conditioning system 401. A second method for drainless system startup is a method in which, as with the first method for drainless system startup, treatment of the latent heat load in the room by the latent heat load treatment system is given priority over treatment of the sensible heat load in the room by the sensible heat load treatment system, and also in the latent heat utilization units 2, 3 in the latent heat load treatment system, outdoor air is passed through one of the first adsorbent heat exchangers 22, 32 and one of the second adsorbent heat exchangers 23, 33, whichever is performing the regeneration process, and then the outdoor air is exhausted to the outside; at the same time, room air is passed through one of the first adsorbent heat exchangers 22, 32 and the second adsorbent heat exchangers 23, 33, whichever is performing the adsorption process, and then supplied to the room.

First, the first operation at drainless system startup will be described with reference to FIGS. 41 and 42.

When an operation command is issued from the remote controls 411, 412, the latent heat load treatment system will start and the dehumidifying operation will be performed in a state in which the sensible heat load treatment system of the air conditioning system 401 is stopped (in other words, the sensible heat utilization side expansion valves 441, 451 of the sensible heat utilization units 404, 405 are closed). Here, since the operation during the dehumidifying operation of the latent heat load treatment system is the same as the one during the above-described drainless dehumidifying and cooling operation (however, the switching time interval is fixed to the time C in the latent heat priority mode), a description thereof will be omitted.

On the other hand, as for the sensible heat load treatment system, for example, when the sensible heat utilization side controllers 448, 458 calculate the dew point temperature or the absolute humidity of the room air based on the temperature and the relative humidity of the room air (specifically, the temperature and relative humidity detected by the RA inlet temperature/humidity sensors 25, 35 in the latent heat utilization units 2, 3 and by the RA inlet temperature/humidity sensors 445, 455 in the sensible heat utilization units 404, 405), and when the measured value of dew point temperature or absolute humidity of the room air is within the hatched area shown in FIG. 42 (in other words, when the dew point temperature and absolute humidity of the room air are higher than the target dew point temperature and the target absolute humidity), the sensible heat load treatment system will be maintained in a stopped state until the dew point temperature of the room air or the absolute humidity will be equal to or below the target dew point temperature or the target absolute humidity, and thus moisture in the air in the air heat exchangers 442, 452 is prevented from being condensed immediately after startup. Here, appropriate dew point temperature or the absolute humidity is set, which is at levels approximately intermediate between the dew point temperature or the absolute humidity calculated based on the target temperature and the target humidity that were input into the remote controls 411, 412, and the dew point temperature or the absolute humidity calculated based on the temperature and the relative humidity detected by the RA inlet temperature/humidity sensors 25, 35 in the latent heat utilization units 2, 3 and by the RA inlet temperature/humidity sensors 445, 455 in the sensible heat utilization units 404, 405.

Then, after the target dew point temperature or the target absolute humidity is attained by the operation of the latent heat load treatment system, the sensible heat load treatment system starts (specifically, the sensible heat utilization side expansion valves 441, 451 of the sensible heat utilization units 404, 405 are put into a controlled state), and the above-described drainless dehumidifying and cooling operation is operated, and thereby, the temperature of the room air is lowered down to the target temperature.

In this way, in the air conditioning system 1, treatment of the latent heat load in the room by the latent heat load treatment system is given priority over treatment of the sensible heat load in the room by the sensible heat load treatment system. Therefore, it is possible to treat the sensible heat by the sensible heat load treatment system after fully lowering the humidity of the room air by treating the latent heat by the latent heat load treatment system. Accordingly, in the air conditioning system 401 that comprises the latent heat load treatment system comprising the latent heat utilization units 2, 3 having the adsorbent heat exchangers 22, 23, 32, 33 and configured to mainly treat the latent heat load in the room; and the sensible heat load treatment system comprising the sensible heat utilization units 404, 405 having the air heat exchangers 442, 452 and configured to be operated so as to prevent condensation of moisture in the air in the air heat exchangers 442, 452 and treat only the sensible heat load in the room, it will be possible to quickly treat the sensible heat load while preventing condensation in the air heat exchangers 442, 452, even when the system starts under a condition in which the dew point temperature of the room air is high.

Next, the second operation at the drainless system startup will be described with reference to FIGS. 43 and 44.

When an operation command is issued from the remote controls 411, 412, the latent heat load treatment system will start and the dehumidifying operation will be performed in a state in which the sensible heat load treatment system is stopped, as in the case of the first drainless system startup. Here, as for the operation during the dehumidifying operation of the latent heat load treatment system, such dehumidifying operation is performed in a circulation mode but not in the full ventilation mode. Note that the control of the latent heat refrigerant circuit 410 in the latent heat load treatment system is the same as the operation performed during the drainless dehumidifying and cooling operation (however, the switching time interval is fixed to time C in the latent heat priority mode). In addition, as for the flow of air in the latent heat utilization units 2, 3 in the latent heat load treatment system, by the operation of the latent heat utilization side four-way directional control valves 21, 31, the air supply fan, the exhaust fan, the damper, etc., the room air RA is drawn into the units through the indoor air inlets, and is supplied as the supply air SA to the room through the supply air outlets, and the outdoor air OA is drawn into the units through the outside air inlets, and is exhausted as the exhaust air EA to the outside through the exhaust air outlets.

In this way, in the air conditioning system 401, at the second drainless system startup, the dehumidifying operation is performed while circulating room air (in other words, the dehumidifying operation in the circulation mode). Consequently, even when the humidity in the room may get high when outdoor air is supplied, such as when outdoor air is at high humidity, dehumidification can be provided while circulating room air. Accordingly, the target dew point temperature or the target absolute humidity can be quickly achieved, and the sensible heat load can be treated by the sensible heat load treatment system.

When performing drainless system startup of the air conditioning system 401 configured to preferentially treat the latent heat load in the room as described above, for example, there are times when the dew point temperature or the absolute humidity of the room air at drainless system startup is close to the target dew point temperature or the target absolute humidity of the room air. In such a case, the above-described drainless system startup does not need to be performed, so that the operation at drainless system startup can be omitted and then shifted to the normal operation.

Therefore, this air conditioning system 401 is configured such that, at drainless system startup, before starting the above-described operation that preferentially treats the latent heat load in the room, whether or not the dew point temperature difference between the target dew point temperature of the room air and the dew point temperature of the room air is equal to or below a predetermined dew point temperature difference (for example, whether or not the target dew point temperature has been reached) is determined, and when the dew point temperature difference between the target dew point temperature of the room air and the dew point temperature of the room air is equal to or below a predetermined dew point temperature, the operation at drainless system startup is prevented from being performed.

In addition, in determining the necessity of the operation that preferentially treats the latent heat load in the room based on the absolute humidity but not the dew point temperature, at drainless system startup, before starting the above-described operation that preferentially treats the latent heat load in the room, whether or not the absolute humidity difference between the target absolute humidity of the room air and the absolute humidity of the room air is equal to or below a predetermined absolute humidity difference (for example, whether or not the target absolute humidity has been reached) is determined. When the absolute humidity difference between the target absolute humidity of the room air and the absolute humidity of the room air is equal to or below a predetermined absolute humidity difference, the operation at drainless system startup does not have to be performed.

Accordingly, in the air conditioning system 401, at drainless system startup, the operation in which the latent heat load in the room is preferentially treated is prevented from being unnecessarily performed, and therefore the normal operation in which the latent heat load and the sensible heat load in the room are treated can be initiated as soon as possible.

(3) Characteristics of the Air Conditioning System

The air conditioning system 401 of the present embodiment has the following characteristics, in addition to the characteristics of the air conditioning system 1 of the first embodiment.

(A)

The air conditioning system 401 of the present embodiment comprises the latent heat load treatment system which includes the latent heat utilization side refrigerant circuits 410*a*, 410*b* that cause moisture in the air to be adsorbed or desorbed in the adsorbent heat exchangers 22, 23, 32, 33 and be exhausted to the outside which mainly treat the latent heat load in the room; and the sensible heat load treatment system which includes the sensible heat utilization side refrigerant circuits 410*c*, 410*d* which can exchange heat between the refrigerant and air so as to prevent condensation of moisture in the air in the air heat exchangers 442, 452 and which only treats the sensible heat load in the room. Consequently, this air conditioning system 401 achieves a drainless system in which a drain pipe is not needed in the latent heat utilization units 2, 3 having the latent heat utilization side refrigerant circuits 410*a*, 410*b* and in the sensible heat utilization units 404, 405 having the sensible heat utilization side refrigerant circuits 410*c*, 410*d*. During the cooling operation, the sensible heat load treatment system cannot increase the sensible heat treatment capacity because the evaporation temperature in the air heat exchangers 442, 452 is restricted based on the dew point temperature of the room air, even when the required sensible heat treatment capacity value $\Delta T$ is high and thus the sensible heat treatment capacity needs to be increased.

However, in the air conditioning system 401 of the present embodiment, when the required sensible heat treatment capacity value $\Delta T$ is high and thus the sensible heat treatment capacity in the sensible heat load treatment system needs to be increased, the switching time interval between the adsorption process and the regeneration process in the adsorbent heat exchangers 22, 23, 32, 33 that constitute the latent heat load treatment system is made longer so as to decrease the latent heat treatment and simultaneously increase the sensible heat treatment capacity in the adsorbent heat exchangers 22, 23, 32, 33, in other words, to increase the sensible heat treatment capacity ratio in the latent heat load treatment system, in order to increase the sensible heat treatment capacity in the latent heat load treatment system.

Accordingly, in the air conditioning system 1 comprising the latent heat load treatment system that mainly treats the latent heat load in the room and the sensible heat load treatment system that is operated so as to prevent condensation of moisture in the air and to treat only the sensible heat load in the room, even when the required sensible heat treatment capacity is high, it is possible to treat only the sensible heat load in the room by being operated so as to prevent condensation of moisture in the air in the sensible heat load treatment system and, simultaneously follow a change in the sensible heat treatment capacity.

(B)

The air conditioning system 401 of the present embodiment controls the evaporation pressure control valves 473, 483 based on the dew point temperature of the room air such that, for example, the evaporation temperature of the refrigerant in the air heat exchangers 442, 452 does not drop below the dew point temperature of the room air. In this way, moisture in the air is prevented from being condensed on the surface of the air heat exchangers 442, 452, and drain water in the air heat exchangers 442, 452 is prevented from being generated.

In addition, in the air conditioning system 401, instead of the dew point temperature, the evaporation pressure of the refrigerant in the air heat exchangers 442, 452 measured by the evaporation pressure sensors 474, 484 is used as a control value for the evaporation pressure control valves 473, 383 for controlling the evaporation pressure of the refrigerant in the air heat exchanger 442, 452. Therefore, the control responsiveness can be improved, compared to a case where the evaporation pressure of the refrigerant is controlled by using the dew point temperature.

(C)

In the air conditioning system 401 of the present embodiment, the condensation in the air heat exchangers 442, 452 is reliably prevented because condensation in the air heat exchangers 442, 452 can be reliably detected by the condensation sensors 446, 456, and when condensation is detected, the minimum evaporation pressure value P3 that is calculated based on the dew point temperature can be changed so as to change the evaporation pressure of the refrigerant in the air heat exchangers 442, 452; the compression mechanism 461 is stopped; and the sensible heat utilization side expansion valves 441, 451 of the sensible heat utilization units 404, 405 are closed.

(D)

In this air conditioning system 401 of the present embodiment, at system startup, treatment of the latent heat load in the room by the latent heat load treatment system is given priority over treatment of the sensible heat load in the room by the sensible heat load treatment system. Therefore, by treating the latent heat by the latent heat load treatment system, it will be possible to treat the sensible heat by the sensible heat load treatment system after fully lowering the humidity of the room air.

More specifically, at system startup, treatment of the sensible heat load by the sensible heat load treatment system is stopped and only the latent heat is treated by the latent heat load treatment system until the dew point temperature of the room air is equal to or below the target dew point temperature, or until the absolute humidity of the room air is equal to or below the target absolute humidity. In this way, treatment of the sensible heat load by the sensible heat load treatment system can be initiated as soon as possible.

Accordingly, in the air conditioning system 1 that comprises the latent heat load treatment system having the adsorbent heat exchangers 22, 23, 32, 33 and configured to mainly treat the latent heat load in the room; and the sensible heat load treatment system having the air heat exchangers 442, 452 and configured to be operated so as to prevent condensation of moisture in the air in the air heat exchangers 442, 452 and treat only the sensible heat load in the room, it is possible to quickly treat the sensible heat load while preventing condensation in the air heat exchangers 442, 452, even when the system is started under a condition in which the dew point temperature of the room air is high.

(E)

In the air conditioning system 401 of the present embodiment, at system startup, outdoor air can be passed through one of the adsorbent heat exchangers 22, 23, 32, 33, whichever is performing the regeneration process, and then be exhausted to the outside; at the same time, room air can be passed through one of the adsorbent heat exchangers 22, 23, 32, 33, whichever is performing the adsorption process, and then be supplied to the room. Consequently, at system startup, the dehumidifying operation is performed while circulating room air, and thus treatment of the sensible heat load by the sensible heat load treatment system can be initiated as soon as possible.

In addition, before starting the system startup operation, the necessity to start such an operation is determined based on the dew point temperature and the absolute humidity of the room air. Accordingly, at system startup, the operation in which the latent heat load in the room is preferentially treated is prevented from being unnecessarily performed, and the normal operation in which the latent heat load and the sensible heat load in the room are treated can be initiated as soon as possible.

(4) Modified Example 1

Figure 45:
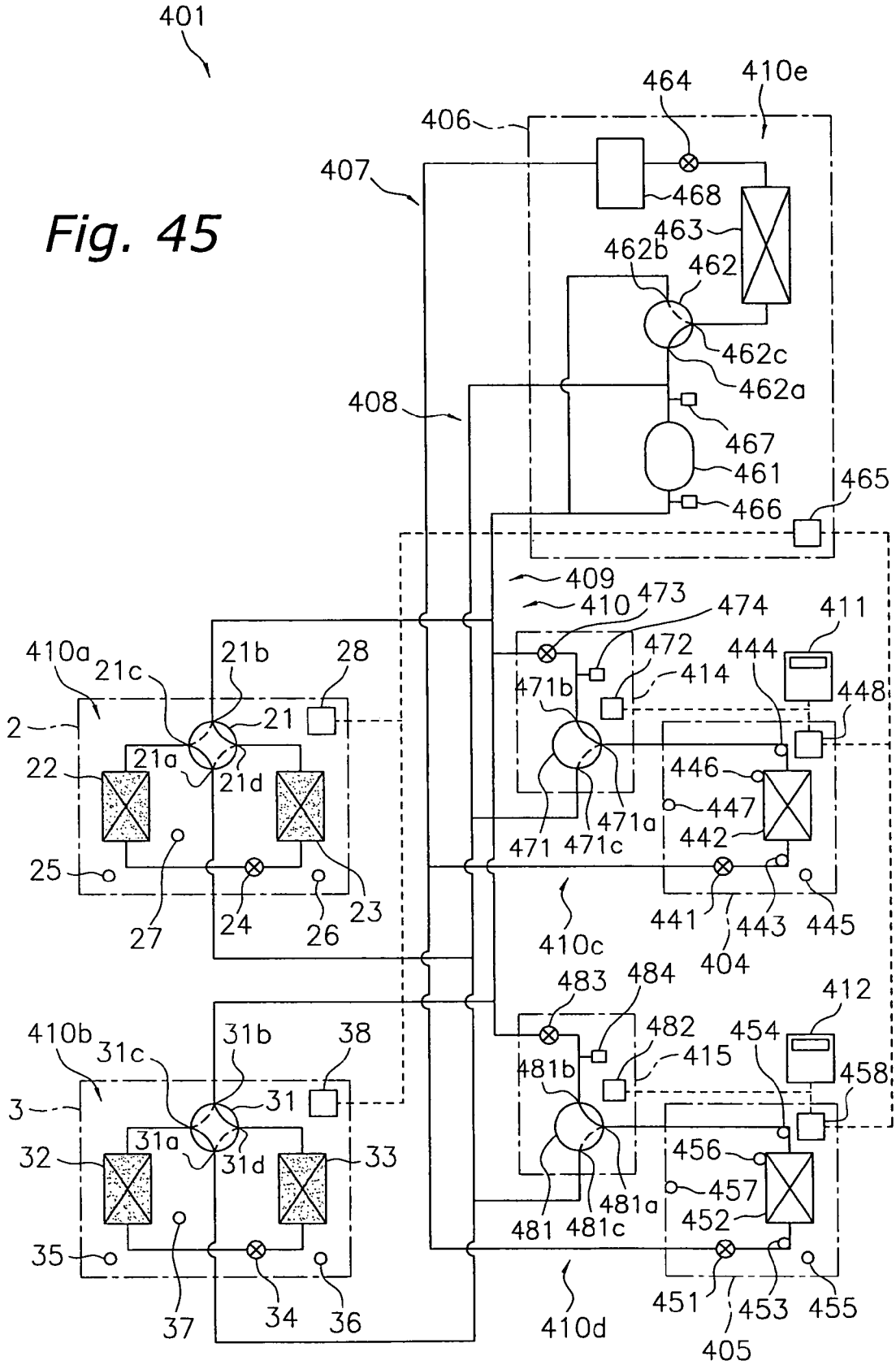
FIG. 45 is a schematic diagram of a refrigerant circuit of an air conditioning system according to a modified example 1 of the third embodiment.

In the air conditioning system 401 in the above-described third embodiment, the dew point temperature of the room air is calculated based on the temperature of the room air and the relative humidity which were detected by the RA inlet temperature/humidity sensors 445, 455 of the sensible heat utilization units 404, 405, and the minimum evaporation temperature Te3 of the refrigerant in the air heat exchangers 442, 452 is calculated in order to use these calculated values for the system control. However, as shown in FIG. 45, dew point sensors 447, 457 may be provided in the sensible heat utilization units 404, 405 so as to use the dew point temperature detected by the dew point sensors 447, 457 for the system control.

(5) Modified Example 2

Figure 46:
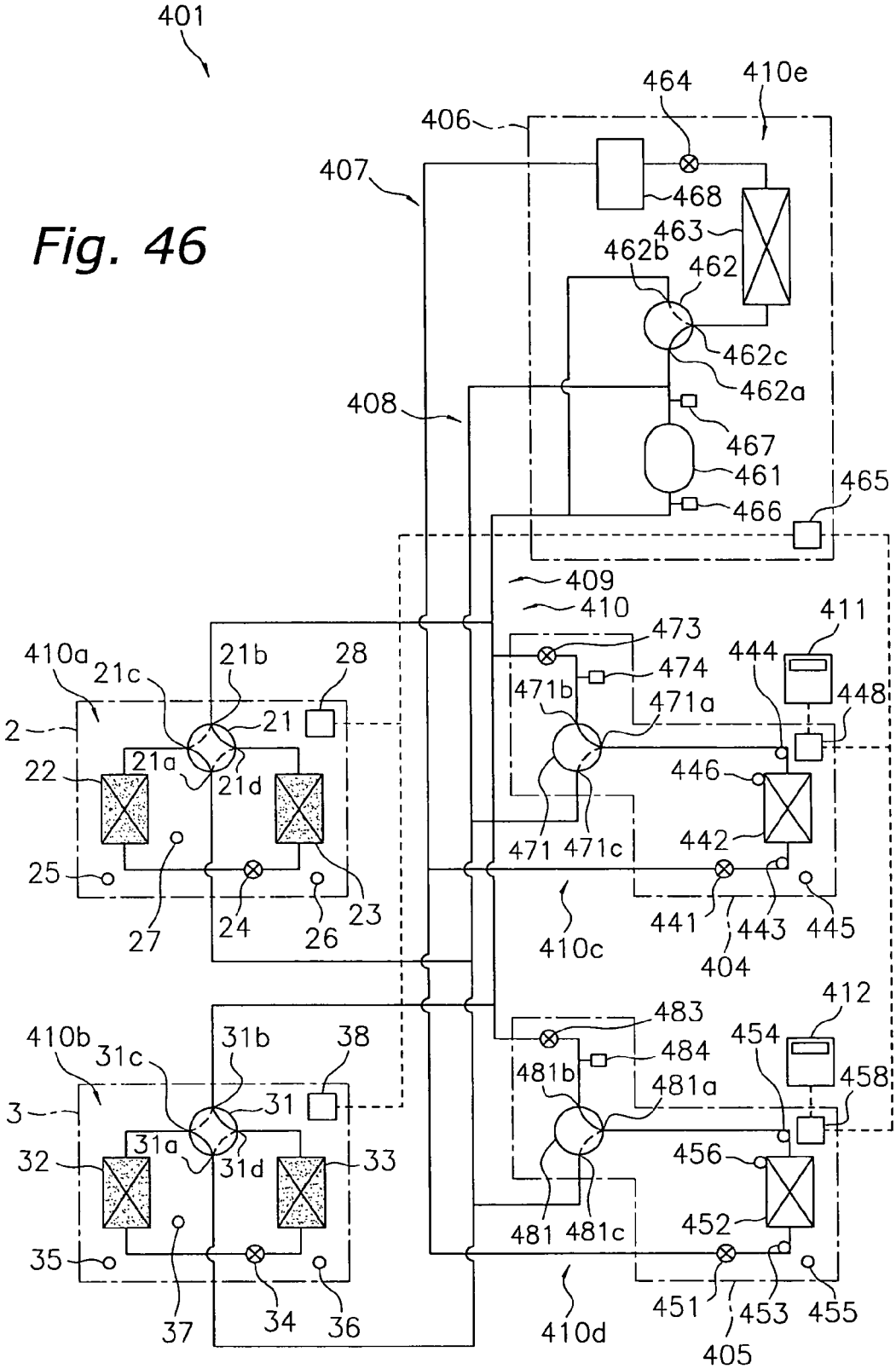
FIG. 46 is a schematic diagram of a refrigerant circuit of an air conditioning system according to a modified example 2 of the third embodiment.

In the air conditioning system 401 of the above-described third embodiment, the sensible heat utilization units 404, 405 that constitute the sensible heat load treatment system are different units from the connection units 414, 415; however, as in the modified example shown in FIG. 46, the evaporation pressure control valves 473, 483 and the evaporation pressure sensors 474, 484 may be built into the sensible heat utilization units 404, 405. In this case, the connection unit controllers 472, 482 provided in the connection units 414, 415 will be omitted, and the sensible heat utilization side controllers 448, 458 will include the functions of the connection unit controllers 472, 482.

(6) Modified Example 3

Figure 47:
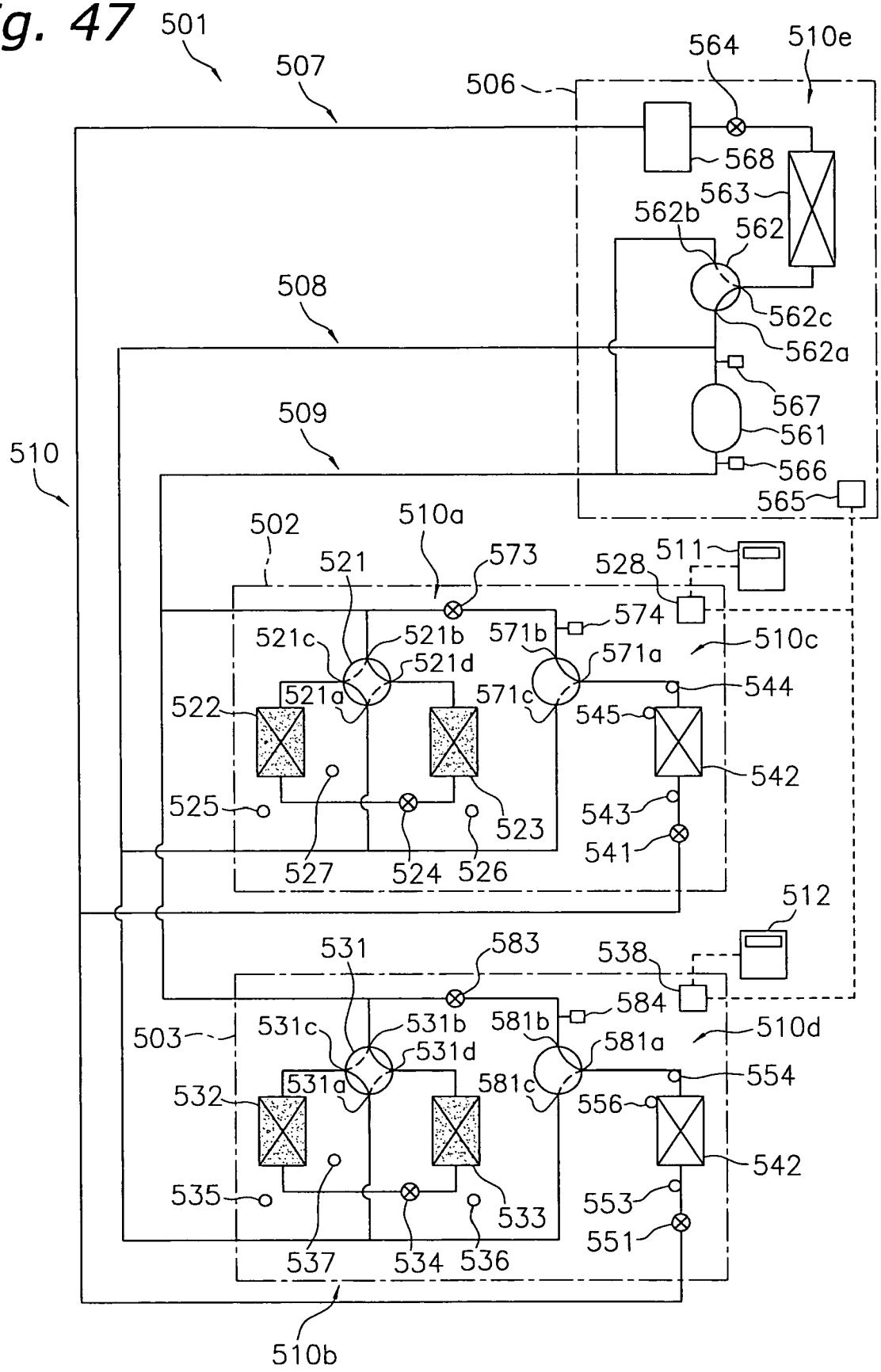
FIG. 47 is a schematic diagram of a refrigerant circuit of an air conditioning system according to a modified example 3 of the third embodiment.

In the air conditioning system 401 of the above-described third embodiment, the latent heat utilization side refrigerant circuits 410*a*, 410*b* that constitute the latent heat load treatment system are respectively built into the latent heat utilization units 2, 3; the sensible heat utilization side refrigerant circuits 410*c*, 410*d* that constitute the sensible heat load treatment system are respectively built into the sensible heat utilization units 404, 405 and the connection units 414, 415; and the latent heat utilization units 2, 3, the sensible heat utilization units 404, 405, and the connection units 414, 415 are installed separately. However, as in an air conditioning system 501 of the modified example shown in FIG. 47, latent heat utilization side refrigerant circuits 510*a*, 510*b* that constitute the latent heat load treatment system, and sensible heat utilization side refrigerant circuits 510*c*, 510*d* that constitute the sensible heat load treatment system may constitute integrated utilization units 502, 503.

In this way, as in air conditioning system 401 in the above-described third embodiment, reduction in the size of the unit and laborsaving installation of the unit can be achieved, compared to the case where the latent heat utilization units 2, 3 respectively comprising the latent heat utilization side refrigerant circuits 410*a*, 410*b*, the sensible heat utilization units 404, 405 respectively comprising the sensible heat utilization side refrigerant circuits 410*c*, 410*d* and the connection units 414, 415 are separately installed in the building. In this case, the RA inlet temperature/humidity sensors 445, 455, the sensible heat utilization side controllers 448, 458 and the connection unit controllers 472, 482 provided in the sensible heat utilization units 404, 405 and the connection units 414, 415 of the air conditioning system 401 in the above-described third embodiment will be omitted, and latent heat utilization side controllers 528, 538 will include the functions of the sensible heat utilization side controllers 448, 458 and the connection unit controllers 472, 482.

In addition, as in the above-described air conditioning system 401, in the air conditioning system 501 of the modified example, it is possible to perform only the operation that supplies the room with the air that was dehumidified or humidified (specifically, the latent heat was treated) in adsorbent heat exchangers 522, 523, 532, 533, i.e., the latent heat utilization side refrigerant circuits 510*a*, 510*b*.

Figure 48:
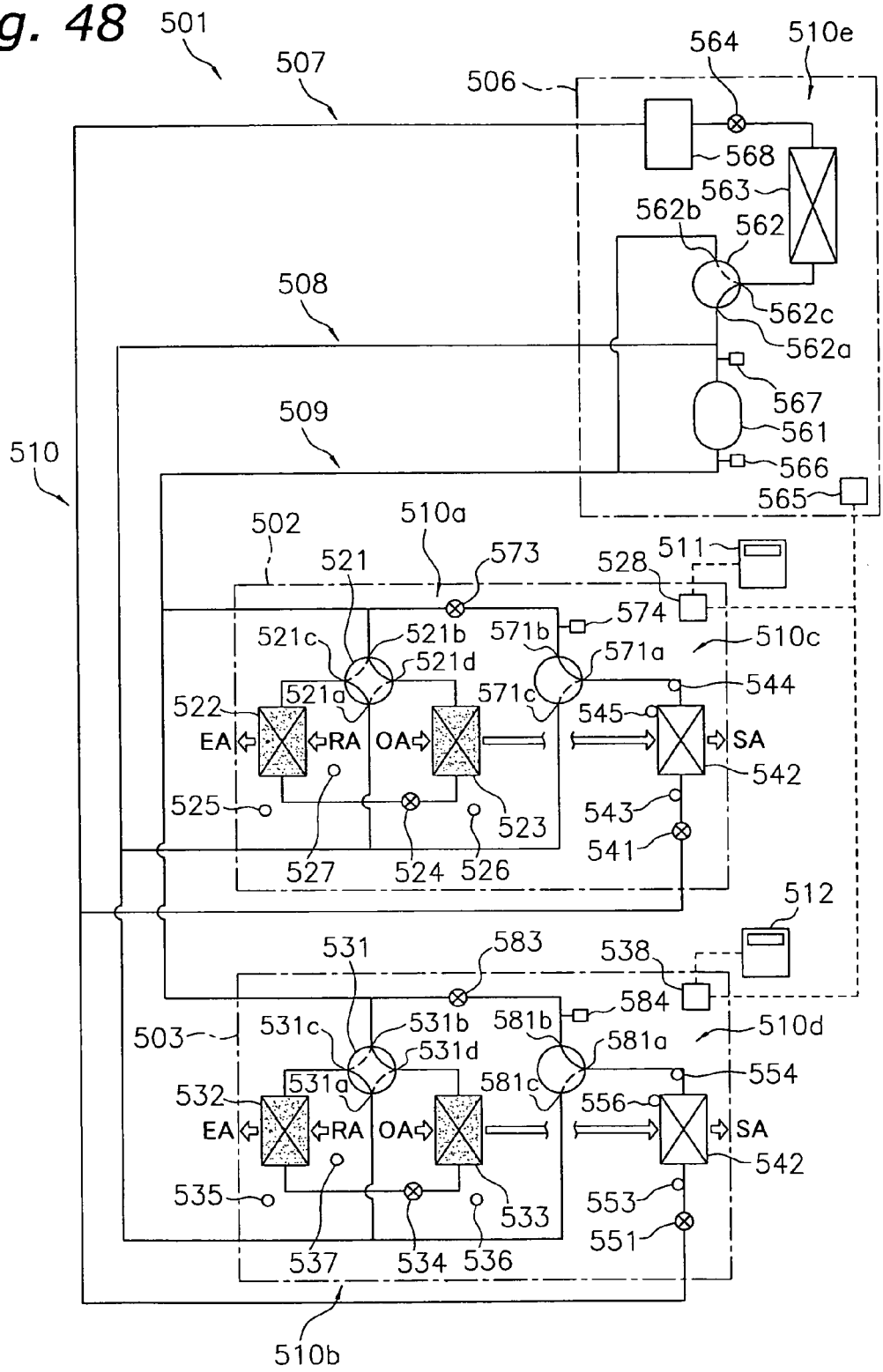
FIG. 48 is a schematic diagram of a refrigerant circuit showing the operation during the dehumidifying and cooling operation in the full ventilation mode in the air conditioning system according to the modified example 3 of the third embodiment.

Further, in the air conditioning system 501 of the modified example, the latent heat utilization side refrigerant circuits 510*a*, 510*b* and the sensible heat utilization side refrigerant circuits 510*c*, 510*d* which constitute the sensible heat load treatment system are built into the integrated utilization units 502, 503. Therefore, as shown in FIG. 48, the air dehumidified or humidified (specifically, the latent heat was treated) in the adsorbent heat exchangers 522, 523, 532, 533, i.e., the latent heat utilization side refrigerant circuit 510*a*, 510*b*, can be further cooled or heated (specifically, the sensible heat is to be treated) (see the arrows shown on both sides of the adsorbent heat exchangers 522, 523, 532, 533 in FIG. 48). As a result, for example, even when the sensible heat load was treated to some degree when the latent heat load was treated in the adsorbent heat exchangers 522, 523, 532, 533, causing the temperature of the air to change to a temperature that is not in agreement with the target temperature of the room air, this air will not be blown out into the room the way it is. Instead, the air will be subjected to the sensible heat treatment in the air heat exchangers 542, 552 so that the temperature of the air is adjusted to be appropriate to the target temperature of the room air, and after which an operation in which air is blown out into the room will be allowed.

Note that since the refrigerant circuit 510 of the air conditioning system 501 of the present modified example and the above-described refrigerant circuit 410 of the air conditioning system 401 have the same configuration, reference numerals representing each component of the above-described air conditioning system 401 will be changed to reference numerals in 500s, and a description of each component will be omitted.

Fourth Embodiment (1) Configuration of the Air Conditioning System

Figure 49:
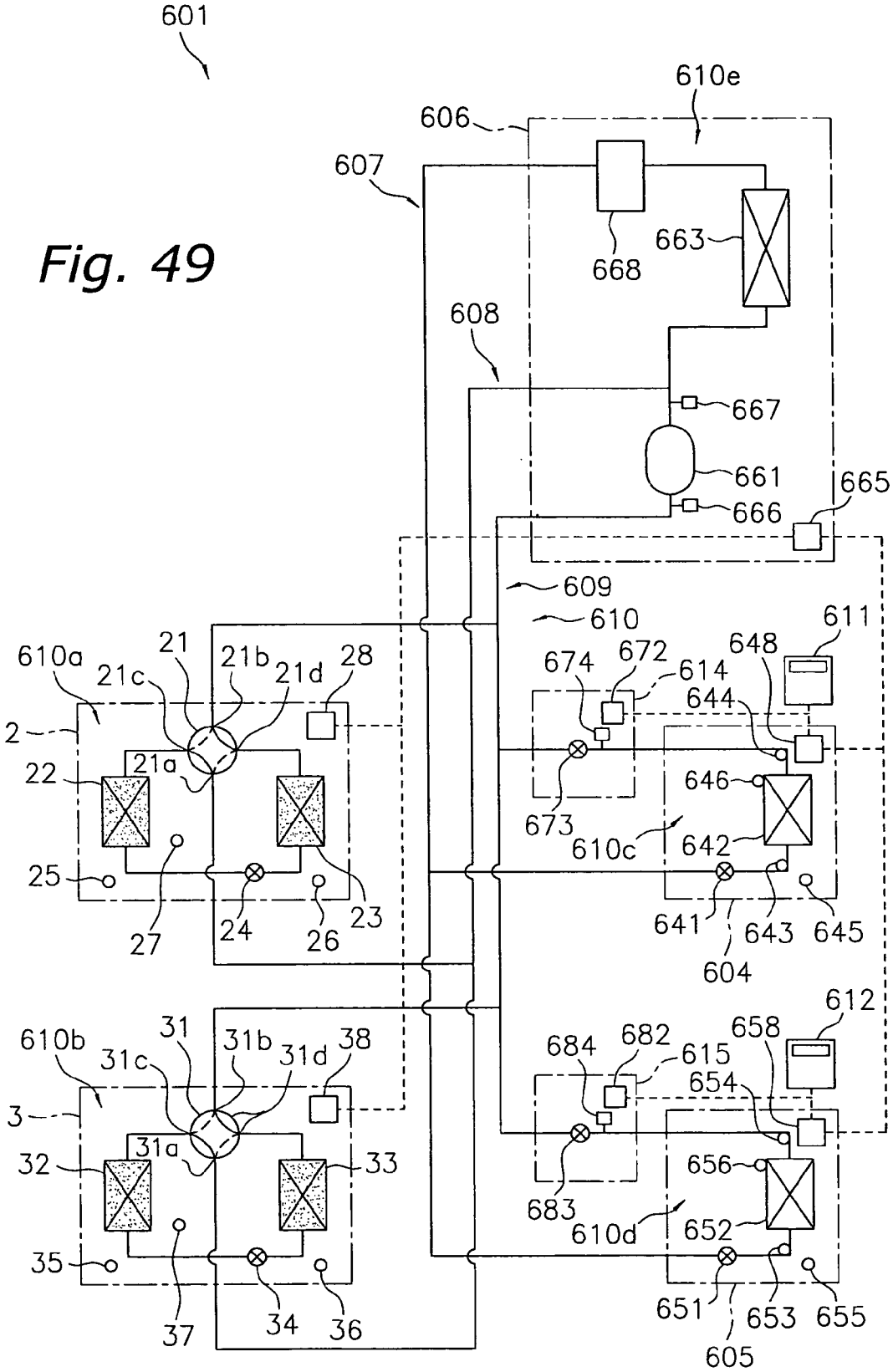
FIG. 49 is a schematic diagram of a refrigerant circuit of an air conditioning system of a fourth embodiment according to the present invention.

FIG. 49 is a schematic diagram of a refrigerant circuit of the air conditioning system 601 of the fourth embodiment according to the present invention. The air conditioning system 601 is an air conditioning system configured to treat the latent heat load and the sensible heat load in the room by operating a vapor compression type refrigeration cycle. The air conditioning system 601 is so-called separate type multi air conditioning system, and mainly comprises a plurality (two in this embodiment) of latent heat utilization units 2, 3 connected in parallel with one another, a plurality (two in this embodiment) of sensible heat utilization units 604, 605 connected in parallel with one another, a heat source unit 606, and connection pipes 607, 608, 609 which connect the latent heat utilization units 2, 3 and the sensible heat utilization units 604, 605 to the heat source unit 606. In the present embodiment, the heat source unit 606 functions as a heat source that is shared between the latent heat utilization units 2, 3 and the sensible heat utilization units 604, 605.

Since the latent heat utilization units 2, 3 and the latent heat utilization units 2, 3 of the first embodiment have the same configurations, a description of each component thereof will be omitted.

Although the sensible heat utilization units 604, 605 are different from the sensible heat utilization units 204, 205 of the second embodiment in that condensation sensors 646, 656 are provided and that RA inlet temperature/humidity sensors 645, 655 are provided; however, since the configuration of other components is the same as that in the sensible heat utilization units 204, 205 of the second embodiment, reference numerals representing each component of the sensible heat utilization units 204, 205 will be simply changed to those in 600s, and here a description of those other components will be omitted.

The condensation sensors 646, 656 are provided to function as condensation detection mechanisms that detect the presence of condensation in air heat exchangers 642, 652. Note that in the embodiment, the condensation sensors 646, 656 are used; however, it is not limited thereto and a float switch may be used instead of the condensation sensor, as long as a function as a condensation detection mechanism is ensured.

The RA Inlet temperature/humidity sensors 645, 655 are temperature/humidity sensors that detect the temperature and the relative humidity of the room air RA to be drawn into the unit.

Note that since the heat source unit 606 and the heat source unit 206 of the second embodiment have the same configuration, all reference numerals representing each component of the heat source unit 206 of the second embodiment will be simply changed to reference numerals in 400s, and a description of each component will be omitted.

In addition, as for the sensible heat utilization units 604, 605, the gas sides of the air heat exchangers 642, 652 are connected to the inlet gas connection pipe 609 through connection units 614, 615. The connection units 614, 615 mainly comprises: evaporation pressure control valves 673, 683; evaporation pressure sensors 674, 684; and connection unit controllers 672, 682 that control the operation of each component that constitutes the connection units 614, 615. The evaporation pressure control valves 673, 683 are electric expansion valves that are provided to function as pressure control mechanisms that control the evaporation pressure of the refrigerant in the air heat exchangers 642, 652, when the air heat exchangers 642, 652 of the sensible heat utilization units 604, 605 are caused to function as evaporators that evaporate the refrigerant. The evaporation pressure sensors 674, 684 are pressure sensors that are provided to function as pressure detection mechanisms that detect the pressure of the refrigerant in the air heat exchangers 642, 652.

In addition, as with the sensible heat utilization units 404, 405 of the third embodiment, the sensible heat utilization units 604, 605 of the present embodiment are controlled such that the cooling operation is performed so as to prevent the generation of condensation in the air heat exchangers 642, 652, in other words, so as to perform the sensible heat cooling operation, when performing the dehumidifying and cooling operation. Accordingly, a drain pipe is not connected to the sensible heat utilization units 604, 605.

Further, as described above, the latent heat utilization units 2, 3 used in the latent heat load treatment system of the air conditioning system 601 can treat the latent heat through the adsorption process and the regeneration process in the adsorbent heat exchangers 22, 23, 32, 33, so that a drain pipe is not connected, as in the case of the sensible heat utilization units 604, 605. In other words, a drainless system is achieved in the air conditioning system 601 of the present embodiment as a whole.

Note that since the operation of the air conditioning system 601 of the present embodiment is the same as the operation of the air conditioning system 401 of the third embodiment, a description thereof will be omitted; however the air conditioning system 601 of the present embodiment also has the same characteristics as those in the air conditioning system 401 of the third embodiment.

(4) Modified Example 1

Figure 50:
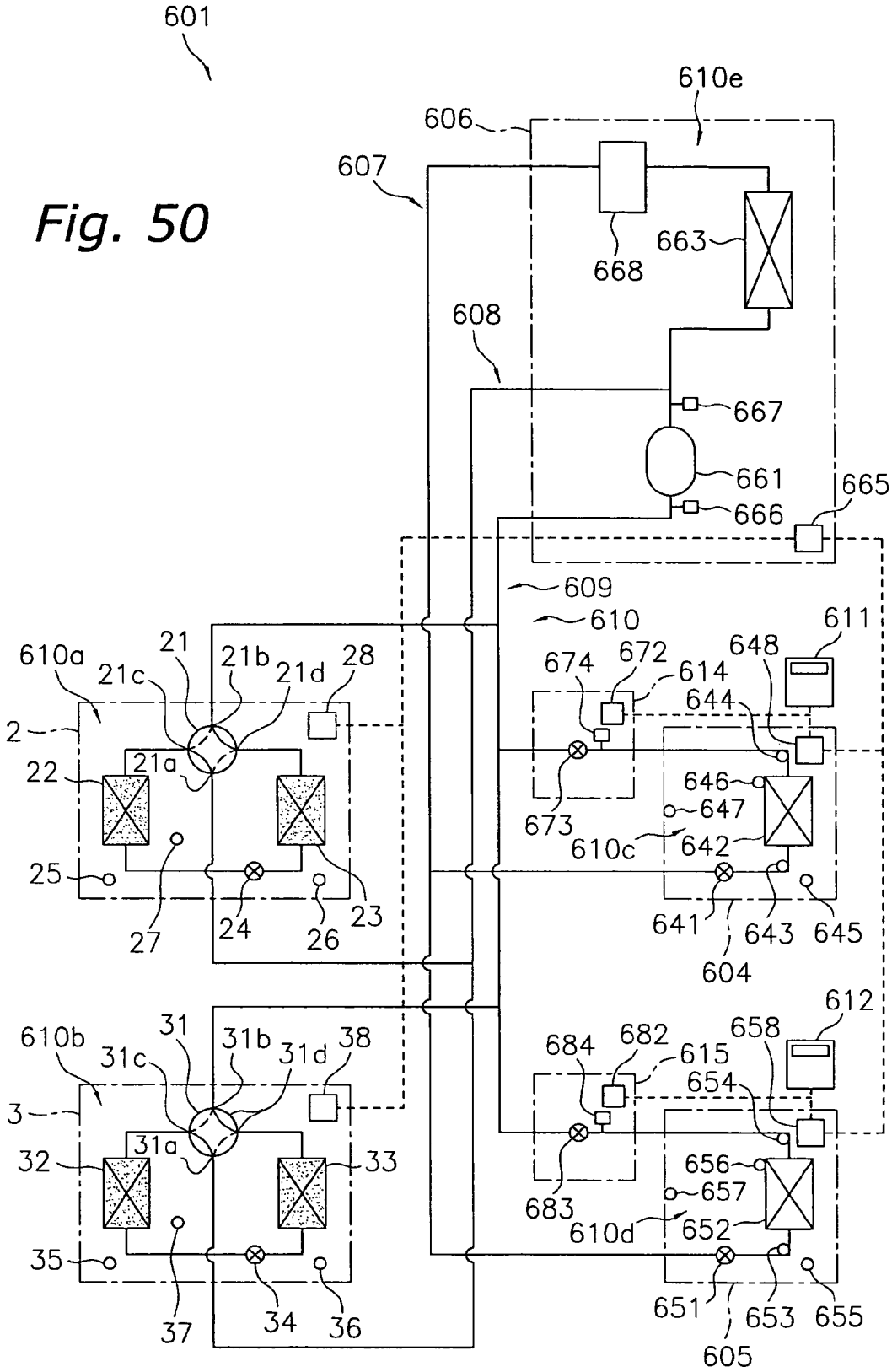
FIG. 50 is a schematic diagram of a refrigerant circuit of an air conditioning system according to a modified example 1 of the fourth embodiment.

In the air conditioning system 601 in the above-described fourth embodiment, the dew point temperature of the room air is calculated based on the temperature and the relative humidity of the room air which were detected by the RA inlet temperature/humidity sensors 645, 655 of the sensible heat utilization units 604, 605, and the minimum evaporation temperature Te3 of the refrigerant in the air heat exchangers 642, 652 is calculated in order to use these calculated values for the system control. However, as shown in FIG. 50, dew point sensors 647, 657 may be provided in the sensible heat utilization units 604, 605 so as to use the dew point temperature detected by the dew point sensors 647, 657 for the system control.

(5) Modified Example 2

Figure 51:
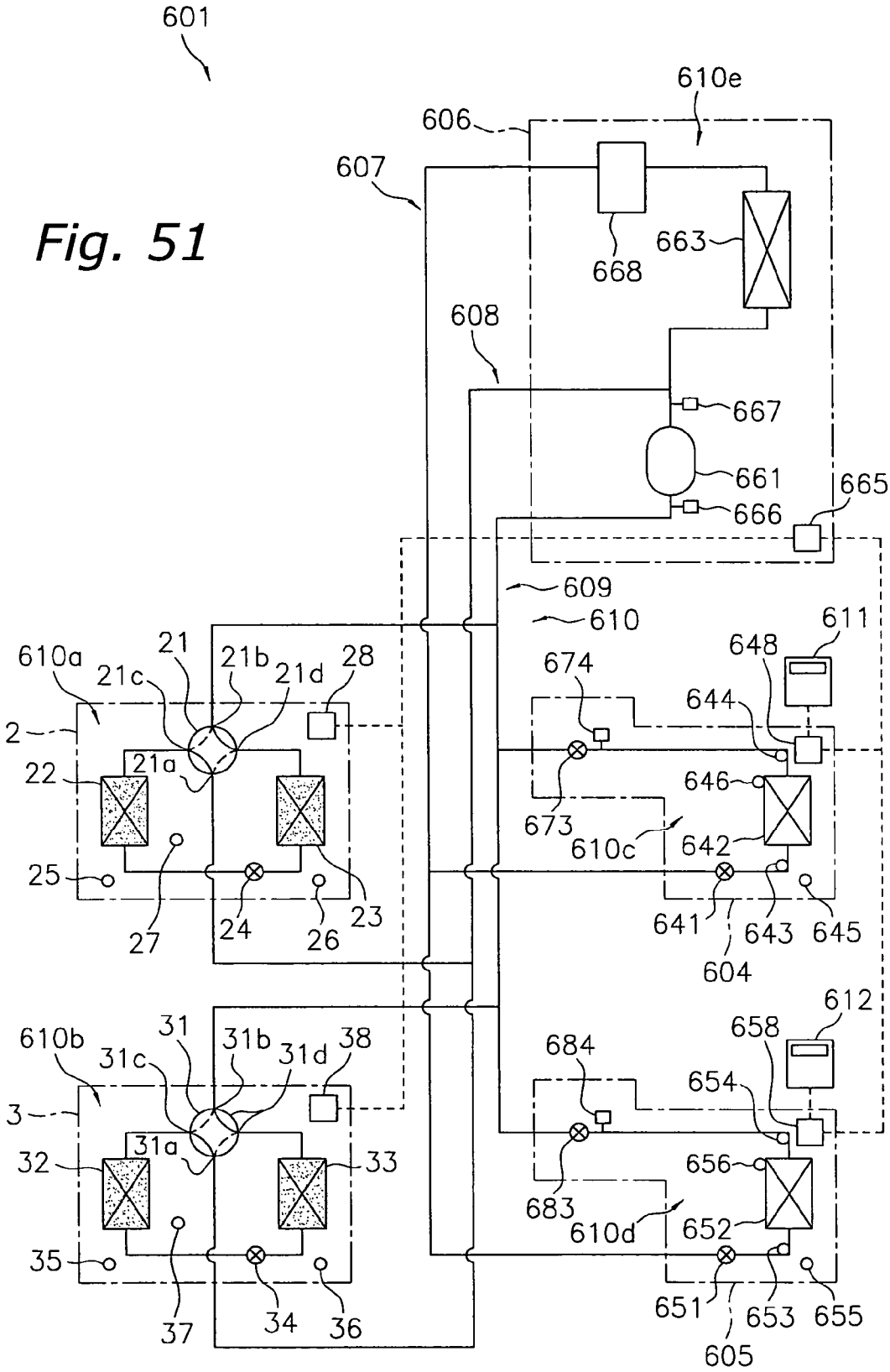
FIG. 51 is a schematic diagram of a refrigerant circuit of an air conditioning system according to a modified example 2 of the fourth embodiment.

In the air conditioning system 601 in the above-described fourth embodiment, the sensible heat utilization units 604, 605 that constitute the sensible heat load treatment system are different units from the connection units 614, 615; however, as in the modified example shown in FIG. 51, the evaporation pressure sensors 674, 684 and the evaporation pressure control valves 673, 683 of the connection units 614, 615 may be built into the sensible heat utilization units 604, 605. In this case, the connection unit controllers 672, 682 provided in the connection units 614, 615 will be omitted, and the sensible heat utilization side controllers 648, 658 will include the functions of the connection unit controllers 672, 682.

(6) Modified Example 3

Figure 52:
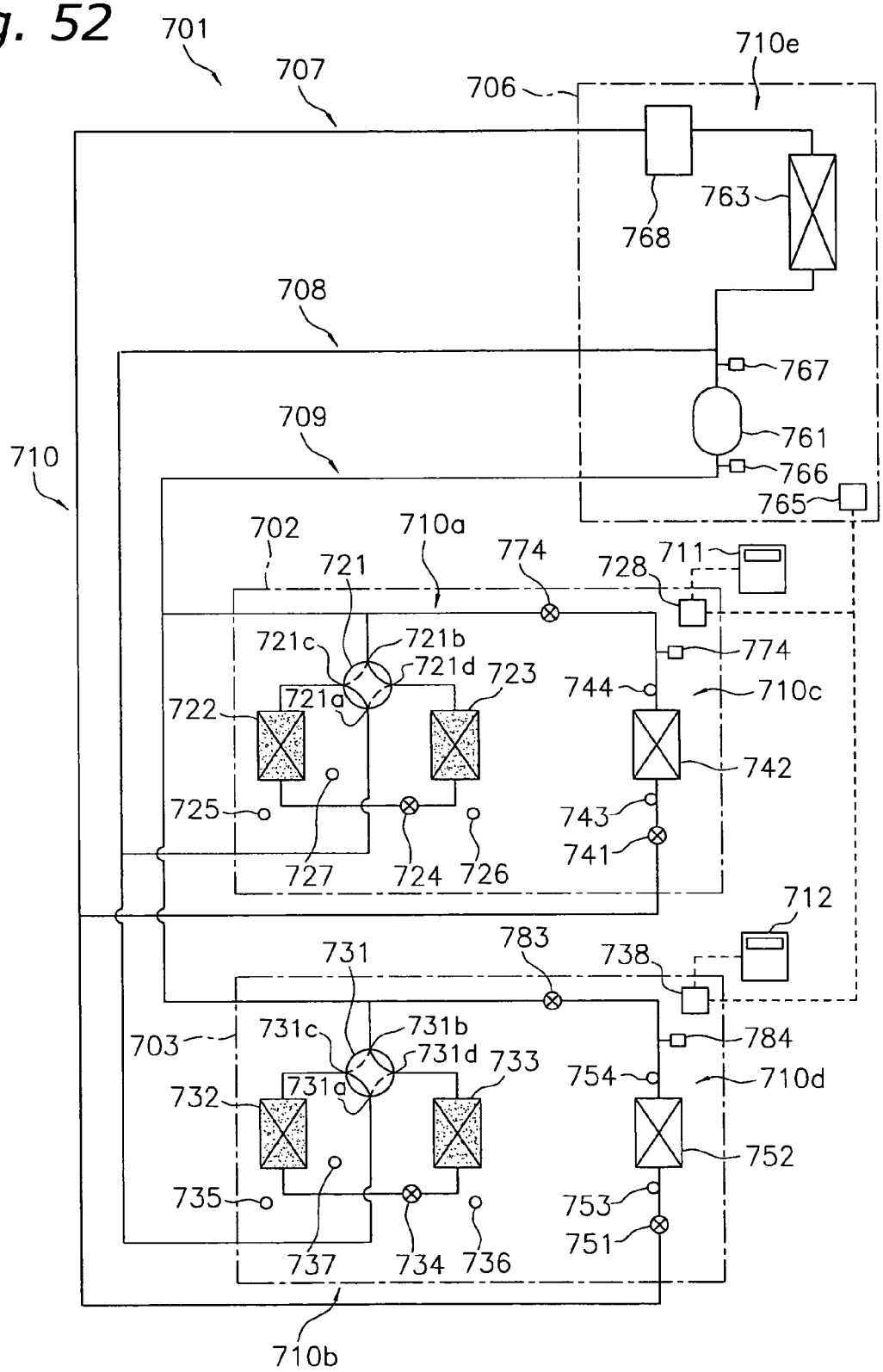
FIG. 52 is a schematic diagram of a refrigerant circuit of an air conditioning system according a modified example 3 of the fourth embodiment.

In the air conditioning system 601 of the above-described fourth embodiment, latent heat utilization side refrigerant circuits 610*a*, 610*b* that constitute the latent heat load treatment system are respectively built into the latent heat utilization units 2, 3; sensible heat utilization side refrigerant circuits 610*c*, 610*d* that constitute the sensible heat load treatment system are respectively built into the sensible heat utilization units 604, 605 and the connection units 614, 615; and the latent heat utilization units 2, 3, the sensible heat utilization units 604, 605, and the connection units 614, 615 are installed separately. However, as in an air conditioning system 701 of the modified example shown in FIG. 52, latent heat utilization side refrigerant circuits 710*a*, 710*b* that constitute the latent heat load treatment system, and sensible heat utilization side refrigerant circuits 710*c*, 710*d* that constitute the sensible heat load treatment system may constitute integrated utilization units 702, 703.

In this way, as in air conditioning system 601 of the above-described fourth embodiment, reduction in the size of the unit and laborsaving installation of the unit can be achieved, compared to the case where the latent heat utilization units 2, 3 respectively comprising the latent heat utilization side refrigerant circuits 610*a*, 610*b*, the sensible heat utilization units 604, 605 respectively comprising the sensible heat utilization side refrigerant circuits 610*c*, 610*d* and the connection units 614, 615 are separately installed in the building. In this case, the RA inlet temperature/humidity sensors 645, 655, the sensible heat utilization side controllers 648, 658 and the connection unit controllers 672, 682 provided in the sensible heat utilization units 604, 605 and the connection units 614, 615 of the air conditioning system 601 in the above-described fourth embodiment will be omitted, and the latent heat utilization side controllers 728, 738 will include the functions of the sensible heat utilization side controllers 648, 658 and the connection unit controllers 672, 682.

In addition, as in the above-described air conditioning system 601, in the air conditioning system 701 of the modified example, it is possible to perform only the operation that supplies the room with the air that was dehumidified or humidified (specifically, the latent heat was treated) in adsorbent heat exchangers 722, 723, 732, 733, i.e., the latent heat utilization side refrigerant circuits 710*a*, 710*b*.

Figure 53:
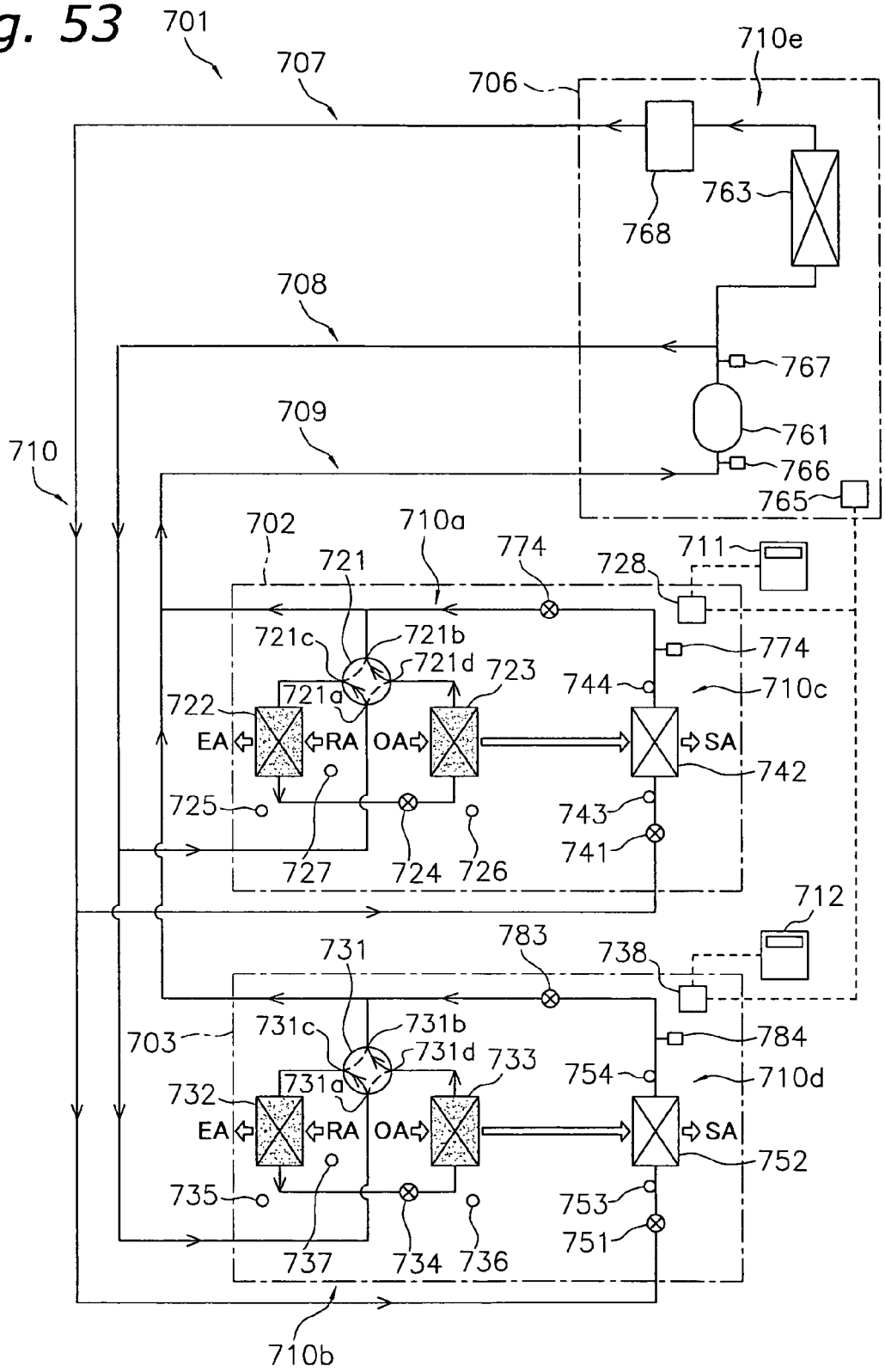
FIG. 53 is a schematic diagram of a refrigerant circuit showing the operation during the dehumidifying and cooling operation in the full ventilation mode in the air conditioning system according the modified example 3 of the fourth embodiment.

Further, in the air conditioning system 701 of the modified example, the latent heat utilization side refrigerant circuits 710*a*, 710*b* and the sensible heat utilization side refrigerant circuits 710*c*, 710*d* which constitute the sensible heat load treatment system are built into the integrated utilization units 702, 703. Therefore, as shown in FIG. 53, the air dehumidified or humidified (specifically, the latent heat was treated) in the adsorbent heat exchangers 722, 723, 732, 733, i.e., the latent heat utilization side refrigerant circuit 710*a*, 710*b*, can be further cooled or heated (specifically, the sensible heat is to be treated) (see the arrows shown on both sides of the adsorbent heat exchangers 722, 723, 732, 733 in FIG. 53). As a result, for example, even when the sensible heat load was treated to some degree when the latent heat load was treated in the adsorbent heat exchangers 722, 723, 732, 733, causing the temperature of the air to change to a temperature that is not in agreement with the target temperature of the room air, this air will not be blown out into the room the way it is. Instead, the air will be subjected to the sensible heat treatment by the air heat exchangers 742, 752 so that the temperature of the air is adjusted to be appropriate to the target temperature of the room air, and after which an operation in which air is blown out into the room will be allowed.

Note that since the refrigerant circuit 710 of the air conditioning system 701 of the present modified example and the above-described refrigerant circuit 610 of the air conditioning system 601 have the same configuration, reference numerals representing each component of the above-described air conditioning system 601 will be changed to reference numerals in 700s, and a description of each component will be omitted.

Fifth Embodiment

Figure 54:
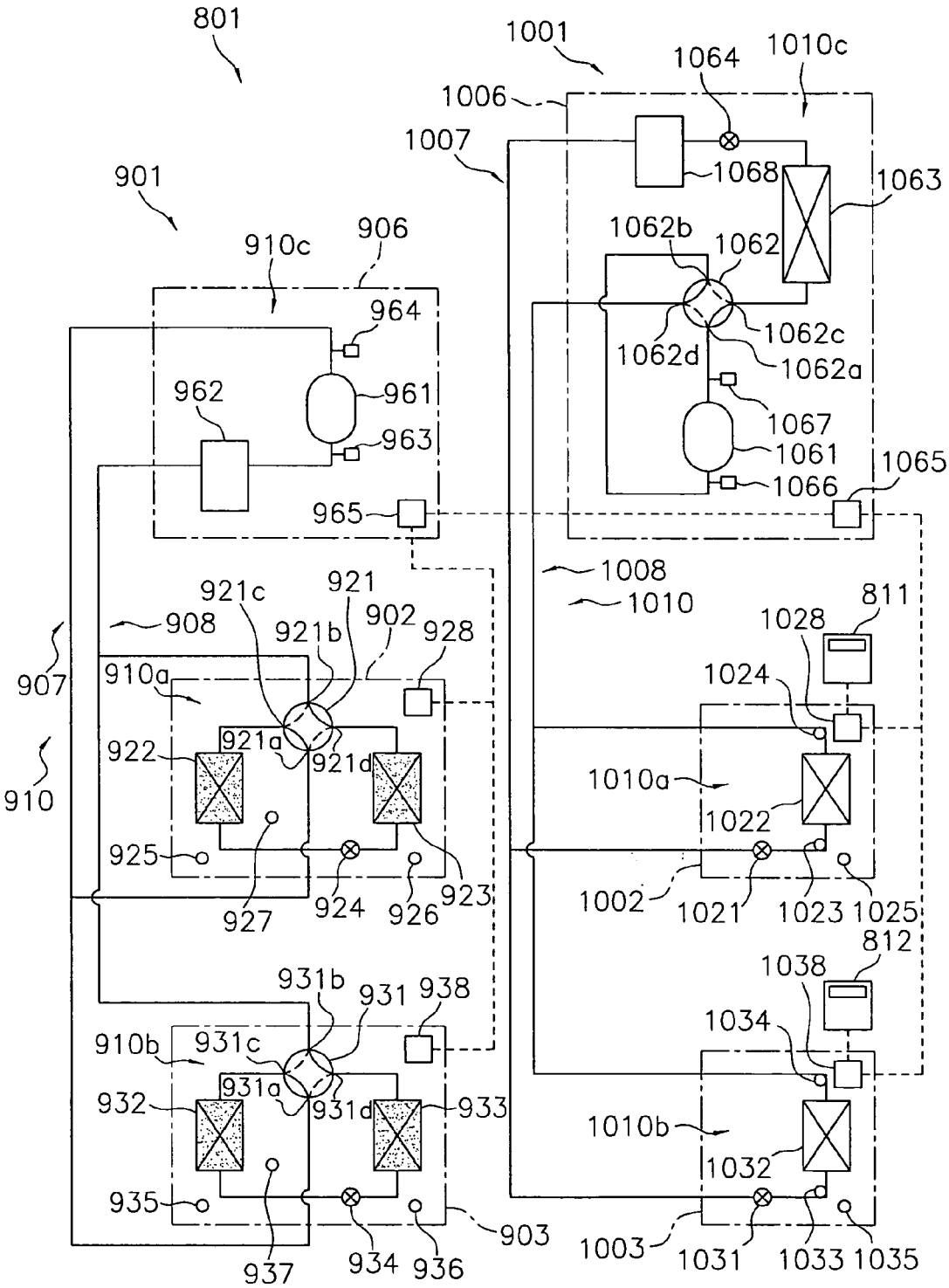
FIG. 54 is a schematic diagram of a refrigerant circuit of an air conditioning system of a fifth embodiment according to the present invention.

FIG. 54 is a schematic diagram of a refrigerant circuit of an air conditioning system 801 of the fifth embodiment according to the present invention. The air conditioning system 801 is an air conditioning system configured to treat the latent heat load and the sensible heat load in the room of a building and the like by operating a vapor compression type refrigeration cycle. The air conditioning system 801 is so-called separate type multi air conditioning system, and mainly comprises a latent heat load treatment system 901 that mainly treats the latent heat load in the room and a sensible heat load treatment system 1001 that mainly treats the sensible heat load in the room.

The latent heat load treatment system 901 is so-called separate type multi air conditioning system, and mainly comprises: a plurality (two in this embodiment) of latent heat utilization units 902, 903; latent heat heat source unit 906; and latent heat connection pipes 907, 908 which connects the latent heat utilization units 902, 903 to the latent heat heat source unit 906.

The latent heat utilization units 902, 903 mainly constitute part of a latent heat refrigerant circuit 910, and respectively comprise latent heat utilization side refrigerant circuits 910*a*, 910*b* which are same as the latent heat utilization side refrigerant circuit 10*a*, 10*b* of the first embodiment. In regard to the configuration of the latent heat utilization units 902, 903, reference numerals in 920s and 930s will be used instead of reference numerals in the 20s and 30s representing each component of the latent heat utilization units 2, 3 of the first embodiment, and a description of each component will be omitted.

The latent heat heat source unit 906 mainly constitutes part of the latent heat refrigerant circuit 910, and comprises a side refrigerant circuit 910*c*. This latent heat heat source side refrigerant circuit 910*c* mainly comprises a latent heat compression mechanism 961 and a latent heat accumulator 962 that is connected to the inlet side of the latent heat compression mechanism 961, and the latent heat utilization units 902, 903 are connected in parallel through the latent heat connection pipes 907, 908.

The sensible heat load treatment system 1001 is so-called separate type multi air conditioning system, and mainly comprises: a plurality (two in this embodiment) of sensible heat utilization units 1002, 1003; sensible heat heat source unit 1006; sensible heat connection pipes 1007, 1008 which connect the sensible heat utilization units 1002, 1003 to the sensible heat heat source unit 1006.

The sensible heat utilization units 1002, 1003 mainly constitutes part of a sensible heat refrigerant circuit 1010, and respectively comprises sensible heat utilization side refrigerant circuits 1010*a*, 1010*b*, which are the same as the sensible heat utilization side refrigerant circuits 10*c*, 10*d* of the first embodiment. In regard to the configuration of the sensible heat utilization units 1002, 1003, reference numerals in 1020s and 1030s will be used instead of reference numerals in the 40s and 50s representing each component of the sensible heat utilization units 4, 5 of the first embodiment, and a description of each component will be omitted.

The sensible heat heat source unit 1006 mainly constitutes part of the sensible heat refrigerant circuit 1010, and comprises a sensible heat heat source side refrigerant circuit 1010*c*. This sensible heat heat source side refrigerant circuit 1010*c* mainly comprises a sensible heat compression mechanism 1061, and the sensible heat utilization units 1002, 1003 are connected in parallel through the sensible heat connection pipes 1007, 1008.

In this way, unlike the air conditioning system in each the first to the fourth embodiments, in the air conditioning system 801 of the present embodiment, a heat source (specifically, the latent heat heat source unit 906 and the sensible heat heat source unit 1006) is provided for each of the latent heat load treatment system 901 and the sensible heat load treatment system 1001, so that the number of heat sources increases, compared to the air conditioning systems of the first through the fourth embodiments. However, still, the heat sources used for the latent heat load treatment system 901 including adsorbent heat exchangers 922, 923, 932, 933 can be collected together, so that it is possible to prevent an increase in cost and an increase in the number of parts to be maintained, which occur when a plurality of air conditioners each having an adsorbent heat exchanger are installed.

Other Embodiments

While preferred embodiments have been described in connection with the present invention, the scope of the present invention is not limited to the above embodiments, and the various changes and modifications may be made without departing from the scope of the present invention.

For example, in the air conditioning system of the above-described third and fourth embodiments, the condensation sensors are provided in the sensible heat utilization unit; however, when the sensible heat cooling operation of the sensible heat load treatment system can be reliably performed, the condensation sensors may not necessarily be provided.

INDUSTRIAL APPLICABILITY

By the application of the present invention, it is possible to prevent problems such as an increase in cost and an increase in the number of parts to be maintained, which arise when a plurality of air conditioners that use adsorbent heat exchangers are installed or when the air conditioner that uses the adsorbent heat exchanger is installed along with the air conditioner comprising the air heat exchanger.

What is claimed is:

1. An air conditioning system configured to treat a latent heat load and a sensible heat load in a room by performing a vapor compression refrigeration cycle operation, comprising:

a plurality of first utilization side refrigerant circuits each having an adsorbent heat exchanger provided with an adsorbent on a surface thereof, configured for alternating between an adsorption process in which moisture in air is adsorbed onto the adsorbent by causing the adsorbent heat exchanger to function as an evaporator that evaporates refrigerant and a regeneration process in which moisture is desorbed from the adsorbent by causing the adsorbent heat exchanger to function as a condenser that condenses the refrigerant, and connected in parallel with one another; and a plurality of second utilization side refrigerant circuits each having an air heat exchanger, configured for exchanging heat between refrigerant and air, and connected in parallel with one another, the first utilization side refrigerant circuits being configured to supply a room with air that passed through the adsorbent heat exchanger, and the second utilization side refrigerant circuits being configured to supply a room with air that passed through the air heat exchangers a heat source side refrigerant circuit including a compression mechanism and a heat source side heat exchanger, with the compression mechanism and the heat source side heat exchanger of the heat source side refrigerant circuit being arranged in the air conditioning system such that only the compression mechanism of the compression mechanism and the heat source side heat exchanger is used in common with the first and second utilization side refrigerant circuits, the heat source side heat exchanger operates as a condenser of the refrigerant discharged from the compression mechanism when the air heat exchangers operate as evaporators of the refrigerant, and the heat source side heat exchanger operates as an evaporator of the refrigerant condensed in the air heat exchanger when the air heat exchangers operate as condensers of the refrigerant discharged from the compression mechanism, the first utilization side refrigerant circuits being connected to a discharge gas connection pipe connected to a discharge side of the compression mechanism, and being connected to an inlet gas connection pipe connected to an inlet side of the compression mechanism.

2. The air conditioning system according to claim 1, wherein the second utilization side refrigerant circuits are connected to a liquid connection pipe that is connected to a liquid side of the heat source side heat exchanger, and switchably connected to the discharge gas connection pipe and the inlet gas connection pipe through a switching mechanism.

3. The air conditioning system according to claim 1, wherein the air conditioning system is configured to calculate a required latent heat treatment capacity value and a required sensible heat treatment capacity value in order to control an operational capacity of the compression mechanism based on a required latent heat treatment capacity value and a required sensible heat treatment capacity value.

4. The air conditioning system according to claim 1, wherein the air conditioning system is configured to calculate a target evaporation temperature and a target condensation temperature of the system as a whole based on the required latent heat treatment capacity value and the required sensible heat treatment capacity value in order to control the operational capacity of the compression mechanism based on a target evaporation temperature and a target condensation temperature.

5. The air conditioning system according to claim 4, wherein the air conditioning system is configured to calculate an evaporation temperature difference between the target evaporation temperature and an evaporation temperature and to calculate a condensation temperature difference between the target condensation temperature and a condensation temperature in order to control the operational capacity of the compression mechanism based on the evaporation temperature difference and the condensation temperature difference.

6. The air conditioning system according to claim 3, wherein a switching time interval between the adsorption process and the regeneration process in the adsorbent heat exchanger is changeable.

7. The air conditioning system according to claim 1, wherein at system startup, a room is supplied with air that passed through the air heat exchanger, and outdoor air is prevented from passing through the adsorbent heat exchanger.

8. The air conditioning system according to claim 1, wherein at system startup, in a state in which switching between the adsorption process and the regeneration process in the plurality of adsorbent heat exchangers is stopped, outdoor air is passed through one of the plurality of adsorbent heat exchangers and then is exhausted to the outside, and also room air is passed through an adsorbent heat exchanger among the plurality of adsorbent heat exchangers, besides the one through which the outdoor air passed, and then is supplied to a room again.

9. The air conditioning system according to claim 1, wherein at system startup, a switching time interval between the adsorption process and the regeneration process in the adsorbent heat exchanger is made longer than that during normal operation.

10. The air conditioning system according to claim 7, wherein a system startup operation is terminated after a predetermined period of time elapsed since system startup.

11. The air conditioning system according to claim 7, wherein a system startup operation is terminated after a temperature difference between a target temperature of room air and a temperature of room air is equal to or below a predetermined temperature difference.

12. The air conditioning system according to claim 7, wherein before a system startup operation starts, a temperature difference between a target temperature of room air and a temperature of room air is determined, and when the temperature difference between the target temperature of room air and the temperature of room air is equal to or below a predetermined temperature, the system startup operation is prevented from being performed.

13. The air conditioning system according to claim 1, wherein the second utilization side refrigerant circuits are connected to a liquid connection pipe connected to a liquid side of the heat source side heat exchanger, and are connected to the inlet gas connection pipe.

14. The air conditioning system according to claim 1, wherein the first utilization side refrigerant circuits and the second utilization side refrigerant circuits constitute an integrated utilization unit.

15. The air conditioning system according to claim 14, wherein the utilization unit is configured to supply a room with air that was dehumidified or humidified in the adsorbent heat exchanger.

16. The air conditioning system according to claim 14, wherein the utilization unit is configured to exchange heat through the air heat exchanger between refrigerant and air that was dehumidified or humidified in the adsorbent heat exchanger.

17. The air conditioning system according to claim 1, further comprising a pressure control mechanism connected to a gas side of the air heat exchanger and configured to control an evaporation pressure of refrigerant in the air heat exchanger when the air heat exchanger is caused to function as an evaporator that evaporates refrigerant.

18. The air conditioning system according to claim 17, wherein when the air heat exchanger is caused to function as an evaporator that evaporates refrigerant, the evaporation pressure of refrigerant is controlled by the pressure control mechanism, based on a dew point temperature of room air.

19. The air conditioning system according to claim 18, further comprising a pressure detection mechanism configured to detect a refrigerant pressure in the air heat exchanger and an evaporation pressure of refrigerant, wherein the air conditioning system calculates a target evaporation pressure value based on the dew point temperature of room air and uses the pressure control mechanism to control the evaporation pressure of refrigerant to be equal to or higher than the target evaporation pressure.

20. The air conditioning system according to claim 19, further comprising a plurality of condensation detection mechanisms configured to detect a presence of condensation in the air heat exchangers, wherein when condensation is detected by the condensation detection mechanism, the target evaporation pressure value is changed.

21. The air conditioning system according to claim 19, further comprising a condensation detection mechanism configured to detect a presence of condensation in the air heat exchanger, wherein when condensation is detected by the condensation detection mechanism, the compression mechanism is stopped.

22. The air conditioning system according to claim 19, further comprising a condensation detection mechanism configured to detect a presence of condensation in the air heat exchanger, wherein, the second utilization side refrigerant circuit includes an utilization side expansion valve connected to a liquid side of the air heat exchangers, and when condensation is detected by the condensation detection mechanism, the utilization side expansion valve is closed.

23. The air conditioning system according to claim 1, wherein a switching time interval between the adsorption process and the regeneration process in the adsorbent heat exchanger is changeable.

24. The air conditioning system according to claim 17, wherein at system startup, treatment of a latent heat load in a room by the first utilization side refrigerant circuit is given priority over treatment of a sensible heat load in a room by the second utilization side refrigerant circuit.

25. The air conditioning system according to claim 24, wherein at system startup, treatment of the sensible heat load in a room by the second utilization side refrigerant circuit is stopped until a dew point temperature of room air is equal to or below a target dew point temperature.

26. The air conditioning system according to claim 24, wherein at system startup, treatment of the sensible heat load in a room by the second utilization side refrigerant circuit is stopped until an absolute humidity of room air is equal to or below a target absolute humidity.

27. The air conditioning system according to claim 24, wherein at system startup, outdoor air is passed through one of the adsorbent heat exchangers that is performing a regeneration process, and then is exhausted to the outside, and then room air is passed through one of the adsorbent heat exchangers that is performing the adsorption process and is supplied to a room.

28. The air conditioning system according to claim 24, wherein before starting a system startup operation, a dew point temperature difference between a target dew point temperature of room air and a dew point temperature of the room air is determined, and when the dew point temperature difference between the target dew point temperature of room air and the dew point temperature of room air is equal to or below a predetermined dew point temperature difference, the startup operation is prevented from being performed.

29. The air conditioning system according to claim 24, wherein before starting a system startup operation, an absolute humidity difference between a target absolute humidity of room air and an absolute humidity of the room air is determined, and when the absolute humidity difference between the target absolute humidity of room air and the absolute humidity of room air is equal to or below a predetermined absolute humidity difference, the system startup operation is prevented from being performed.

* * * * *

UNITED STATES PATENT AND TRADEMARK OFFICE

CERTIFICATE OF CORRECTION

PATENT NO. : 7,886,556 B2
APPLICATION NO. : 10/591060
DATED : February 15, 2011
INVENTOR(S) : Ryusuke Fujiyoshi et al.

It is certified that error appears in the above-identified patent and that said Letters Patent is hereby corrected as shown below:

Column 82,
Line 1, "4. The air conditioning system according to claim 1," should read -- 4. The air conditioning system according to claim 3, --.

Signed and Sealed this
Nineteenth Day of April, 2011

David J. Kappos

David J. Kappos
*Director of the United States Patent and Trademark Office*